United States Patent [19]

Shah et al.

[11] 4,381,835

[45] May 3, 1983

[54] CONTROL DEVICE

[75] Inventors: Hasmukh R. Shah, Hot Springs, Ark.; Ashok K. Gupta, Fairport, N.Y.

[73] Assignee: UMC Industries, Inc., Stamford, Conn.

[21] Appl. No.: 137,524

[22] Filed: Apr. 4, 1980

[51] Int. Cl.[3] ..... G07F 5/22

[52] U.S. Cl. ..... 194/1 N; 194/9 R; 364/479

[58] Field of Search ..... 194/1 R, 1 L-1 N, 194/9 R, 10; 364/464, 478, 479

[56] References Cited

U.S. PATENT DOCUMENTS

| | | | |
|---|---|---|---|
| 3,982,620 | 9/1976 | Kortenhaus | 194/1 N |
| 4,056,181 | 11/1977 | Ikeguchi et al. | 194/10 |
| 4,109,775 | 8/1978 | Hayashi | 194/10 |
| 4,231,105 | 10/1980 | Schuller et al. | 364/479 X |
| 4,233,660 | 11/1980 | Fagan | 364/479 X |
| 4,272,757 | 6/1981 | McLaughlin e al. | 194/1 N X |

FOREIGN PATENT DOCUMENTS

| | | | |
|---|---|---|---|
| 54-125096 | 9/1979 | Japan | 194/1 N |

*Primary Examiner*—Robert B. Reeves
*Assistant Examiner*—Edward M. Wacyra
*Attorney, Agent, or Firm*—Senniger, Powers, Leavitt and Roedel

[57] ABSTRACT

A control device for a vending machine for setting prices and storing prices in a memory with a price-setting mode, a price verification mode and a product-vending mode. In the product-vending mode, actuation of a selection switch provides a momentary pulse through the vending circuit to enable a price to be loaded into a register for subsequent comparison with accumulated credit. That pulse is so short that a product is not vended; but it is sufficiently large to keep leakage from simulating it. Switches select the locations in memory where prices are stored, and further switches are provided to set the prices in those locations. The control device automatically responds to actuation of any of these switches to shift from the product-vending to the price-setting mode. Coin tube inventory switches are provided which have a dual function, namely, effecting emptying of the coin tubes and also placing the control device in the price verification mode. The control device is also responsive to the insertion of a coin or to the pressing of the cancel sale button to automatically take the vending machine out of the price-setting or price verification mode and place it in the product-vending mode. In the product-vending mode, the availability of coins will determine which coins will be used in dispensing the change -- three dimes being used to provide thirty cents in change if the nickel tube is empty.

14 Claims, 25 Drawing Figures

62
P1-Ø
P1-1
P1-2
P1-3
P1-4
P1-5
P1-6
P4-7
PØ-7
P5-5
P5-6
P5-2
+12
416
420
431
432
434
436
433
430
426
262
418
422
424
428
440
442
438
444
446
448
450
452
454
456
458
460
462
464
466
468
470
472
474
574
520
486
149
308
310
306
803
478
476
312
480
482
484
488
490
828
830
834
826
836
832
230
822
824
808
812
820
818
810
816
814
366
804
806
108
110
112
114
116
118
120
122
124
126
128
130

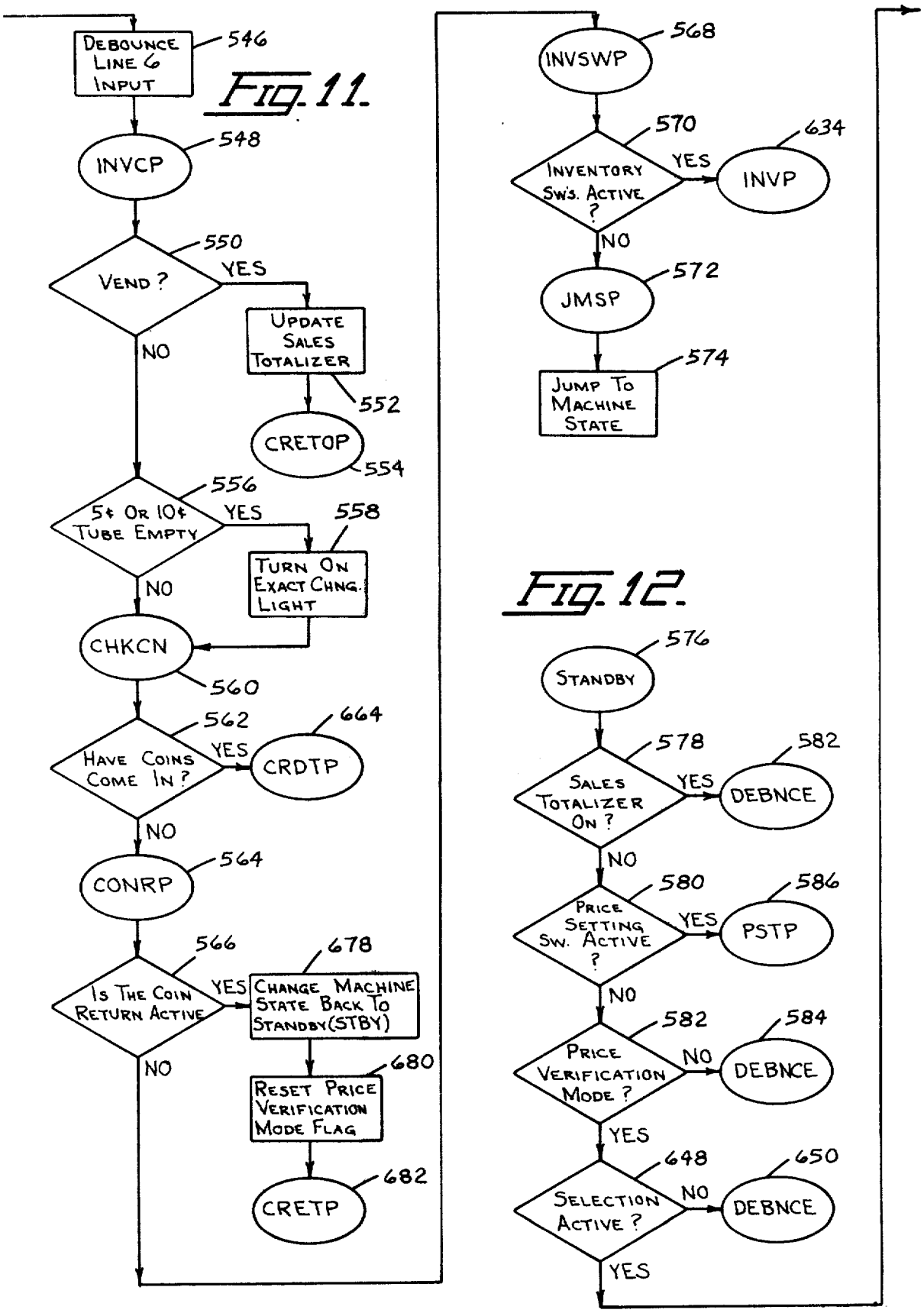
DEBOUNCE LINE 6 INPUT
546
FIG. 11.
INVCP
548
VEND ?
550
YES
NO
UPDATE SALES TOTALIZER
552
CRETOP
554
5¢ OR 10¢ TUBE EMPTY
556
YES
558
TURN ON EXACT CHNG. LIGHT
NO
CHKCN
560
HAVE COINS COME IN ?
562
YES
664
CRDTP
NO
CONRP
564
IS THE COIN RETURN ACTIVE
566
YES
678
CHANGE MACHINE STATE BACK TO STANDBY(STBY)
NO
680
RESET PRICE VERIFICATION MODE FLAG
682
CRETP
INVSWP
568
INVENTORY SW'S. ACTIVE ?
570
YES
634
INVP
NO
JMSP
572
JUMP TO MACHINE STATE
574
FIG. 12.
STANDBY
576
SALES TOTALIZER ON ?
578
YES
582
DEBNCE
NO
PRICE SETTING SW. ACTIVE ?
580
YES
586
PSTP
NO
PRICE VERIFICATION MODE ?
582
NO
584
DEBNCE
YES
SELECTION ACTIVE ?
648
NO
650
DEBNCE
YES

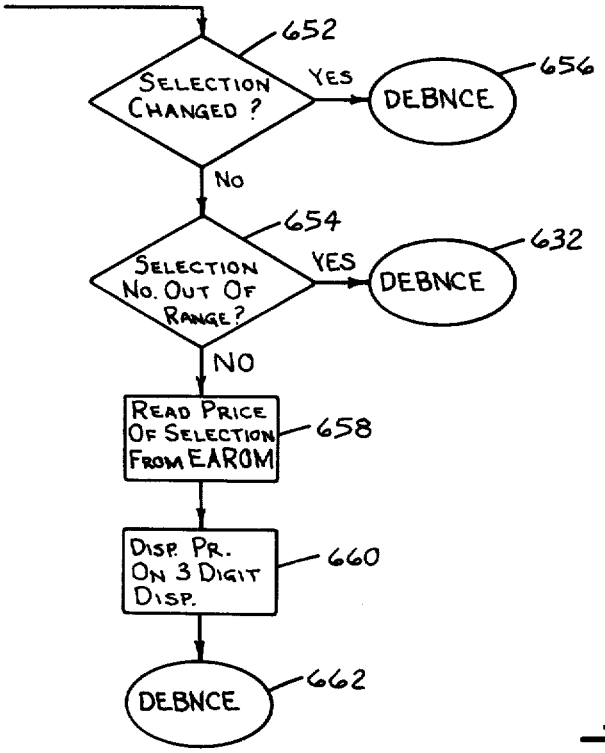
FIG. 13.
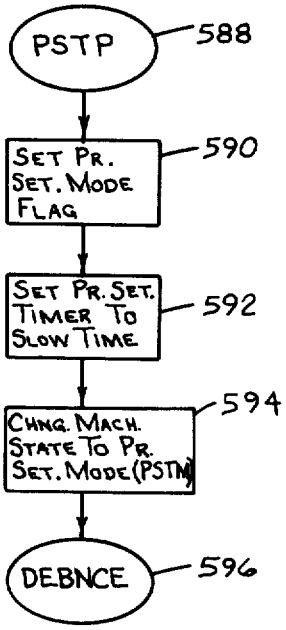
FIG. 14.
FIG. 16.
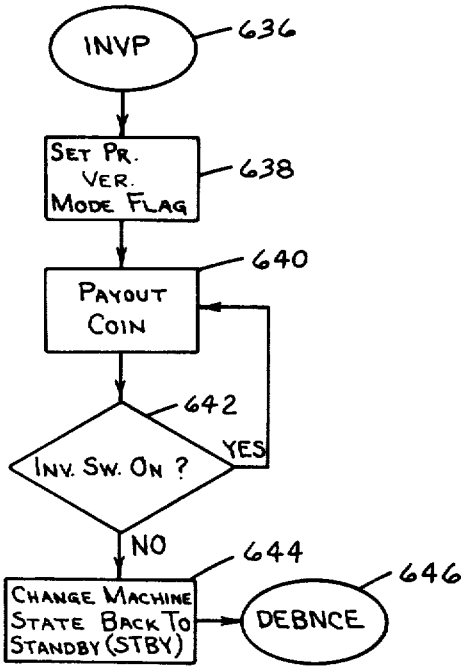

FIG. 15
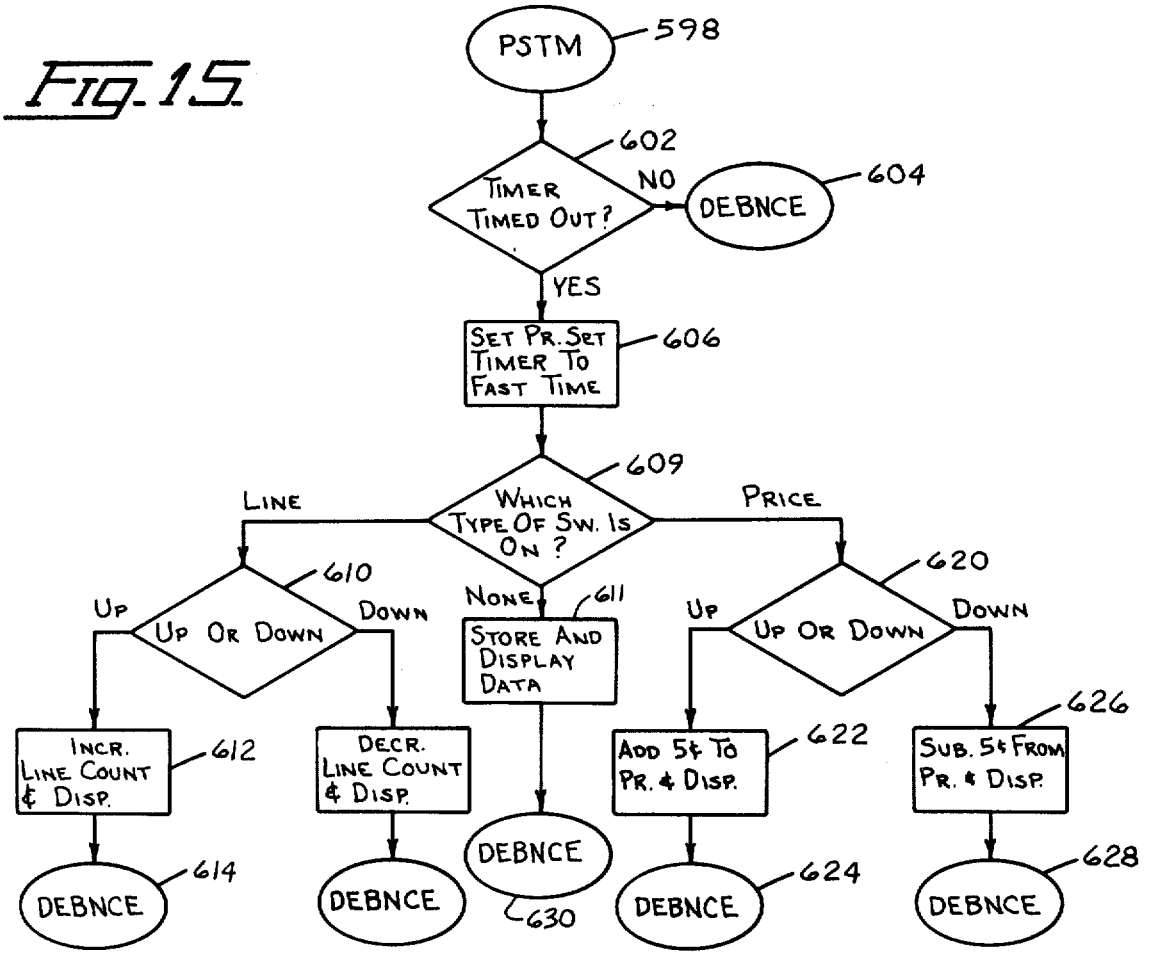
FIG. 17
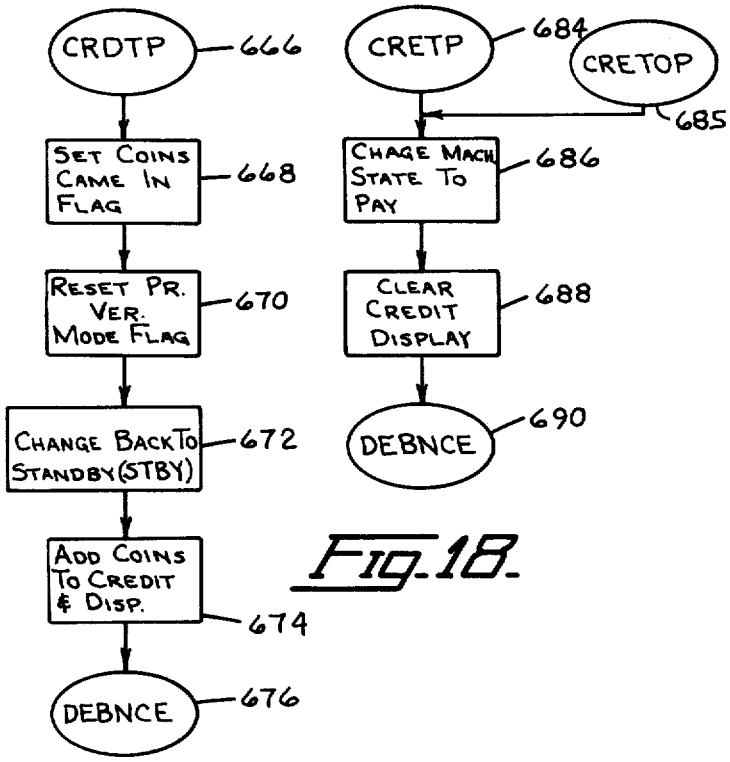
FIG. 18

CONTROL DEVICE

CROSS-REFERENCE TO RELATED APPLICATION

This is an improvement on the control device which is shown and described in Hasmukh R. Shah et al. application Ser. No. 906,234 for Control Device which was filed on May 15, 1978.

BACKGROUND OF THE INVENTION

This invention relates to control devices for a vending machine which can be used to set prices and to store those prices in a memory and more particularly to such a control device having a price-setting mode, a price verification mode and a product vending mode.

Prior control devices which provided price-setting and price verification modes for vending machines used manually-operated switches to place those control devices in, and to hold those control devices in, those modes. In the event the control device for that vending machine was inadvertently left in the price-setting or verification mode, the vending machine would be unable to vend.

SUMMARY OF THE INVENTION

The present invention provides a control device for a vending machine which can be used to set prices and to store those prices in a memory; and it can establish a price-setting mode, a price verification mode and a product-vending mode. That control device can easily be shifted out of the price-setting or price verification modes, as by inserting a coin or by pressing the cancel sale button. It is, therefore, an object of the present invention to provide a control device for a vending machine which can establish a price-setting mode, a price verification mode or a product-vending mode, and which automatically shifts that vending machine out of the price-setting or price verification mode into the product-vending mode when a coin is inserted or the cancel sale button is pressed.

The control device of the present invention has switches that are used to select the locations in a memory where prices are stored, and has further switches that are usable to set the prices in those locations. The control device automatically responds to the actuation of any of those switches to shift from the product-vending to the price-setting mode. It is, therefore, an object of the present invention to provide a control device with switches that select locations in a memory where prices can be stored, and with further switches that can change the data in those locations, and wherein actuation of any of those switches automatically places the vending machine in the price-setting mode.

The control device provided by the present invention responds to the closing of a selection switch to send a short pulse through the vending circuit. That pulse will be of such short duration that it will be unable to cause a vend to occur, but it will cause a price to be loaded into a price register for comparison with credit in a credit register so a vend can be effected if the credit exceeds the price. It is, therefore, an object of the present invention to provide a control device which responds to the closing of a selection switch to send a short pulse through the vending circuit.

If, during any transaction, the credit exceeds the price, change will be paid out. The present invention varies the manner of paying out coins in accordance with the kinds of coins which are available to make change. For example, if thirty cents is to be paid out and the nickel coin tube is empty, the control device of the present invention will use three dimes to pay out the change. It is, therefore, an object of the present invention to provide a control device which varies the manner of paying out coins in accordance with the kinds of coins which are available to make change.

Other and further objects and advantages of the present invention should become apparent from an examination of the drawing and accompanying description.

In the drawing and accompanying description some embodiments of the present invention are shown and described, but it is to be understood that the drawing and accompanying description are for the purpose of illustration only and do not limit the invention and that the invention will be defined by the appended claims.

BRIEF DESCRIPTION OF THE DRAWING

FIGS. 1 and 2 are interrelated and how the sheets bearing FIGS. 4–6 are interrelated, FIG. 10 and FIG. 11 are parts of the flow chart for the control device of the present invention, and they show a number of debouncing steps of that flow chart, FIG. 12 and FIG. 13 show the portion of the flow chart which represents the standby routine, FIG. 14 shows the portion of the flow chart which is used to initialize the microprocessor for the price-setting mode, FIG. 15 shows the portion of the flow chart wherein the price-setting routine is executed, FIG. 16 shows a portion of the flow chart which is executed when an inventory switch is closed, FIG. 17 is the portion of the flow chart showing the establishment of credit when coins are inserted, FIG. 18 is a portion of the flow chart wherein the program is guided to the routine of FIGS. 19 and 20, FIGS. 19 and 20 show the portion of the flow chart which relates to the dispensing of coins.

BRIEF DESCRIPTION OF PREFERRED EMBODIMENT

Components of Control Device

Figure 1:
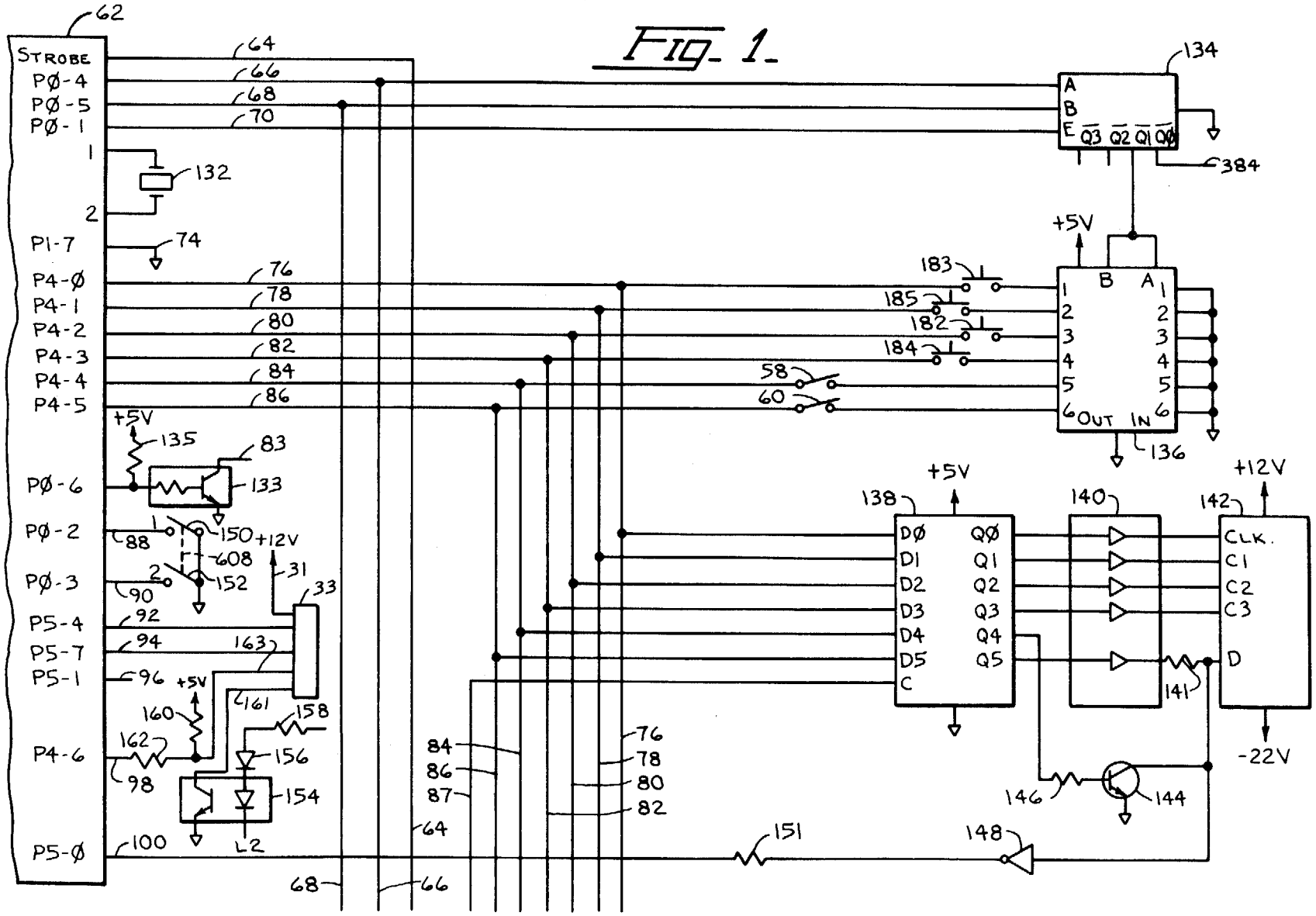
FIG. 1 is a part of the circuit diagram of a preferred form of control device which is provided by the present invention, and it shows line-selecting switches, price-setting switches, and inventory switches.

Referring particularly to FIG. 1, the numerals 183 and 185 denote normally-open, push button switches that are connected, respectively, to pins 0 and 1 of Port 4 of a microprocessor 62. Those switches can, and preferably will, be identical to the similarly-numbered switches in Hasmukh R. Shah et al application Ser. No. 906,234 for CONTROL DEVICE which was filed on May 15, 1978. Numerals 182 and 184 denote further normally-open, push button switches that are connected, respectively, to pins 2 and 3 of that port. Those switches can, and preferably will, be identical to the similarly-numbered switches in said application. The numeral 58 denotes a normally-open, single-pole, single-throw switch that is connected to pin 4 of Port 4; and the numeral 60 denotes a further normally-open, single-pole, single-throw switch that is connected to pin 5 of that port.

The numeral 134 denotes a dual 2 to 4 decoder which has its A, B and E inputs connected, respectively, to pins 4, 5 and 1 of Port 0 of microprocessor 62 by conductors 66, 68 and 70. The $\overline{Q1}$ output of that decoder is connected to the A and B inputs of a tri-state buffer 136; and the $\overline{Q0}$ output of that decoder is connected to the A Output Disable pin of a tri-state register 374 in FIG. 6 by a conductor 384. All of the input channels of the tri-state buffer 136 are connected to ground, but the output channels 1, 2, 3, 4, 5, and 6 are connected, respectively, to switches 183, 185, 182, 184, 58 and 60.

The numeral 132 denotes a three and fifty-eight hundredths (3.58) megahertz crystal which is connected to the crystal pin inputs of microprocessor 62. The numeral 133 denotes a driver which has the input thereof connected to pin 6 of Port 0 of the microprocessor 62. A resistor 135 connects that input and that pin to plus five (+5) volts. A conductor 83 will connect the output of that driver to a coin return electromagnet if a mechanical-type slug rejector is used with the control device. However, if an electronic slug rejector—such as the electronic slug rejector disclosed in Hasmukh R. Shah application for Coin-Handling Device which is filed of even date and which bears U.S. Pat. No. 4,353,452 issued Oct. 12, 1982—is used with the control device, pin 6 of Port 0 of the microprocessor of said Shah et al Control Device application will be directly connected to the circuitry of that electronic slug rejector to keep that electronic slug rejector from accepting further coins during a vending operation.

The numeral 150 denotes a normally-open, single-pole, single-throw switch that is connected to pin 2 of Port 0 of microprocessor 62 by a conductor 88; and the numeral 152 denotes a normally-open single-pile, single throw switch that is connected to pin 3 of that port by a conductor 90. A slide-type actuator 608 has a normal position wherein it will permit both switches 150 and 152 to be open, has a switch-closing position wherein it will hold switch 150 closed but will permit switch 152 to be open, has a second switch-closing position wherein it will hold switch 152 closed but will permit switch 150 to be open, and has a third switch-closing position wherein it will hold both switches 150 and 152 closed.

The numeral 154 denotes a opto-coupler which is connected, by a resistor 158 and a diode 156, to LINE 6 from the vending machine with which the control device is used. That opto-coupler also is connected to LINE 2 from the vending machine, as indicated by the notation L2. The output of opto-coupler 154 is connected to pin 6 or Port 4 of microprocessor 62 by a resistor 162 and a conductor 98; and it is connected to plus five (+5) volts by a resistor 150.

Pin 7 of Port 1 of microprocessor 62 is grounded by a conductor 74. Pins 4 and 7 of Port 5 of that microprocessor are connected, respectively, by conductors 92 and 94 to a plug and socket 33 which can be connected to a device, not shown, which will keep running counts of the number of each product that is selected and vended, and which also can keep other running counts. Pin 1 of Port 5 is connected, by a conductor 96, to the vending machine to enable the EXACT CHANGE lamp, not shown, in the vending machine to be illuminated, The numeral 138 denotes a HEX latch which has the inputs D0 through D5 thereof connected, respectively, to pins 0 through 5 of Port 4 of microprocessor 62, via conductors 76, 78, 80, 82, 84 and 86. Those conductors also extend, respectively, to switches 183, 185, 182, 184, 58 and 60; and conductors 76, 78, 80 and 82 additionally extend, respectively, to inputs A through D of a BCD to 7-segment decoder 166 of FIG. 2 and to inputs D0 through D3 of a HEX latch 170, and conductors 84 and 86 extend, respectively, to inputs D4 and D5 of that HEX latch. A conductor 87 extends from the $\overline{Q1}$ output of a 2 to 4 decoder 164 of FIG. 2 to input C of HEX latch 138 of FIG. 1. The $\overline{Q0}$ output of that decoder is connected to the C input of HEX latch 170, and the $\overline{Q2}$ output of that decoder is connected to the LE input of decoder 166. Conductors 66 and 68 are connected, respectively, to inputs A and B of decoder 164. The strobe output of microprocessor 62 is connected to input E of decoder 164 by a conductor 64.

The Q0 through Q3 outputs of HEX latch 138 are connected, via a level shifter 140, to the clock and the C1, C2and C3 inputs of an EAROM 142. The Q5 output of that HEX latch is connected, via level shifter 140 and a resistor 141, to the D input of that EAROM. The Q4 output of that HEX latch is connected, via a resistor 146, to the base of an NPN transistor 144 which has the emitter thereof grounded. The collector of that transistor is connected (a) to a junction between resistor 141 and the D input of EAROM 142, and (b) via an inverter 148, a resistor 151, and a conductor 100 to pin 0 of Port 5 of microprocessor 62.

Figure 2:
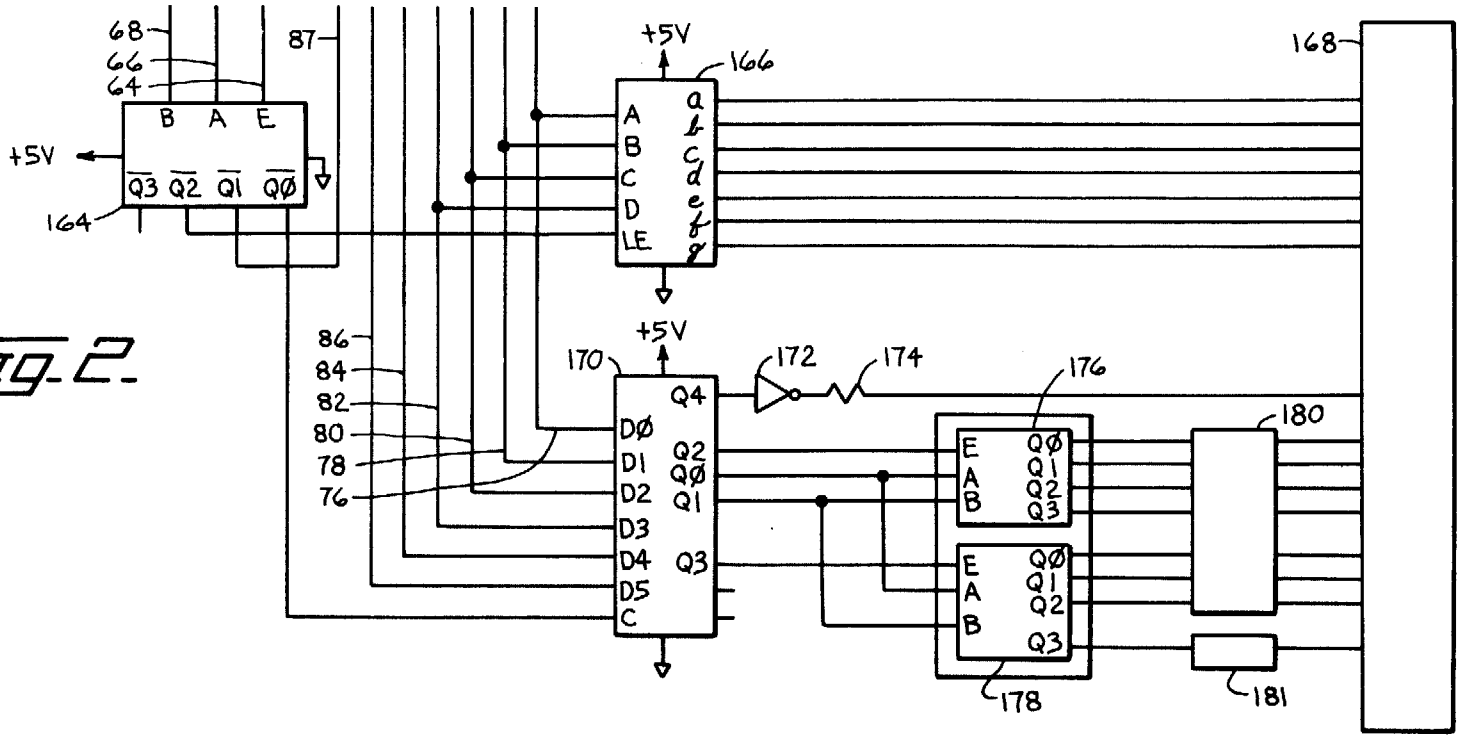
FIG. 2 is a further part of the circuit diagram, and it shows a display on which data can be exhibited, and it also shows the latches and drivers used therewith.

The Q0 through Q2 outputs of HEX latch 170 of FIG. 2 are connected, respectively, to the A, B and E inputs of a 2-to-4 decoder 176; and the Q0 and Q1 outputs of that HEX latch also are connected to the A and B inputs of a 2-to-4 decoder 178. The Q3 output of HEX latch 170 is connected to input E of decoder 178. The Q0 through Q3 outputs of decoder 176 are connected to four inputs of a driver 180 which supplies corresponding amplified outputs to an eight digit display 168. The Q0 through Q2 outputs of decoder 178 are connected to further inputs of digit driver 180, and corresponding amplified outputs are supplied to further inputs of display 168. The Q3 output of decoder 178 is connected to an input of a further digit driver 181, and the corresponding amplified output is supplied to a further input of display 168. The Q4 output of HEX latch 170 is connected to a further pin of display 168 by an inverter 172 and a resistor 174. The a through g outputs of decoder 166 are connected, respectively, to the a through g inputs of all of the eight seven-segment units of display 168.

Figure 3:
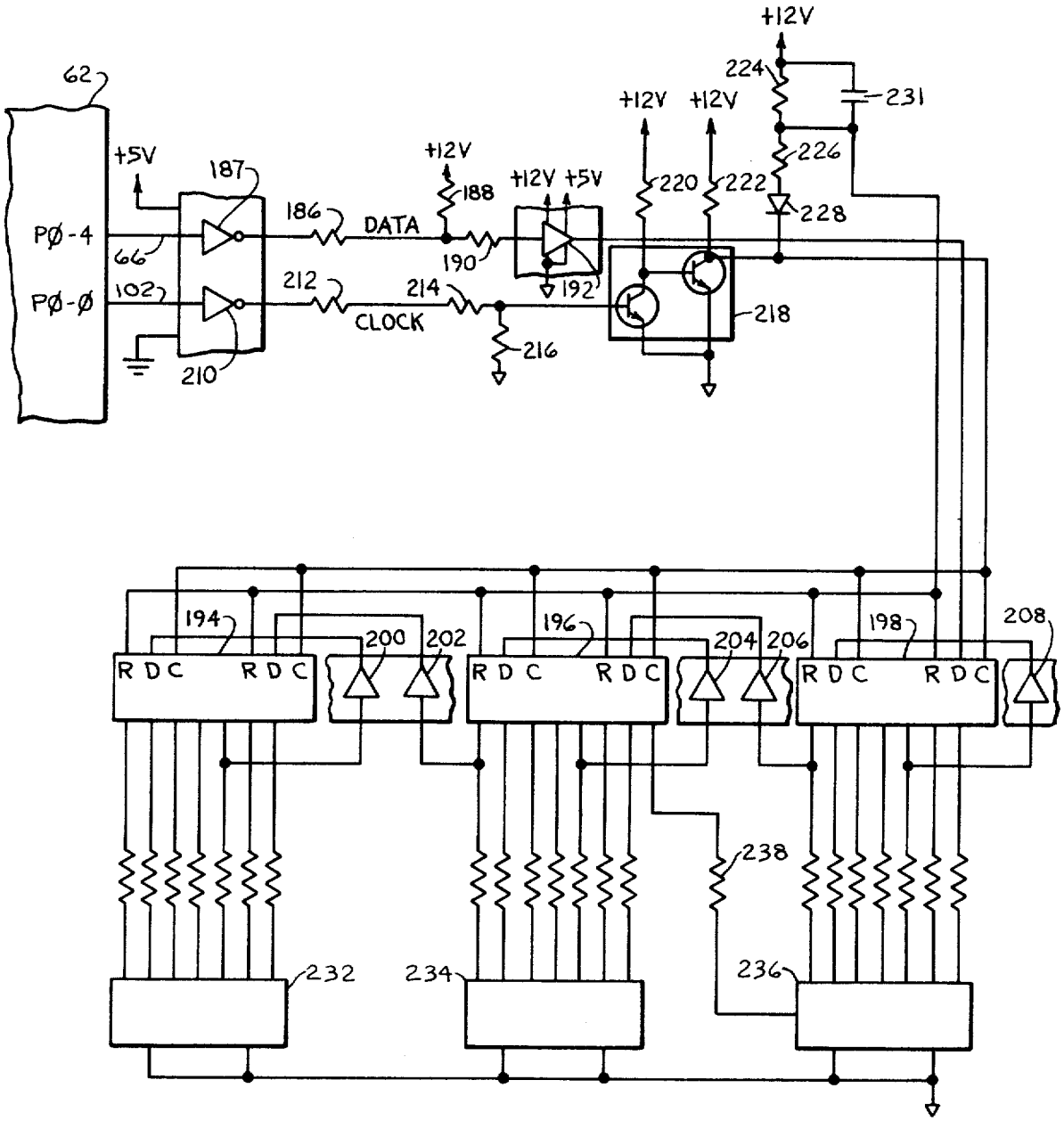
FIG. 3 is a rear view of a three-section display on which data can be exhibited, and it also shows the registers and drivers associated with that display.

Referring particularly to FIG. 3, the numerals 194, 196 and 198 denote dual 4-bit shift registers. The numerals 192, 200, 202, 204, 206 and 208 denote HEX level shifters which are used as buffers. The outputs of register 194 are connected to the inputs of a seven-segment display 232 by seven current-limiting resistors, the outputs of register 196 are connected to the seven inputs of a seven-segment display 234 by seven further current-limiting resistors, and the outputs of register 198 are connected to the inputs of another seven-segment display 236 by another seven current-limiting resistors. A resistor 238 extends from the eighth output of register 196 to display 236 to control the decimal point. Conductor 66, an inverter 187, resistors 186 and 190, and buffer 192 connect pin 4 of Port 0 of microprocessor 62 to input D of register 198. A resistor 188 connects the junction between resistors 186 and 190 to plus-five (+5) volts. A conductor 102, an inverter 210, resistors 212 and 214, and a Darlington amplifier 218 connect pin 0 of Port 0 of microprocessor 62 to the C inputs of registers 194, 196 and 198. A resistor 216 connects the input of that amplifier to ground; and resistors 220 and 222 connect the collectors of that amplifier to plus twelve (+12) volts. Parallel-connected resistor 224 and capacitor 231 are connected to the output of amplifier 218 by a resistor 226 and a diode 228. That parallel-connected resistor and capacitor also are connected to the R inputs of registers 194, 196 and 198. The fifth output of register 194 is connected by buffer 200 to the left-hand D input of that register; and the first output of register 196 is connected by buffer 202 to the right-hand D input of register 194. The fifth output of register 196 is connected by buffer 204 to the left-hand D input of that register; and the first output of register 198 is connected by buffer 206 in the right-hand D input of register 196. The fifth output of register 198 is connected by buffer 208 to the left-hand D input of that register.

Figure 4:
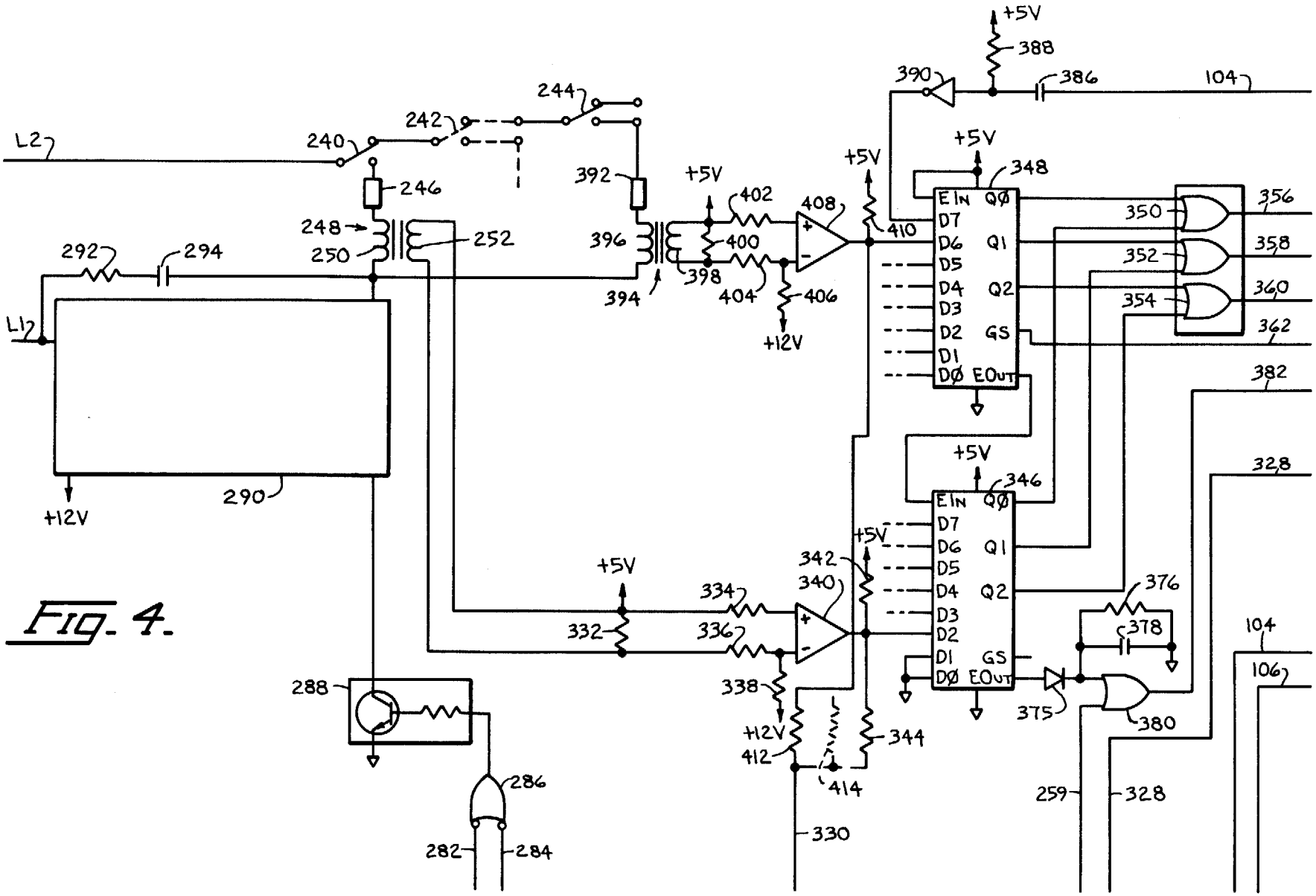
FIG. 4 is another portion of the circuit diagram, and it shows selection switches, vending devices, and other parts of the vending circuit.

Referring particularly to FIG. 4, the numerals 240 and 244 denote single-pole, double-throw switches which are mounted on the vending machine to enable customers to select desired products. The movable contact of switch 240 is connected to line L2 of the vending machine. The numeral 242 denotes any desired number of additional selection switches which are mounted on the vending machine to enable customers to select further desired products. Those selection switches are of standard and usual design, and they are mounted in the standard and usual locations on that vending machine.

The numeral 246 denotes a vending device—which can be a solenoid, relay or a motor—that is mounted in the vending machine to initiate the vending of the product which is desired by the customer who presses selection switch 240; and one terminal of that device is connected to the normally-open contact of that switch. The numeral 248 denotes a current transformer which has the primary winding 250 thereof connected between the output of vending device 246 and one terminal of a solid state relay 290. The other terminal of that relay is connected to line L1 of the vending machine. A resistor 292 and a capacitor 294 are connected in series between the terminals of that relay to by-pass line noise and other transients around that relay. The numeral 288 denotes a driver which has the output thereof connected to the input of solid state relay 290; and the input of that driver is connected to a NAND gate 286.

The secondary winding 252 of transformer 248 is connected to the non-inverting and inverting inputs of a comparator 340 by resistors 334 and 336, respectively. A biasing resistor 332 is connected across the terminals of that secondary winding; and the junction between that resistor and resistor 334 is connected to plus five (+5) volts. The inverting input of comparator 340 is connected to plus twelve (+12) volts by a resistor 338. The output of that comparator is connected to plus five (+5) volts by a resistor 342, is connected to input D2 of an encoder 346, and via a resistor 344 and a conductor 330 to the non-inverting input of a comparator 326 in FIG. 5. The Q0 through Q2 outputs of encoder 346 are connected, respectively, to the lower inputs of OR gates 350, 352 and 354. The E out of that encoder is connected by a diode 375 to the upper input of a OR gate 380. A resistor 376 and a capacitor 378 are connected between ground and that upper input; and they constitute part of a re-setting network.

The numeral 392 denotes a further vending device in the vending machine; and it is connected to the normally-open contact of selection switch 244. The primary winding 396 of a further current transformer 394 is connected between that vending device and the upper terminal of solid state relay 290. The secondary winding 398 of transformer 394 is connected to the non-inverting and inverting inputs of a comparator 408 via resistors 402 and 404, respectively. A biasing resistor 400 is connected across that secondary winding; and the junction between that resistor and resistor 402 is connected to plus five (+5) volts. The inverting input of comparator 408 is connected to plus twelve (+12) volts by a resistor 406. The output of comparator 408 is connected to plus five (+5) volts by a resistor 410, to the D6 input of an encoder 348, and via a resistor 412 and conductor 330 to the non-inverting input of comparator 326. The Q0 through Q2 outputs of encoder 348 are connected to the upper inputs of OR gates 350,352 and 354. The E out of that encoder is connected to the E in of encoder 346.

Figure 5:
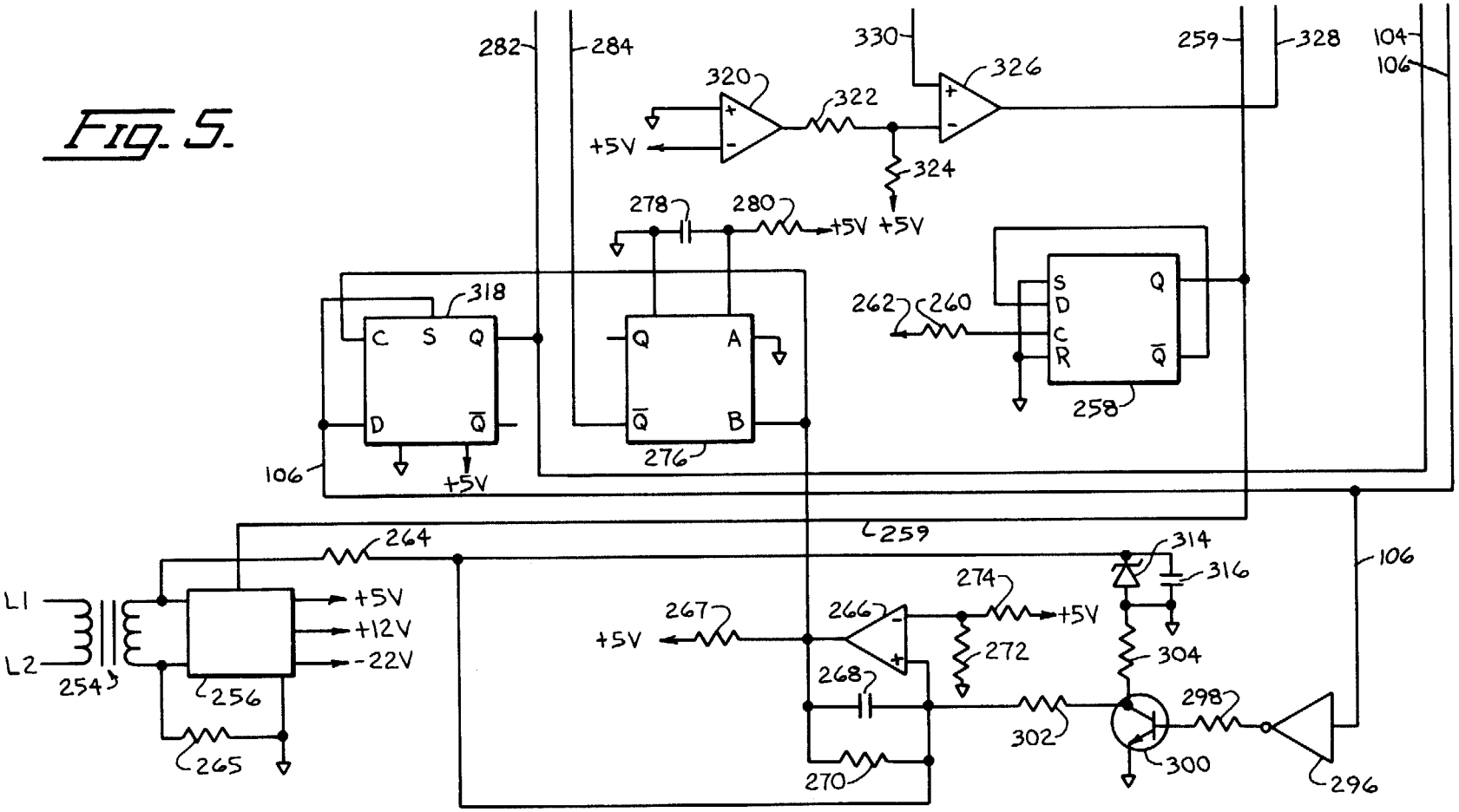
FIG. 5 shows a portion of the circuit diagram which supplies triggering signals.
Figure 7:
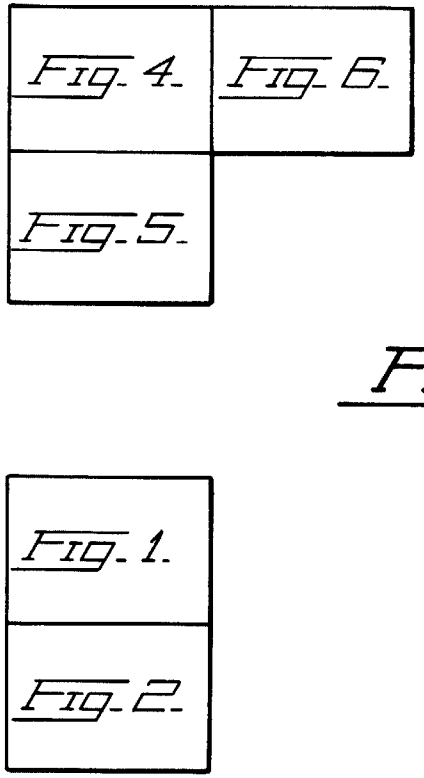
FIG. 7 is a diagrammatic view showing how the sheets bearing
Figure 6:
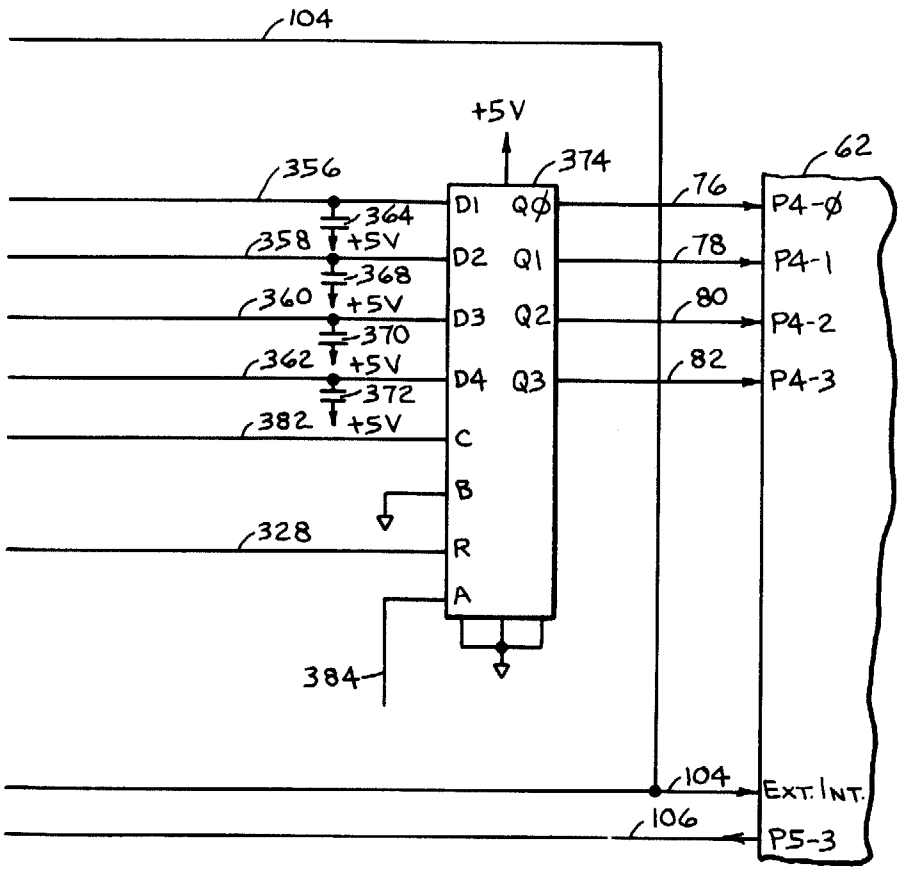
FIG. 6 shows a portion of the circuit diagram which includes a latch that is connected to a microprocessor.

The outputs of OR gates 350, 352 and 354 are connected, respectively, by conductors 356, 358 and 360 to the D1, D2 and D3 inputs of the tri-state register 374 of FIG. 6—which is used as a latch. The GS output of encoder 348 of FIG. 4 is connected, via a conductor 362, to the D4 input of register 374. The output of NAND gate 380 in FIG. 4 is connected, via a conductor 382, to the C input of that register. The output of comparator 326 in FIG. 5 is connected, via a conductor 328, to the R input of that register. The B output disable input of that register is grounded. The Q0 through Q3 outputs of register 374 are connected, respectively, by conductors 76, 78, 80 and 82 to pins 0 through 3 of Port 4 of microprocessor 62.

The Q output of a flip-flop 318 of FIG. 5 is connected, by a conductor 282, to one input of NOR gate 286 in FIG. 4; and by a conductor 104 to the EXT. INT. input of microprocessor 62, and by a capacitor 386 and an inverter 390 to the D7 input of encoder 348. The input of that inverter is connected to plus five (+5) volts by a resistor 388. A conductor 106 extends from pin 3 of Port 5 of microprocessor 62 to the input of an inverter 296 in FIG. 5, and also to the D and S inputs of flip-flop 318. The numerals 364, 368, 370 and 372 in FIG. 6 denote capacitors which have the lower terminals thereof connected to plus five (+5) volts, and which have the upper terminals thereof connected to the D1 through D4 inputs of register 374. Those capacitors will minimize the effects of noise and other transients.

The dotted-line representation of selection switch 242 in FIG. 4, the dotted-line inputs to the D0 through D5 inputs of encoder 348, the dotted-line inputs to D3 through D7 inputs of encoder 346, and the dotted-line resistor 414 indicate that eleven additional selection switches, eleven additional current transformers, eleven additional vending devices, eleven additional comparators, and eleven additional resistors would be used in a vending machine which vended products at thirteen (13) specifically-different prices. Significantly, it will be noted that the lower terminals of all of the primary windings of all thirteen (13) current transformers will be connected to the upper terminal of solid state relay 290. As a result, only one such relay is needed.

A power transformer 254 in FIG. 5 has the primary winding thereof connected to lines L1 and L2 of the vending machine—which are connected to a standard and usual source of 115 volts A.C. The secondary winding of that transformer supplies 24 volts A.C. to a power supply 256 which provides regulated plus five (+5) volts, plus twelve (+12) volts and minus twenty-two (−22) volts. A resistor 264 is connected to the upper terminal of that secondary winding, and a resistor 265 is connected between ground and the lower terminal of that secondary winding. Those resistors and resistors 302 and 304 constitute a voltage divider; and the junction between resistors 264 and 302 is connected to the non-inverting input of a comparator 266. A ten (10) volt Zener diode 314, which is paralleled by a capacitor 316 is connected between ground and that non-inverting input. An NPN transistor 300 is connected in parallel with resistor 304 and has its emitter grounded. A resistor 298 connects the output of inverter 296 to the base of transistor 300. Resistors 274 and 272 are connected between plus five (+5) volts and ground to constitute a voltage divider which will apply a fixed reference voltage to the inverting input of comparator 266. A resistor 270 and a capacitor 268 are connected between the output and the non-inverting input of that comparator. That output is connected to plus five (+5) volts by a resistor 267, to the C input of flip-flop 318, and to the B input of a monostable multivibrator 276. A resistor 280 connects plus five (+5) volts to one input of that monostable multivibrator and, via a capacitor 278 to a grounded input of that monostable multivibrator. The $\overline{Q}$ output of that monostable multivibrator is connected to the other input of NAND gate 286 of FIG. 5 by conductor 284.

A comparator 320 in FIG. 5 has the non-inverting input thereof grounded, and has the inverting input thereof connected to plus five (+5) volts. A resistor 322 connects the output of that comparator to the inverting input of comparator 326; and a resistor 324 connects that input to plus five (+5) volts.

A flip-flop 258 in FIG. 5 has the Q output thereof connected to the lower input of NAND gate 380 in FIG. 4 by a conductor 259 and also is connected to the power supply 256 in FIG. 5. The $\overline{Q}$ output of that flip-flop is connected to the D input thereof; and the S and R inputs are grounded. A resistor 260 and a conductor 262 connect the C input of that flip-flop to a junction 426 that is connected to the outputs 11 of switch chips 416 and 418 in FIG. 8. Chip 416 has outputs 7, 9, 14 and 16 thereof connected, respectively, to pins 0 through 3 of Port 1 of microprocessor 62 via conductors 108, 110, 112 and 114. The numerals 149, 486, 520 and 574 denote sensing coils which are identical in purpose and function to the similarly-numbered sensing coils in Raymond A. Johnson application Ser. No. 36,335 for COIN HANDLING DEVICE which was filed on May 4, 1979. Coil 149 will be mounted adjacent a passageway for dollar coins to sense the insertion of such coins. Sensor 486 will be mounted adjacent a passageway for quarters to sense the insertion of such coins. Sensor 520 will be mounted adjacent a passageway for dimes to sense the insertion of such coins. The sensor 574 will be mounted adjacent a passageway for nickels to sense the insertion of such coins. Those passageways will be located as shown by said Johnson application. One terminal of sensor 574 is connected to input 6, one terminal of sensor 520 is connected to input 8, one terminal of sensor 486 is connected to input 15, and one terminal of sensor 149 is connected to input 1 of switch chip 416.

The numerals 306, 308 and 310 denote sensing coils which are identical in function and purpose to similarly-numbered sensing coils in said Johnson application. Coil 306 will be mounted adjacent a storage tube for quarters, sensor 310 will be mounted adjacent a storage tube for dimes, and sensor 308 will be mounted adjacent a storage tube for nickels. The upper terminal of coil 308, the upper terminal of coil 310, and the upper terminal of coil 306 are connected, respectively, to inputs 6, 15 and 1 of switch chip 418. The number 803 denotes a sensing coil which is mounted adjacent a ferrous metal vane that is movable relative to the magnetic field of that coil whenever the "cancel sale" button of the vending machine is pushed to effect the moving of that vane. The lower terminals of the coils 574, 520, 486, 149, 308, 310, 306 and 803 are connected to a voltage reference source—which consists of an NPN transistor 480, an operational amplifier 484, resistors 482, 488 and 490—by resistors 446, 450, 454, 458, 462, 466, 470 and 474, respectively. The collector of transistor 480 is connected to plus twelve (+12) volts. Resonating capacitors 444, 448, 452, 456, 460, 464, 468 and 472 are connected, respectively, across the outputs of the coils 574, 520, 486, 149, 308, 310, 306 and 803 to constitute parts of the tank circuits which include those coils.

The numeral 230 denotes a motor which is identical in structure, purpose and function to the similarly-numbered motor in the said Johnson application. That motor is controlled by NPN transistor 830 and PNP transistor 832 which are connected in series between plus twelve (+12) volts and ground. The junction 836 between the emitter of transistor 830 and the collector of transistor 832 is connected to one terminal of that motor; and the other terminal of that motor is grounded. A resistor 828 and an NPN transistor 826 are connected in series between plus twelve (+12) volts and ground; and the collector of that transistor is connected to the bases of transistors 830 and 832 by a junction 834 to selectively energize and de-energize the motor 230, all as described in said Johnson application. A conductor 126 connects the base of transistor 826 to pin 5 of Port 5 of microprocessor 62. The motor 230 is used to effect dispensing of coins—either in response to the pressing of the "cancel sale" button or to make change. A sensing coil 312, which is identical in structure, function and purpose to the similarly-numbered coil of said Johnson application, is mounted adjacent a gear in a gear train which is driven by the motor 230. That coil will sense each revolution of that gear, all as explained in said Johnson application. A resonating capacitor 476 is connected in parallel with the coil 312; and one terminal of that coil is connected to the voltage reference by a resistor 478. The other terminal of that sensor is connected to input 8 of switch chip 418. The 7, 14, 16, 2 and 9 outputs of that chip are connected, respectively, to pins 4–6 of Port 1, pin 7 of Port 4, and pin 7 of Port 0 of microprocessor 62. Resistor 422 connects outputs 11 of chips 416 and 418 to plus twelve (+12) volts, and resistor 424 connects inputs 13 of those chips to plus twelve (+12) volts. Plus twelve (+12) volts is applied to inputs 12 of chips 416 and 418 and to the upper terminals of grounded capacitors 420 and 438. Plus twelve (+12) volts also is applied to input 10 of chip 418 and to the upper terminal of a grounded capacitor 440 by a resistor 442. In addition, plus twelve (+12) volts is applied to inputs 4 of chips 416 and 418 via paralleled resistor 434 and thermistor 436, resistor 432, and junctions 431 and 433. Paralleled resistor 428 and capacitor 430 are connected to junction 433 to by-pass noise and other transients to ground.

A conductor 128, an inverter 822, and a driver 824—in the form of an inverter—connect pin 6 of Port 5 of microprocessor 62 to a movable relay contact 820. A conductor 130, an inverter 804, and a driver 806—in the form of an inverter—connect pin 2 of that port to one terminal of a relay coil 808. Plus 12 (+12) volts is connected to the other terminal of that coil, and also to a movable relay contact 814. Coil 808, the movable contacts 814 and 820, and stationary relay contacts 810, 812, 816 and 818 constitute a reversing delay which is identical to the similarly-numbered reversing relay in the said Johnson application. The numeral 366 denotes a selector motor which is identical to the similarly-numbered selector motor in said Johnson application. By being energized in one direction, while the motor 230 is de-energized, the selector motor 366 can cause a dollar coin to be directed to the cash box of the vending machine; whereas by being energized in the opposite direction, while the motor 230 is de-energized, the selector motor 366 can cause a dollar coin to be directed to the coin cup at the exterior of the vending machine. By being left de-energized, by being energized in one direction, or by being energized in the opposite direction when the motor 230 is running, the selector motor 366 can effect the paying out of specifically-different coins. Signals from pins 2 and 6 of Port 5 of microprocessor 62 will control the energization and de-energization of selector motor 366.

Preferred Components

Although various microprocessors could be used, a Fairchild 3870 microprocessor is preferred. Although various devices could be used as the HEX latches 138 and 170, of FIGS. 1 and 2, Motorola MC14174B HEX latches are preferred. Although various devices could be used as the level shifter 140, five-sixths (5/6) of a Motorola MC14504 level shifter is preferred. Although various devices could be used as the EAROM 142, a General Instruments ER 1400 EAROM is preferred. Although various devices could be used as the tri-state buffer 136, a Motorola MC14503B HEX Tri-State buffer is preferred. Although various devices could be used as the decoders 134, 164, 176 and 178, a Motorola MC14556B Dual 2-to-4 Decoder could be used as the decoders 134 and 164, and a Motorola MC14555B Dual 2-to-4 Decoder could be used as the decoders 176 and 178. Although various devices could be used as the decoder 166, a Motorola MC14495B BCD to 7-segment decoder is preferred. Although various devices could be used as the drivers 180 and 181, Sprague ULN 2003A drivers are preferred—the driver 180 consisting of a full Sprague driver and the driver 181 consisting of one-seventh (1/7) of such a driver. Although different devices could be used as the display 168, a National NSA 1588A 8-digit display is preferred. The display 168 will be mounted inside of the vending machine and will not be visible to customers. However, that display can easily be seen by a route man whenever he opens the vending machine to service it.

Although different devices could be used as the registers 194, 196 and 198 of FIG. 3, Motorola MC14015B Dual 4-Bit shift registers are preferred. Although different devices could be used as the displays 232, 234 and 236, Hewlett Packard HP 5082-7653 seven-segment displays are preferred. Although various devices could be used as the buffers 192, 200, 202, 204, 206 and 208, portions of Motorola MC14504B HEX Level Shifters are preferred. The displays 232, 234 and 236 are mounted at the exterior of the vending machine so they can be seen by customers, the route man, or anyone else—even when the vending machine is closed.

Although various devices could be used as the solid state relay 290 of FIG. 4, a Theta-J Corp. 0FA1201N OPTOFILM Solid State Relay is preferred. Although various devices could be used as the driver 288, part of a Sprague ULN 2003 driver is preferred. Various devices could be used as the comparators 266, 320, 326, 340 and 408—and the other eleven comparators, not shown, in FIGS. 4 and 5—but portions of Motorola MLM339 Quad Comparators are preferred. Although various devices could be used as the encoders 346 and 348, Motorola MC14532B encoders are preferred. Although different devices could be used as the flip-flops 258 and 318 of FIG. 5, a Motorola MC14013B Dual D-Type flip-flop is preferred. Although different devices could be used as the multivibrator 276, one-half of a Motorola MC14538B monostable multivibrator is preferred. Although various devices could be used as register 374, a Motorola MC14076B Quad D-Type Tri-State Register is preferred. Although various devices could be used as the current transformers 248, 394 and the other eleven (11) current transformers, not shown, in FIG. 4, TRW EO-53061-R5 current transformers are preferred. The primary windings of those transformers have only a few turns, and hence require appreciable values of current to flow through them to develop the ampere-turns which are needed to cause the secondary windings to provide usable outputs.

Various devices could be used as the power supply 256 of FIG. 5. Flip-flop 258 receives a forty-eight kilohertz (48 KHz) clock from switch chips 416 and 418 in FIG. 8; and it acts as a divide-by-two counter to provide a twenty-four kilohertz (24 KHz) signal to power supply 256. A switching voltage regulator, of standard and usual design, within that power supply responds to that twenty-four kilohertz (24 KHz) signal to develop a minus twenty-two (−22) volts. Although it is desirable to use switch chips 416 and 418, flip-flop 258, and the switching voltage regulator in the power supply 256, any source of regulated plus twelve (+12) volts, plus five (+5) volts, and minus twenty-two (−22) volts could be used. However, if such a source was used, switch chips 416 and 418 and flip-flop 258 would still be needed to supply a clock, via conductor 259, to the lower input of NAND gate 380 in FIG. 4. As a result, the use of the switching voltage regulator within the power supply 256 is preferred.

Figures 8, 9:
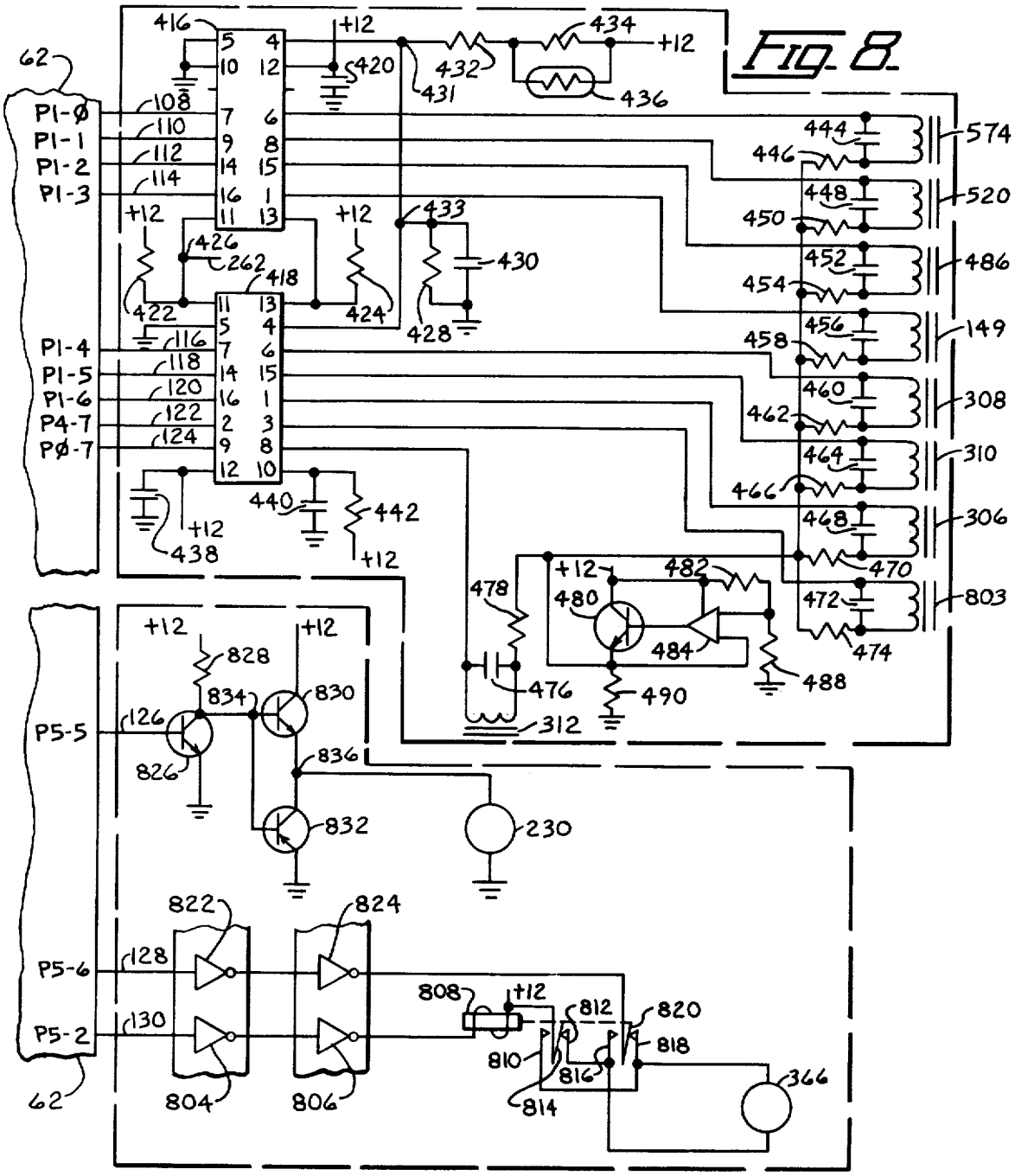
FIG. 8 is a further portion of the circuit diagram which shows coin-sensing devices and level-sensing devices, and also shows the circuitry associated therewith.
FIG. 9 shows the part of the circuit diagram which relates to the paying out of change.

Referring to FIG. 8, various devices could be used as the switch chips 416 and 418; but Synertek C10522 switch chips are preferred. Although the thermistor 436 of FIG. 8 is useful, a temperature-compensator resistor could be used as resistor 434; and then the thermistor could be deleted.

Turn On

Figure 10:
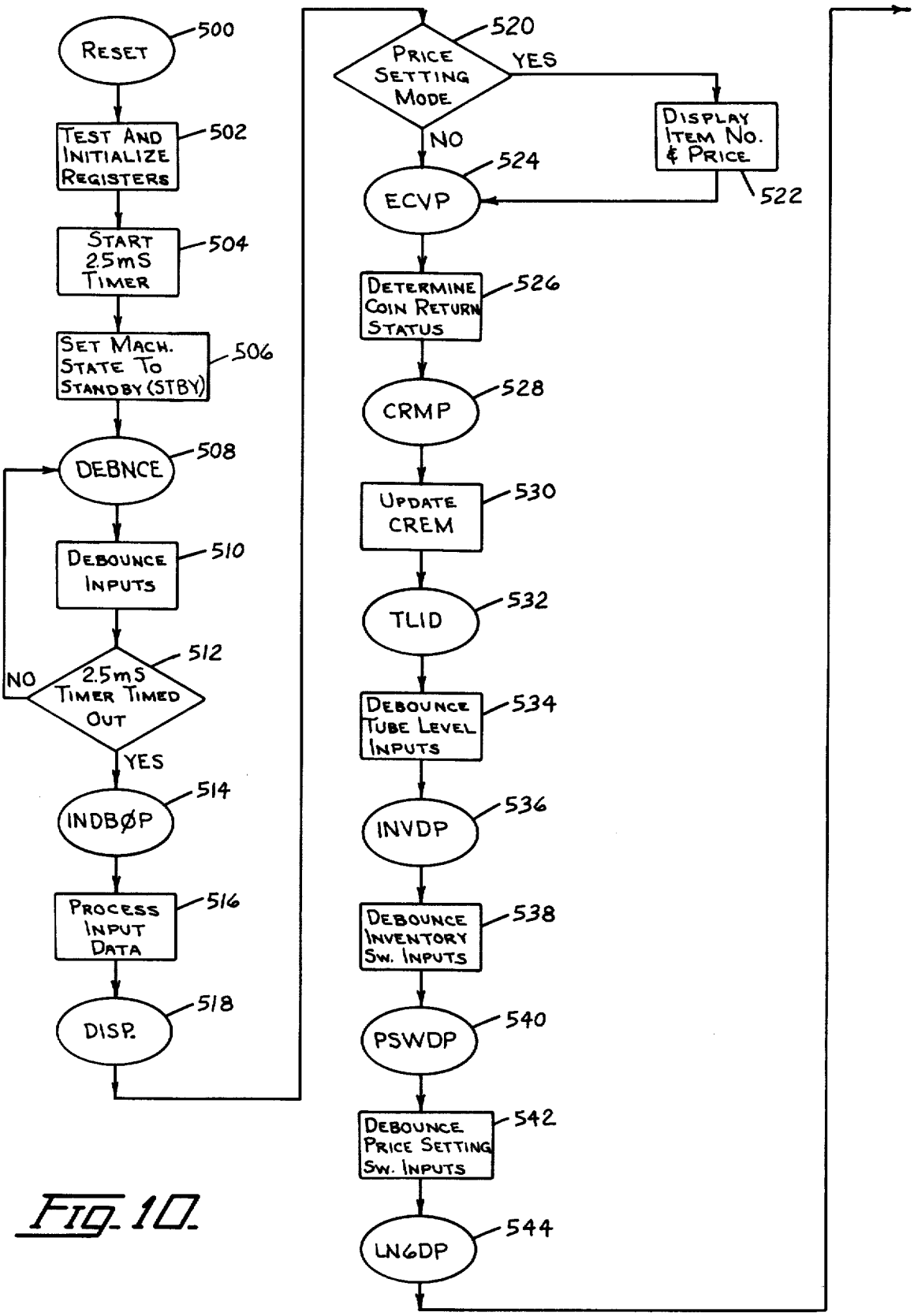

Referring particularly to FIG. 10, the numeral 500 denotes a label which is entitled RESET and which corresponds to line 0220 of the program that is attached hereto and made a part hereof. Whenever the control device is turned on, that program will, via label 500, address step 502—which is entitled TEST AND INITIALIZE REGISTERS and which corresponds to lines 3029 through 3057 and lines 3068 through 3094 of the program. During that step, a number of registers within the microprocessor 62 are tested (lines 3029 through 3057) and then a number of those registers are initialized (lines 3068 through 3094). Other registers in that microprocessor do not require initialization; and still further registers will be initialized during later steps of the program. Among the registers that are initialized during step 502 are register 10 (hereinafer RFLG register), register 11 (hereinafter R1FLG register) and register 0 (hereinafter R2FLG register)—the RFLG and R2FLG registers being initialized to zero (0) and the R1FLG register being initialized to HEX 50. Also during step 502, pins 0 through 5 of Port 4 of the microprocessor 62 will supply a code to the D0 through D5 inputs of latch 138 of FIG. 1 and of latch 170 of FIG. 2; and pins 0 through 3 of that port will supply a code to the A through D inputs of decoder 166. Further, pins 4 and 5 of Port 0 of that microprocessor will apply a code to inputs A and B of decoder 164 of FIG. 2, and the strobe of that microprocessor will apply a signal to input E of that decoder. The resulting signal at the $\overline{Q0}$ output of decoder 164 will clock latch 170 to enable the Q2 and Q3 outputs of that latch to apply signals to the E inputs of decoders 176 and 178. Thereupon, those two decoders will apply signals to the drivers 180 and 181 which will blank the eight seven-segment units of the display 168.

During the next-succeeding step 504, which is entitled START 2.5 MS TIMER and which corresponds to lines 3061 through 3066 of the program, the programmable timer of the microprocessor 62 is programmed to provide time periods of two and one-half milliseconds (2.5 ms). During step 506, which is entitled SET MACHINE STATE TO STANDBY (STBY) and which corresponds to lines 2976 and 2984 of the program, the machine state is set to "standby".

The numeral 508 denotes a label which is entitled DEBNCE and which corresponds to line 3118 of the program. The numeral 510 denotes a step which is entitled DEBOUNCE INPUTS and which corresponds to lines 1628 through 1748 of the program. During that step, the microprocessor 62 will initiate a subroutine which will periodically supply a changing code to pins 4, 5 and 1 of Port 0 of that microprocessor. That code will be applied, via conductors 66, 68 and 70, to the A, B and E inputs, respectively, of decoder 134. The portion of that code which conductors 66 and 68 apply to the A and B inputs, respectively, of decoder 164 of FIG. 2 is not significant at this time because it will not cause that decoder to develop a signal at its Q0 output. The decoder 134 of FIG. 1 will respond to the code, which pins 4, 5 and 1 of Port 0 periodically supply to it, to cause the Q1 output thereof to supply a signal to pins A and B of buffer 136. Thereupon, a signal will simultaneously appear at all of outputs 1 through 6 of that buffer. If, during the application of that signal to all of those outputs, any one of the switches 182, 183, 184 and 185 was in its closed state, a corresponding signal would be applied to the corresponding one of pins 0 through 3 of Port 4 of microprocessor 62. Also during step 510 and during the succeeding step 512—which is entitled 2.5 MS TIMER TIMED OUT and which represents the conclusion of one of the two and one-half millisecond (2.5 ms) successively-developed time periods which were initiated during step 504—a delay will be provided that will enable the inputs of microprocessor 62 to assume states which correspond to the steady-state logic "0's" and "1's" at those inputs. Specifically, during step 512, a comparing function will determine whether the two and one-half milliseconds (2.5 ms) timer has timed out; and, if a NO is the response, the program will loop at steps 510 and 512 until that timer has timed out. During each such looping, a comparison will be made between the states of the ports and the states in the corresponding port status registers; and any changes will be stored in three port change registers. If any change had been stored in a port change register during any of the loopings of the program at steps 510 and 512 but had not continued to the end of the then-active two and one-half millisecond (2.5 ms) time period, that change would not be present in the port change register during step 512, and hence would not subsequently be used to change the status in the corresponding port status register. In this way, the port change registers and the port status registers provide a filtering action against electrical noise and other transients.

The numeral 514 denotes a label which is entitled INDBOP and which corresponds to line 0269 of the program; and step 516 is entitled PROCESS INPUT DATA and it corresponds to lines 0269 through 0284 of the program. When the timer of step 512 times out, step 516 will be executed; and, during that step, the status registers which reflect the status of the ports of microprocessor 62 will be updated to reflect the data currently at those ports. The numeral 518 denotes a label which is entitled DISP. and which corresponds to line 0301 of the program; and a step 520 is entitled PRICE SETTING MODE and it corresponds to lines 0301 through 0348 of the program. A comparing function during step 520 will determine whether the control device is in the price setting mode, as by determining whether a price setting flag had been set in the R2FLG register.

The numeral 524 denotes a label which is entitled ECVP and is represented by line 0356 of the program; and step 526 is entitled DETERMINE COIN RETURN STATUS and is represented by lines 0356 through 0363 of the program. If it is assumed that the comparing function of step 520 provides a NO, and also if it is assumed that the control device is being used with a mechanical slug rejector, the program will move past label 528, which is entitled CRMP and corresponds to line 0368 of the program to step 530, which is entitled UPDATE CREM and which corresponds to lines 0368 through 0451. During that step, the driver 133 of FIG. 1 will respond to a signal at pin 6 of Port 0 of microprocessor 62 to apply a signal, via conductor 83, which will energize the coin return electromagnet (CREM). As a result, the CREM will withdraw a coin-blocking finger from the path of coins introduced into the vending machine, and thus enable those coins to be sensed and accepted.

A label 532 is entitled TLID and corresponds to line 0455 of the program; and a step 534 is entitled DEBOUNCE TUBE LEVEL INPUTS and corresponds to lines 0455 through 0478 of the program. During that step, a comparison will be made between the states in the port status register and the states in the tube level input status register. If those states are different, the difference will be stored in a tube level input change register. Subsequently, any difference between the data in the tube level input status register and the tube level input change register will be used to update the data in the tube level input status register. The overall result is a debouncing of the signals which are applied to pins 4, 5 and 6 of Port 1 by sensing coils 308, 310 and 306, capacitors 460, 464 and 468, resistors 462, 466 and 470, switch chip 418, and conductors 116, 118 and 120 of FIG. 8. A label 536 is entitled INVDP and is represented by line 0482 of the program; and a step 538 is entitled DEBOUNCE INVENTORY SW. INPUTS and is represented by lines 0482 through 0500 of the program. During that step, a comparison will be made between the states in the port status register and the states in an inventory switch input status register. If any differences are noted between those states, the change will be noted and stored in the inventory switch input change register. If that change in that inventory switch input change register continues, it will subsequently be used to change the status of the data in the inventory switch input status register. All of this provides a debouncing of the signals which are applied to pins 2 and 3 of Port 0 of microprocessor 62 by inventory switch 150 and conductor 88 and by inventory switch 152 and conductor 90, respectively, of FIG. 1. Label 540 is entitled PSWDP and is represented by line 0504 of the program; and step 542 is entitled DEBOUNCE PRICE SETTING SW. INPUTS and is represented by lines 0504 through 0525 of the program. During that step, the states in the Port 4 status register is compared with the states in a price setting switch input status register. If any differences are noted between those states, the change will be stored in a price setting switch input change register; and if that change continues, it will subsequently be used to revise the data in the price setting switch input status register. All of this provides a de-bouncing of the signals which are applied to pins 0 through 3 of Port 4 by line-addressing switch 183 and conductor 76, line-addressing switch 185 and conductor 78, price-setting switch 182 and conductor 80, and price-setting switch 184 and conductor 82, of FIG. 1. Label 544 is entitled LN6DP and is represented by line 0530 of the program. Step 546 is entitled DEBOUNCE LINE 6 INPUT and is represented by lines 0530 through 0563 of the program. During that step, the states in the Port 4 status register will be compared with the states in a line 6 input status register. If any differences are noted between those states, the change will be stored in a line 6 input change register; and, if that change continues, it will subsequently be used to change the data in the line 6 input status register. All of this provides a de-bouncing of the signal which is applied to line 6 of Port 4 of the microprocessor 62 by LINE 6, resistor 158, octocoupler 154, resistor 162 and conductor 98 of FIG. 1.

Label 548 is entitled INVCP and is represented by line 0568 of the program. Step 550 is entitled VEND? and is represented by lines 0568 through 0617 of the program; and that step provides a comparing function to determine whether an inventory flag had been set in the R1FLG register. The initialization of that register during step 502 would have re-set the inventory flag; and hence the first comparing function of step 550 will provide a NO. Step 556 is entitled 5¢ or 10¢ TUBE EMPTY? and is represented by lines 0624 through 0651 of the program. During that step, the state of the signals, which are applied to pins 4 and 5 of Port 1, by sensing coils 308 and 310, capacitors 460 and 464, resistors 462 and 466, switch chip 418, and conductors 116 and 118, will be checked. If those states indicate that the sensing coils 308 and 310 are, respectively, sensing nickels and dimes in the corresponding coin tubes, the comparing function of that step will provide a NO. Label 560 is entitled CHKCN and is represented by line 0656; and step 562 is entitled HAVE COINS COME IN? and corresponds to lines 0656 through 0662 and lines 0770 through 0786. During that step the portions, of the port status register, which correspond to pins 0 through 3 of Port 1 will be checked. Any difference between the port status register and the corresponding port change register will cause an updating of the port status register.

A label 564 is entitled CONRP and it corresponds to line 0656 of the program; and step 566 is entitled IS THE COIN RETURN ACTIVE? and corresponds to lines 0666 through 0689 of the program. If the comparing function of step 562 provides a NO, step 566 will check the states of the Port 4 status register to determine whether the cancel sale sensing coil 803 has sensed a movement of the ferrous vane relative to it—as would occur during the pressing of the cancel sale button. Label 568 is entitled INVSWP and corresponds to line 0693 of the program; and step 570 is entitled INVENTORY SW's ACTIVE? and corresponds to lines 0693 through 0723 of the program. If the cancel sale button has not been actuated, the comparing function of step 566 will provide a NO; and step 570 will check the states of the inventory switch input status register. If both of the inventory switches 150 and 152 are open, the comparing function of step 570 will provide a NO. Label 572 is entitled JMSP and it corresponds to line 0728 of the program; and step 574 is entitled JUMP TO MACHINE STATE and it corresponds to line 0728 of the program. During that step, the program will jump to the "standby" machine state which was stored in the Q register during step 506.

The numeral 576 in FIG. 12 denotes a label which is entitled STANDBY and which corresponds to line 2198 of the program; and the numeral 578 denotes a step which is entitled SALES TOTALIZER ON? and which corresponds to lines 2201 through 2203 of the program. A comparing function during that step will check the inventory flag of the R1FLG register to determine whether it was set. If that comparing function provides a NO, step 580—which is entitled PRICE SETTING SW. ACTIVE? and which corresponds to lines 2204 through 2206 of the program —will provide a comparing function. During the latter comparing function, the states of the Port 4 status register will be checked; and those states will indicate whether any of the switches 182, 183, 184 and 185 had been closed. If that comparing function provides a NO, step 582—which is entitled PRICE VERIFICATION MODE? and which corresponds to lines 2207 through 2209 of the program—will provide a comparing function. During the latter comparing function, the price verification mode flag, which is in the RFLG register will be checked. If that function provides a NO, connective 584 of FIG. 12—which is entitled DEBNCE and which corresponds to line 2236 of the program—and label 508 of FIG. 10 will branch the program to step 510. Thereupon, the program will loop at steps 510 and 512 until the two and one-half millisecond (2.5 ms) timer times out; and, during that looping, all of the inputs of the microprocessor 62 will be debounced. When the time of step 512 times out, the rest of the hereinbefore-identified steps of the routine of FIGS. 10 and 11 will be executed unless some change has occurred. As step 574, the program will jump to the current machine state; and, unless some change has occurred, that state will continue to be "standby". Thereupon, via label 576 and steps 578 and 580 of FIG. 12, the program will execute step 582; and, unless some change has occurred, will then continually loop through label 508 and the succeeding steps of FIGS. 10 and 11 and label 576 and steps 578, 580 and 582 of FIG. 12.

Placing Control Device In Price-Setting Mode

If it is assumed that a route man opens the vending machine and closes any one of the switches 182, 183, 184 or 185 of FIG. 1, the logic state at one of the pins 0 through 3 of Port 4 will be changed during the next time buffer 136 develops signals at all of its outputs 1 through 6. Thereupon, during the next looping of the program through the routine of FIGS. 10 and 11, steps 510 and 516 will sense the change of state at the appropriate one of pins 0-3 of Port 4 and will appropriately change the states in the price-setting switch input status register and in the Port 4 status register and will store any difference in the price-setting switch change register. Subsequently, during step 542, the Port 4 status register will have the states therein changed to reflect the states in the price-setting switch change register; and the microprocessor will be inhibited from supplying a strobe—as it always is when any of switches 58, 60, 182, 183 and 185 is closed. Thereupon, the comparing function of step 580 of FIG. 12 will provide a YES; and then the program will, via connective 586—which is entitled PSTP and which corresponds to line 2206 of the program—and connective 588 of FIG. 14—which is entitled PSTP and which corresponds to line 1762 of the program—will execute step 590. The latter step is entitled SET PR. SET. MODE FLAG, and it corresponds to lines 1762 through 1764 of the program; and, during that step, the price-setting mode flag in the R2FLG register will be set. During the next-succeeding step 592, which is entitled SET PR. SET. TIMER TO SLOW TIME and which corresponds to lines 1775 through 1778 of the program, the programmable timer will be set to time out every one-half (½) of a second. During step 594, which is entitled CHANGE MACH. STATE TO PR. SET. MODE (PSTM) and which corresponds to lines 1782 and 1783 of the program, the machine state will be changed from "standby" to "price-setting mode". Thereafter, connective 596, which is entitled DEBNCE and which corresponds to line 2026 of the program, and label 508 of FIG. 1 will cause the program to loop at steps 510 and 512 until the timer of the latter step times out. Subsequently, the program will execute steps 516 and 520; and, during the comparing function of the latter step, a YES will be produced. Thereupon, step 522, which is entitled DISPLAY ITEM NO. & PRICE and which corresponds to lines 0304 through 0348 of the program, will cause pins 0 through 5 of Port 4 of microprocessor 62 to supply data to decoder 166 and to latches 138 and 170, via conductors 76, 78, 80, 82, 84 and 86. Also, pins 4 and 5 of Port 0 and the strobe will cause decoder 164 to supply $\overline{Q0}$, $\overline{Q1}$ and $\overline{Q2}$ signals to those latches and that decoder which will cause the data, in the location in the EAROM 142 which corresponds to line 0 and which represents TOTAL CASH, to be exhibited by the display 168.

The program then will execute the remaining steps of the routine of FIGS. 10 and 11; and, during step 574, it will respond to the machine state—which was set during step 594 of FIG. 14—to jump to step 602 of FIG. 15 via connective 598 which is entitled PSTM and which corresponds to line 1805 of the program. During step 602, which is entitled TIMER TIMED OUT? and which corresponds to lines 1805 through 1813 of the program, a comparing function will check the states of the price setting timer NO. 2 register to determine whether that register has been decremented to zero (0)—as will be the case at the end of the one-half (½) second time period which was set during step 592 of FIG. 14. If that comparing function provides a NO, connective 604, which is entitled DEBNCE and which corresponds to line 1821 of the program, and label 508 of FIG. 10 will cause the program to loop through the rest of the routine of FIGS. 10 and 11 and step 602 of FIG. 15 until the value in the price setting timer NO. 2 register is decremented to zero (0). During each of those loopings, the line number and the corresponding data will be exhibited by the display 168. When the comparing function of step 602 provides a YES, step 606, which is entitled SET PR. SET TIMER TO FAST TIME and which corresponds to lines 1830 and 1831 of the program, will set the programmable timer to time out in one-tenth (1/10) of a second. During the succeeding step 609, which is entitled WHICH TYPE OF SWITCH IS ON? and which corresponds to lines 1862 through 1871, a comparing function will determine (a) whether any of switches 182, 183, 184 and 185 is still closed, (b) which if either, of switches 183 and 185 is closed, and (c) which, if either, of switches 182 and 184 is closed.

If it is assumed that the route man closed switch 185, and if it is further assumed that switch 185 still is closed, the program will execute step 610, which is entitled UP OR DOWN and which corresponds to lines 2030 through 2034 of the program. During that step, it will be determined that switch 185 still is closed, and hence the program will execute step 612, which is entitled INCR. LINE COUNT & DISP. and which corresponds to lines 2046 through 2089 of the program. During that step, the data in the line count register will be incremented and that incremented data will be stored in the display register. Thereafter, the program will, via connective 614, which is entitled DEBNCE and which corresponds to line 2026 of the program, and label 508 of FIG. 10, loop at steps 510 and 512 until the timer of the latter step times out. Subsequently, the program will execute steps 516 and 520; and, again, the comparing function of the latter step will provide a YES and, again, step 522 will be executed. During the latter step, the newly-incremented line number—which was established during step 612 will be exhibited by the display 168.

The connective 614 of the routine of FIG. 15 and label 508 of FIG. 10 will cause the program to loop at steps 510 and 512 until the timer of the latter step times out. Thereafter, that program will execute the rest of the steps of FIGS. 10 and 11; and, in doing so, will cause the newly-incremented line number to be exhibited by the display 168. Step 574 will again cause the program to jump to step 602 of FIG. 15; and the program will then loop via connective 604, label 508 of FIG. 10, the rest of the routine of FIGS. 10 and 11 and step 602 of FIG. 15 until the comparing function of the latter step provides a YES—to indicate that the one-tenth (1/10) of a second time period which was set by step 606 has timed out.

A further "fast time" setting of the programmable timer will be provided by step 606; and then step 609 will again determine which, if either, pair of switches 183 and 185 or 182 and 184 has one of the switches thereof closed. If step 609 determines that switch 185 is still closed, step 612 will provide a further incrementing of the data in the line number register, and will store that data in the display register. Subsequently, during step 522 of FIG. 10, the display 168 will exhibit the additionally-incremented line number. As long as the switch 185 is held closed, the program will continue to loop and to increment the data in the line count register, to store the corresponding data in the display register, and then during step 522 to display the incremented line number.

If, during one of the loopings to step 609, the switch 185 was permitted to re-open, steps 510 and 516 of the next succeeding looping would sense, and store data reflecting, the resulting change of state at pin 1 of Port 4; and step 542 of that looping would change the value in the price setting switch input status register. Subsequently, in that looping, the comparing function of step 609 would determine that none of the switches 182, 183, 184 and 185 was closed. Thereupon, the program would, during step 611—which is entitled STORE AND DISPLAY DATA and which corresponds to lines 1892 through 2026 of the program—cause the data corresponding to the currently-addressed line number, and which is stored at the corresponding location in the EAROM 142, to be exhibited by the display 168. Also, the program will branch, via connective 630, which is entitled DEBNCE and which corresponds to line 1821 of the program, and step 508 of FIG. 10 to loop at steps 510 and 512 until the timer of the latter step times out. Thereafter, as long as all of the switches 182, 183, 184 and 185 remain open, and no changes occurred which affected any of the steps of the routine of FIGS. 10 and 11, the program would loop through that routine, step 609 and connective 630.

If switch 183 is closed, steps 510 and 516 will, during the next-succeeding looping of the program sense, and store data reflecting, the resulting change of state at pin 0 of Port 4; and step 542 of that looping will change the value in the price setting switch input status register. Subsequently, in that looping, the comparing function of step 609 will determine that one of the switches 183 and 185 had been closed. Thereafter, the comparing function in step 610 will determine that switch 183 was closed; and hence step 616 will be executed. That step is entitled DECR. LINE COUNT & DISP. and it corresponds to lines 2030 to 2039 of the program; and, during that step, the data in the line count register will be decremented and the decremented data will be stored in the display register. The program will, then, via connective 618—which is entitled DEBNCE and which corresponds to line 2026 of the program—branch to step 508 of FIG. 10, where it will loop at steps 510 and 512 until the timer of the latter step times out. Thereafter, the program will loop back through the rest of the routine of FIGS. 10 and 11 and through steps 602, 606, 609 and 610 of FIG. 15 to step 616; and in doins so, will cause step 522 to effect the exhibiting of the decremented line number and corresponding data by display 168. If the route man continues to hold switch 183 closed, each looping of the program through step 616 will cause the data in the line count register to be decremented and the corresponding decremented data to be stored in the display register; and, during the next-succeeding execution of step 522, the further decremented line number will be exhibited by display 168. Subsequently, when the switch 183 is released, the program will, during step 611, execute step 611, and will thereby cause the newly-decremented price to be written into the location in EAROM 142 where the price, which was decremented had been stored. Also, that newly-decremented price will be exhibited by the display 168. At this time, the program will exit at step 630 and branch to label 508, where it again will loop at steps 510 and 512 until the timer of the latter step times out. Thereafter, that program will loop through the rest of the routine of FIGS. 10 and 11 and through the routine of FIG. 15 is connective 630.

If, during any such looping of the program, switch 182 is closed, steps 510 and 516 will, during the next-succeeding looping of the program sense, and store data reflecting, the resulting change of state at pin 2 of Port 4, and step 542 of that looping will change the value in the price setting switch input status register. Subsequently, in that looping, the comparing function of step 609 will determine that one of the switches 182 and 184 has been closed. At such time, step 620, which is entitled UP OR DOWN and which corresponds to lines 2123 through 2128 of the program, will provide a comparing function wherein it will be determined that the switch 182 has been closed. Thereupon step 626, which is entitled SUB.5¢ FROM PR. & DISP. and which corresponds to lines 2129 through 2135 of the program, will be executed to decrement the data— which corresponds to the then-addressed line—by five cents (5¢); unless that data is non-alterable data, such as the running counts of the numbers of vending operations of each product and the running count of the total of the prices of all such products. Also, the newly-decremented price will be stored in a price register and also in the display register. Subsequently, the program will, via connective 628—which is entitled DEBNCE and which correponds to line 2026 of the program—and step 508 of FIG. 10, loop at steps 510 and 512 until the timer of the latter step times out. Thereafter, as long as switch 182 is held closed, the program will loop through the rest of the routine of FIGS. 10 and 11 and steps 602, 606, 609, 620 and 626 of FIG. 15; and, in doing so, will (a) cause step 522 of FIG. 10 to effect the exhibiting, by display 168, of the currently-addressed line number and the newly-decremented price, an (b) cause step 626 of FIG. 15 to again decrement the price, corresponding to that line number, by a further five cents (5¢). When switch 182 is permitted to re-open, the next execution of step 542 of FIG. 10 will make an appropriate change in the state of the Port 4 status register; and then step 609 will determine that none of the switches 182, 183, 184 and 185 is closed. Thereupon, the program will execute step 611, and will thereby cause the newly-decremented price to be written into the location in EAROM 142 where the price, which was decremented, had been stored. Also, the newly-decremented price will be exhibited by the display 168. At this time, the program will branch, via connective 630 and label step 508 of FIG. 10 to steps 510 and 512 where it will loop until the timer of the latter step times out. That program will, until a further one of the switches 182, 183, 184 and 185 is closed, or some other action affects one of the steps in the routine, continue to loop through the routine of FIGS. 10 and 11, and steps 602, 606 and 609 and connective 630 of FIG. 15.

If switch 184 is closed, steps 510 and 516 will, during the next-succeeding looping of the program sense, and store data reflecting, the resulting change of state at pin 3 of Port 4; and step 542 of that looping will change the value in the price setting switch input status register. Subsequently, in that looping, the comparing function of step 609 will determine that one of the switches 182 and 184 had been closed. Thereafter, the comparing function in step 620 will determine that switch 184 was closed; and hence step 622 will be executed. That step is entitled ADD 5¢ TO PR. & DISP. and it corresponds to lines 2136 through 2138 of the program; and, during that step, the data—which corresponds to the then-addressed line—will be incremented by five cents (5¢); unless that data is non-alterable data. Also, the incremented data will be stored in the display register and in the price register. The program will then, via connective 624—which is entitled DEBNCE and which corresponds to line 2026 of the program—branch to step 508, where it will loop at steps 510 and 512 until the timer of the latter step times out. Thereafter, the program will loop back through the rest of the routine of FIGS. 10 and 11 and through steps 602, 606, 609 and 620 of FIG. 15 to step 622; and, in doing so, will cause step 522 to effect the exhibiting of the currently-addressed line number and the incremented price. As long as switch 184 is held closed, the program will loop through the rest of the routine of FIGS. 10 and 11 and steps 602, 606, 609, 620 and 622 of FIG. 15; and, in doing so, will (a) cause step 522 of FIG. 10 to effect the exhibiting, by display 168, of the currently-addressed line number and the newly-incremented price, and (b) cause step 622 of FIG. 15 to again increment the price corresponding to that line number by a further five cents (5¢). When switch 184 is permitted to re-open, the next execution of step 542 of FIG. 10 will make an appropriate change in the state of the Port 4 status register; and then step 609 will determine that none of the switches 182, 183, 184 and 185 is closed. Thereupon, the program will execute step 611, and will thereby cause the newly-incremented price to be written into the location in EAROM 142 when the price, which was incremented had been stored. Also, the newly-incremented price will be exhibited by the display 168. At this time, the program will branch, via connective 630 and label step 508 of FIG. 10 to steps 510 and 512 where it will loop until the timer of the latter step times out. That program will, until a further one of the switches 182, 183, 184 and 185 is closed, or some other action affects one of the steps in the routine, continue to loop through the routine of FIGS. 10 and 11, and steps 602, 606 and 609 of FIG. 15.

While the control device is in the price-setting mode, the closing of switch 183 or switch 185 can cause all of the lines, which correspond to locations in EAROM 142 where data is stored, to be addressed. Thereupon, the number of that line, and the data corresponding to that line, will be exhibited on the display 168. The route man will, if he wishes to change the price corresponding to any of those lines, permit both of switches 183 and 185 to be in their normally-open state, and then will close switch 182 or switch 184. However if, as the route man uses switch 183 or 185 to cause each line number and the corresponding data to be exhibited by the display 168, he sees that the prices need not be changed, he will not close either of switches 182 and 184. As a result, the price-setting mode of the control device also constitutes a price-checking mode.

The foregoing portion of the description illustrated how the control device can be put in the price-setting mode by closing switch 185. It should be recognized that the control device can also be put into the price-setting mode by the closing of any one of the switches 182, 183 and 184. This is due to the fact that the closing of any one of those switches will cause step 542 of FIG. 10 to provide a change of state in the Port 4 status register which will cause step 580 of FIG. 12 to branch the program, via connective 586 and the routines of FIGS. 14, 10 and 11, to the routine of FIG. 15.

Placing Control Device In Price-Verification Mode

When the route man has finished using various of the switches 182, 183, 184 and 185 to check or change the data for one or more of the lines which correspond to the products offered by the vending machine, he may want to make absolutely certain that those prices will be charged when the control device is in the product-vending mode and the customer-operated selection switch 240, 242 and 244 of FIG. 2 are used. The present invention makes this possible by providing a price verification mode for the control device. Also, the present invention makes it very easy to place that control device in that mode.

All a route man need do, to place the control device in its price verification mode, is to momentarily close either or both of the inventory switches 150 or 152 of FIG. 1. During the next succeeding executions of steps 510 and 516, the resulting change of state at pin 2 or 3 of Port 0 will cause the states in the Port 0 status register and in the inventory switch input status register to be compared, and also will cause any difference between those states to be stored in the inventory switch input change register. During the subsequent execution of step 538, the states in the Port 0 status register will be modified to reflect the data in the inventory switch input change register. Thereafter, during the execution of step 570 of FIG. 11, a comparing function will determine that one or both of the inventory switches had been closed; and the resulting YES will cause the program to branch via connective 634—which is entitled INVP and which corresponds to line 0723 of the program—to connective 636 of FIG. 16. The latter connective also is entitled INVP, and it corresponds to line 2834 of the program. Step 638, which is entitled SET PR VER. MODE FLAG and which corresponds to lines 2834 through 2837 of the program, will set a price verification mode flat in the RFLG register.

During the next-succeeding step 640—which is entitled PAYOUT COIN and which corresponds to lines 2851 through 2865 of the program—the bit in the inventory switch input register will be sensed to energize the motor 230 of FIG. 9 to keep that motor energized long enough for it to establish a cycle-control circuit, of standard and usual design, which will make certain that at least one coin will be dispensed. If inventory switch 150 had been the switch that was pressed, step 640 would have responded to a predetermined bit in that register to permit the selector motor 366 of FIG. 9 to remain de-energized—with consequent dispensing of a nickel from the nickel tube. However, if inventory switch 152 had been the switch that was pressed, step 640 would have responded to a different predetermined bit to permit the relay coil 808 to remain de-energized but would have energized the selector motor 366 in the forward direction—with consequent dispensing of a dime from the dime tube. If both inventory switches had been closed, relay coil 808 would have been energized and the selector motor 366 would have been energized in the reverse direction—with consequent dispensing of a quarter from the quarter tube.

The next-succeeding step 642 is entitled INV. SW. ON? and it corresponds to lines 2851 through 2863 of the program. During that step, a comparing function will determine whether one or more of the inventory switches 150 and 152 still is closed. If that function provides a YES, the program will loop at steps 640 and 642; and hence it will continue to effect the dispensing of coins of the desired enomination. However, when all of the inventory switches are open, the next-succeeding comparing function of step 642 will provide a NO which will initiate the execution of step 644. That step is entitled CHANGE MACHINE STATE BACK TO STANDBY (STBY), and it corresponds to line 2869 of the program which causes a jump to line 2828 which causes a jump to lines 2717 through 2722 which causes a further jump to lines 2875 through 3020 that cause a final jump to lines 0799 through 0869 of the program. At such time, the program will branch via connective 646—which is entitled DEBNCE and which corresponds to line 0869 of the program—to label 508 of FIG. 10, where the program will again loop at steps 510 and 512 until the timer of the latter step times out. During the next execution of the rest of the routine of FIGS. 10 and 11, step 574 will cause the program to jump to step 576 of FIG. 12; and, during the ensuing execution of step 582, the price verification mode flag which was set during step 538 of FIG. 10 will cause the comparing function of step 582 to provide a YES. At this time, the control device will be in its price verification mode.

Step 648 which is entitled SELECTION ACTIVE? and which corresponds to lines 2210 through 2217 of the program, will then check the states of the Port 4 status register to determine whether one of the selection switches 240, 242 or 244 of the vending machine had been closed. As explained hereinafter in the Operation Of Selection Switches section, the closing of any of the selection switches 240, 242 and 244 of FIG. 4 will cause a change of state at one or more of the pins 0 through 3 of Port 4 of microprocessor 62. Also, steps 510 and 516 of FIG. 10 will respond to those changes in state to effect appropriate changes in the states in the Port 4 status register. If the comparing function of 648 provides a NO—thereby indicating that none of the selection switches has been closed, the program will branch via connective 650—which is entitled DEBNCE and which corresponds to line 2236 of the program—to label 508 of FIG. 10, where the program will loop at steps 510 and 512 until the timer of the latter step times out. The program will continue to loop through the routine of FIGS. 10 and 11 and through steps 578, 580, 582 and 648 of FIG. 12 until the route man presses one of the selection switches 240, 242 or 244 or takes the control device out of the price verification mode. If the route man presses one of those selection switches, steps 510 and 512 will, during the next execution thereof, appropriately change the states in the Port 4 status register. During the next-succeeding execution of step 648, a YES will be obtained; and step 652—which is entitled SELECTION CHANGED? and which corresponds to lines 2218 through 2223 of the program—will determine whether a previously-pressed selection switch still is closed or a further selection switch has been closed. If it is assumed that the selection switch which is closed is the first selection switch that is closed by the route man, a YES will be provided by step 652; and step 654–which is entitled SELECTION NO. OUT OF RANGE? and which corresponds to lines 2224 through 2227 of the program—will determine whether voltage spikes or other transients have provided states in the Port 4 status register which do not fit the states corresponding to the selections which can be made by closing any of the selection switches 240, 242 and 244. If step 654 provides a NO, step 658—which is entitled READ PRICE OF SELECTION FROM EAROM and which corresponds to line 2229 of the program—will be executed.

During the latter step, the sub-routine wll call from the EAROM the price which corresponds to the selection switch which was pressed, and it will store that price in the price register. Thereafter, during step 660—which is entitled DISP, PR. ON 3 DIGIT DISP. and which corresponds to line 2235 which causes a jump to lines 0791 through 0793 which causes a jump to lines 0811 through 0868 of the program—the three ssseven-segment displays 232, 234 and 236 of FIG. 3 will display the price which corresponds to the last-pressed selection switch. Thereafter, the program will branch, via connective 662—which is entitled DEBNCE and which corresponds to line 0869 of the program—to label 508 of FIG. 10, where the program will loop at steps 510 and 512 until the timer of the latter step times out. The program will containue to loop through the routine of FIGS. 10 and 11 and the routines of FIGS. 12 and 13 until a further selection switch is pressed or the control device is taken out of the price verification mode.

The pressing of a further selection switch 240, 242 or 244 will cause steps 510 and 512, during the next executions thereof, to appropriately change the states in the Port 4 status register. During the next-succeeding execution of step 648, a YES will be obtained; and step 652 will then determine whether a previously-pressed selection switch still is closed or a further selection switch has been closed. The resulting YES from step 652 will cause the program to execute steps 654, 658 and 660 of FIG. 13 are then the routines of FIGS. 10–13, as described hereinbefore. If, during the next execution of steps 652, the previously-pressed selection switch still is closed, the comparing function of that step will provide a NO. Thereupon, the program will branch, via connective 656—which is entitled DEBNCE and which corresponds to line 2236 of the program—and label 508 of FIG. 10, where it will loop at steps 510 and 512 until the timer of the latter step times out. The program then will execute the rest of the routine of FIGS. 10 and 11, jump to the routine of FIGS. 12 and 13, and then execute steps 578, 580, 582, 648 and 652 of the latter routine.

The program will continue to loop through the routine of FIGS. 10 and 11 and the routine of FIGS. 12 and 13 until a further selection switch is pressed or the control device is taken out of the price verification mode.

It will be noted that the control device was not placed in the price verification mode at the time the inventory switch 150 or 152 was closed. Instead, that control device was not placed in that mode until (a) step 638 of FIG. 16 set a price verification flag, (b) step 642 of FIG. 16 provided a NO, (c) step 570 of FIG. 11 provided a NO, and (d) step 582 of FIG. 12 provided a YES. The fact that the control device was not placed in the price verification mode until step 642 of FIG. 16 provided a NO is very desirable; because it virtually obviates the possibility of a route man failing to permit both of the switches 150 and 152 to re-open. Specifically, if the route man were, somehow, to fail to shift the actuator 608 of FIG. 1 to the position wherein both switches 150 and 152 are open, the route man would be unable to effect the displaying of any data on the seven-segment displays 232, 234 and 236 of FIG. 3 when he pressed any of the selection switches 240, 242 and 244 of FIG. 4. Immediately and unmistakably, the route man would be made aware of the fact that either or both of the switches 150 and 152 was still closed. Moreover, because the motor 230 must operate and must reciprocate a coin-dispensing slide—whenever either or both of those switches have not been permitted to re-open—the resulting noise will automatically remind the route man of the need of re-opening both of those switches. In this way, by keeping the control device out of the price verification mode until after both of the switches 150 and 152 are restored to their open positions, by making it impossible for the route man to effect the exhibiting of any price on the three seven-segment displays 232, 234 and 236 of FIG. 3 until both of those switches are restored to their open positions, and by using the noise from the operation of motor 230 and the reciprocation of a coin-dispensing slide to remind the route man that he must restore those switches to their open positions, the present invention virtually eliminates any likelihood that a route man might fail to re-open the switches 150 and 152 before he closed the vending machine.

After the route man has pressed each of the selection switches of the vending machine and has satisfied himself that the desired price for each selection switch has been established, he will—unless he has previously done so—close the vending machine. Thereafter, to take the control device out of the price verification mode and to place it in the product-vending mode, the route man can (a) insert a nickel, dime, quarter or dollar, (b) press the cancel sale button, (c) depend upon a customer to insert a nickel, dime, quarter or dollar, or (d) depend upon a customer to press the cancel sale button. For purposes of illustration, it will be assumed that the route man inserts a quarter. The passage of that quarter past the sensor 486 of FIG. 8 will effect a change of state at pin 2 of Port 1; and, during the next executions of steps 510, 516 and 562 of FIGS. 10 and 11, the Port 1 status register will have the states therein changed to reflect the insertion of that quarter. The comparing function of FIG. 562 will provide a YES; and then the program will branch, via connector 664—which is entitled CRDTP and which corresponds to line 0662 of the program—to connective 666 of FIG. 17—which is entitled CRDTP and which corresponds to line 0739 of the program. Thereafter, step 668, which is entitled SET COINS CAME IN FLAG and which corresponds to steps 0741 through 0744 of the program, will set a flag in the RFLG register. During step 670, which is entitled RESET PR. VER. MODE FLAG and which corresponds to line 0743 of the program, the price verification mode flag in the RFLG register will be re-set to zero (0). Subsequently, during step 672, which is entitled CHANGE BACK TO STANDBY (STBY) and which corresponds to line 0740 of the program, the machine state will be changed to "standby". At this time, the control device will be out of the price verification mode and will be in the product—vending mode. It will be noted that the route man did not have to close, open or otherwise actuate any switch to take the control device out of the price verification mode and to place it in the conduct vending mode. In fact, the route man did not even have to insert the quarter or any other coin. Instead, he could have walked away from the vending machine as soon as he closed it; because the first subsequent insertion of a coin—whether by the route man or by a customer—would automatically take the control device out of the price verification mode and place it in the product-vending mode.

If the quarter or other first coin had been inserted by a customer, that customer could effect the dispensing of a desired product by closing the appropriate selection switch 240, 242 or 244 of FIG. 4. Alternatively, that customer could insert one or more additional coins and then select a corresponding higher-priced product. Moreover, if desired, that customer could press the cancel sale button to effect the return of a coin or coins equalling the value of the coin or coins inserted by him. All of these features inhere in the operation of the control device in the product-vending mode; and that customer and all succeeding customers can fully utilize those features in succeeding cycles of operation of the vending machine.

Step 674 of FIG. 17 is entitled ADD COINS TO CREDIT & DISP. and it corresponds to lines 0745 through 0793 which cause a jump to lines 0811 through 0868 of the program. During that step, the value of the quarter will be transferred from the Port 1 status register to the credit register. Also, the value in the credit register wll be exhibited by the seven-segment displays 232, 234 and 236 of FIG. 3 as "0.25". The program will then branch, via connective 676—which is entitled DEBNCE and which corresponds to line 0869 of the program—to label 508 of FIG. 10, where it will resume looping at steps 510 and 512. At this time, the program will execute the rest of the routine of FIGS. 10 and 11 and steps 578, 580 and 582 of the routine of FIG. 12, and then—due to the NO which step 582 will provide because the control device is out of the price verification mode—will branch to label 508 of FIG. 10.

Placing Control Device in Product-Vending Mode—Cancel Sale Operation

In the assumed situation, where the route man inserted a quarter to take the control device out of the price verification mode and to place it in the product-vending mode, he will press the CANCEL SALE button. The resulting signal from sensor 803 of FIG. 8 will change the state of pin 7 of Port 4 of the microprocessor 62. During the next execution of steps 510 and 516, that change of state will be used to change the states in the Port 4 coin return input status register and in the Port 4 coin return change register. During the succeeding execution of step 566 of FIG. 11, the comparing function thereof will provide a YES. Step 678—which is entitled CHANGE MACHINE STATE BACK TO STANDBY (STBY) and which corresponds to line 0680 of the program—will change the value in the Q register to "standby". Thereafter step 680—which is entitled RESET PRICE VERIFICATION MODE FLAG and which corresponds to lines 0681 through 0683 of the program—would, if the price verification flag in the RFLG register had not already been re-set, effect the re-setting of that flag to zero (0).

The program will then branch, via connective 682—which is entitled CRETP and which corresponds to line 0689 of the program—and connective 684 of FIG. 18—which is entitled CRETP and which corresponds to line 2465 of the program—to step 686. That step is entitled CHANGE MACH. STATE TO PAY and it corresponds to lines 2480 and 2481 of the program; and it will change the state of the Q register to the state representing "pay". The next-succeeding step 688 is entitled CLEAR CREDIT DISPLAY and it corresponds to line 2482 of th program which causes a jump to lines 0799 through 0868 of the program. During that step, the seven-segment displays 232, 234 and 236 of FIG. 3 will be "cleared" by causing them to exhibit "0.00". The program will then branch, via connective 690—which is entitled DEBNCE and which corresponds to line 0869 of the program—to label 508 of FIG. 10, with consequent looping at steps 510 and 512 until the timer of the latter step times out. During the next execution of the rest of the routine of FIGS. 10 and 11, the "pay" state of the Q register, which was set by step 686 of FIG. 18, will cause step 574 of FIG. 11 to jump the program to the routine of FIGS. 19 and 20, all as explained hereinafter in the Dispensing of Coins—During Cancel Sale Operation section. At the conclusion of that routine, the program would resume its looping through the routines of FIGS. 10-12—exiting via connective 584 of FIG. 12 and re-entering at label 508 of FIG. 10—until coinage is inserted and a selection switch is closed. At this time, the vending machine will be in its "standby" condition in the product-vending mode.

It will be noted that the control device can be taken out of the price-setting mode in either of the hereinbefore-described ways in which it was taken out of the price verification mode. Specifically, that control device can be taken out of the price-setting mode by the insertion of a coin or by the pressing of the cancel sale button. As such a coin is inserted, steps 510, 512 and 562 of FIGS. 10 and 11 will cause the program to branch—via CRDTP connectives 664 and 666, respectively, of FIGS. 11 and 17—to the routine of FIG. 17. Step 672 of that routine will change the state of the Q register from PSTM—which was set by step 594 of FIG. 14 to initiate the placing of the control device in the price-setting mode—to "standby". Thereafter, during the next execution of step 574 of FIG. 11, the program will jump to the routine of FIGS. 12 and 13 rather than to the routine of FIG. 15. In this direct and simple way, the insertion of a coin promptly and automatically takes the control device out of the price-setting mode. Similarly, when the cancel sale button is pushed, steps 510, 512 and 566 of FIGS. 10 and 11 will cause the program to branch—via steps 678 and 680, CRETP connectives 682 and 684, respectively, of FIGS. 11 and 18,—and steps 686 and 688 to label 508 of FIG. 10. The change in the state of the Q register from PSTM—which was set by step 594 of FIG. 14 to initiate the placing of the control device in the price-setting mode—to "standby", which is effected by steps 678 will cause the program—during the next execution of step 574 of FIG. 11—to jump to the routine of FIGS. 12 and 13 rather than to the routine of FIG. 15. In this direct and simple way, the pressing of the cancel sale button promptly and automatically takes the control device out of the price-setting mode. As a result, the present invention provides automatic escape from the price-setting mode, just as it provides automatic escape from the price verification mode. The automatic escape of the control device from the price-setting mode is just as important as the automatic escape from the price verification mode; because a route man might be so pressed for time that he might not place the control device in the price verification mode before he closed the vending machine. The price verification mode and the price setting mode are non-public modes, and hence are quite different from the product-vending mode.

Vending machines, wherein mode switches are used to select between product-vending and price-setting modes or between product-vending and price verification modes do not ordinarily have tell-tale lamps to indicate the modes in which those vending machines are set. Consequently, if a route man failed to shift the mode switch of such a vending machine from the price-setting mode or the price verification mode to the product-vending mode, he would have no visible indication that he had failed to do so. Further, if he closed up the vending machine without shifting the mode switch from the price-setting mode or the price verification mode to the product-vending mode, there would be nothing at the exterior of the vending machine to indicate to him that he had failed to execute the critical step of shifting the vending machine out of the price-setting mode or the price verification mode. Consequently, the automatic escape which the present invention provides—either from the price-setting mode or from the price verification mode is an aid to the route man and to his employer in avoiding the total loss of vending business which would occur between service calls in the event the mode switch was not shited to the product-vending mode.

Whenever a route man services a vending machine, he must perform a number of operations—including the replacing of the products that have been dispensed, the emptying of the cash box, the emptying and re-filling of the coin tubes, and the restoration of that vending machine to its "standby" condition in the product-vending mode. A route man often is pressed for time as he services a vending machine; and, sometimes he is repeatedly interrupted by customers who insist upon obtaining desired products while the vending machine is being serviced. As a result, route men frequently are under the pressures of time commitments and of distractions as they service vending machines. Consequently, it would be desirable to reduce to an absolute minimum the number of devices which the route man must operate, and it would also be desirable to reduce to an absolute minimum the number of operations which he must perform. Further, it would be desirable to arrange the operations which the route man should perform so the operations which he must perform would automatically enforce the performance of the former operations.

The present invention ideally reduces to an absolute minimum the number of devices which the route man must operate by enabling either of the switches 150 and 152 to perform two functions, namely, effecting the dispensing of coins and placing the control device in the price verification mode. Further, the present invention ideally reduces to an absolute minimum the number of operations which the route man must perform by enabling the same actuation of switch 150 or 152 to (a) effect the dispensing of coins and (b) initiate the placing of the control device in the price verification mode. Moreover, the present invention ideally arranges an operation which the route man should perform, namely, the closing of one of the switches 150 and 152, so it is automatically performed during an operation which the route man must perform, namely, the emptying of the coin tubes. Additionally, the present invention ideally precludes the performance of an operation which should be performed, namely, the verification of prices, until a prior operation which must be performed, namely, the re-opening of switches 150 and 152, has been completed. Moreover, the present invention obviates all of the initial cost of an extra switch, all of the cost of wiring such a switch into the circuit, and all of the problems of servicing and maintaining such a switch.

It was assumed hereinbefore that the route man inserted a quarter to cause the contact device to shift out of the price verification mode and into the product-vending mode, and it subsequently was assumed that he pressed the cancel sale button to effect the return of that quarter to him. Motor 230, selector motor 366, and relay coil 808 of FIG. 9 will be energized to effect the dispensing of that quarter, all as explained hereinafter in the Dispensing of Coins—During Cancel Sale Operation section. When that quarter has been dispensed, the control device and the vending machine will be in their "standby" conditions in the product-vending mode. At such time, the program will continually loop through the routine of FIGS. 10 and 11, connective 576 of FIG. 12, steps 578,580 and 582, and connective 584 until some further action is taken by a customer.

Placing Control Device in Product-Vending Mode—Insertion of Coins

Whenever a one dollar coin is inserted, sensor 149 of FIG. 8 will respond to the presence of that coin to apply a signal, via chip 416, to pin 3 of Port 1 of microprocessor 62. During the next looping of the program through steps 510 and 516 of FIG. 10, the data in the Port 1 status register will be compared with the states of Port 1; and any differences between those states will be stored in the Port 1 change status register. Subsequently, during step 562 of FIG. 11, the data in the Port 1 status change register will be supplied to a dollar coin register —as indicated by lines 0770 through 0786 of the program—to establish a running count of the values of all inserted coins. Each succeeding insertion of a dollar coin will provide an incrementing of the number in the dollar coin register and also will provide an augmenting of the value in the credit register. As a result, the control device will store a running count, in the dollar coin register, of the number of dollar coins which are inserted during any given transaction and also will add to the running count, in the credit register, the values represented by those dollar coins.

Importantly, the YES from step 562 of FIG. 11 will cause the program to branch, via CRDTP connectives 664 and 666 respectively, of FIGS. 11 and 17 to the routine of FIG. 17. AS pointed out hereinbefore, in the section entitled Placing Control Device in Product-Vending Mode—Cancel Sale Operation, step 670 re-sets the price verification flag to zero (0)—thereby taking the control device out of the price verification mode and putting it in the product-vending mode. Also, as pointed out hereinbefore, the route man did not have to close, open or otherwise actuate any switch to take the control device out of the price verification mode and to place it in the product vending mode. In fact, the route man did not even have to insert a dollar or any other coin. Instead, he could have walked away from the vending machine as soon as he closed it; because the first subsequent insertion of a coin—whether by the route man or by a customer—would automatically take the control device out of the price verification mode and place it in the product-vending mode.

Whenever a quarter is inserted, sensor 486 of FIG. 8 will respond to the presence of that quarter to apply a signal, via switch chip 416, to pin 2 of Port 1 of microprocessor 62. During the next execution of steps 510 and 516 of FIG. 10, the data in the Port 1 status register will be compared with the states of Port 1; and any differences between those states will be stored in the Port 1 change status register. Subsequently, during step 562 of FIG. 11, the data in the Port 1 status change register will be supplied to a quarter register to establish a running count of the number of inserted quarters and also will be supplied to the credit register to augment the running count of the values of all inserted coins. Each succeeding insertion of a quarter will provide an incrementing of the number in the quarter register and also will provide an augmenting of the value in the credit register. As a result, the control device will store a running count, in the quarter register, of the number of quarters which are inserted during any given transaction and also will add to the running count, in the credit register, the values represented by those quarters.

Again, importantly, the YES from step 562 of FIG. 11 will cause the program to ranch, via CRDTP connectives 664 and 666, respectively, of FIGS. 11 and 17 to the routine of FIG. 17. Step 670 of that routine re-sets the price verification flag to zero (0)—thereby taking the control device out of the price verification mode and putting it in the product-vending mode.

Similarly, whenever a dime is inserted, sensor 520 will provide a change of state at pin 1 of Port 1, and steps 510, 516 and 562 of FIGS. 10 and 11 will establish a running count of the number of inserted dimes in a dime register and also will augment the running count of the values of all inserted coins which is stored in the credit register. Here again, importantly, the YES from step 562 of FIG. 11 will cause the program to branch, via CRDTP connectives 664 and 666, respectively, of FIGS. 11 and 17 to the routine of FIG. 17. Step 670 of that routine re-sets the price verification flag to zero (0)—thereby taking the control device out of the price verification mode and putting it in the product-vending mode.

Whenever a nickel is inserted, steps 510, 516 and 562 of FIGS. 10 and 11 will establish a running count of the number of inserted nickels in a nickel register and also will augment the running count of the values of all inserted coins which is stored in the credit register. Again, importantly, the YES from step 562 of FIG. 11 will cause the program to branch, via CRDTP connectives 664 and 666, respectively, of FIGS. 11 and 17 to the routine of FIG. 17. Step 670 of that routine re-sets the price verification flag to zero (0)—thereby taking the control device out of the price verification mode and putting it in the product-vending mode.

Operation of Selection Switches

The selection switch 240 of FIG. 4 can be closed to connect L2 to the upper terminal of solid state relay 290 via vending device 246 and the primary winding 250 of current transformer 248. Similarly the selection switch 244 can be closed to connect L2 to the upper terminal of that relay via vending device 392 and the primary winding 396 of current transformer 394. Further, any of the selection switches represented by the numeral 242 can be closed to connect L2 to the upper terminal of relay 290 via a vending device and a primary winding which are similar to vending device 246 and primary winding 250.

The vending machine, with which the control device of the present invention will be used, will usually be operated by 115 A.C. power. In contrast, the microprocessor 62 and most of the other components of that control device will be operated by twelve (12) volts or less D.C. The current transformers 248 and 394 and the other eleven (11) current transformers, not shown, permit signals for the control device to be transferred from the vending machine, and, importantly also permit the control device to be operated by low voltage D.C. whereas the vending machine is operated by higher voltage A.C. The resulting electrical isolation is important, because the contacts on solid state devices frequently are too close to each other and to other components to be used in places where 115 volt A.C. is used.

Product Selection

Resistors 272 and 274 of FIG. 5 and plus five (+5) volts apply a positive reference voltage to the inverting input of comparator 266; and that voltage will tend to make that comparator develop a logic "0" at its output. The voltage divider, which is constituted by resistors 264, 302, 304 and 265, responds to each positive-going half-cycle of the A.C. from the secondary winding of transformer 254 to apply a positive control voltage to the non-inverting input of comparator 266. That control voltage is sinusoidal; and it will repeatedly rise above, and then fall below, a value which is equal to the value of the reference voltage at the inverting input of that comparator. When the value of the control voltage rises above the value of the reference voltage, the comparator 266 will "toggle" to provide a logic "1" at the output thereof; and that logic "1" will remain at that output as long as that control voltage is higher than that reference voltage. However, when that control voltage falls below the level of that reference voltage, the output of the comparator will toggle back to logic "0".

The transistor 300 is connected in parallel with resistor 304; and, because it normally is non-conductive, it normally constitutes a high resistance in parallel with that resistor. However, that transistor can be rendered conductive to "short out" that resistor. The positive voltage, which is developed during each positive-going half cycle, will increase progressively during the first ninety degrees (90°) of that half cycle, and then will decrease progressively during the rest of that half cycle. Also, that voltage will be distributed across the resistors 264, 302, 304 and 265 in proportion to the resistances thereof. When resistor 304 is not "shorted out", a higher percentage of the voltage of each positive-going half cycle will be developed across series-connected resistors 302 and 304—and hence between ground and the non-inverting input of comparator 266—then will be developed across resistor 302 when resistor 304 is "shorted out". Moreover, and significantly, if a voltage level is set—which can and must be attained at an earlier point in the half cycle when transistor 300 is non-conductive than will be the case when that transistor is rendered conductive. Also, that voltage level will be maintained for a longer time during each half cycle when transistor 300 is non-conductive than will be the case when that transistor is rendered conductive.

Pin 3 of Port 5 of microprocessor 62 in FIG. 6 normally applies a logic "1" to the input of inverter 296, and also to the D and S inputs of flip-flop 318 in FIG. 5, via conductor 106. That flip-flop will, as soon as it received a "1" at the C input thereof, respond to the logic "1" on conductor 106 to develop a logic "1" at its Q output. Moreover, until pin 3 of Port 5 applies a logic "0" to conductor 106, that flip-flip will continue to have a "1" at that Q output, and will apply that logic "1" to the left-hand input of NAND gate 286, via conductor 282. That gate will provide a logic "0" at its output whenever logic "1" is applied to both of its inputs, but will provide a logic "1" at that output whenever either or both of its inputs is "0". The $\overline{Q}$ output of monostable multivibrator 276 of FIG. 5 normally applies a logic "1" to the right-hand input of that NAND gate; and hence that NAND gate normally applies a logic "0" to driver 288 to render that driver non-conductive. As a result, that driver normally will not supply a triggering signal to solid state relay 290.

The logic "1" on conductor 106 will cause inverter 296 to develop a logic "0" at its output. Resistor 298 will apply that logic "0" to the base of transistor 300; and hence that transistor normally will be non-conductive.

During each half-cycle of the A.C. from the secondary winding of transformer 254, a positive voltage will develop between the non-inverting input of comparator 266 and ground. The rate at which that voltage will be able to rise to a voltage equal to the reference voltage of the inverting input of that comparator will be a function of the ratio between the combined resistances of resistors 302 and 304 and the total resistance of voltage divider 264, 302, 304 and 265. Whenever resistor 304 is not "shorted out" it will make the ratio higher, and hence will enable the voltage between ground and the non-inverting input of comparator 266 to rise to the pre-set level shortly after the beginning of each half-cycle and to remain above that level until very close to the trailing edge of that half-cycle. On the other hand, when resistor 304 is "shorted out"—as when transistor 300 becomes conductive—it will take longer to attain that level. The overall result is that when transistor 300 is non-conductive, the positive voltage reaches a pre-set level within a few degrees after the beginning of each half-cycle and that positive voltage will remain above that level until close to the trailing edge of that half-cycle. In contrast, when transistor 300 is conductive and is "shorting out" resistor 304, the positive voltage will not reach the preset level until a few degrees before the midpoint of the half-cycle, and that voltage will drop below that level shortly after that midpoint.

Each time the control voltage at the non-inverting input of comparator 266 becomes higher than the reference voltage at the inverting input of that comparator, the output of that comparator will provide a logic "1". However, because the B input of multivibrator 276 responds to negative-going edges, that multivibrator will not change its output during the first ninety degrees (90°) of positive-going half-cycle. The control voltage at that non-inverting input will remain higher than the reference voltage until just a few degrees before the end of the positive-going half-cycle. As the control voltage falls below the reference voltage, the output of comparator 266 will "toggle" back to "0"; and the B input of multivibrator 276 will respond to that negative-going edge to apply a "0" to the right-hand input of NAND gate 286. Thereupon, the output of that NAND gate will become a logic "1", and will cause driver 288 to apply a triggering pulse to relay 290. The comparator 266, the multivibrator 276, the NAND gate 286 and the driver 288 will apply triggering pulses to the solid state relay 290 sixty (60) times every second, and hence the closing of any of the selection switches will provide essentially-immediate firing of that relay.

If it is assumed that selection switch 240 is closed, by a route man or a customer, the next positive-going, half-cycle of the A.C. will develop a positive voltage across resistors 302 and 304—and hence the non-inverting input of comparator 266—which will quickly build up to a level which exceeds the voltage at the inverting input of that comparator; and thereupon that comparator will toggle to provide a logic "1" output. During the latter portion of that half-cycle, that positive voltage will fall below the voltage at the inverting input of comparator 266; and, thereupon, the output of that comparator will change back to logic "0". Multivibrator 276 will respond to the change from "1" to "0" at its input B to apply a short-duration logic "0" to the right-hand input of NAND gate 286 via conductor 284; and the resulting logic "1" at the output of that NAND gate will enable driver 288 to render solid state relay 290 conductive. Thereupon, current will flow from L2 via switch 240, vending device 246, primary winding 250, and relay 290 to L1.

The toggling of the output of comparator 266 back to logic "0" will occur prior to the end of the positive-going half-cycle, and the logic "0" from multivibrator 276 is of such short duration that it will disappear before the end of that half-cycle. As a result, the negative-going zero crossing of the current flowing through relay 290 will promptly render that relay non-conductive; and hence, at the instant the selection switch 240 is closed, only a very narrow, short-duration current pulse will be applied to the vending device 246. That pulse will be unable to actuate that vending device; and hance that vending device will not respond to that pulse. Similarly, when selection switch 244, or any of the other selection switches represented by the switch 242, is initially closed, only a very narrow, short-duration current pulse will be applied to the corresponding vend-device. Again, the relay 290 will be rendered conductive for such a short length of time that the vending device, whose selective switch was closed, can not be actuated.

Although the narrow, short-duration current pulses—which are provided by relay 290 when transistor 300 is non-conductive—are too short to actuate vending device 246 or 392 or any of the other eleven vending devices, not shown, those pulses are long enough to cause the secondary winding 252 or secondary winding 398 or any of the other eleven secondary windings, not shown, to provide a usable output pulse. In the assumed situation where selection switch 20 was closed, resistors 334 and 336 will apply that output pulse to the non-inverting and inverting inputs of comparator 340. Those resistors, resistors 332 and 338, the plus five (+5) volts, and the plus twelve (+12) volts provide a bias for comparator 340 which enables that comparator to ignore each pulse from secondary winding 252, unless that pulse is developed by the flow of more than one hundred and twenty milliamperes (120 MA) through primary winding 250. This is very desirable; because it will keep any leakage currents in the primary circuit of transformer 248 from developing a pulse in the secondary circuit of that transformer which could toggle comparator 340. Leakage currents can sometimes develop across the "open" selection switches of vending machines where those vending machines are used in damp or moist locations, or in locations where the air has unduly-high amounts of metallic or graphitic dust therein. Some control devices, which have used prior selection switch circuits rather the sub-circuit of FIG. 5, have experienced problems because of leakage in the selection circuits.

Each output pulse, which will be developed by the secondary winding 252 in response to a flow of one hundred and twenty or more (120+) milliamperes through the primary winding 250, will provide a voltage differential between the inverting and non-inverting inputs of comparator 340 that will "toggle" that comparator. Thereupon, a changed-state output will be applied to the D2 input of encoder 346 and also, via resistor 344 and conductor 330, to the non-inverting input of comparator 326 of FIG. 5. The inverting input of comparator 326 responds to comparator 320 and to plus five (+5) volts to keep a "low" logic state on conductor 328—and hence at the R input of the tri-state register 374 which is used as a latch—as long as the non-inverting input of comparator 326 receives a signal from only one of resistors 344, 412 and the other eleven resistors represented by the numeral 414. As a result, that R input will not normally receive an output from comparator 326 via conductor 328.

Because the selection switches 240, 244 and the eleven other selection switches which are represented by numeral 242 are connected in series relation, and because the closing of any of those switches will disconnect L2 from all selection switches which are disposed to the right of that closed switch, the closing of two selection switches in rapid succession should not provide a simultaneous "toggling" of the outputs of the comparators corresponding to those selection switches. However, in the event the comparator which corresponds to the first-closed selection switch is slower-than-usual in "toggling" back to its normal state, and in the event the comparator which corresponds to the second-closed selection switch is faster-than-usual in "toggling" to its actuated state, the outputs of both comparators could be in their actuated states at the same instant. Without comparator 326 and resistors 344, 412 and 414, the outputs of those simultaneously-actuated comparators might effect the dispensing of the second-selected product, and might even effect the dispensing of both the first-selected and second-selected products. However, by providing that comparator and those resistors, and by keeping that comparator from "toggling " its output until it receives current through at least two of the resistors 344, 412 and 414, the present invention keeps the closing of two selection switches from effecting the dispensing of the second-selected product—much less the dispensing of products corresponding to both selection switches.

Specifically, in the event two comparators were tricked into being in their actuated states at the same time, the resistors 344, 412 and 414, which correspond to those comparators, will supply sufficient current to the non-inverting input of comparator 326 to "toggle" that comparator. The resulting signal on conductor 328 would constitute a re-set signal at the R input of tri-state register 374; and, thereupon, that tri-state register would be rendered incapable of developing any usable data at its Q0 through Q3 outputs. Consequently, no product would be dispensed.

If it is assumed that a customer closed selection switch 240 and made no effect to close another selection switch, only the comparator 340 would be "toggled", and comparator 326 would not apply a re-set signal to the R input of tri-state register 374. The application of the "toggled" output of comparator 340 to input D2 of encoder 346 would cause that encoder to apply a three-bit code to inputs D1 through D3 of tristate register 374 via the lower inputs of OR gases 350, 352 and 354. Because comparator 408 is not supplying a signal to encoder 348, the GS output of that encoder will be supplying a "0" to input D4 of the tri-state register. This means that tri-state register 374 will have a four-bit code applied to its D1 though D4 inputs.

If selection switch 244, rather than selection switch 240, had been actuated, comparator 408 would have applied a signal to the D6 input of encoder 348, and comparator 340 would not have applied a signal to encoder 346. The QO through Q2 outputs of encoder 348 would have supplied a three-bit code to the D1 through D3 inputs of tri-state 374 via the upper inputs of OR gates 350, 352 and 354. Also, the GS output of that encoder will have applied a logic "1" to the D4 input of that tri-state register, and hence would have enabled that encoder to supply a four-bit code to inputs D1 through D4 of that register.

The four-bit Code at the D1 through D4 inputs of tri-state register 374 will not appear at the outputs QO through Q3 of that register until a clock signal is applied to the C input of that register. Consequently, until that clock signal is developed, conductors 76, 78, 80 And 82 will be unable to apply signals to the 0 through 3 pins of Port 4 of microprocessor 62. Whenever an input signal is applied to any of the D1 through D6 inputs of encoder 348 of FIG. 4, the Eout of that encoder will apply a signal to the Ein of encoder 346; and, when the latter encoder receives such a signal, it provides an Eout in the form of a logic "0". However, diode 375 will prevent that logic "0" from appearing at the upper input of OR gate 380, but after a short delay the capacitor 378 will discharge through the resistor 376 to supply a logic "0" at that input of OR gate 380. As long as the upper input of OR gate 380 is at logic "1", a logic "1" will continue to appear at its output and thus at the C input of tri-state register 374. That logic "1" will not be effective to clock the data into the tri-state register 374, because the C input of that register responds only to a positive going signal. The flip-flop 258 of FIG. 5 continuously receives a forty-eight kilohertz (48 KHz) signal at its C input—from either or both of the switch chips 416 and 418 of FIG. 8, via junction 426, conductor 262, and resistor 260 in FIG. 5. That flip-flop will serve as a divide-by-two counter; and hence it will develop a logic "1" at its Q output at a twenty-four kilohertz (24 KHz) rate, and that signal is applied to the lower input of OR gate 380. As a result, whenever an Eout logic "0" is developed by encoder 346, the capacitor 378 discharges a logic "0" will appear at the upper input of OR gate 380. At that time the OR gate will respond to the signal at its lower input to develop a twenty-four kilohertz (24 KHz) signal at its output. Thereupon, the four-bit code which was being applied to the D1 through D4 inputs of that tri-state register will be applied to pins 0 through 3 of Port 4 of microprocessor 62 on the next positive-going transition of that clock. The tri-state register 374 of FIG. 6 will act as a latch; and hence it will—until it is subsequently re:set—continue to apply to pins 0 through 3 of Port 4 of microprocessor 62 the four-bit code whih had been applied to its D1 through D4 inputs. That register could be re-set by the "toggling" of comparator 326 of FIG. 4 which would apply a signal to the R input of that register. However, the register 374 will be re-set at the end of each vending transaction by having conductor 384 apply a signal to the A output disable pin thereof. That signal is developed by the decoder 134 of FIG. 1 during step 550 of FIG. 11 after a vending operation has been initiated or during step 566 of FIG. 11 after a coin returning operation has been initiated.

Vending

The application of the four-bit code to pins 0 through 3 of Port 4 of microprocessor 62 will be sensed, and responded to, by steps 510 and 516 of FIG. 10. During the latter step, a sub-routine of the microprocessor will respond to the four-bit code at pins 0 through 3 of Port 4 to cause the microprocessor to address the location in the EAROM where the price corresponding to the selected product is stored. Thereafter, that price will be loaded into the price register; and then the arithmetic unit of the microprocessor will compare the data in the credit register with the data in the price register. If the value of the data in the credit register at least equals the value of the data in the price register, the microprocessor will change the logic "1" at pin 3 of Port 5 to a logic "0". Conductor 106 will apply that "0" to the D and S inputs of flip-flop 318 of FIG. 4, and also to the input of inverter 296. That flip-flop will not be able to respond to that "0" until a clock signal is applied to the C input thereof by comparator 266.

Figure 22:
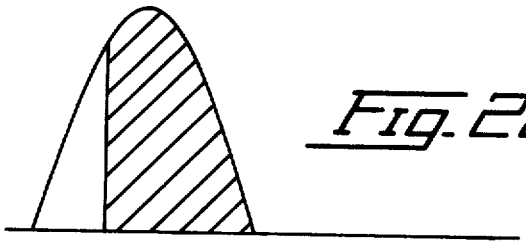
FIG. 22 shows a current pulse which is developed after a selection switch has been closed and which is used to initiate a vending operation.

The inverter 296 will respond to the "0" on conductor 106 to apply a "1" to the base of transistor 300, thereby rendering that transistor conductive. The resulting "shorting out" of resistor 304 will cause comparator 266 to "toggle" close to the midpoint of the next positive-going half-cycle. More specifically, the "shorting out" of resistor 304 will require the voltage across resistor 302—and hence the voltage between the non-inverting input of comparator 266 and ground—to be greater than the voltage which was developed across resistor 302 when transistor 300 was non-conductive and constituted a high impedance in parallel with resistor 304. Consequently, the voltage at the non-inverting input of comparator 266 will not reach the level of the reference voltage at the inverting input of that comparator—and hence the comparator will not toggle—until shortly before the midpoint of that next positive-going half-cycle of the A.C. from the secondary winding of transformer 254. However, as soon as the output of that comparator becomes a logic "1", flip-flop 318 will respond to the resulting "1" at its C input to develop a "0" at its Q output; and then NAND gate 286 will supply a "1" to driver 288. The resulting triggering of relay 290 will occur close to the midpoint of the half-cycle of the A.C., and it will supply a wide current pulse to vending device 392, as indicated by the hatched portion of FIG. 22. That vending device will respond to that pulse to become actuated and thereby initiate a vending cycle for the vending machine.

The logic "0" at the Q output of flip-flop 318 also will be applied to the EXT. INT. input of microprocessor 62 in FIG. 6 by conductor 104; and, via conductor 104, capacitor 386 and inverter 390, will be inverted and applied to the D7 input of encoder 348. The logic "0" on conductor 104 will indicate that a vend operation has been initiated, and the microprocessor will respond to the application of that "0" to the EXT. INT. input thereof to start a timing function. The control device will provide a "fixed vend" if switch 58 of FIG. 1 is left open; and it will provide a "short vend" if that switch is closed. The duration of the timing function will be set in accordance with the "open" or "closed" state of switch 58—providing a twelve millisecond (12 ms) time period when that switch is "open" and providing a potentially longer time period when that switch is "closed".

The logic "1" which inverter 390 of FIG. 4 applies to input D7 of encoder 348 will cause that encoder to develop a four-bit code at its Q1 through Q2 and GS outputs, and also will cause it to provide an Eout signal which will be applied to the Ein of encoder 346. OR gates 350, 352, and 354 will apply, to the D1 through D3 inputs of register 374, the portion of the four-bit code which appears at the Q0 through Q2 outputs of encoder 348; and the GS output of that encoder will apply the fourth bit of that code to the D4 output of that register. The encoder 346 will respond to the signal at its Ein to re-set each of the Q0 through Q2 outputs thereof to zero (O), and also to provide a logic "0" at its Eout. As described hereinbefore diode 375, resistor 376 and capacitor 378 will cause, after a short delay, a logic "0" to appear at the upper input of the OR gate 380. The resulting clock at the output of that OR gate will be applied to the C input of register 374 to clock the four-bit code at its D1 through D4 inputs to its Q0 through Q3 outputs—and thence to pins 0 through 3 of Port 4 of microprocessor 62. During steps 510 and 516 of the next execution of the routine of FIGS. 10 and 11, the new states of those pins will be sensed; and then, the microprocessor 62 will determine that the four-bit code does not match any four-bit code which should be received from register 374. Thereupon, the microprocessor will disregard, and not respond to, that four-bit code—just as it would disregard and not respond to any other "invalid" code at pins 0 through 3 of Port 4. Also, the timing function which was initiated by the "0" at the EXT. INT. input will be permitted to control the duration of the logic level on conductor 106.

Transistor 300, comparator 266, multivibrator 276, flip-flop 318, and the associated resistors permit only a narrow, one millisecond (1 ms), current pulse to be supplied to each vending device and its associated transformer primary winding at the instant the corresponding selection switch is closed. Subsequently, transistor 300, comparator 266, flip-flop 318, and the associated resistors permit a wider, four millisecond (4 ms), current pulse to be supplied to that vending device if microprocessor 62 provides a logic "0" on conductor 106. The flow of current during the four millisecond (4 ms) current pulse and the consequent further flow of current through the immediately-succeeding, approximately eight millisecond (8 ms) negative-going half-cycle of the A.C. will heat the solid state relay 290 and also will heat the vending device—246, 392 or one of the eleven (11) vending devices, not shown—to which that current pulse will be applied. The heat which is generated in that relay by the overall twelve millisecond (12 ms) current pulse will be dissipated by the "heat sink" of that relay, and hence that relay can safely be used to supply such pulses to those vending devices. Also, the heat which is generated in each of those vending devices by such pulses will be safely dissipated, and hence those vending devices can safely receive, and respond to, such pulses—even though the resulting current flow through the relay 290 and through some of those vending devices can be in the order of several amperes.

Where the control device is used with a vending machine which responds to a "fixed vend" time signal, the triggering pulses for the relay 290 must be long enough to actuate the vending device selected by the closing of the selection switch, and yet must not be so long that the relay 290 or the vending device could be overheated. The sub-circuit of FIG. 5 provides current pulses—for the vending devices 246 and 392 and for the other eleven (11) vending devices, not shown—which are wide enough and of sufficiently-long duration to actuate those vending devices but are short enough to avoid overheating of those vending devices or of relay 290, by not "toggling" the comparator 266 at the beginning of each half-cycle. Where that comparator is not toggled until about the midpoint of the positive-going half-cycle, and where the switch 58 of FIG. 1 is open—to provide a "fixed vend"—the twelve millisecond (12 ms) "fixed vend" timing function will change the "0" at pin 3 of Port 5 back to "1" close to the next positive-going zero crossing of the A.C. The flip-flop 318 will respond to the next "1" at the output of comparator 266 to develop a "1" at its Q output—thereby causing NAND gate 286 and driver 288 to discontinue the triggering signal which that driver had been applying to relay 290. As a result, that relay will be non-conductive during the first part of the next-succeeding positive-going half-cycle of the A.C. This means that where switch 58 is open, the maximum duration of a current pulse for a vending device will be the remainder of the positive-going half-cycle—during which that pulse was initiated—plus the succeeding negative-going half-cycle of the A.C.; and hence will be about twelve milliseconds (12 ms). A current pulse of that width and duration will be able to actuate a vending device without overheating it or the relay 290.

Where a vending machine is designed to receive a "short vend" signal from a control device, the vending device of that vending machine will be designed so the value of the current flowing through that vending device will be low enough to avoid overheating of that vending device. Because that value of current will be less than the value of current required by "fixed vend" time vending machines, that relay and that vending device can operate during the longer vend time without becoming overheated. Specifically, the control device will provide triggering signals for just three-quarters of the first A.C. cycle, subsequent to microprocessor supplying a "0" on conductor 106, and continuously thereafter, when switch 58 is closed; and it will supply those signals only as long as a "0" appears on conductor 106. The "short vend" timing function, which will be indicated when flip-flop 318 supplies a "0" to the EXT. INT. input of FIG. 6, will cause pin 3 of Port 5 to maintain the logic "0" on conductor 106 until the vending machine develops a LINE 6 signal, the opto-coupler 154 of FIG. 1 supplies a resulting signal to pin 6 of Port 4, the next execution of steps 510 and 516 of FIG. 10 enables that signal to be sensed, the next execution of step 546 of FIG. 11 provides further de-bouncing of that signal, and will cause a "1" to re-appear on conductor 106. This logic "1" on conductor 106, is applied to the S input of flip-flop 318 and that flip-flop will immediately re-establish logic "1" at its Q output; and NAND gate 286 and driver 288 will discontinue the triggering signal which that driver has been applying to relay 290. Until the "short term" vend signal is discontinued, the vending device will receive and respond to current during each negative-going, as well as during each positive-going, half-cycle of the A.C.; because the relay 290 is able to pass current in both directions.

At the time pin 3 of Port 5 of microprocessor 62 applied a "0" to conductor 106, that microprocessor set a flag in the R1FLG register to indicate that a vending operation had been initiated. Also, it addressed the register in EAROM 142 which stores data representing the number of products—selected by selection switch 240 and vended by vending device 246—which have been vended, and then incremented that data. Further, the microprocessor addressed the register in EAROM 142 which stores data representing the total of all sales of products by the vending machine and then incremented that data by the price of the vended product.

These various actions during step 550 require finite amounts of time; and hence the program will excecute the rest of the steps of FIG. 11, jump to the routine of FIG. 12, via connectives 574 and 576, exit at step 582 via connective 584, and then loop through the routines of FIGS. 10–12. During the last portion of step 550, the program will respond to the flag in the R1FLG register to execute the step 552.

Totalizer

A device, not shown, which is referred to as a data acquisition unit and which is not, per se, a part of the present invention, is mounted within the vending machine and is connected to pins 4 and 7 of Port 5 by conductors 92 and 94 of FIG. 1. That device also is connected to resistor 162 by conductor 163, to the output of opto-coupler 154 by conductor 161, and to plus twelve (+12) volts by conductor 31, all as shown by FIG. 1. A plug and socket 33 are used to connect those conductors to correspondingly-numbered conductors which extend to that device, which is shown and described in Hasmukh R. Shah et al application for Data Acquisition Unit that is filed of even date and that bears U.S. Pat. No. 4,350,238 issued Sept. 21, 1982.

That device receives a serial bit stream on conductor 92 whenever a vending operation is initiated by the application of a logic "0" to conductor 106 of FIG. 6, and thereafter receives a serial bit stream on conductor 94 if that vending operation was not a "free" vending operation. That device will respond to those serial bit streams to record the data represented by the bits of those serial bits streams, to accumulate two sets of totals representing (a) the number of vends initiated by the closing of each selection switch, (b) the total cash represented by those vending operations, and (c) the total cash represented by all of the vending operations initiated by all of those selection switches. Those totals can be printed on a printout at any time by a printer therein. One set of totals is non-resettable, and hence provides an unalterable, running count which can be used for statistical purposes over a long period of time. The other set of totals is re-settable and represents the vending operations and total cash corresponding to vending operations which occurred subsequent to the last printing of totals.

The data acquisition unit has relay contacts therein which normally complete a circuit from opto-coupler 154 to resistor 162 of FIG. 1. However, during the time the printer of the data acquisition unit is printing a printout, those relay contacts will be permitted to open and thereby keep the coin changer of the present invention from accepting further coins. The opening of those contacts provides the same action that is provided when a Line 6 signal is applie to conductor 158.

The reading of the various data in the EAROM and the updating of the corresponding data in the data acquisition unit require finite amounts of time; and hence the program will jump via connective 554—which is entitled CRET0P and which corresponds to line 2665 of the program—and connective 685, respectively, of FIGS. 11 and 18 to the routine of FIG. 18. After executing steps 686 and 688 in the manner described hereinbefore, the program will jump, via connectives 690 and 692, respectively, of FIGS. 18 and 19 to the routine of FIG. 19. During the execution of that routine, the change, if any, that was required as a result of the vending function of step 550 will be dispensed. Thereafter, the program will jump, via connectives 734 and label 508, respectively, of FIGS. 20 and 10, to the routine of FIGS. 10 and 11. During the next execution of step 550, a NO will be produced, because that step has been completed; and hence the program will execute the rest of the steps of FIG. 11, jump to the routine of FIG. 12 via connectives 574 and 576, and then execute step 578 of FIG. 12. A determination will be made, during that step, of whether data is still being read from the EAROM and is still being used to update the data in the data acquisition unit. If that step produces a YES, the program will jump, via connective 582—which is entitled DEBNCE and which corresponds to line 3118 of the program—and label 508 of FIG. 10 to execute the routines of FIGS. 10 and 12, jump to connective 576 of FIG. 12, and again execute step 578. The program will loop in this manner until the comparing function of step 578 provides a NO, and then it will execute steps 580 and 582 to exit at connective 584 and loop through the routines of FIGS. 10–12. At this time, the control device and the vending machine will be in the "standby" condition in the product-vending mode.

Dispensing of Coins—During Cancel Sale Operations

Nickels, dimes and quarters can be dispensed from the nickel, dime and quarter tubes, and dollars can be dispensed from the passageway therefor, in response to the pressing of the cancel sale button or in response to a vending transaction wherein the value of inserted coinage exceeds the price of the selected product. If it is assumed that the cancel sale button is pressed, sensor 803 of FIG. 8 will change the state at pin 7 of Port 4; and, during the next executions of steps 510 and 516 of FIG. 10, the difference between the state and states in the Port 4 status register will be stored in the Port 4 change register. During the next execution of step 566 of FIG. 11, a YES will be provided; and then step 678 will change the state of the Q register to the state representing "standby", step 680 will reset the price verification flag in the RFLG register, the CRETP connectives 682 and 684, respectively, of FIGS. 11 and 18 will cause step 686 of FIG. 18 to change the state of the Q register to the state representing "pay", and step 688 will clear the 7-segment displays 232, 234 and 236 of FIG. 3 by causing them to exhibit "0.00". Thereafter, connective 690 of FIG. 18 and connective 692 of FIG. 19, which is entitled PAY and which corresponds to line number 2672 of the program, will initiate step 694 which is entitled PAY OUT DOLLARS IF REQUIRED and which corresponds to lines 2697 through 2702 of the program.

The microprocessor 62 will, in response to the data in the Port 4 status register, cause data corresponding to zero (0) to be loaded into the price register, and then will cause the arithmetic unit thereof to subtract the value of the data in the price register from the value of the data in the credit register, and to store data representing the difference in the credit register. The program will then cause that arithmetic unit to check the data in the dollar coin register. As described hereinbefore, that coin register stores the running count of all inserted dollar coins during one transaction. If the data stored in that register represents zero, then no dollar coin is payed. But if that data stored in that register represents a non-zero number, the arithmetic unit will then load data, representing the value of one dollar ($1) value of the data in the change register, the selector motor 366 of FIG. 9 will be actuated in the dollar-returning direction, but the motor 230 will be left de-energized, all as described in said Johnson application. Also, the value of the data in the change register will be subtracted from the value in the credit register, and the difference will be stored in the credit register. Also the number stored in the dollar coin register will be decremented by one. Thereupon, a dollar will be released from the passageway in which it was being held, and will be directed to the coin cup at the exterior of the vending machine. The arithmetic unit will again check the data in the dollar coin register and if that data represents a non-zero number, it will load data, representing the value of one dollar ($1), into the change register and will compare that data with the new data in the credit register—which represents the difference obtained by subtracted the dollar-value data from the original data in the credit register. If the value of the data in the credit register at least equals the one dollar ($1) value of the data in the change register, the selector motor 366 will again be actuated in the dollar-returning direction, and the motor 230 will again be left-de-energized. Thereupon, a further dollar will be released from the passageway in which it was being held, and will be directed to the coin cup at the exterior of the vending machine. Again, the value of the data in the change register will be subtracted from the value in the credit register, and the difference will be stored in the credit register. Also the number stored in the dollar coin register will be decremented by one. The process of checking the dollar coin register, the loading of the change register with data representing the value of one dollar ($1), the comparing of the value of that data with the value of the data in the credit register, and the dispensing of dollars, will be repeated until the arithmetic unit determines that the number stored in the dollar coin register is zero, or the value of the residual data in the credit register does not at least equal the value of the data in the change register. Thereafter, in the concluding operation of step 694, the selector motor 366 would be actuated in the opposite direction to cause any dollar which might still be in the dollar passageway—because a dollar which was dispensed during the execution of step 694 had been inserted during a vending transaction but had not fallen from the dollar passageway to the cash box—to pass to the cash box of the vending machine.

In the assumed situation where a route man inserted a quarter and then pressed the cancel sale button, the first process of checking the dollar coin register will show that the number in that register is zero, and hence the selector motor 366 will not be actuated. Thereupon any dollar which might still be in the dollar passageway—because a dollar which was dispensed during the execution of step 694 had been inserted during a vending transaction but had not fallen from the dollar passageway to the cash box—would be permitted to pass to the cash box of the vending machine.

In the step 695, which is entitled RESET TUBE EMPTY REGISTERS, the program will cause the 25¢ tube empty register and 10¢ tube empty register to be reset to zero. The program will then pass, via label 696, which is entitled PAY CHG. to step 697 which is entitled UPDATE TUBE EMPTY REGISTERS. During this step the bit in the word in the tube level status register which corresponds to the quarter coin tube will be sensed to determine whether that tube is "full". Since a route man customarily "fills" all of the coin tubes before he closes the vending machine, that bit represents that quarter tube is "full" and cause the 25¢ tube empty register to be set to represent a count of four. In the same step 697 the bit in the word in the tube level status register which corresponds to the dime coin tube will be sensed to determine whether that tube is "full". Since a route man customarily "fills" all of the coin tubes he closes the vending machine, that bit will represent that dime tube is "full" and cause the 10¢ tube empty register to be set to represent a count of eight.

The program will then pass to step 698 which is entitled IS REMAINING CHG.<25¢ and which corresponds to lines 2735 through 2756 of the program. During that step, data having a value of twenty-five cents (25¢) will be loaded into the change register and then will be compared with the value in the credit register.

In the assumed situation where a route man inserted a quarter and then pressed the cancel sale button, that comparing operation will cause step 698 to provide a NO, because the values of the data in the change register and credit register will be equal. During step 700—which is entitled IS 25¢ TUBE EMPTY REG.=0? and which corresponds to lines 2762 through 2765 of the program—the comparing function of step 700 will provide a NO, because this register was set to represent a count of four in the step 697. During step 702—which is entitled IS THE 5¢ TUBE FULL? and which corresponds to lines 2775 through 2777 of the program—the bit in the word in the tube level status register which corresponds to the nickel coin tube will be sensed to determine whether that tube is "full". Since a route man customarily "fills" all of the coin tubes before he closes the vending machine, the comparing function of step 702 will provdie a YES, thereby branching the program to step 706. That step is entitled PAY OUT A QUARTER and it corresponds to line 2792 of the program; and, during that step, the motor 230, the relay coil 808 and the selector motor 366 of FIG. 9 will be energized to effect the dispensing of a quarter from the quarter tube—all as described in said Johnson application. Also, during step 706, the value in the credit register was reduced by twenty-five cents (25¢) to reflect the paying out of the quarter. The program will then start the step 707 which is entitled DECR. THE 25¢ TUBE EMPTY REG. In this step the count in the twenty-five cent tube empty register is decremented by one. At the conclusion of step 707, connective 708, which is entitled PAY CHG. and which corresponds to line 2810 of the program, will cause the program to jump to label 696 of FIG. 19. In the ensuing execution of step 697 the bit in the word in the tube level input status register which corresponds to the quarter coin will be sensed to determine whether that tube is still "full" and if that tube is "full", the twenty-five cent tube empty register will again be set to a count of four. In the execution of the next step 698, data having a value of twenty-five cents (25¢) will again be loaded into the change register, and it will be compared with the value in the credit register. In the assumed situation where a route man inserted a quarter and then pressed the cancel sale button, the value of the residual data in the credit register will be zero (0), and hence that comparing operation will cause step 698 to provide a YES. During the next-succeeding step 724—which is entitled IS REMAINING CHG. < 10¢? and which corresponds to lines 2766 through 2772 of the program—data having a value of ten cents (10¢) will be loaded into the change register and then will be compared with the value in the credit register. In the assumed situation where a route man inserted a quarter and then pressed the cancel sale button, the value of the residual data in the credit register will be zero (0) and hence the comparing function of step 724 will provide a YES. Thereupon, during step 730 of FIG. 20—which is entitled IS REMAINING CHANGE = TO 0? and which corresponds to lines 2772 and 2818 through 2823 of the program—data having the value of five cents (5¢) will be loaded into the change register and then will be compared with the value in the credit register. In the assumed situation where a route man inserted a quarter and then pressed the cancel sale button, the value of the residual data in the credit register will be zero (0), and hence the comparing function of step 730 will provide a YES. Step 732, which is entitled SET MACH. STATE BACK TO STANDBY (STBY) and which corresponds to lines 2976 and 2984 of the program, will change the state of the Q register to "standby". Connective 734—which is entitled DEBNCE and which corresponds to line 3020 of the program which jumps to lines 0799 through 0868 of the program—and label 508 of FIG. 10 will cause the program to loop at steps 510 and 512 until the timer in the latter step times out. Thereafter, the program will loop through the routine of FIGS. 10 and 11, jump to the routine of FIG. 12, and exit from the latter routine via step 582 and connective 584. The program will continue to loop through those routines until a customer inserts money. At this time, the control device and the vending machine are again in the "standby" condition of the product-vending mode.

Figure 19:
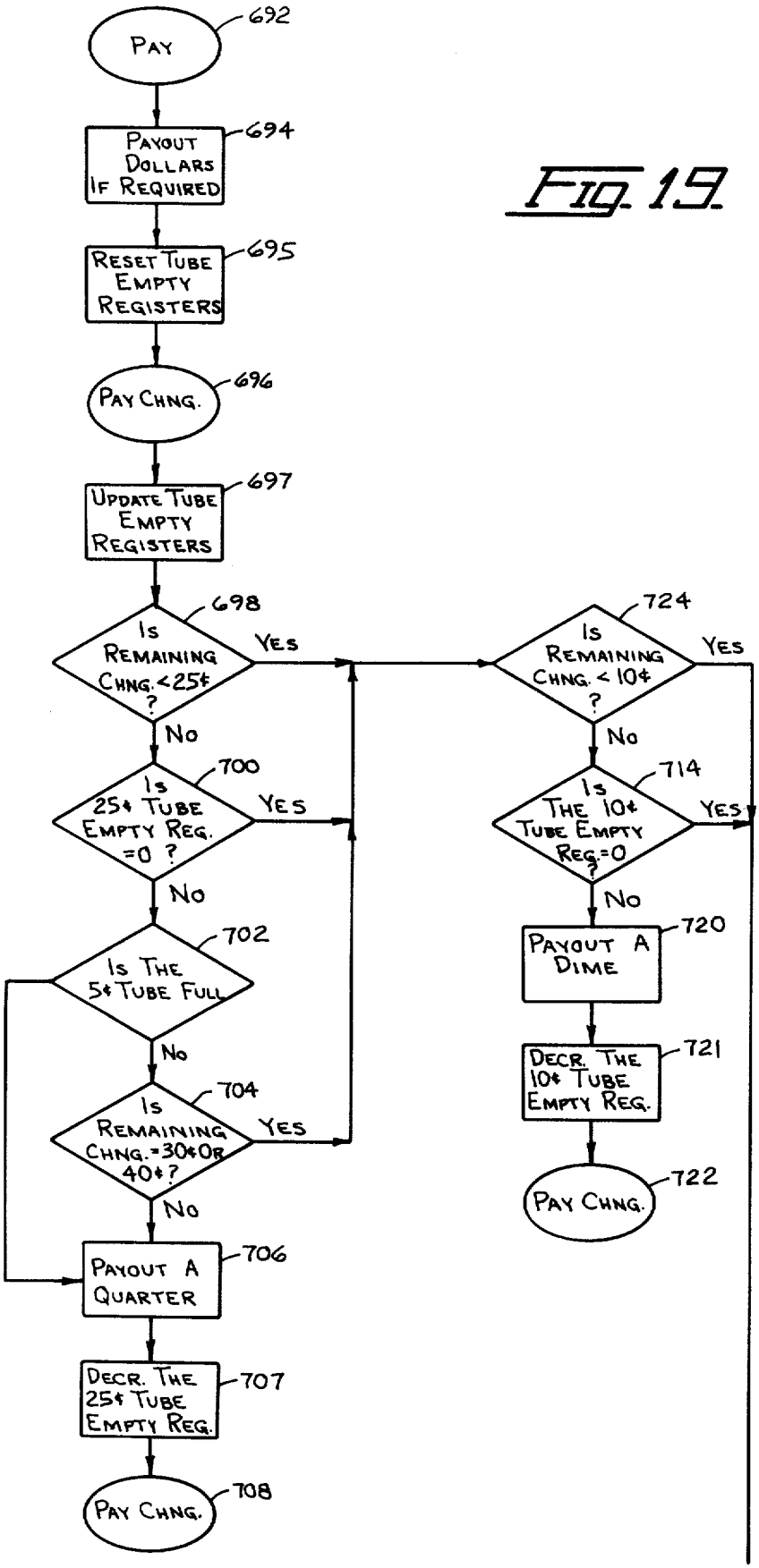

If the cancel sale button is pressed at a time when the value in the credit register constitutes an integral multiple of twenty five cents (25¢), the program will respond to the YES from step 566 of FIG. 11 to execute steps 678 and 680, jump via CRETP connectives 682 and 684, respectively, of FIGS. 11 and 18, execute steps 686 and 688, jump via connectives 690 and 692, respectively of FIGS. 18 and 19, and execute steps 694, 695, 697 and then step 698 to provide a NO. Thereafter, the program will execute steps 700, 702, 706 and 707 in the manner described hereinbefore; and it will effect the dispending of a quarter and the reduction of the value of the data in the credit register by twenty-five cents (25¢). Thereafter the program will branch, via connective 708 and label 696, to step 697 of FIG. 19. Further executions of steps 697, 698, 700, 702, 706 and 707 will effect further dispensings of quarters and further subtractings of twenty-five cent (25¢) values from the value of the data in the credit register—until a comparison shows that the value of the data in the credit register does not at least equal the twenty-five cents (25¢) value in the change register. Thereafter, the YES from step 698, a YES from step 724, and a YES from step 730 of FIG. 20 will enable step 732 to change the state of the Q register to the state representing "standby". The program will then jump, via connective 734 of FIG. 19 and label 508 of FIG. 10 to the routine of FIGS. 10 and 11; and it will loop through that routine and the routine of FIG. 12. At this time, the control device and vending machine will again be in the "standby" condition of the product-vending mode.

In the event the cancel sale button is pressed at a time when the value of the data in the credit register is twenty cents (20¢), the YES from step 566 of FIG. 11 will cause the program to execute steps 678 and 680, jump via CRETP connectives 682 and 684, respectively of FIGS. 11 and 18, execute steps 686 and 688, jump via connectives 690 and 692, respectively, of FIGS. 18 and 19, execute steps 694, 695, 697 and 698, and then respond to the YES from the latter step to execute step 724. During that step, data having a value of ten cents (10¢) will be loaded into the change register; and a comparison will be made to determine whether the value of the data in the credit register at least equals the value of the data in the credit register. The resulting NO, because the value in the credit register will be twenty cents (20¢) and the value in the change register will be ten cents (10¢), will cause the program to execute step 714, wherein the count in the ten cent (10¢) tube empty register will be checked to determine whether there are any coins in the dime tube. If that comparison provides a NO, the program will execute step 270 wherein the motor 230 and the selector motor 366 of FIG. 9 will be energized to effect the dispensing of a dime, all as explained in said Johnson application. In addition, the value of the data in the change register will be subtracted from the value of the data in the credit register, and the ten cent (10¢) difference will be written into the credit register. The program will then start the step 707 which is entitled DECR. THE 10¢ TUBE EMPTY REG. In this step the count in the ten cents (10¢) tube empty register is decremented by one. Thereafter, the program will jump, via connective 722 and label 696, to step 697. In this step the bit in the word in the tube level input status register which corresponds to the dime coin will be sensed to determine whether that tube is still "full", and if that tube is "full", the ten cents tube empty register will again be set to a count of eight. The program will then cause the execution of step 698. The resulting YES from that step will cause step 724 to again load data having a value of ten cents (10¢) into the change register and again compare the value of the data in the credit register with the value of the data in the change register. The resulting NO from step 724 will again cause step 714 to be executed; and, since the ten cents tube empty register is not zero, step 720 will effect the paying out of a second dime, and will again effect the subtraction of the value of the data in the change register from the value of the data in the credit register. The step 721 will cause the count in the ten cent tube empty register to be decremented by one. The program will then jump, via connective 722 and label 696, to step 697 and then 608. The resulting YES will co-act with a YES from step 724—because the dispensing of two dimes reduced the value of the data in the credit register to zero (0)—will cause the program to execute step 730 of FIG. 20. The resulting YES from that step will cause the program to execute step 732 and then jump, via connective 734 of FIG. 20 to label 508 of FIG. 10—with subsequent looping of the program through the routines of FIGS. 10 and 12. Again, the control device and vending machine will be in the "standby" condition of the product-vending mode.

If the cancel sale button is pressed at a time when the value of the data in the credit register equals ten cents (10¢), the program will effect the dispensing of a dime in the manner in which that program effected the dispensing of the first dime in response to the closing of the cancel sale button when the value of the data in the credit register equalled twenty cents (20¢). Also, the value of the data in the change register will be subtracted from the value in the credit register to produce a zero (0)—in the same manner in which the value in the change register was subtracted from the ten cents (10¢) value corresponding to the second dime to produce a zero (0). During the subsequent execution of each of the steps 697, 698, 724 and 730 of FIGS. 19 and 20 a YES will be obtained; and hence step 732 will change the state of the Q register to the state representing "standby". Thereafter, the program will execute the routines of FIGS. 10–12 and again be in its "standby" condition in the product-vending mode.

If the cancel sale button is pressed at a time when the value of the data in the credit register equals fifteen cents (15¢), the YES from step 566 in FIG. 11 will cause the program to execute steps 678 and 680, jump via CRETP connectives 682 and 684, respectively, of FIGS. 11 and 18, execute steps 686 and 688, jump via connectives 690 and 692, respectively, of FIGS. 18 and 19, execute steps 694, 695, 697, 698, 724, 714, 720 and 721 in the manner described hereinbefore in the dispensing of the first dime when the cancel sale button was pressed when the value in the credit register equalled twenty cents (20¢). The execution of those steps will effect the dispensing of a dime and a reducing of the value in the credit register by ten cents (10¢) to five cents (5¢). Thereafter, the program will jump via connective 722 and label 696, to steps 697, 698 and 724. The resulting YES from step 724 will cause the program to execute step 730 of FIG. 20, wherein data having a value of five cents (5¢) will be loaded into the change register, and a comparison will be made between the value of the data in the credit register and the nickel value in the change register. That comparison will cause step 730 to provide a NO; and, thereupon step 726—which is entitled PAY OUT A NICKEL and which corresponds to lines 2792 through 2794 of the program—will cause motor 230 of FIG. 9 to be energized while both selector motor 366 and relay coil 808 are left de-energized. A nickel will then be dispensed in the manner described in said Johnson application. Also, during step 726, the value of the data in the change register will be subtracted from the value of the data in the credit register to make the latter value zero (0). The program will then jump, via connective 728—which is entitled PAY CHG. and which corresponds to line 2810 of the program—to label 696. The succeeding execution of each of steps 697, 698, 724 and 730 will provide a YES; and step 732 will change the machine state back to the state representing "standby". The subsequent jumping of the program via connective 734 of FIG. 20 to label 508 of FIG. 10 will cause the program to loop through the routines of FIGS. 10–12; and, again, the control device and the vending machine will be in their "standby" conditions in the product-vending mode.

In the event the cancel sale button is pressed at a time when the value of the data in the credit register equals five cents (5¢), the program will effect the dispensing of a nickel in the same manner in which the program effected the dispensing of a nickel when the cancel sale button was pressed while the value of the data in the credit register was fifteen cents (15¢). Also, the nickel value of the data in the change register will be subtracted from the nickel value of the data in the credit register to provide zero (0). Thereafter, the program will execute steps 697, 698, 724, 730 and 732 of FIGS. 19 and 20, and then jump to label 508 of FIG. 10 to resume the looping through the routines of FIGS. 10–12. Once again, the control device and the vending machine will be in the "standby" condition in the product-vending mode.

The cancel sale button can be pressed at times when widely-different values will be stored in the credit register; and hence the control device can be required to dispense many different combinations of coins to enable patrons to receive coinage which aggregates the value of the inserted coinage. In each instance, the control device will attempt to dispense the fewest number of coins which can aggregate the value of the inserted coinage.

Coin Dispensing - During Change Making

In the foregoing Operation Of Selection Switches section, it was pointed out that the microprocessor 62 applies a logic "0" to conductor 106 when it determines that the value of the data in the credit register at least equals the value of the data in the price register. Thereafter, a delay of about one-half of a second is provided to permit any coin which might have been inserted by a customer but had not yet been sensed by the corresponding one of sensors 149, 486, 520 and 574 of FIG. 8, to reach that sensor so its value would be added to the value of the data in the credit register. At the end of that delay, the arithmetic unit will subtract the value of the data in the price register from the value of the data in the credit register and then store the data corresponding to the remainder in the credit register. These various actions take place during step 550 of FIG. 11; and, thereafter, step 552—which is entitled UPDATE SALES TOTALIZER and which corresponds to lines 2535 through 2665 of the program—will be executed. During that step a register, which stores the number of vending transactions that effect the dispensing of a product of the type that was just dispensed, will be incremented. Also another register, which stores a running count of the total sales of products of the type that was just dispensed, will be incremented. Moreover, a further register, which stores a running count of the total sales of all products vended by the vending machine, will be incremented. In addition, serial bit streams will be applied to conductors 92 and 94 of FIG. 1 by pins 2 and 3 of Port 0; and those serial bit streams will be supplied to the data acquisition unit—all as described hereinbefore in the Totalizer section.

At the conclusion of step 552, the program will jump, via connective 554—which is entitled CRETOP and which corresponds to line 2665 of the program—and connective 685 of FIG. 18—which is entitled CRETOP and which corresponds to lines 2480 and 2481 of the program—to step 686 of FIG. 18. The execution of steps 686 and 688 will change the states of the Q register to the state representing PAY, and the displays 232, 234 and 236 of FIG. 3 will be caused to exhibit "0.00", all as described hereinbefore. Connectives 690 and 692, respectively, of FIGS. 18 and 19 will cause the program to execute the routine of FIG. 19.

During step 694, it will be determined whether a dollar should be dispensed, all as described hereinbefore. If a dollar should be dispensed, and if the customer had inserted one or more dollars, step 694 would effect the dispensing of that dollar and the subtraction of a dollar value from the value in the credit register, all as described hereinbefore. If, however, a dollar should be dispensed but the customer had not inserted any dollars, step 694 would not attempt to pay out a dollar and also would not attempt to subtract a dollar value from the value in the credit register.

During steps 697, 698, 700, 702, 706 and 707, it will be determined whether any quarters should be dispensed, all as described hereinbefore. If any quarters should be dispensed, and if the quarter tube has enough quarters therein, steps 697, 698, 700, 702, 706 and 707 will effect the dispensing of those quarters and the corresponding reducing of the value in the credit register, all as described hereinbefore.

During steps 724, 714, 720 and 721, it will be determined whether any dimes should be dispensed, all as described hereinbefore. If any dimes should be dispensed, and if the dime tube has enough dimes therein, steps 724, 714, 720 and 721 will effect the dispensing of those dimes and the corresponding reducing of the value in the credit register, all as described hereinbefore.

Figure 20:
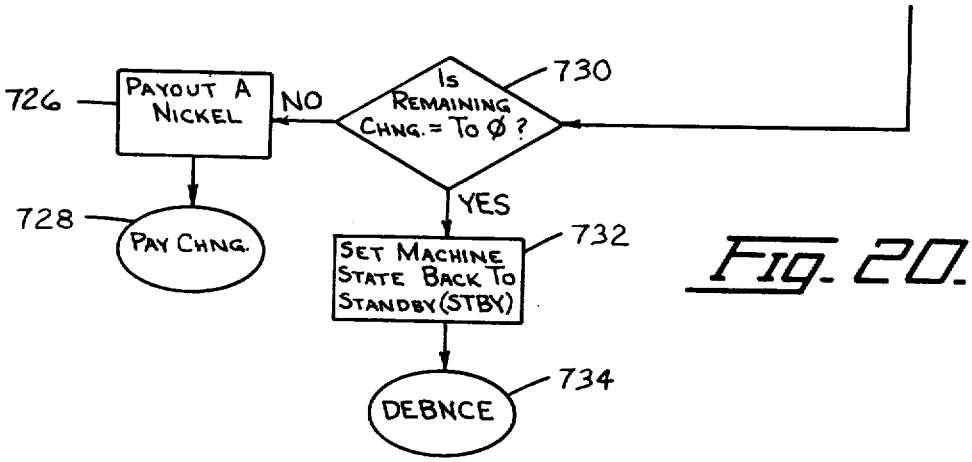
Figure 21:
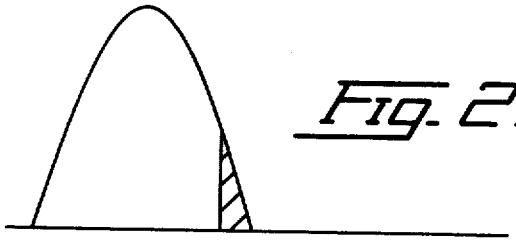
FIG. 21 shows current pulses which are developed prior to the closing of a selection switch.

During steps 730 and 726 of FIG. 20, it will be determined whether any nickels should be dispensed, all as described hereinbefore. If any nickels should be dispensed, and if the nickel tube has enough nickels therein, steps 730 and 726 will effect the dispensing of those nickels and the corresponding reducing of the value in the credit register, all as described hereinbefore.

Except for the fact that during change-making operations, the values in the credit register represent the differences between the values of the inserted coinage and the prices of the selected products, whereas during cancel sale operations the values in the credit register represent the values of the inserted coinage, the executions of the routine of FIG. 19 during those operations are essentially the same. As a result, the foregoing detailed descriptions of the executions of that routine during cancel sale operations will largely serve to describe the executions of that routine during change-making operations. However, step 704—which is entitled IS REMAINING CHG.=30¢ OR 40¢ and which corresponds to lines 2778 through 2782 of the program—is seldom, if ever, executed during cancel sale operations, but can be executed from time to time during change-making operations.

If the level of nickels in the nickel tube falls far enough for the sensor 308 of FIG. 8 to supply an "empty" signal to pin 4 of Port 1, the next execution of steps 510 and 516 of FIG. 10 will recognize and respond to that fact; and then step 556 of FIG. 11 will provide a YES. Similarly, if the level of dimes in the dime tube falls far enough for the sensor 310 of FIG. 8 to supply an "empty" signal to pin 5 of Port 1, the next execution of steps 510 and 516 of FIG. 10 will recognize and respond to that fact; and then step 556 of FIG. 11 will provide a YES. In either event, step 558 of FIG. 11—which is entitled TURN ON EXACT CHANGE LAMP and which corresponds to lines 0645 through 0650 of the program—will cause pin 1 of Port 5 of microprocessor 62 to apply a signal to conductor 96.

EXACT CHANGE LAMPS are provided for the protection of customers, but many customers do not pay any attention to the illuminating of those lamps. As a result, even though the EXACT CHANGE LAMPS are illuminated, customers frequently insert coinage and seek products which have prices that are below the value of that coinage—thereby requiring the dispensing of change. Some control devices for vending machines will dispense insufficient change if the nickel tubes thereof are empty and if the value of the change is thirty cents (30¢) or forty cents (40¢). In contrast, the control device of the present invention will dispense exact change even if the required amount of change is thirty cents (30¢) or forty cents (40¢) and all five (5) of the nickels—which must be in the lower portion of the nickel tube to keep sensor 308 of FIG. 8 from providing an "empty" signal—have been dispensed during prior vending transactions.

For example, if at a time when the nickel tube has no nickels therein but sensor 310 indicates that the dime tube is "full", a customer ignores the EXACT CHANGE LAMP, inserts a dollar coin, and then presses a selection switch calling for the dispensing of a product having a price of sixty cents (60¢), the control device will be required to dispense forty cents (40¢) as change. Steps 510 and 516 of FIG. 10 and step 562 of FIG. 11 will cause a dollar value to be stored in the credit register. Thereafter, step 550 of FIG. 11 will respond to the closing of the appropriate one of selection switches 240, 242 and 244 to successively (a) draw from EAROM 142 the price data into the price register, (b) compare the value of the data in the credit register with the value of the data in the price register, (c) supply a vend-initiating logic "0" to conductor 106 if the value of the data in the credit register at least equals the value of the data in the price register, (d) update the data in the appropriate registers of step 552, and (e) execute the routine of FIG. 19 to effect the dispensing of change.

The comparing function of step 698 of FIG. 19 will provide a NO, the comparing function of step 700 will provide a NO, and the comparing function of step 702 will provide a NO. Step 704—which is entitled IS REMAINING CHG=30¢ OR 40¢ and which corresponds to lines 2778 through 2782 of the program—will cause data having the value of a quarter to be loaded into the change register and also will cause a comparison to be made between that data and the data in the credit register. At this time, the data in the credit register has a value of forty cents (40¢); and the comparison will determine that the difference represents a value of fifteen cents (15¢); and the resulting YES of step 704 will execute steps 724 and 714. During the latter step, the count in the ten cent tube empty register will be checked, and, since in step 697 it was set to represent a count of ten, the comparing function of step 714 will provide a NO. Thereupon, step 720 will effect the dispensing of a dime, and also will cause the value of that time to be subtracted from the value in the credit register—thereby reducing that value to thirty cents (30¢). The step 721 will cause the count in the ten cent tube empty register to be decremented by one. The program will then exit through connective 722 and re-enter at label 696 to again execute steps 697 and 698, 700, 702, 704, 724, 714, 720 and 721. Those steps will again initiate the paying out of a dime and the subtracting of the value of that dime from the value in the credit register—thereby reducing that value to twenty cents (20¢). At this time, the program will loop via connective 722, label 696, and steps 697, 698, 724, 714, 720 and 721 to effect the paying out of a third dime and the subtracting of the value of that dime from the value in the credit register—thereby reducing that value to ten cents (10¢). Thereupon, the program will again loop via connective 722, label 696 and steps 697, 698, 724, 714, 720 and 721 to effect the paying out of a fourth dime and the subtracting of the value of that dime from the value in the credit register—thereby reducing that value to zero (0). The succeeding looping of the program via connective 722, label 696, steps 697, 698, 724, 730 and 732, connective 734 of FIG. 20 and label 508 of FIG. 10 to step 510 will cause the program to loop at steps 510 and 512 until the timer of the latter step times out. At this time, the control device and vending machine will be in "standby" condition in the product-vending mode.

If, in the preceding example, the price of the selected product had been seventy cents (70¢) rather than sixty cents (60¢), the comparing function of step 704 would again provide a YES; and steps 724, 714, 720 and 721 would again initiate the dispensing of a dime and the subtracting of the value of that dime from the value in the credit register—thereby reducing that value to twenty cents (20¢). The program will then exit through connective 722 and re-enter at label 696 to execute steps 697, 698, 724, 714, 720 and 721. Those steps will again initiate the paying out of a second dime and the subtracting of the value of that dime from the value in the credit register—thereby reducing that value to ten cents (10¢). Thereupon, the program will again loop via connective 722, label 696, and steps 697, 698, 724, 714, 720 and 721 to effect the paying out of a third dime and the subtracting of the value of that dime from the value in the credit register—thereby reducing that value to zero (0). The succeeding looping of the program via connective 722, label 696, steps 697, 698, 724, 730 and 732, connective 734 of FIG. 20, and label 508 of FIG. 10 to step 510 will cause the program to loop at steps 510 and 512 until the timer of the latter step times out. At this time, the control device and vending machine will be in "standby" condition in the product-vending mode.

The foregoing illustrations show that instead of dispensing quarters prior to the dispensing of any smaller-denomination coins—as some prior control devices invariably do, the control device of the present invention determines whether the dispensing of quarters prior to the dispensing of any smaller-denomination coins could short-change a customer. If the dispensing of quarters prior to the dispensing of any smaller-denomination coins would not short-change the customer, the control device of the present invention will dispense a quarter as part of the thirty cents (30¢) or forty cents (40¢) which is to be delivered to the customer. However, if the dispensing of a quarter prior to the dispensing of any smaller-denomination coins could short-change the customer, the control device of the present invention will automatically use dimes to dispense the required thirty cents (30¢) or forty cents (40¢).

By anticipating the potential loss of a nickel to any customer who is entitled to thirty cents (30¢) or forty cents (40¢) at a time when the nickel tube is devoid of nickels, and then dispensing the full amount that is due, the control device of the present invention merits the confidence of customers. Also, that control device can provide this desirable result even where the amount due the patron is greater than thirty cents (30¢) or forth cents (40¢). Thus, if the difference between the credit and the selected price is fifty-five cents (55¢) or sixty-five cents (65¢), the paying out of a quarter would reduce the amount due to thirty cents (30¢) or forty cents (40¢)—with consequent potential loss to the customer if the nickel tube was devoid of nickels. As a result, the protections offered by step 704 of FIG. 19 can be of considerable value.

Dispensing of Coins—Empty Signal During a Coin-Dispensing Operation Does Not Halt That Operation It will be noted that the present invention enables the control device to continue to effect the dispensing of coins from a coin tube during any given coin-dispensing operation even if, shortly after the beginning of that operation, the level of the coins in that tube were to fall below the level at which the sensor for that tube indicates an "empty" condition. This is desirable; because it makes those coins in that coin tube, which are located below the "empty" level, available for change-making purposes—thereby minimizing the dispensing of lower-denomination coins to effect the paying out of the required amount of money. For example, if it is assumed that the quarter tube contains the minimum number, namely five (5), of quarters which is needed to enable sensor 306 to sense a "full" condition, if it is assumed that both the dime and nickel tubes are "full" and if it is assumed that a patron inserts a dollar ($1) and then selects a product priced at twenty-five cents (25¢), the execution of step 706 will result in dispensing of the first of the five (5) quarters. In the next step 707 the count in the twenty-five cents tube empty register will be decremented from four to three. Also, the dispensing of the first of the five (5) quarters in the quarter tube will enable sensor 306 to change the state of the signal at pin 6 of Port 1. During the succeeding execution of steps 510 and 516 of FIG. 10, that change of state will be sensed as an "empty" signal, and it will change a particular bit in the tube level status register to represent that the quarters tube in "empty". In the step 697 this bit will cause the twenty-five cents tube empty register to reamin unchanged and then direct the program to steps 698 and 700. The step 700 will determine if the twenty-five cents tube empty register has been decremented to zero. Since in step 707 it was decremented to three and in step 697 it remained unchanged, the step 700 will provide a NO. Thereupon, step 702 will determine whether the nickel tube is full; and, in the assumed situation, the comparing function of that step will provide a YES. Step 706 will then effect the paying out of a quarter even though sensor 306 is providing an "empty" signal and even though step 697 recognized that such a signal had been provided. The program will then loop through steps 697, 698, 700, 702, 706 and 707 to dispense another quarter, thereby providing the required seventy-five cents (75¢) in change—even though sensor 306 continued to provide the "empty" signal.

It will be noted that none of the dimes in the dime tube was used to effect the paying out of the seventy-five cents (75¢) in change. Further, it will be noted that none of the nickels in the nickel tube was used to effect the paying out of that change. Consequently, the supplies of coins in the dime tube and in the nickel tube were not reduced, and hence will be available for further coin-dispensing operations.

Step 697 anbd 707 of FIG. 19 are provided to permit the continued paying out of quarters in a currently-executed transaction wherein sensor 306 changes the state of pin 6 of Port 1; but steps 697 and 707 will keep more than four (4) quarters from being dispensed during that transaction after that sensor provides the "empty" signal. It is very unlikely that there would ever be a need to pay out more than four (4) quarters during a transaction after sensor 306 has provided an "empty" signal; because if a patron had inserted dollars and then (a) pressed the cancel sale button or (b) selected a product that was inexpensive enough to require more than a dollar in change, one or more of the inserted dollars would be available to provide the required value of returned coins of the required amount of change. Similarly, if a patron inserted a considerable number of quarters and then (a) pressed the cancel sale button or (b) selected a product that was inexpensive enough to require more than a dollar in change, those inserted quarters would be available to provide the required value of returned coins or the required amount of change. However, if a patron had an extremely large number of dimes and nickels, and if he wanted to use them to effect the purchase of a relatively high-priced product and then, after inserting that large number of nickels and dimes, decided to select a product which was offered at a substantially-smaller price, the control device could be called upon to pay out more than four quarters after sensor 306 had provided an "empty" signal. For example, if it was assumed that a patron inserted a dollar and sixty-five cents ($1.65) in dimes and nickels and then pressed a selection button corresponding to a product priced at forty cents (40¢), the value which would be stored in the change register would be a dollar and twenty-five cents ($1.25). If, at that time, the quarter tube had only five (5) quarters in it, the first execution of the routine of FIG. 19 would execute steps 697, 698, 700, 702, 706 and 707—with the dispensing of a quarter and with the development of an "empty" signal by the sensor 306. The first execution of step 697 causes the twenty-five cents empty register to be set to the count of four. The next execution of steps 697, 698, 700, 706 and 707 would effect the dispensing of a quarter and a decrementing of the count in the twenty-five cents tube empty register to three. Simimlarly, the next two executions of the routine of FIG. 19 would execute steps 697, 698, 700, 702, 706 and 707 with two (2) further dispensing of quarters and two (2) further decrementings of the count in the twenty-five cent tube empty register. Those four (4) executions of the routine of FIG. 19 would effect (a) the dispensing of four (4) quarters, (b) four (4) decrementings of the count in the twenty-five cent tube empty register. The next execution of the routine of FIG. 19—which would be needed to pay out the remaining twenty-five cents (25¢) in change—would include steps 697, 698, 700, 724, 714, 720 and 721 to effect the paying out of a dime; because the twenty-five cents tube empty register would have been decremented to zero, and step 700 will provide a YES. A further execution of the routine of FIG. 19 would include steps 697, 698, 724, 712, 720 and 721 to effect the dispensing of a second dime. The next-to-last execution of the routing of FIG. 19 would include steps 697, 698, 724, 730 and 726 to effect the dispensing of a nickel; and the last execution of that routine would include steps 697, 698, 724, 730 and 732—with consequent setting of the machine state to "standby". It thus should be apparent that the development of an "empty" signal—during a transaction which requires the dispensing of a number of quarters—will not halt the dispensing of quarters. Instead, up to four (4) quarters can be dispensed during that transaction. It should also be apparent that if quarters can no longer be dispensed from the quarter tube, the program will automatically dispense two (2) dimes and a nickel to aggregate the required twenty-five cents (25¢).

If a subsequent transaction—which requires the dispensing of a quarter—is initiated before any further quarters are introduced into the quarter tube—by a route man or by the introduction of quarters into the coin slot of the vending machine—no quarters will be dispensed; and, instead, dimes and nickels will be dispensed to provide the money value of coinage that otherwise would be provided by the dispensing of one or more quarters. Specifically, steps 697, 698 and 700 will direct the program to step 724. Steps 714, 720 and 721 will then dispense a dime with a consequent corresponding reduction of the value in the credit register. The program will then cause those steps to dispense a further dime, with a further consequent corresponding reduction of the value in the credit register. The next execution of the routine of FIG. 19 would cause steps 697, 698, 724, 730 and 726 to dispense a nickel, with a consequent corresponding reduction of the value in the credit register. The action of step 697 and 700 of FIG. 19 in distinguishing between an "empty" condition of the quarter tube which develops during a currently-executed transaction and an "empty" condition of that tube which developed during a prior transaction is important; because quarters can be dispensed in the former condition without any risk of short-changing a customer, whereas the dispensing of quarters in the latter condition could easily short-change a customer.

Steps 697 and 721 of FIG. 19 are provided to permit continued paying out of dimes in a currently-executed transaction wherein sensor 310 changes the state of pin 5 of Port 1; but steps 697 and 721 will keep more than eight (8) dimes from being dispensed during that transaction after that sensor provides the "empty" signal. It is very unlikely that there would ever be a need to pay out more than eight (8) dimes during a transaction after sensor 310 provided an "empty" signal; because if a patron had inserted dollars and then (a) pressed the cancel sale button or (b) selected a product that was inexpensive enough to require more than a dollar in change, one or more of the inserted dollars would be available to provide the required value of returned coins or the required amount of change. Similarly, if a patron inserted a considerable number of quarters and then (a) pressed the cancel sale button or (b) selected a product that was inexpensive enough to require more than a dollar in change, those inserted quarters would be available to provide the required value of returned coins or the required amount of change. Further, if a patron inserted a considerable number of dimes and then (a) pressed the cancel sale button or (b) selected a product that was inexpensive enough to require a substantial amount of change, those inserted dimes would be available to provide the required value of returned coins or the required amount of change. However, if a transaction were to occur wherein more than eight (8) dimes should be dispensed after the sensor 310 develops an "empty" signal, steps 697 and 721 will be effective in dispensing only eight (8) dimes after that sensor develops an "empty" signal. For example, if it was assumed that prior transactions had completely emptied the quarter and the dime tubes, and if it was assumed that a customer had inserted five (5) quarters, nine (9) dimes and two (2) nickels and then pressed the cancel sale button, the first execution of the routine of FIG. 19 would execute steps 697, 698, 700, 702, 706 and 707—with consequent dispensing of a quarter, and decrementing of twenty-five cent tube empty register to a count of three. During the second execution of the routine of FIG. 19, step 697 will sense that quarter tube is still "full" and set the twenty-five cent tube empty register to a count of four. Next, steps 698, 700, 702, 706 and 707 will be executed with consequent dispensing of a second quarter, a decrementing of the twenty-five cent tube empty register to a count of three, and the immediate development of an "empty" signal by sensor 306 of FIG. 8. During each of the three (3) succeeding executions of the routine of FIG. 19, steps 697, 698, 700, 702 and 706 would again be executed—with consequent dispensing of three (3)further quarters, and with three further decrementings of the twenty-five cent tube empty register. During the sixth execution of the routine of FIG. 19, steps 697, 698, 700, 724, 714, 720 and 721 would be executed, because the comparing function of step 700 would provide a Yes. During the execution of that routine, a dime would be dispensed. During the seventh execution of the routine of FIG. 19, steps 697, 698, 700, 724, 714, 720 and 721 would be executed—with consequent dispensing of a second dime, a decrementing of the ten cent tube empty register. During the next six (6) executions of the routine of FIG. 19, steps 697, 698, 700, 724, 714, 720 and 721 would be executed—with consequent dispensing of six (6) dimes, six (6) decrementings of the ten cent tube empty register. During the fourteenth execution of the routine of FIG. 19, steps 697, 698, 724, 714, 720 and 721 would be executed—with consequent dispensing of a ninth dime, an eighth decrementing of the ten cent tube empty resigter. During the fifteenth execution of the routine of FIG. 19, steps 697, 698, 724, 714, 730 and 726 would be executed, because the comparting function of step 714 would provide a YES. During the execution of that routine, a nickel would be dispensed. During the sixteenth execution of the routine of FIG. 19, steps 697, 698, 724, 730 and 732 would be executed—with consequent dispensing of a second nickel.

The foregoing illustration shows that the control device of the present invention (a) makes it possible to continue to pay out quarters during a transaction even after the sensor 306 of FIG. 8 has developed an "empty" signal during that transaction, (b) limits the number of such after-"empty" quarters to four (4) and then automatically causes any further credit to be met by dimes or nickels, (c) makes it possible to continue to pay out dimes during a transaction even after the sensor 310 of FIG. 8 has developed an "empty" signal during that transaction, and (d) limits the number of such after-"empty" dimes to eight (8) and then automatically causes any further credit to be met by nickels. As a result, that control device provides a large change-making capability.

Dispensing of Coins—During Inventorying of Coins In Coin Tubes

A control device for vending machines customarily is equipped with "inventory" switches—usually one switch for each coin tube. Further, these "inventory" switches usually are single function switches. The present invention makes it possible to use just two (2) "inventory" switches to control the dispensing of coins from three (3) coin tubes, and also enables either or both of those "inventory" switches to perform dual functions, namely, placing the control device in the price verification mode, and controlling the emptying of the coin tubes.

The slide 608 preferably is identical to the correspondingly-numbered slide of the said Johnson application. When that actuator is in position to close only switch 150, that switch will apply a signal to pin 2 of Port 0 of microprocessor 62. During the next execution of steps 510, 516 and 534 of FIG. 10, the change in the state of that pin will be sensed. During step 570 of FIG. 11, a comparing function will determine whether either or both of the switches 150 and 152 is closed; and, in the assumed instance, step 570 will provide a YES. The program then will jump via connectives 634 and 636, respectively, of FIGS. 11 and 16, to the routine of FIG. 16. During the execution of step 638, the price verification flag is set; and during steps 640 and 642 nickels will be paid out as long as switch 150 is held closed. In this way, the closing of that switch initiated two functions.

When the actuator 608 is in position to close only switch 152, that switch will apply a signal to pin 3 of Port 0 of microprocessor 62. During the next execution of steps 510, 516 and 538 of FIG. 10, the change in the state of that pin will be sensed. During step 570 of FIG. 11, a comparing function will determine whether either or both of the switches 150 and 152 is closed; and, in the assumed instance, step 570 will provide a YES. The program then will jump via connectives 634 and 636, respectively, of FIGS. 11 and 16, to the routine of FIG. 16. During the execution of step 638, the price verification flag is set; and during steps 640 and 642, dimes will be paid out as long as switch 152 is held closed. In this way, the closing of that switch initiated two functions.

When the actuator 608 is in position to close both switches 150 and 152, those switches will apply signals to pins 2 and 3 of Port 0 of microprocessor 62. During the next execution of steps 510, 516 and 538 of FIG. 10, the changes in the states of those pins will be sensed. During step 570 of FIG. 11, a comparing function will determine whether either or both of the switches 150 and 152 is closed; and, in the assumed instance, step 570 will provide a YES. The program then will jump via connectives 634 and 636, respectively, of FIG. 11 and 16, to the routine of FIG. 16. During the execution of step 638, the price verification flag is set; and during steps 640 and 642 quarters will be pair out as long as switches 150 and 152 are held closed. In this way, the closing of those switches initiated both functions. Moreover, in this way, the present invention makes it possible to use just two (2) switches to effect the selective dispensing of three-individually different kinds of coins from three individually-different tubes. Such an arrangement not only saves a further connection to microprocessor 62, but it obviates a need for a third switch and the cost and size requirements which such a switch would entail.

CREM

Whenever the control device and program are to be used with a mechanical slug rejector, a driver 133 will have the input thereof connected to pin 6 of Port 0 of microprocessor 62. A pull-up resistor 135 will be connected between the input of that driver and plus five (+5) volts. Conductor 83 will extend from the output of that driver to the CREM for that slug rejector.

When that control device and the vending machine, with which it is used, are in the "standby" condition in the product-vending mode, pin 6 of Port 0 of microprocessor 62 will apply a signal to the driver 133, and that driver will energize the CREM to permit the insertion and acceptance of authentic coins of desired denominations. However, during a vending operation, during a cancel sale operation, or during a change-making operation—when it is not desirable for coins to be accepted—pin 6 of Port 0 will not supply that signal to driver 133; and hence the CREM will be de-energized. At such time, even authentic coins of desired denominations will not be accepted. Step 530 of FIG. 10 will, during each execution of the routine of FIGS. 10 and 11, make certain that the CREM is in its proper condition.

Use With Electronic Slug Rejector

The control device and the program can be used with mechanical slug rejectors or with electronic slug rejectors—each of which receives, and determines the denominations of, various combinations of nickels, dimes, quarters and dollar coins. A mechanical slug rejector utilizes a CREM to selectively reject all inserted coins before they can be fully tested by that slug rejector; but an electronic slug rejector can test all inserted coins and then utilize an accept-reject gate to effect the acceptance of acceptable coins. Where the control device and the program are to be used with an electronic slug rejector, the switch chip 416, the capacitor 420, the sensors 574, 520, 486 and 149, the resonating capacitors 444, 448, 452 and 456, and the resistors 446, 450, 454 and 458 of FIG. 8 will be deleted, and conductors 108, 110, 112 and 114 will be connected directly to the outputs of the electronic slug rejector. Also, the sensor 803, resonating capacitor 472 and resistor 474, or counterparts thereof, will be mounted on the board of the electronic slug rejector, and conductor 122 will be disconnected from switch chip 418 and grounded. In addition, the driver 133 of FIG. 1 will be removed, and sensor 802, or its counterpart, will be connected to circuitry which will be connected directly to pin 6 of Port 0 of microprocessor 62. That sensor and circuitry will respond to the pressing of the cancel sale button to apply a signal to that pin. Also, pin 6 of Port 0 will be directly connected to the circuitry of that electronic slug rejector.

The electronic slug rejector will respond to the insertion of authentic dollar coins, quarters, dimes and nickels to supply signals to pins 0 through 3 of Port 1 of microprocessor 62 in the same way in which sensors 149, 486, 520, 574 and switch chip 416 respond to the insertion of such coins to supply signals to those pins. As a result, where the control device and the program are used with an electronic slug rejector, rather than with a mechanical slug rejector, the execution of the various routines of FIGS. 10 through 20 will, with the exception of steps 526 and 530 of FIG. 10 and step 566 of FIG. 11, be identical. Where the control device and program are used with a mechanical slug rejector, step 526 will always provide an essentially-immediate output which will cause the program to execute step 530. Where, however, that control device and program are used with an electronic slug rejector, step 526 will sense the state of pin 6 of Port 0 to determine whether that pin is being used to send a signal to the circuitry of the electronic slug rejector to keep that electronic slug rejector from accepting further coins. If that pin is not being so used, step 526 will respond to that state as indicating whether the cancel sale button has been pressed—setting an appropriate flag if that button has been pressed. If, at the time step 526 is initiated, pin 6 of Port 0 is being used to send a signal to the circuitry of the electronic slug rejector to keep that electronic slug rejector from accepting further coins, a check will be made of the Port 0 status register to determine whether the cancel sale button had been pressed after the last execution of step 526 but before pin 6 of Port 0 was used to send the signal to the circuitry of the electronic slug rejector to keep that electronic slug rejector from accepting further coins. Thereafter, a flag will be set in that appropriate register to indicate whether the check of the Port 0 status register had indicated a pressing of the cancel sale button.

Step 530 will, when the control device and program are used with an electronic slug rejector, operate somewhat differently than it will when that control device and program are used with a mechanical slug rejector. Specifically, it will supply a signal on pin 6 of Port 0 which is connected to the circuitry of the electronic slug rejector. A logic "0" on that pin will be used by that electronic slug rejector to keep the accept-reject gate in reject position and logic "1" will be used by that electronic slug rejector to energize that solenoid if inserted coin is acceptable.

Step 566 will, when the control device and program are used with an electronic slug rejector, operate somewhat differently than it will when that control device and program are used with a mechanical slug rejector. Specifically, it will sense for the presence of the flag which might have been set during step 526 of FIG. 10. When the control device and program are used with a mechanical slug rejector, the state of pin 6 of Port 1 is directly sensed. However, by using the conductor, which connects pin 6 of Port 0 to sensor 803, to connect that pin to the circuitry of the electronic slug rejector to keep that electronic slug rejector from accepting further coins, the present invention obviates the need of an additional conductor.

Alternates

Figure 23:
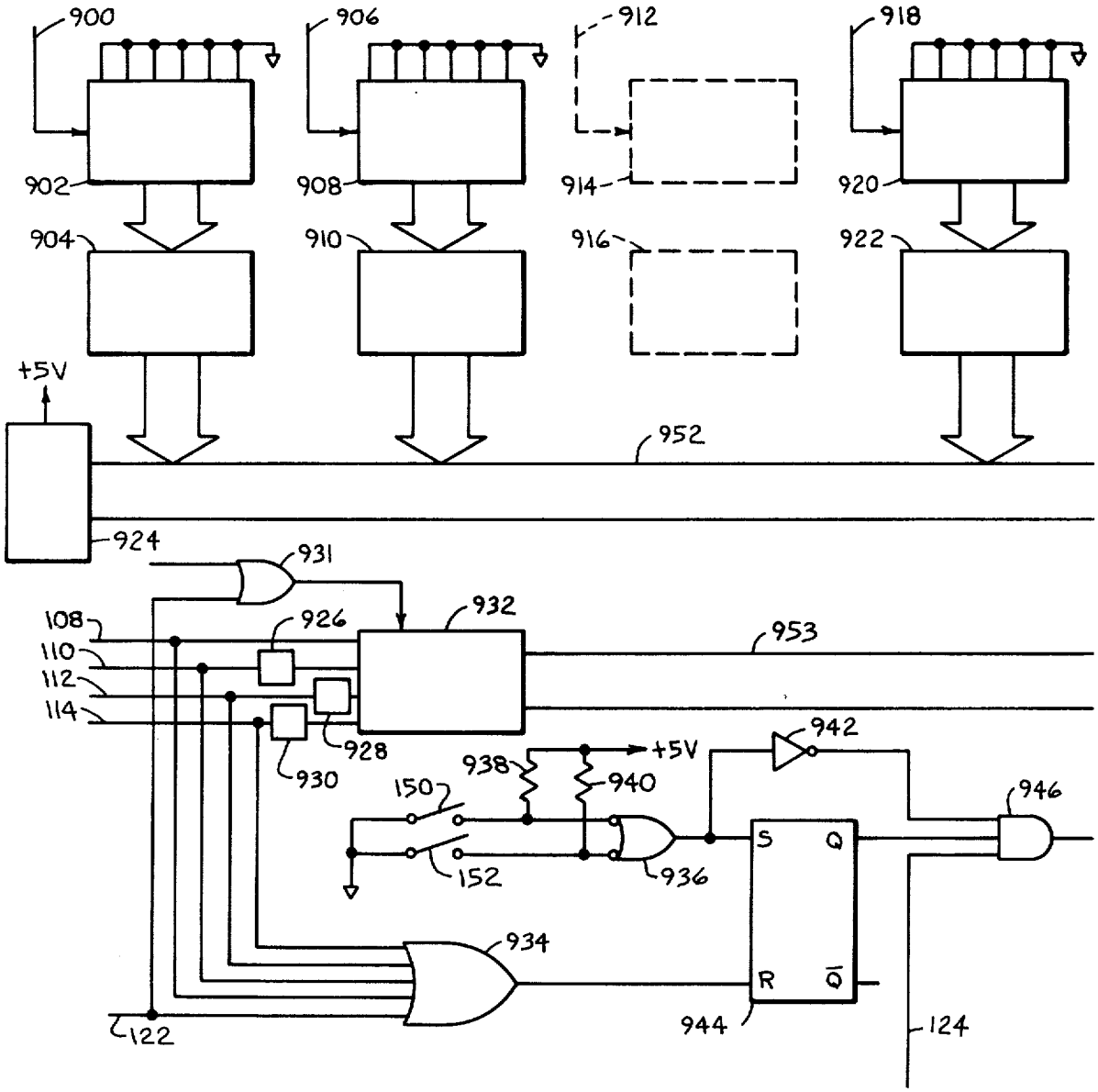
FIGS. 23 and 24 show a circuit, for an alternate embodiment of control device for a vending machine, which can place that control device in a price verification mode.
Figure 24:
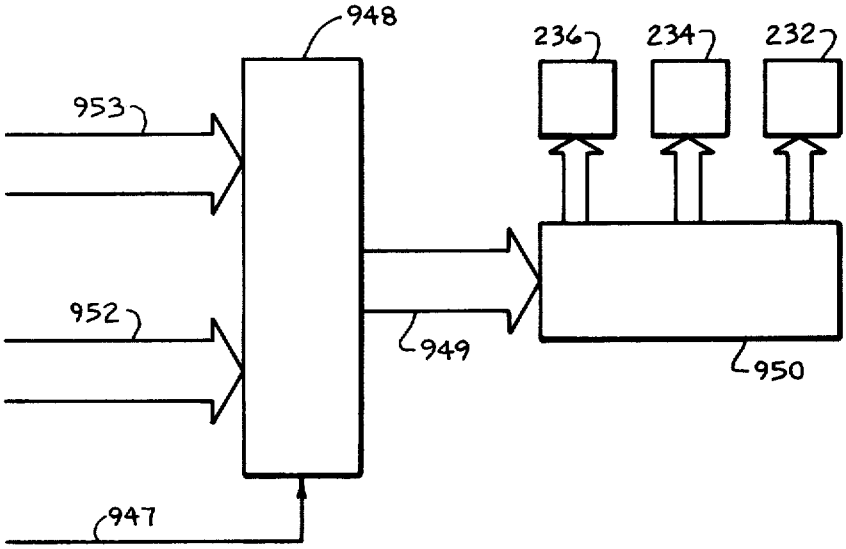

Referring particularly to FIGS. 23 and 24, portions of a control device, for a vending machine which responds to the pressing of selection switches to display the prices corresponding to those selection switches, are shown. Those portions illustrate how credit, corresponding to the values of inserted coins is exhibited. Also, FIGS. 23 and 24 illustrate a simple and direct way of placing that control device in a price verification mode, and additionally illustrate a simple and direct way of taking that control device out of that mode and placing it in the product-vending mode.

The numerals 150 and 152 denote inventory switches that preferably are identical to the similarly-numbered switches of FIG. 1. The numerals 902, 908 and 920 denote HEX tri-state buffers, which preferably are identical to the buffer 136 of FIG. 1; and conductors 900, 906 and 918 connect the outputs of comparators, not shown, such as comparators 340 and 408 of FIG. 4, to the clocking inputs of those buffers. All of the data inputs of those buffers are connected to six-position dip switches 904, 910 and 922, of standard and usual design, which have the outputs thereof connected to a six-bit price bus 952. Pull up resistors 924 are connected to the six (6) conductors of that bus, and are connected to plus five (+5) volts. The numeral 914 denotes additional HEX tri-state buffers, the numeral 916 denotes additional six-position dip switches, and the numeral 912 denotes additional conductors which are connected to the outputs of additional comparators.

The numeral 932 denotes a standard and usual binary counter, which has its outputs connected to a six-bit credit bus bar 953. That counter has an OR gate 931 connected to it; and one input of that gate is connected to the output of inverter 296 of FIG. 5, and the other input of that gate is connected to conductor 122 of FIG. 8. That conductor also is connected to the lower input of a five-input OR gate 934. Conductors 108, 110, 112 and 114 of FIG. 8 are connected to the other four inputs of OR gate 934; and conductor 108 is directly connected to the input of counter 932, but conductor 110 is connected to that input by a pulse generator 926 which will supply two (2) pulses to that input when it receives an input from conductor 110. Conductor 112 is connected to the input of counter 932 by a pulse generator 928 which will supply five (5) pulses to that input when it receives an input from conductor 112; and conductor 114 is connected to that input by a pulse generator 930 which will supply twenty (20) pulses to that input when it receives an input from conductor 114.

Pull up resistors 938 and 940 connect the inputs of a NAND gate 936 to plus five (+5) volts. An inverter 942 connects the output of NAND gate 936 to the upper input of an AND gate 946, the middle input of that AND gate is connected to the Q output of a set-reset flip-flop 944, and the lower input of that AND gate is connected to conductor 124 of FIG. 8. A conductor 947 extends from the output of OR gate 934 of FIG. 23 to the select input of MUX 948. The numeral 948 in FIG. 24 denotes two Motorola 4053 multiplexer/de-multiplexers (hereafter MUX); and the output of AND gate 946 is connected to the "select" input thereof. The output of that MUX is connected, by a six-bit bus bar 949 to a gate array 950 which consists of three MMI PAL10H8 Dual Octo Ten-Input AND/OR Gate Arrays. The numerals 236, 234 and 231 denote seven-segment displays which preferably are identical to the similarly-numbered displays of FIG. 3.

In its normal state, the MUX 948 will connect the six-bit bus bar 953 to six-bit bus bar 949, while simultaneously disconnecting six-bit bus bar 952 from six-bit bus bar 949. The insertion of coins will cause conductor 108, conductor 110 and pulse generator 926, conductor 112 and pulse generator 928, and conductor 114 and pulse generator 930 to supply signals to counter 932. Those signals will represent the values of inserted coins; and the gate array 950 of FIG. 24 will cause the sum of those values to be exhibited by the displays 236, 234 and 232.

When a customer presses one of the selection switches, not shown, of the control device, the corresponding one of the buffers 902, 908, 914 and 920, and the corresponding one of the six-position dip switches 904, 910, 916 and 922, will apply a code to six-bit bus bar 952 which will represent the price of the desired object. Thereupon, a comparator, not shown, of standard and usual type, which senses the price-based signals on six-bit bus bar 952 and the credit-based signals on six-bit bus bar 953, will (a) determine whether the value of the credit at least equals the value of the price, and (b) initiate a vending of the desired product if that value does at least equal the value of the price. At this time the control device of FIGS. 23 and 24 will be, and will operate, in the product-vending mode.

To place the control device of FIGS. 23 and 24 in the price verification mode, a route man will close one or the other of switches 150 and 152 of FIG. 23 by moving the actuator 608. Thereupon, a zero (0) will be applied to the corresponding input of NAND gate 936; and will thereby cause a "1" to appear at the S input of flip-flop 944. The logic "0" at the Q output of that flip-flop will change to a "1". NAND gate 936 and inverter 942 will apply a "0", to the upper input of AND gate 946, which will continue as long as either or both of switches 150 and 152 are closed. Payout motor 230 of FIG. 9 will respond to the closing of either or both of switches 150 and 152 to become energized, and to rotate the gears connected to its rotor, thereby causing sensor 312 of FIG. 8 to apply a "0" to the lower input of AND gate 946 via conductor 124.

At this time the AND gate 946 will have only one logic "1" at its input; and hence that AND gate will apply a logic "0" to the select input of MUX 948. Because that 948 must receive a logic "1" at its select input to connect the six-bit bus bar 952 to the six-bit bus bar 949, and because those six-bit bus bars must be connected to each other to place the control device in the price verification mode, that control device will not, at this time, be able to enter the price verification mode. Consequently, it will be noted that closing switches 150 and 152 will not immediately place the control device in the price verification mode.

When both of the switches 150 and 152 are permitted to re-open, inverter 942 will again apply a "1" to the upper input of AND gate 946. When the motor 230 completes its cycle and comes to rest, conductor 124 will again apply a "1" to the lower input of that AND gate. At this time, the Q output of flip-flop 944 will still be applying a "1" to the middle input of AND gate 946; and hence that AND gate will apply a "1" to the select input of MUX 948 via conductor 947. That MUX will then connect the six-bit bus bar 952 to six-bit bus bar 949 while disconnecting six-bit bus bar 953 from the latter bus bar. At this time, the control device will be in the price verification mode.

That control device will automatically be changed from the price verification mode to the product-vending mode as soon as a coin is inserted or the cancel sale button is pressed. Specifically, as soon as a signal appears on any of the conductors 108, 110, 112 or 114, due to the insertion of a nickel, dime, quarter or dollar, the OR gate 934 will respond to that signal to re-set flip-flop 944. The resulting "0" at the Q output of that flip-flop will cause a "0" to appear at the output of AND gate 946, and hence at the select input of MUX 948. Thereupon, the six-bit bus bar 953 will be connected to six-bit bus bar 949, and six-bit bus bar 952 will be disconnected from the latter six-bit bus bar. At this time, the control device and the vending machine will again be in the product-vending mode.

In this simple and direct way, without any requirement of a microprocessor or program, the control device can be placed in the price verification mode and then removed from that mode. As in the case of the control device of FIGS. 1 through 20, the present invention ideally arranges an operation which the route man should perform, namely, the closing of one of the switches 150 and 152, so it is automatically performed during an operation which the route man must perform, namely, the emptying of the coin tubes. Additionally, the present invention ideally precludes the performance of an operation which should be performed, namely, the verification of prices, until a prior operation which must be performed, namely, the re-opening of switches 150 and 152, has been completed. Moreover, the present invention obviates all of the initial cost of an extra switch, all of the cost of wiring such a switch into the circuit, and all of the problems of servicing and maintaining such a switch.

Figure 25:
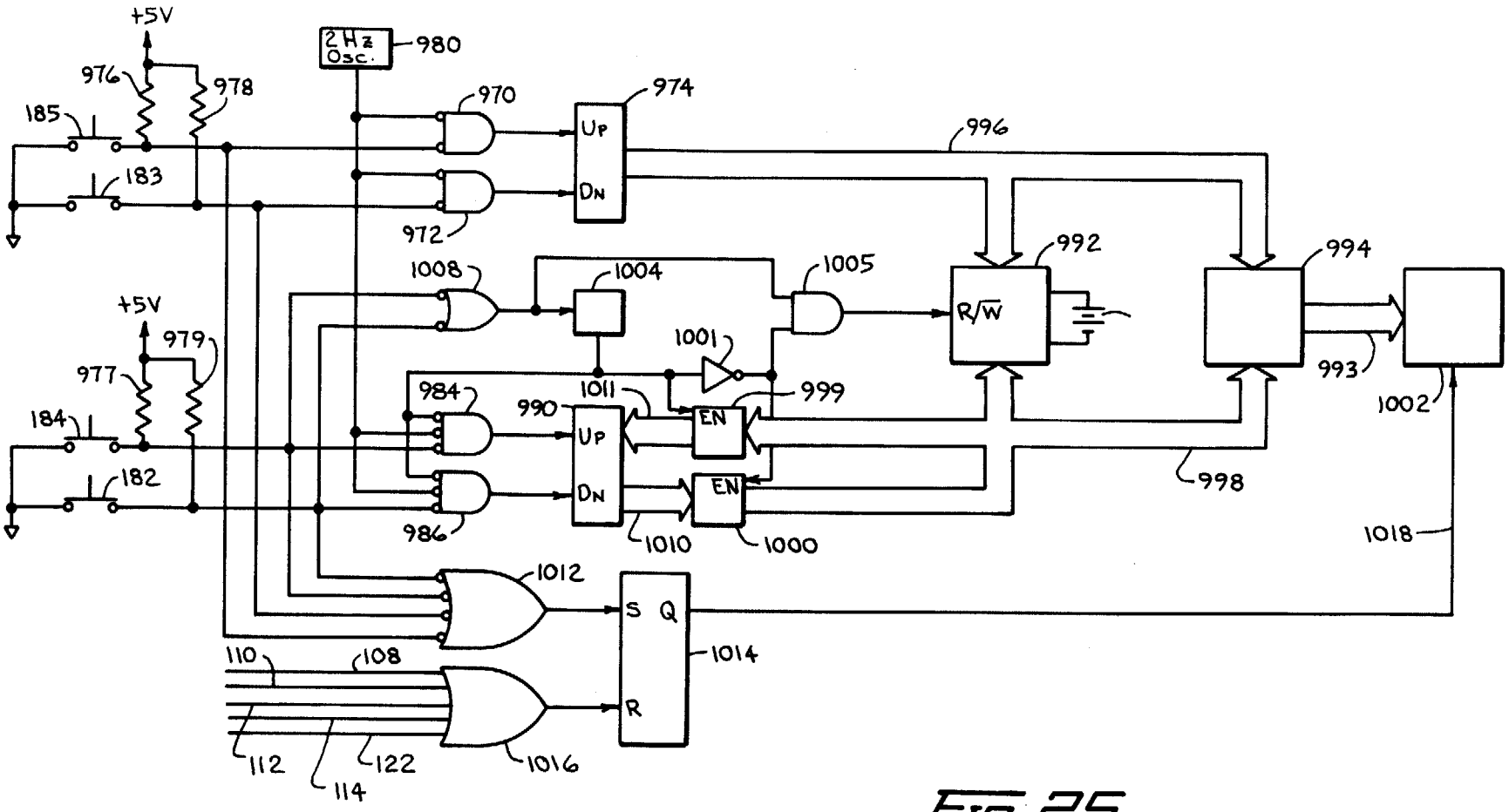
FIG. 25 shows a circuit which can place a control device for a vending machine in a price-setting mode.

Referring particularly to FIG. 25, a simple circuit is shown for placing the control device of a vending machine in the price-setting mode and then taking that control device out of that mode. Switches 185 and 183 are identical to the similarly-numbered switches of FIG. 1. The left-hand terminals of those switches are connected to ground, and the right-hand terminals thereof are connected to the lower inputs of NAND gates 970 and 972. The outputs of those NAND gates are connected, respectively, to the UP and DOWN inputs of an UP DOWN counter 974 of standard and usual design. Pull up resistors976 and 978 are connected, respectively, between the right-hand terminals of switches 185 and 183 and plus five (+5) volts. The upper inputs of NAND gates 970 and 972 are connected to an oscillator 980 which supplies signals at a frequency of two hertz (2 Hz).

The numerals 184 and 182 denote switches which preferably are identical to the similarly-numbered switches in FIG. 1. The left-hand terminals of those switches are connected to ground; and the right-hand terminals of those switches are connected, respectively, to the lower inputs of NAND gates 984 and 986. The outputs of those NAND gates are connected, respectively, to the UP and DOWN inputs of an UP DOWN counter 990 of standard and usual design. Pull up resistors 977 and 979 are connected, respectively, between the right-hand terminals of switches 184 and 182 and plus five (+5) volts. The middle inputs of NAND gates 984 and 986 are connected to oscillator 980. Although different counters could be used as the UP DOWN counters 974 and 990, it is preferred to use two CD 4029A counters as each of those counters.

The numeral 992 denotes an R/$\overline{W}$ 256X8 RAM, which has an eight-bit bus bar 996 connected to it. Although various RAMs could be used, it is preferred to use two Motorola 5101 RAMs as the RAM 992. A back-up battery 993, of standard and usual design, is connected to that RAM. The numeral 994 denotes a decoder to which the eight-bit bus bars 996 and 998 are connected. Although various decoders could be used, eight MMI PAL10H8 dual octal 10 input AND/OR gate arrays are preferred. The eight-bit bus bar 996 is connected to the output of UP DOWN counter 974; and the eight-bit bus bar 998 is connected to the inputs of a tri-state buffer 999 and also to the outputs of a tri-state buffer 1000. Although different buffers could be used as the buffers 999 and 1000, Motorola 14503 buffers are preferred. An eight-digit display 1002 can, and preferably will, be the same as the display 168 of FIG. 2; and an eight-bit bus bar 993 is connected between a decoder 994 and that display.

The numeral 1004 denotes a one-shot multivibrator, of standard and usual design, which has the input thereof connected to the output of NOR gate 1008. The inputs of that gate are connected to the right-hand terminals of switches 184 and 182. An eight-bit bus bar 1010 connects the output of UP DOWN counter 990 to the inputs of register 1000. An eight-bit bus bar 1011 connects the outputs of register 999 to the UP DOWN counter 990. An AND gate 1005 has one input thereof connected to the output of NAND gate 1008, and has the other input thereof connected to the output of inverter 1001. The output of that AND gate is connected to the R/$\overline{W}$ input of RAM 992. The input of inverter 1001 is connected to the output of the multivibrator 1004; and the output of that inverter also is connected to the enable input of register 1000. The output of that multivibrator also is connected to the enable input of register 999 and to the upper inputs of NAND gates 984 and 986.

A NAND gate 1012 has two of the four inputs thereof connected to the right-hand terminals of switches 184 and 182, and has the other two inputs thereof connected to the right-hand terminals of switches 185 and 183. The output of that NAND gate is connected to the S input of a set-reset flip-flop 1014; and the Q output of that flip-flop is connected to the enable input of the display 1000 by a conductor 1018. An OR gate 1016 has four of the inputs thereof connected to conductors 108, 110, 112 and 114 of FIG. 8, and has the other input thereof connected to conductor 122. The output of that OR gate is connected to the R input of flip-flop 1014.

Because the inverting functions of NAND gates 970, 972, 984 and 986 occur at the inputs of those gates, a "1" at any input will provide a "0" output, and all inputs must be "0" to provide a "1" output. Because the inverting functions of NAND gates 1008 and 1012 occur at the inputs of those gates, a "0" at any input will provide a "1" output, and all inputs must be "1" to provide a "0" output.

Closing of switch 185 will apply a "0" to the lower input of NAND gate 970 and also to the the lower input of NAND gate 1012. During the next time the oscillator 980 applies a "0" to the upper input of that NAND gate, that gate will apply a "1" to the UP input of counter 974, and will thereby cause that counter to increment the line number. NAND gate 1012 will respond to the "0" from switch 185 to apply a "1" to the S input of flip-flop 1014, and will cause that flip-flop to apply a "1" to the ENABLE input of display 1002. The output of counter 974 will be applied to decoder 994 and also to RAM 992. At this time, the location in that RAM which corresponds to the incremented line number will be addressed; and the data in that location will be decoded by decoder 994 and supplied to the display 1002. Consequently, the actuation of switch 185 effected an incrementing of the selection line number and also effected the displaying of that line number and of the corresponding data. As long as that switch is held closed, oscillator 980 will cause the line number to be changed twice each second, and will cause the corresponding data to be decoded by decoder 994 and exhibited by the display 1002. This is due to the fact that the "1"'s from that oscillator will disable NAND gate 970, and will thereby simulate the opening of switch 185.

If switch 183 is closed, NAND gate 1012 will receive a "0" and apply a "1" to the S input of flip-flop 1014; and NAND gate 972 will respond to the "0" from switch 183 and the next "0" from oscillator 980 to supply a "1" to the DOWN input of counter 974—with decrementing of the line number and with consequent exhibiting of that decremented line number and of the corresponding data on display 1002. As long as that switch is held closed, oscillator 980 will cause the line number to be changed twice each second, and will cause the corresponding data to be decoded by decoder 994 and exhibited by the display 1002. This is due to the fact that the "1"'s from that oscillator will disable NAND gate 972 and will thereby simulate the opening of switch 183.

If switch 184 is closed, NAND gate 1012 will respond to the resulting "0" to apply a "1" to the S input of flip-flop 1014. NAND gate 1008 will respond to the "0" from that switch to apply a "1" to the upper input of AND gate 1005 and to the input of multivibrator 1004. The resulting "1" at the output of that multivibrator will enable buffer 999, will disable NAND gates 984 and 986, and will cause inverter 1001 to provide a "0" which will disable AND gate 1005 and buffer 1000. Because the AND gate 1005 is unable to develop a "1" at its output, RAM 992 will continue to be in its "read" mode. The buffer 999 will respond to the data which is addressed in the RAM to load that data into the UP DOWN counter 990, thereby initializing that counter. When the multivibrator 1014 "times out", the resulting "0" at its output will no longer enable buffer 999; and hence the data at the input of that buffer will no longer be applied to UP DOWN counter 990. Inverter 1001 will apply a "1" to AND gate 1005 which will cause that AND gate to supply a "1" to the R/$\overline{W}$ input of RAM 992 to place that RAM in its "write" mode. The "0" which multivibrator 1004 applies to the upper input of NAND gate 984 will coact with the "0" from switch 184 and the next "0" from oscillator 980 to cause that NAND gate to apply a "1" to the UP input of counter 990. Thereupon, that counter will increment—by a five cent (5¢) value—the data which was loaded into it by RAM 992 and buffer 999. Also, the "1" at the output of inverter 1061 will enable buffer 1000; and that buffer will respond to the incremented data within the UP DOWN counter 990 to write that incremented data into the RAM, and also to cause decoder 994 to decode that data and apply it to display 1002. The "1" from the Q output of flip-flop 1014 will effect the exhibiting of that data. In this way, the closing of switch 184 enabled the data which corresponded to the currently-addressed location in the RAM 992 to be loaded into the UP DOWN counter 990, to be incremented by a five cent (5¢) value, to be written back into that location in incremented form, and to be exhibited by the display 1002. As long as that switch is held closed, oscillator 980 will cause the data in the currently-addressed RAM location to be changed twice each second, and will cause that changed data to be written into that RAM location and decoded by decoder 994 and exhibited by display 1002. In this way, the data corresponding to the currently-addressed RAM location can be progressively incremented.

If switch 182 is closed, NAND gate 1012 will apply a "1" to the set input of flip-flop 1014. NAND gate 1008 will respond to the "0" from that switch to apply a "1" to the upper input of AND gate 1005 and to the input of multivibrator 1004. The resulting "1" at the output of that multivibrator will enable buffer 999 and disable NAND gates 984 and 986, and it will cause inverter 1001 to disable AND gate 1005 and buffer 1000. The data in the currently-addressed RAM location will be loaded into the UP DOWN counter 990 by buffer 999; and then, as the multivibrator 1004 times out, the resulting "0" at its output will disable buffer 999, will coact with the next "0" from oscillator 980 to cause NAND gate 986 to apply a "1" to the DOWN input of UP DOWN counter 990, and will cause inverter 1001 to apply an enabling "1" to AND gate 1005 and buffer 1000. The "1" at the DOWN input of counter 990 will decrement—by a five cent (5¢) value—the data that was loaded into that counter by buffer 999. Thereafter, that decremented value will be written into the RAM location by buffer 1000, and also will be decoded by decoder 994 and applied to display 1002 by bus bar 993. The "1" from the Q output of flip-flop 1014 will cause display 1002 to exhibit the corresponding value. As long as that switch is held closed, oscillator 980 will cause the data in the currently-addressed RAM location to be changed twice each second, and will cause that changed data to be written into that RAM location and decoded by decoder 994 and exhibited by display 1002. In this way, the data corresponding to the currently-addressed RAM location can be progressively decremented.

It will be noted that the circuit of FIG. 25 permits the control device to be placed in its price-setting mode in a simple and direct manner. Further, that circuit enables any desired location within the RAM to be addressed, and then have the data therein incremented or decremented to any desired value. That control device is automatically taken out of its price-setting mode by releasing the switches 185, 183, 184 and 182.

If desired, a digital technique, rather than the analog technique of FIGS. 4 and 5, could be used to provide narrow and wide current pulses for the solid state relay 290. Specifically, the microprocessor 62 could load a first scratch pad register with data representing seven and eight-tenths millisecond (7.8 ms) and then sense a positive-going zero crossing of the A. C. to start decrementing that data. When that data had been decremented to zero (0), a logic "0" would be applied to pin 3 of Port 5, and that "0" would be inverted and applied directly to the input of gate 286 of FIG. 4. About four-tenths of a millisecond (0.4 ms) later, a further scratch pad register, which had been loaded with data corresponding to eight and two-tenths milliseconds (8.2 ms) would "time out", and would change the "0" at pin 3 of Port 5 back to a "1". Because each half-cycle of the A. C. has a duration of about eight and three-tenths milliseconds (8.3 ms), that driver would apply a triggering pulse to relay 290 which would terminate before the negative-going zero crossing of the A. C. In this way, a four-tenths millisecond (0.4 ms) current pulse would be applied to relay 290 during each positive-going half-cycle but would be terminated before the end of that half-cycle.

The four-tenths millisecond (0.4) ms current pulse would be supplied to the relay 290 during each positive-going half-cycle of the A.C. until a selection switch was closed. Thereafter, the microprocessor would compare the price of the product selected by the closing of that selection switch with the inserted credit to determine whether that credit at least equalled that price. If that microprocessor determined that the credit at least equalled the price, data representing four and three-tenths milliseconds (4.3 ms) would be loaded into the first scratch pad register and then the next positive-going zero crossing of the A. C. would be sensed to start the decrementing of that data. When that data had been decremented to zero (0), a logic "0" would be applied to pin 3 of Port 5; and that "0" would be inverted and applied directly to the input of driver 288 of FIG. 4. The resulting current pulse would be applied to relay 290 through the rest of that half-cycle, so that current pulse could continue throughout the immediately-following negative-going half-cycle. The overall width of the resulting current pulse would be about twelve milliseconds (12 ms); and such a pulse would be long enough to actuate the corresponding vending device but would be short enough to prevent overheating of the solid state relay 290 or that vending device.

Conclusion

The numeral 60 denotes a switch which can be closed to place the control device in a "declining balance" mode. That mode has been used in a number of coin changers, and hence is not unique. The closing of that switch enables the control device to permit varying numbers of products to be selected and vended—as long as the price of any selected product is matched or exceeded by the un-used credit. The operation of the control device in the "declining balance" mode is provided for in lines 2535 through 2665 of the program.

The attached program enables the control device to provide a considerable number of operations and functions which are not shown on the flow chart of FIGS. 10 through 20. Those operations and functions are of the type generally performed by coin changers and control devices for vending machines, and they are performed in a manner known to those skilled in the art. As a result, those operations and functions are not parts of, and are not necessary for an understanding of, the present invention.

The control device of the present invention is particularly adapted for use with slug rejectors that respond to U.S. coins and is particularly adapted for use with coin-dispensing devices that accommodate U.S. coins. However, that control device can be used with slug rejectors and coin-dispensing devices that respond to, and that accommodate, coins of different nations.

Whereas the drawing and accompanying description have shown and described different embodiments of the present invention, it should be apparent to those skilled in the art that various changes could be made in the form of the invention without affecting the scope thereof.

```
0001 0010  R0       EQU   1          PORT 0
0002 0011  R1       EQU   2          PORT 4 PRICE SW.
0003 0012  R2       EQU   3          PORT 1
0004 0013  RX1      EQU   4          TEMPORARY REGS.
0000 0014  RX1U     EQU   0
0004 0015  RX1L     EQU   4
0005 0016  RX2      EQU   5
0006 0017  RX3      EQU   6
0007 0018  RX4      EQU   7
0008 0019  RX5      EQU   8
0008 0020  BINR     EQU   RX5
000B 0021  R1FLG    EQU   11          FLAG REGS.
000A 0022  RFLG     EQU   10
0000 0023  R2FLG    EQU   0
0002 0024  INRU     EQU   2          INPUT REGS.
0007 0025  INRL     EQU   7
0003 0026  INVU     EQU   3          INVENTORY DEBOUNCE
0000 0027  INVL     EQU   0
0003 0028  LN6U     EQU   3          LINE 6 DEBOUNCE
0002 0029  LN6L     EQU   2
0003 0030  PSWU     EQU   3          PRICE SETTING SWITCHES
0003 0031  PSWL     EQU   3          DEBOUNCE
0003 0032  P0RU     EQU   3          P0R
0005 0033  P0RL     EQU   5
0003 0034  P5RU     EQU   3          P5R
0006 0035  P5RL     EQU   6
0003 0036  WATRU    EQU   3          WAITR
0007 0037  WATRL    EQU   7
0003 0038  DISDU    EQU   3          DISPLAY DIGIT NO.
0007 0039  DISDL    EQU   7
0004 0040  DISPLU   EQU   4          DISPLAY REGISTERS
0000 0041  DISPLL   EQU   0
0020 0042  TL4R     EQU   0'40'      ACCEPT $ REG.
0004 0043  TL4RU    EQU   4
0000 0044  TL4RL    EQU   0
0004 0045  CHGRU    EQU   4          CHANGE COMPUTING REGS.
0002 0046  CHGRL    EQU   2
0004 0047  VNDU     EQU   4          VEND INPUT REGISTER
0003 0048  VNDL     EQU   3
0004 0049  CH1RU    EQU   4          NO. OF CHANGE COINS
0007 0050  CH1RL    EQU   7
0027 0051  CH1R     EQU   0'47'
0025 0052  CH5R     EQU   0'45'
```

```
0005 0053  CTRU     EQU   5          CREM TIMERS
0000 0054  CTRL     EQU   0
0005 0055  TLIRU    EQU   5          FILTERED TLI INPUTS
0003 0056  TLIRL    EQU   3
0005 0057  PTRU     EQU   5          PAYOUT TIMER
0004 0058  PTRL     EQU   4
0005 0059  INCLU    EQU   5          INVENTORY CONTROL REG.
0007 0060  INCLL    EQU   7
0006 0061  PUSHU    EQU   6          RETURN ADDRS. & Q
0003 0062  PUSHL    EQU   3
0006 0063  C1RU     EQU   6          NO. OF INSERTED COINS
0007 0064  C1RL     EQU   7
0037 0065  C1R      EQU   0'67'
0007 0066  FVMU     EQU   7          FREE VEND MODE REG.
0000 0067  FVML     EQU   0
0007 0068  CRDU     EQU   7          CREDIT.PRICE
0001 0069  CRDL     EQU   1
0007 0070  SELRU    EQU   7          SELECTION NO.
0003 0071  SELRL    EQU   3          &LINE NO.
0007 0072  PSTRU    EQU   7          PRICE SETTING TIMERS
0005 0073  PSTRL    EQU   5
     0074  *
     0075          EJECT
     0076  *
     0077  * MASKS
     0078  *
000C 0079  INVM     EQU   H'0C'      INVENTORY
0040 0080  CRM      EQU   H'40'      CREM
0080 0081  CYSWM    EQU   H'80'      CYCLE SW.
000F 0082  COINM    EQU   H'0F'      ALL COINS
0001 0083  C1M      EQU   H'01'
0002 0084  C2M      EQU   H'02'
0004 0085  C5M      EQU   H'04'
0008 0086  C20M     EQU   H'08'
0070 0087  TLM      EQU   H'70'      ALL TUBE LEVELS
0010 0088  TL1M     EQU   H'10'
0020 0089  TL2M     EQU   H'20'
0040 0090  TL3M     EQU   H'40'
0080 0091  CRETM    EQU   H'80'      COIN RET
0040 0092  LN6M     EQU   H'40'      LINE 6
003F 0093  SLCTM    EQU   H'3F'      SELECT INPUTS
0040 0094  SLCM     EQU   H'40'      SELECTOR MOTOR
0020 0095  PMOTM    EQU   H'20'      PAYOUT MOTOR
0060 0096  MOTM     EQU   H'60'
0004 0097  REVRM    EQU   H'04'      REVERSE RELAY
0002 0098  ECM      EQU   H'02'      EXACT CHANGE
0080 0099  SALEM    EQU   H'80'      SALES TOTALIZER
0010 0100  SELNM    EQU   H'10'      SELECTION NO.(INV.CONTROL)
0008 0101  VENDM    EQU   H'08'      VEND OUT
0010 0102  DDM      EQU   H'10'      DISPLAY DIGIT LATCH MASK
0030 0103  DGNM     EQU   H'30'      DIGIT NO. LATCH MASK
0020 0104  EROM     EQU   H'20'      EAROM LATCH
0022 0105  SWENM    EQU   H'22'      SWITCH ENABLE
0032 0106  SLENM    EQU   H'32'      SELECTION ENABLE
000F 0107  PSWM     EQU   H'0F'      PRICE SETTING SWITCHES MASK
000C 0108  LNSWM    EQU   H'0C'      LINE SWITCH MASK
0003 0109  PRSWM    EQU   H'03'      PRICE SWITCH MASK
0010 0110  FVSWM    EQU   H'10'      FIXED VEND SW.
0020 0111  DBSWM    EQU   H'20'      DECL BAL SW.
     0112  *
     0113          EJECT
     0114  *
     0115  * CONSTANTS
     0116  * ALL TIME CONSTANTS ARE NO. OF
     0117  * TIMER INTERRUPT CYCLES
     0118  * TIMER DURATION = 2.50 MS AT 4MHZ
     0119  *
```

```
     0120  *          TUBE LEVEL INPUTS DEBOUNCE
00C8 0121  TLID1K     EQU   200
0028 0122  TLID2K     EQU   40          WHEN PAYOUT IS ON
     0123  *
     0124  *          INVENTORY INPUTS DEBOUNCE
00C8 0125  INVK       EQU   200
     0126  *
     0127  *          LINE 6 OFF DEBOUNCE
0014 0128  LN6K       EQU   20
     0129  *
     0130  *          CREM OFF TIME BEFORE STARTING PAYOUT
00C8 0131  CT1K       EQU   200
     0132  *          CREM ON TIME TO ENABLE THE SOLENOID
     0133  *          TO PULL IN (M.R. ONLY)
003C 0134  CT2K       EQU   60
     0135  *          CREM ON/OFF CYCLE TIME FOR E.G.V.
000A 0136  CT3K       EQU   10
     0137  *
     0138  *          REVERSE RELAY ON TIME
000F 0139  PT1K       EQU   15
     0140  *          REVERSE RELAY OFF TIME
000F 0141  PT2K       EQU   15
     0142  *
     0143  *          SELECTOR MOTOR ON TIME
0032 0144  PT3K       EQU   50
     0145  *          SELECTOR MOTOR OFF TIME
0078 0146  PT4K       EQU   120
     0147  *
     0148  *          PAYOUT MOTOR TIME
     0149  *          CYCLE SW SHOULD TRANSFER WITHIN THIS TIME
     0150  *          OTHERWISE IT IS TAKEN AS PAYOUT JAM
000A 0151  PMKL       EQU   H'0A'
     0152  *
     0153  *          VEND TIME CONST.(INTERNAL TIME OUT)
0007 0154  TQKU       EQU   7           4 SECS.
     0155  *
     0156  *          SELECTION DISABLE TIME CONST.
     0157  *          AFTER INTERNAL TIME OUT
0004 0158  SELK       EQU   4           2.5 SECS.
     0159  *
     0160  *          FIXED VEND TIME CONST.
0004 0161  FVTK       EQU   4
     0162  *
     0163  *          MAX. NO. OF SCANS TO FILTER VEND INPUT
0003 0164  VFILK      EQU   3
     0165  *
     0166  *          MAX. NO. OF COINS IN PAYOUT TUBES
     0167  *          QUARTERS
0023 0168  TL3K1      EQU   35
     0169  *          DIMES
0046 0170  TL2K1      EQU   70
     0171  *          NICKELS
004B 0172  TL1K1      EQU   75
     0173  *
     0174  *          NO. OF COINS AT EMPTY LEVELS OF
     0175  *          QUARTERS, DIMES, NICKELS
0004 0176  TL3K       EQU   4
0008 0177  TL2K       EQU   8
0004 0178  TL1K       EQU   4
     0179  *
     0180  *          SALES TOTALISER PULSE WIDTH
0014 0181  SALEK      EQU   20
     0182  *
     0183  *          WAIT TIME AFTER SELECTION DISAPPEARS
     0184  *          DURING VEND
007D 0185  VNDK       EQU   125
     0186  *
```

```
                 *          WAIT TIME AFTER VEND IN DECL.BAL.MODE
0028             VDBK       EQU   40
                 *
                 *          END OF CYCLE WAIT
0028             EOCK       EQU   40
                 *
                 *          PRICE SETTING MODE CONSTANTS
                 *
                 *          TIME CONST. WHEN VERIFICATION OF
                 *          WRITTEN DATA FAILS
000F             PST0K      EQU   15
00C8             PST2K      EQU   200        SLOW TIME
0028             PST3K      EQU   40         FAST TIME
                 *          TIME CONST. WHEN ALL SWS. ARE OFF
                 *          OR BOTH LINE SWS. ARE ON
0064             PST4K      EQU   100
0014             PSWK       EQU   20         DEBOUNCE TIME
002D             LNMK       EQU   45         MAX. NO. OF SELECT LINES
                 *
                 *          EJECT
                 *
                 * PORT NOS.
                 *
0000             P0         EQU   0
0001             P1         EQU   1
0004             P4         EQU   4
0005             P5         EQU   5
0006             P6         EQU   6
                 *
                 *          EJECT
                 *
                 *          ORG   H'00'
                 *          ---   -----
0000 290CDB 0CDB            JMP   RESET
                 *
                 *
                 *
                 *********
                 * TABLES
                 *********
                 *
                 * SEVEN SEGMENT DECODER TABLE
0003 3F          SEGM       DC    B'00111111'      0
0004 06                     DC    B'00000110'      1
0005 5B                     DC    B'01011011'      2
0006 4F                     DC    B'01001111'      3
0007 66                     DC    B'01100110'      4
0008 6D                     DC    B'01101101'      5
0009 7C                     DC    B'01111100'      6
000A 07                     DC    B'00000111'      7
000B 7F                     DC    B'01111111'      8
000C 67                     DC    B'01100111'      9
000D 00                     DC    B'0'            10
000E 00                     DC    B'0'            11
                 *
                 *          CREDIT TABLE
                 *
000F 00          CRDTBL     DC    0
0010 01                     DC    1
0011 02                     DC    2
0012 03                     DC    3
0013 05                     DC    5
0014 06                     DC    6
0015 07                     DC    7
0016 08                     DC    8
0017 14                     DC    20
0018 15                     DC    21
0019 16                     DC    22
```

```
001A 17              0255            DC     23
001B 19              0256            DC     25
001C 1A              0257            DC     26
001D 1B              0258            DC     27
001E 1C              0259            DC     28
                     0260  *
                     0261            EJECT
                     0262  *
                     0263            ORG    H'20'
                     0264  *
                     0265  *
                     0266  *
                     0267  *         INPUT DEBOUNCE
                     0268  *
0020 62              0269  INDB0P    LISU   INRU
0021 6F              0270            LISL   INRL
0022 4C              0271  INDBP     LR     A,S
0023 60              0272            LISU   0
0024 5E              0273            LR     D,A
0025 62              0274            LISU   INRU
0026 EC              0275            XS     S
0027 5D              0276            LR     I,A
0028 20FF            0277            LI     H'FF'
002A 5E              0278            LR     D,A
002B 4E              0279            LR     A,D
002C 8FF5    0022    0280            BR7    INDBP
002E 45              0281            LR     A,RX2
002F 52              0282            LR     R1,A
0030 20FA            0283            LI     D'250'
0032 B7              0284            OUTS   7
                     0285  *
                     0286  *         FIXED VEND TIME PROGRAM
                     0287  *
0033 40              0288  FVTP      LR     A,R2FLG    CHECK VENDF2
0034 15              0289            SL     4
0035 810B    0041    0290            BP     DISP
0037 62              0291            LISU   INRU       CHECK VEND MODE
0038 6C              0292            LISL   INRL-3
0039 4C              0293            LR     A,S
003A 2110            0294            NI     FVSWM
003C 8404    0041    0295            BZ     DISP       BR IF SHORT VEND
003E 65              0296            LISU   PTRU
003F 6D              0297            LISL   PTRL+1
0040 3C              0298            DS     S
                     0299  *
                     0300  *         INTERNAL DISPLAY ROUTINE
0041 40              0301  DISP      LR     A,R2FLG
0042 13              0302            SL     1
0043 8138    007C    0303            BP     ECVP
0045 63              0304            LISU   P0RU
0046 6D              0305            LISL   P0RL
0047 4C              0306            LR     A,S
0048 54              0307            LR     RX1,A      RX1=PORT 0
0049 2230            0308            OI     DGNM
004B 30              0309            OUTS   P0
004C 73              0310            LIS    H'3'
004D B4              0311            OUTS   P4         TURN OFF ALL DIGITS
004E 63              0312            LISU   DISDU      ACC = PREVIOUS DIGIT NO.
004F 6F              0313            LISL   DISDL
0050 4C              0314            LR     A,S
0051 1F              0315            INC
0052 250C            0316            CI     H'0C'
0054 9402    0057    0317            BNZ    *+3
0056 74              0318            LIS    B'0100'
0057 5C              0319            LR     S,A
0058 55              0320            LR     RX2,A      RX2 = DIGIT NO.
0059 0B              0321            LR     IS,A
```

```
005A 64              0322            LISU  DISPLU    ISAR = ADDRESS OF DIGIT
005B 44              0323            LR    A,RX1      TO BE DISPLAYED
005C 2210            0324            OI    DDM        OUTPUT THIS DIGIT
005E B0              0325            OUTS  P0
005F 4C              0326            LR    A,S
0060 250A            0327            CI    H'A'
0062 8415      0078  0328            BZ    DIS1P
0064 18              0329            COM
0065 B4              0330            OUTS  P4
0066 B4              0331            OUTS  P4
0067 21F0            0332            NI    H'F0'      OUTPUT DECIMAL POINT
0069 E5              0333            XS    RX2        AND DIGIT NO.
006A 55              0334            LR    RX2,A
006B 203C            0335            LI    D'60'      DELAY
006D 56              0336            LR    RX3,A
006E 36              0337            DS    RX3
006F 94FE      006E  0338            BNZ   *-1
0071 44              0339            LR    A,RX1
0072 2230            0340            OI    DGNM
0074 B0              0341            OUTS  P0
0075 45              0342            LR    A,RX2
0076 18              0343            COM
0077 B4              0344            OUTS  P4
0078 44              0345  DIS1P     LR    A,RX1
0079 B0              0346            OUTS  P0
007A 70              0347            CLR
007B B4              0348            OUTS  P4
                     0349  *
                     0350  *
                     0351  *        STORE CREM BIT (P0-6) IN RX1 BIT 7
                     0352  *        RX1-7 = 0 IF COIN RET. INACTIVE
                     0353  *              = 1 IF COIN RET. ACTIVE
                     0354  *        THIS IS USED BY CONRP(COIN RET. PROGRAM)
                     0355  *
007C 70              0356  ECVP      CLR
007D CB              0357            AS    R1FLG      BIT 7 = 0 MEANS CREM OFF
007E 8105      0084  0358            BP    ECM1P      BR IF CREM OFF
0080 62              0359            LISU  INRU
0081 68              0360            LISL  INRL-7
0082 4C              0361            LR    A,S
0083 13              0362            SL    1
0084 54              0363  ECM1P     LR    RX1,A
                     0364  *
                     0365  *
                     0366  * ROUTINE TO CONTROL THE CREM
                     0367  *
0085 62              0368  CRMP      LISU  INRU       STORE MODE SWITCH INPUTS
0086 6C              0369            LISL  INRL-3
0087 4C              0370            LR    A,S
0088 55              0371            LR    RX2,A
0089 65              0372            LISU  CTRU
008A 68              0373            LISL  CTRL
008B 4B              0374            LR    A,R1FLG
008C 13              0375            SL    1
008D 8125      00B3  0376            BP    CRM2P      BR IF CREM OFF
008F 4A              0377            LR    A,RFLG
0090 13              0378            SL    1
0091 13              0379            SL    1
0092 9114      00A7  0380            BM    CRM1P      BR IF PSTF1 = 1
0094 4B              0381            LR    A,R1FLG
0095 13              0382            SL    1
0096 13              0383            SL    1
0097 910F      00A7  0384            BM    CRM1P      BR IF MVPF=1
0099 13              0385            SL    1
009A 910C      00A7  0386            BM    CRM1P      BR IF CRMF1 = 1
009C 70              0387            CLR
009D C5              0388            AS    RX2
009E 9154      00F3  0389            BM    TLID       BR IF E.C.V.
```

```
00A0 69            0390            LISL  CTRL+1
00A1 3C            0391            DS    S
00A2 9450    00F3  0392            BNZ   TLID
00A4 71            0393            LIS   1
00A5 902C    00D2  0394            BR    CRM5P
00A7 4B            0395  CRM1P     LR    A,R1FLG
00A8 21BF          0396            NI    H'BF'       CRMF = 0
00AA 5B            0397            LR    R1FLG,A
00AB 20C8          0398            LI    CT1K        LOAD CRTR'S
00AD 5D            0399            LR    I,A
00AE 200A          0400            LI    CT3K
00B0 5C            0401            LR    S,A
00B1 9025    00D7  0402            BR    CRM7P
00B3 3C            0403  CRM2P     DS    S
00B4 9403    00B8  0404            BNZ   CRM3P
00B6 71            0405            LIS   1
00B7 5C            0406            LR    S,A
00B8 4A            0407  CRM3P     LR    A,RFLG
00B9 13            0408            SL    1
00BA 13            0409            SL    1
00BB 9109    00C5  0410            BM    CRM4P       BR IF PSTF1 = 1
00BD 4B            0411            LR    A,R1FLG
00BE 13            0412            SL    1
00BF 13            0413            SL    1
00C0 9104    00C5  0414            BM    CRM4P       BR IF MVPF = 1
00C2 13            0415            SL    1
00C3 811E    00E2  0416            BP    CRM6P       BR IF CRMF1 = 0
00C5 70            0417  CRM4P     CLR
00C6 CE            0418            AS    RX2
00C7 812B    00F3  0419            BP    TLID        BR IF M.R.
00C9 4B            0420            LR    A,R1FLG
00CA 15            0421            SL    4
00CB 810B    00D7  0422            BP    CRM7P
00CD 69            0423            LISL  CTRL+1
00CE 3C            0424            DS    S
00CF 9423    00F3  0425            BNZ   TLID
00D1 7A            0426            LIS   CT3K
00D2 5C            0427  CRM5P     LR    S,A
00D3 70            0428            CLR
00D4 CB            0429            AS    R1FLG       BR IF CREM HAS
00D5 8113    00E9  0430            BP    CRM8P       TO BE TURNED ON
00D7 4B            0431  CRM7P     LR    A,R1FLG     TURN CREM OFF
00D8 217F          0432            NI    H'7F'       CRMF3 = 0
00DA 5B            0433            LR    R1FLG,A
00DB 63            0434            LISU  P0RU
00DC 6D            0435            LISL  P0RL
00DD 4C            0436            LR    A,S
00DE 2240          0437            OI    CRM
00E0 9010    00F1  0438            BR    CRM9P
00E2 69            0439  CRM6P     LISL  CTRL+1
00E3 203C          0440            LI    CT2K
00E5 5C            0441            LR    S,A         CRT2R = CT2K
00E6 4B            0442            LR    A,R1FLG
00E7 2240          0443            OI    H'40'       CRMF = 1
00E9 2280          0444  CRM8P     OI    H'80'       CRMF3 = 1
00EB 5B            0445            LR    R1FLG,A
00EC 63            0446            LISU  P0RU
00ED 6D            0447            LISL  P0RL
00EE 4C            0448            LR    A,S
00EF 21BF          0449            NI    H'FF'-CRM
00F1 B0            0450  CRM9P     OUTS  P0
00F2 5C            0451            LR    S,A
                   0452  *
                   0453  * TLI INPUTS DEBOUNCE
                   0454  *
00F3 2805EA  05EA  0455  TLID      PI    DBNCS
00F6 43            0456            LR    A,R2
```

```
00F7 2170          0457          NI    TLM
00F9 9410   010A   0458          BNZ   TLIP1
00FB 62            0459          LISU  INRU
00FC 6A            0460          LISL  INRL-5
00FD 4C            0461          LR    A,S
00FE 65            0462          LISU  TLIRU
00FF 6B            0463          LISL  TLIRL
0100 EE            0464          XS    D
0101 2170          0465          NI    TLM
0103 8411   0115   0466          BZ    INVDP      BR IF NO CHANGE
0105 3D            0467          DS    I
0106 940E   0115   0468          BNZ   INVDP
0108 EC            0469          XS    S          UPDATE TLIR
0109 5E            0470          LR    D,A
010A 65            0471  TLIP1    LISU  TLIRU
010B 6A            0472          LISL  TLIRL-1
010C 4A            0473          LR    A,RFLG
010D 15            0474          SL    4
010E 20C8          0475          LI    TLID1K
0110 8103   0114   0476          BP    *+4        BR IF PAYOUT OFF
0112 2028          0477          LI    TLID2K
0114 5C            0478          LR    S,A
                   0479  *
                   0480  *       INVENTORY SWITCH DEBOUNCE
                   0481  *
0115 41            0482  INVDP   LR    A,R0
0116 210C          0483          NI    INVM
0118 9410   0129   0484          BNZ   INVD1P
011A 62            0485          LISU  INRU       COMPARE IN0AR WITH
011B 68            0486          LISL  INRL-7     INVR
011C 4C            0487          LR    A,S
011D 63            0488          LISU  INVU
011E 69            0489          LISL  INVL+1
011F EE            0490          XS    D
0120 210C          0491          NI    INVM
0122 840B   012E   0492          BZ    PSWDP      BRANCH IF NO CHANGE
0124 3D            0493          DS    I
0125 9408   012E   0494          BNZ   PSWDP
0127 EC            0495          XS    S          UPDATE INVR
0128 5C            0496          LR    S,A
0129 63            0497  INVD1P   LISU  INVU       SET INVDR
012A 68            0498          LISL  INVL
012B 20C8          0499          LI    INVK
012D 5C            0500          LR    S,A
                   0501  *
                   0502  *PRICE SETTING SWITCH DEBOUNCE PROGRAM
                   0503  *
012E 42            0504  PSWDP   LR    A,R1
012F 210F          0505          NI    PSWM
0131 70            0506          CLR
0132 52            0507          LR    R1,A
0133 9411   0145   0508          BNZ   PSWD1P
0135 62            0509          LISU  INRU
0136 6C            0510          LISL  INRL-3     COMPARE IN2AR
0137 4C            0511          LR    A,S        WITH PSWR
0138 63            0512          LISU  PSWU
0139 6C            0513          LISL  PSWL+1
013A EE            0514          XS    D
013B 210F          0515          NI    PSWM
013D 840C   014A   0516          BZ    LN6DP      BRANCH IF NO CHANGE
013F 3D            0517          DS    I
0140 9409   014A   0518          BNZ   LN6DP
0142 52            0519          LR    R1,A       R1 = 0: IF NO CHANGE
0143 EC            0520          XS    S          1: IF CHANGE
0144 5C            0521          LR    S,A        UPDATE PSWR
0145 63            0522  PSWD1P   LISU  PSWU       SET PSWDR
0146 6B            0523          LISL  PSWL
```

```
0147 2014          0524          LI    PSWK
0149 5C            0525          LR    S,A
                   0526  *
                   0527  *
                   0528  * LINE 6 DEBOUNCE
                   0529  *
0149 74            0530  LN6DP   LIS   H'4'
014B F0            0531          NS    R2FLG
014C 8404    0151  0532          BZ    *+5
014E 2805EA  05EA  0533          PI    DBNCS     IF VENDF = 1
0151 62            0534          LISU  INRU      CHECK LINE 6 BIT
0152 65            0535          LISL  INRL-1    IN IN3AR
0153 4C            0536          LR    A,S
0154 13            0537          SL    1
0155 63            0538          LISU  LN6U
0156 6A            0539          LISL  LN6L
0157 910D    0165  0540          BM    LN6P1     BR IF LINE 6 CLOSED
0159 70            0541          CLR
015A C0            0542          AS    R2FLG     CHECK LN6F
015B 8110    016C  0543          BP    LN6P2+1   BR IF LN6 OPEN
015D 3C            0544          DS    S
015E 940D    016C  0545          BNZ   LN6P2+1
0160 40            0546          LR    A,R2FLG   LN6F = 0
0161 217F          0547          NI    H'7F'
0163 9007    016B  0548          BR    LN6P2
0165 2014          0549  LN6P1   LI    LN6K      LOAD LN6DR
0167 5C            0550          LR    S,A
0168 40            0551          LR    A,R2FLG   LN6F = 1
0169 2280          0552          OI    H'80'
016B 50            0553  LN6P2   LR    R2FLG,A
016C 4B            0554          LR    A,R1FLG
016D 2101          0555          NI    H'01'     CHECK CRMF2
016F 840C    017C  0556          BZ    INVCP
0171 E0            0557          XS    R2FLG
0172 4B            0558          LR    A,R1FLG
0173 8105    0179  0559          BP    LN6P3     BR IF LN6F = 0
0175 21EF          0560          NI    H'EF'     CRMF1 = 0
0177 9003    017B  0561          BR    *+4
0179 2210          0562  LN6P3   OI    H'10'     CRMF1 = 1
017B 5B            0563          LR    R1FLG,A
                   0564  *
                   0565  *
                   0566  * INVENTORY CONTROL PROGRAM
                   0567  *
017C 4B            0568  INVCP   LR    A,R1FLG   CHECK INVF
017D 15            0569          SL    4
017E 13            0570          SL    1
017F 813C    01BC  0571          BP    ECP
0181 13            0572          SL    1         CHECK INV1F
0182 911F    01A2  0573          BM    INVC3P
0184 63            0574  INVC1P  LISU  P5RU      COMPLEMENT SEL. NO. BIT
0185 6E            0575          LISL  P5RL
0186 4C            0576          LR    A,S
0187 2310          0577          XI    SELNM
0189 5C            0578          LR    S,A
018A B5            0579          OUTS  P5
018B 2110          0580          NI    SELNM
018D 942E    01BC  0581          BNZ   ECP
018F 65            0582          LISU  INCLU
0190 6F            0583          LISL  INCLL
0191 3C            0584          DS    S
0192 9429    01BC  0585          BNZ   ECP
0194 71            0586  INVC2P  LIS   1
0195 5C            0587          LR    S,A
0196 67            0588          LISU  CRDU      CHECK PRICE
0197 6A            0589          LISL  CRDL+1
0198 70            0590          CLR
```

```
0199 CC              0591            AS    S
019A 841D    01B8    0592            BZ    INVC4P     BR IF PRICE=0
019C 4B              0593            LR    A,R1FLG    INV1F=1
019D 2202            0594            OI    H'02'
019F 5B              0595            LR    R1FLG,A
01A0 901B    01BC    0596            BR    ECP
                     0597  * SALES TOTALIZER PULSES
01A2 65              0598  INVC3P    LISU  INCLU      DECREMENT INV. CONTROL
01A3 6F              0599            LISL  INCLL      REGISTER
01A4 3C              0600            DS    S
01A5 9416    01BC    0601            BNZ   ECP
01A7 2014            0602            LI    SALEK
01A9 5C              0603            LR    S,A
01AA 63              0604            LISU  P5RU       COMPLEMENT SALES TOTAL
01AB 6E              0605            LISL  P5RL       OUTPUT BIT
01AC 4C              0606            LR    A,S
01AD 2380            0607            XI    SALEM
01AF B5              0608            OUTS  P5
01B0 5C              0609            LR    S,A
01B1 910A    01BC    0610            BM    ECP
01B3 67              0611            LISU  CRDU       DECREMENT PRICE
01B4 6A              0612            LISL  CRDL+1
01B5 3C              0613            DS    S
01B6 9405    01BC    0614            BNZ   ECP
01B8 4B              0615  INVC4P    LR    A,R1FLG    INVF,INV1F=0
01B9 21F9            0616            NI    H'F9'
01BB 5B              0617            LR    R1FLG,A
                     0618  *
                     0619  *
                     0620  *EXACT CHANGE PROGRAM
                     0621  *ECF = 1 IF EXACT CHANGE LIGHT IS ON
                     0622  * = IF TL1 OR TL2 IS EMPTY
                     0623  *
01BC 74              0624  ECP       LIS   H'4'
01BD F0              0625            NS    R2FLG
01BE 941F    01DE    0626            BNZ   EC3P       BR IF VEND ON
01C0 4A              0627            LR    A,RFLG
01C1 2101            0628            NI    H'01'
01C3 941A    01DE    0629            BNZ   EC3P
01C5 62              0630            LISU  INRU
01C6 6A              0631            LISL  INRL-5
01C7 4C              0632            LR    A,S
01C8 13              0633            SL    1
01C9 13              0634            SL    1
01CA 9105    01D0    0635            BM    EC1P       BR IF TL2 EMPTY
01CC 13              0636            SL    1
01CD 70              0637            CLR
01CE 9102    01D1    0638            BP    EC2P       BR IF TL1 FULL
01D0 72              0639  EC1P      LIS   2
01D1 EA              0640  EC2P      XS    RFLG
01D2 2102            0641            NI    H'02'
01D4 9409    01DE    0642            BZ    EC3P       BR IF NO CHANGE IN ECF
01D6 EA              0643            XS    RFLG
01D7 5A              0644            LR    RFLG,A
01D8 63              0645            LISU  P5RU
01D9 6E              0646            LISL  P5RL
01DA 72              0647            LIS   ECM
01DB EC              0648            XS    S
01DC 5C              0649            LR    S,A
01DD B5              0650            OUTS  P5
01DE 2805EA 05EA     0651  EC3P      PI    DBNCS
                     0652  *
                     0653  *
                     0654  *PROGRAM TO CHECK COIN INPUTS
                     0655  *
01E1 62              0656  CHKCN     LISU  INRU
01E2 6A              0657            LISL  INRL-5
01E3 4C              0658            LR    A,S
```

```
01E4 18                 COM
01E5 F3                 NS      R2
01E6 210F               NI      COINM
01E8 9457     0240      BNZ     CRDTP       BR IS COINS IN
                        *
                        *PROGRAM TO CHECK COIN RETURN INPUT
                        *
01EA 4B         CONRP   LR      A.R1FLG
01EB 15                 SL      4
01EC 811E     020B      BP      INVSWP      BR IF CRETF = 0
01EE 62                 LISU    INRU
01EF 6C                 LISL    INRL-3
01F0 70                 CLR
01F1 CC                 AS      S
01F2 6E                 LISL    INRL-1      ISAR = ADDRESS OF IN3AR
01F3 8103     01F7      BP      *+4         BR IF W.R.
01F5 60                 LISU    RX1U
01F6 6C                 LISL    RX1L
01F7 70                 CLR
01F8 CC                 AS      S
01F9 8111     020B      BP      INVSWP      BR IF C.R. INACTIVE
01FB 2804A3   04A3      PI      RPSTMS
01FE 4A                 LR      A.RFLG
01FF 21FB               NI      H'FB'       PRVF = 0
0201 5A                 LR      RFLG.A
0202 67                 LISU    CRDU        CHECK CREDIT
0203 69                 LISL    CRDL
0204 70                 CLR
0205 CC                 AS      S
0206 8404     020B      BZ      INVSWP
0208 2909F7   09F7      JMP     CRETP
                        *
                        *CHECK INVENTORY SWITCHES
                        *
020B 40         INVSWP  LR      A.R2FLG
020C 2120               NI      H'20'
020E 8430     023F      BZ      JMSP
0210 74                 LIS     H'4'
0211 5D                 NS      R1FLG
0212 942C     023F      BNZ     JMSP
0214 63                 LISU    INVU
0215 63                 LISL    INVL+1
0216 CC                 AS      S
0217 8427     023F      BZ      JMSP
0219 2804A3   04A3      PI      RPSTMS
021C 4A                 LR      A.RFLG
021D 2204               OI      H'04'       PRVF = 1
021F 5A                 LR      RFLG.A
0220 40                 LR      A.R2FLG
0221 2110               NI      H'10'
0223 9418     023C      BNZ     JINVP
0225 40                 LR      A.R2FLG
0226 2210               OI      H'10'       CASHF = 1
0228 50                 LR      R2FLG.A
0229 70                 CLR
022A 51                 LR      R0.A
022B 52                 LR      R1.A
022C 2061               LI      D'97'
022E 57                 LR      RX4.A
022F 280362   0362      PI      EROMWS
0232 2805EA   05EA      PI      DBNCS
0235 37                 DS      RX4
0236 280362   0362      PI      EROMWS
0239 290D45   0D45      JMP     DEBNCE
023C 290BDB   0BDB      JMP     INVP
                        *
                        *
```

```
                 0726  *JUMP TO MACHINE STATE
                 0727  *
023F 0D          0728  JMSP     LR     F0,Q
                 0729  *
                 0730  *
                 0731         EJECT
                 0732  *
                 0733  *
                 0734  *
                 0735  * PROGRAM TO CREDIT INPUT COINS
                 0736  *
                 0737  *
                 0738  *
0240 53          0739  CRDTP    LR     R2,A      R2=INPUT COINS
0241 2804A3 04A3 0740          PI     RPSTMS
0244 4A          0741          LR     A,RFLG
0245 2240        0742          OI     H'40'     COINF = 1
0247 21FB        0743          NI     H'FB'     PRVF = 0
0249 5A          0744          LR     RFLG,A
024A 2A000F 000F 0745          DCI    CRDTBL
024D 43          0746          LR     A,R2
024E 8E          0747          ADC
024F 16          0748          LM                ACC=VALUE OF INPUT COINS
0250 67          0749          LISU   CRDU      ADD TO CREDIT
0251 69          0750          LISL   CRDL
0252 CC          0751          AS     S
0253 25C7        0752          CI     D'199'
0255 8203   0259 0753          BC     *+4
0257 20C7        0754          LI     D'199'
0259 5C          0755          LR     S,A
025A 58          0756          LR     BINR,A
025B 2805EA 05EA 0757          PI     DBNCS
025E 74          0758          LIS    4         LOAD RX1-RX4 WITH
025F 54          0759          LR     RX1,A     MAX. NO. OF COINS IN TUBES
0260 2023        0760          LI     TL3K1
0262 55          0761          LR     RX2,A
0263 2046        0762          LI     TL2K1
0265 56          0763          LR     RX3,A
0266 204B        0764          LI     TL1K1
0268 57          0765          LR     RX4,A
0269 66          0766          LISU   C1RU
026A 6C          0767          LISL   C1RL-3
026B 43          0768          LR     A,R2
026C 15          0769          SL     4
026D 53          0770  CRD1P    LR     R2,A
026E 66          0771          LISU   C1RU
026F 4C          0772          LR     A,S       INCREMENT CIR
0270 8103   0274 0773          BP     *+4
0272 1F          0774          INC
0273 5C          0775          LR     S,A
0274 18          0776          COM
0275 60          0777          LISU   0
0276 CC          0778          AS     S         ACC = TLIK1-CIR-1
0277 8105   027D 0779          BP     CRD2P
0278 [illegible] 0780          LR     A,R1FLG
027A 2220        0781          OI     H'20'     MVPF = 1
027C [illegible] 0782          LR     R1FLG,A
[illegible]      0783  CRD2P    LR     A,I
[illegible]      0784          LR     A,R2
[illegible]      0785          SL     1
0280 94EC   026D 0786          BNZ    CRD1P
0282 2805EA 05EA 0787          PI     DBNCS
0285 74          0788          LIS    H'4'
0286 F0          0789          NS     R2FLG
0287 94B7   023F 0790          BNZ    JMSP      SKIP DISPLAY IF VEND ON
0289 2805EA 05EA 0791  CRD3P    PI     DBNCS
028C 28030C 030C 0792          PI     BCD8
028F 9005   0295 0793          BR     DECOD
```

```
                 *
                 *********
                 *
                 * CLEAR DISPLAY
                 *
0291 70          CDISP    CLR
0292 54                   LR     RX1,A
0293 55                   LR     RX2,A
0294 57                   LR     RX4,A
                 *
                 *
                 *
                 * DECODE THE DIGITS INTO SEVEN SEGMENTS
                 * AND DISPLAY THEM
                 *
                 *
                 *
0295 2805EA 05EA DECOD    PI     DBNCS
0298 2A0003 0003          DCI    SEGM       3RD DIGIT
029B 45                   LR     A,RX2
029C 14                   SR     4
029D 8E                   ADC
029E 47                   LR     A,RX4      4TH DIGIT
029F 15                   SL     4
02A0 13                   SL     1
02A1 13                   SL     1
02A2 13                   SL     1
02A3 8B                   OM
02A4 56                   LR     RX3,A
02A5 2A0003 0003          DCI    SEGM       2ND DIGIT
02A8 45                   LR     A,RX2
02A9 210F                 NI     H'0F'
02AB 8E                   ADC
02AC 16                   LM
02AD 2280                 OI     H'80'      DECIMAL POINT
02AF 55                   LR     RX2,A
02B0 2A0003 0003          DCI    SEGM       1ST DIGIT
02B3 44                   LR     A,RX1
02B4 8E                   ADC
02B5 16                   LM
02B6 54                   LR     RX1,A
                 *CONTENTS OF R2, RX1 - RX5 ARE DESTROYED
02B7 73          DISPL    LIS    3
02B8 57                   LR     RX4,A
02B9 63                   LISU   P0RU
02BA 6D                   LISL   P0RL
02BB 4C                   LR     A,S
02BC 58                   LR     RX5,A
02BD 74                   LIS    RX1
02BE 0B                   LR     IS,A
02BF 78          DISP1    LIS    8
02C0 53                   LR     R2,A
02C1 4D                   LR     A,I
02C2 54                   LR     RX1,A
02C3 2101        DISP2    NI     01
02C5 15                   SL     4
02C6 E8                   XS     RX5
02C7 B0                   OUTS   P0
02C8 B0                   OUTS   P0
02C9 0F                   LR     DC,Q       DELAY
02CA 1F                   INC
02CB B0                   OUTS   P0
02CC B0                   OUTS   P0
02CD 21FE                 NI     H'FE'
02CF B0                   OUTS   P0
02D0 44                   LR     A,RX1
02D1 12                   SR     1
02D2 54                   LR     RX1,A
```

```
02D3 33              0862            DS    R2
02D4 94EE    02C3    0863            BNZ   DISP2
02D6 2805EA 05EA     0864            PI    DBNCS
02D9 37              0865            DS    RX4
02DA 94E4    02BF    0866            BNZ   DISP1
02DC 48              0867            LR    A,RX5
02DD B0              0868            OUTS  P0
02DE 290D45 0D45     0869            JMP   DEBNCE
                     0870  *
                     0871            EJECT
                     0872  *
                     0873  *
                     0874  ****************************************
                     0875  * SUBROUTINES
                     0876  ****************************************
                     0877  *
                     0878  *SUBROUTINE PUSH
                     0879  *
                     0880  *
                     0881  *
02E1 66              0882  PUSH      LISU  PUSHU
02E2 6B              0883            LISL  PUSHL
02E3 03              0884            LR    A,QL
02E4 5E              0885            LR    D,A
02E5 02              0886            LR    A,QU
02E6 5E              0887            LR    D,A
02E7 01              0888            LR    A,KL
02E8 5E              0889            LR    D,A
02E9 00              0890            LR    A,KU
02EA 5C              0891            LR    S,A
02EB 1C              0892            POP
                     0893  *
                     0894  * SUBROUTINE PULL
                     0895  *
02EC 66              0896  PULL      LISU  PUSHU
02ED 6B              0897            LISL  PUSHL
02EE 4E              0898            LR    A,D
02EF 07              0899            LR    QL,A
02F0 4E              0900            LR    A,D
02F1 06              0901            LR    QU,A
02F2 4E              0902            LR    A,D
02F3 05              0903            LR    KL,A
02F4 4C              0904            LR    A,S
02F5 04              0905            LR    KU,A
02F6 1C              0906            POP
                     0907  *
                     0908            EJECT
                     0909  *
                     0910  * WAIT SUBROUTINE
                     0911  * THIS ROUTINE DESTROYS THE CONTENTS OF K AND Q
                     0912  *
02F7 08              0913  WAITS     LR    K,P
02F8 63              0914            LISU  WATRU
02F9 6F              0915            LISL  WATRL
02FA 44              0916            LR    A,RX1
02FB 5C              0917            LR    S,A
02FC 2A0303 0303     0918            DCI   WAIT
02FF 0E              0919            LR    Q,DC
0300 290D45 0D45     0920  WAITP     JMP   DEBNCE
                     0921  *
0303 63              0922  WAIT      LISU  WATRU
0304 6F              0923            LISL  WATRL
0305 3C              0924            DS    S
0306 94F9    0300    0925            BNZ   WAITP
0308 2805EA 05EA     0926            PI    DBNCS
030B 0C              0927            PK
                     0928  *
```

```
                  0929          EJECT
                  0930  *
                  0931  *SUBROUTINE TO CONVERT BINARY NO.
                  0932  *STORED IN BINR TO A BCD NO. X5
                  0933  *RX4 = 4TH DIGIT (MSD), RX2 = 3RD & 2ND.
                  0934  *RX1 = 1ST DIGIT (LSD)
                  0935  *RX3 USED AS TEMPORARY REG
                  0936  *NO OTHER SUBROUTINE IS CALLED
                  0937  *
030C 48           0938  BCD8     LR    A.BINR
030D 14           0939          SR    4
030E 2509         0940          CI    H'09'
0310 8103   0314  0941          BP    *+4
0312 2406         0942          AI    6
0314 55           0943          LR    RX2.A      UPPER NIBBLE IN RX2
0315 73           0944          LIS   3
0316 57           0945          LR    RX4.A
0317 45           0946  DBL     LR    A.RX2
0318 2466         0947          AI    H'66'
031A D5           0948          ASD   RX2
031B 55           0949          LR    RX2.A      DOUBLE THE NUMBER
031C 70           0950          CLR              IN RX2
031D 19           0951          LNK
031E 56           0952          LR    RX3.A      CARRY IN RX3
031F 37           0953          DS    Rx4
0320 94F6   0317  0954          BNZ   DBL
0322 48           0955          LR    A.BINR
0323 2101         0956          NI    H'01'
0325 8402   0328  0957          BZ    *+3
0327 75           0958          LIS   5
0328 54           0959          LR    RX1.A      1ST DIGIT IN RX1
0329 48           0960          LR    A.BINR
032A 210F         0961          NI    H'0F'
032C 12           0962          SR    1
032D 2466         0963          AI    H'66'
032F D5           0964          ASD   RX2
0330 55           0965          LR    RX2.A      2ND. 3RD DIGIT IN RX2
0331 46           0966          LR    A.RX3
0332 19           0967          LNK
0333 57           0968          LR    RX4.A      4TH DIGIT IN RX4
0334 1C           0969          POP
                  0970  *
                  0971  *SUBROUTINE TO CONVERT 14 BIT BINARY NO.
                  0972  *INTO 4 DIGIT BCD NO. (9999 IS MAXIMUM)
                  0973  *REGISTERS USED - R1, R2, RX1 - RX5
                  0974  *NO OTHER SUBROUTINE IS CALLED
                  0975  *
            0008  0976  BINU     EQU   RX5
            0007  0977  BINL     EQU   RX4
            0006  0978  BCDU     EQU   RX3
            0005  0979  BCDL     EQU   RX2
0335 72           0980  BCD14    LIS   2
0336 [illegible]  0981          LR    R2.A
0337 [illegible]  0982          LIS   6
0338 54           0983          LR    RX1.A
0339 70           0984          CLR
033A 55           0985          LR    BCDL.A
033B 56           0986          LR    BCDU.A
033C 48           0987          LR    A.BINU
033D 13           0988          SL    1
033E 13           0989          SL    1
033F 841A   035A  0990          BZ    B14P1      BR IF ONLY 8 BITS
0341 58           0991          LR    BINU.A
0342 45           0992  BCD14L   LR    A.BCDL     DOUBLE BCD NO.
0343 2466         0993          AI    H'66'
0345 D5           0994          ASD   BCDL
0346 55           0995          LR    BCDL.A
0347 1E           0996          LR    J.W        STORE CARRY
```

```
0348 46                0997          LR    A,BCDU
0349 2466              0998          AI    H'66'
034B D6                0999          ASD   BCDU
034C 1D                1000          LR    W,J          ADD CARRY
034D 19                1004          LNK
034E 56                1002          LR    BCDU,A
034F 48                1003          LR    A,BINU       SHIFT BINU
0350 C8                1004          AS    BINU
0351 58                1005          LR    BINU,A
0352 9204    0357      1006          BNC   BCD14P
0354 45                1007          LR    A,BCDL
0355 1F                1008          INC
0356 55                1009          LR    BCDL,A
0357 34                1010  BCD14P   DS    RX1
0358 94E9    0342      1011          BNZ   BCD14L
035A 47                1012  B14P1   LR    A,BINL
035B 53                1013          LR    BINU,A
035C 78                1014          LIS   8
035D 54                1015          LR    RX1,A
035E 33                1016          DS    R2
035F 94E2    0342      1017          BNZ   BCD14L
0361 1C                1018          POP
                       1019  *
                       1020          EJECT
                       1021  *
                       1022  *EAROM SUBROUTINES
                       1023  *       EROMRS --- READ FROM EAROM
                       1024  *       EROMWS --- WRITE INTO EAROM
                       1025  *
                       1026  *RX4 = ADDRESS
                       1027  *R1 = DATA UPPER (6 BITS)
                       1028  *R0 = DATA LOWER (8 BITS)
                       1029  *REGISTERS USED R2, RX1 - RX5
                       1030  *
                       1031  *
                       1032  *SUBROUTINE CALLED BCD14
                       1033  *
                       1034  * SET WRITF = 1 IF IT IS WRITE
0362 78                1035  EROMWS   LIS   H'8'
0363 E0                1036          XS    R2FLG
0364 50                1037          LR    R2FLG,A
                       1038  *
0365 08                1039  EROMRS   LR    K,P
0366 63                1040          LISU  P0RU         SET UP ADDRESS FOR
0367 6D                1041          LISL  P0RL         EAROM LATCH
0368 4C                1042          LR    A,S
0369 2220              1043          OI    EROM
036B B0                1044          OUTS  P0
036C 42                1045          LR    A,R1
036D 13                1046          SL    1
036E 13                1047          SL    1
036F 52                1048          LR    R1,A
                       1049  *
                       1050  *ROUTINE TO SEND OUT ADDRESS TO EAROM
                       1051  *
0370 70                1052  ADDRS    CLR
0371 58                1053          LR    BINU,A
0372 280335  0335      1054          PI    BCD14
0375 72                1055          LIS   2
0376 53                1056          LR    R2,A
0377 45                1057          LR    A,BCDL
0378 14                1058          SR    4
0379 56                1059          LR    RX3,A
037A 45                1060          LR    A,BCDL
037B 210F              1061          NI    H'0F'
037D 55                1062          LR    RX2,A
037E 79                1063          LIS   9
037F 54                1064          LR    RX1,A
```

```
0380 71                1065            LIS   1
0381 B4                1066            OUTS  P4          CLOCK = 1 = LOW
0382 0F                1067            LR    DC,Q        DELAY
0383 0F                1068            LR    DC,Q
0384 09                1069            NOP
0385 70                1070            CLR               CONTROL LINES = STANDBY
0386 9004    038B      1071            BR    ADDR1P+1
0388 0F                1072  ADDRL     LR    DC,Q        DELAY
0389 0F                1073            LR    DC,Q
038A 48                1074  ADDR1P    LR    A,RX5
038B B4                1075            OUTS  P4          CLOCK = 0 = HIGH FOR 18 CYC
038C 7C                1076            LIS   H'C'        DATA = 0 = LOW
038D 36                1077            DS    RX3
038E 9203    0392      1078            BNC   *+4         BR IF -1
0390 2210              1079            OI    H'10'       DATA = 1 = HIGH
0392 B4                1080            OUTS  P4          OUTPUT DATA
0393 58                1081            LR    RX5,A
0394 1F                1082            INC
0395 B4                1083            OUTS  P4          CLOCK = 1 = LOW FOR
0396 34                1084            DS    RX1         18 CYCLES - NORMAL LOOP
0397 81F0    0388      1085            BP    ADDRL       18.5 CYCLES - IF RX1 = -1
0399 45                1086            LR    A,RX2       18 CYCLES IF LAST CYCLE
039A 56                1087            LR    RX3,A
039B 79                1088            LIS   D'9'
039C 54                1089            LR    RX1,A
039D 33                1090            DS    R2
039E 94EB    038A      1091            BNZ   ADDR1P
03A0 48                1092            LR    A,RX5
03A1 B4                1093            OUTS  P4          CLOCK = 0 = HIGH
03A2 70                1094            CLR               CONTROL = STBY
03A3 B4                1095            OUTS  P4
03A4 40                1096            LR    A,R2FLG
03A5 15                1097            SL    4
03A6 9166    040D      1098            BM    WRITS       BR IF WRITE
                       1099  *
                       1100  *READ THE ADDRESSED LOCATION
                       1101  *
03A8 8E                1102  READP     ADC               DELAY
03A9 71                1103            LIS   1
03AA B4                1104            OUTS  P4          CLOCK = 1 = LOW
03AB 0F                1105            LR    DC,Q        STBY MODE
03AC 0F                1106            LR    DC,Q
03AD 0F                1107            LR    DC,Q
03AE 70                1108            CLR
03AF B4                1109            OUTS  P4          CLOCK = 0 = HIGH
03B0 72                1110            LIS   2           FOR 18 CYCLES
03B1 B4                1111            OUTS  P4          CONTROL = READ
03B2 0F                1112            LR    DC,Q
03B3 0F                1113            LR    DC,Q
03B4 73                1114            LIS   3
03B5 B4                1115            OUTS  P4          CLOCK = 1 = LOW
03B6 0F                1116            LR    DC,Q        FOR 17 CYCLES
03B7 0F                1117            LR    DC,Q
03B8 0F                1118            LR    DC,Q
03B9 72                1119            LIS   2
03BA B4                1120            OUTS  P4
03BB 70                1121            CLR
03BC B4                1122            OUTS  P4          CONTROL = STBY
                       1123  *
                       1124  *SHIFT DATA OUT OF EAROM
                       1125  *
03BD 7E                1126  SDTP      LIS   14          NO. OF BITS
03BE 53                1127            LR    R2,A
03BF 76                1128            LIS   6
03C0 54                1129            LR    RX1,A
03C1 70                1130            CLR
03C2 51                1131            LR    R0,A
03C3 2031              1132            LI    H'31'
03C5 B4                1133            OUTS  P4          CLOCK = 1 = LOW
```

```
03C6 0F            1134            LR    DC,Q
03C7 0F            1135            LR    DC,Q
03C8 203A          1136            LI    H'3A'
03CA 58            1137            LR    RX5,A
03CB 2030          1138            LI    H'30'
03CD B4            1139            OUTS  P4        CLOCK = 0 = HIGH
03CE 203A          1140            LI    H'3A'
03D0 B4            1141            OUTS  P4        CONTROL = SHIFT DATA
03D1 2B            1142            NOP
03D2 900B    03DE  1143            BR    SDT4P
03D4 48            1144  SDT1P     LR    A,RX5
03D5 B4            1145            OUTS  P4        CLOCK = 0 = HIGH
03D6 41            1146            LR    A,R0
03D7 34            1147            DS    RX1
03D8 9402    03DB  1148            BNZ   *+3
03DA 52            1149            LR    R1,A
03DB 13            1150            SL    1
03DC 51            1151            LR    R0,A
03DD 8E            1152            ADC             DELAY
03DE 203B          1153  SDT4P     LI    H'3B'
03E0 B4            1154            OUTS  P4        CLOCK = 1 = LOW
03E1 A5            1155            INS   P5
03E2 2101          1156            NI    H'01'
03E4 E1            1157            XS    R0
03E5 51            1158            LR    R0,A
03E6 33            1159            DS    R2
03E7 94EC    03D4  1160            BNZ   SDT1P
03E9 48            1161            LR    A,RX5
03EA B4            1162            OUTS  P4        CLOCK = 0 = HIGH
03EB 2030          1163            LI    H'30'
03ED B4            1164            OUTS  P4
03EE 70            1165            CLR
03EF B4            1166            OUTS  P4        STANDBY
                   1167  *
03F0 40            1168            LR    A,R2FLG
03F1 15            1169            SL    4
03F2 810F    0402  1170            BP    EARM2P    BR IF IT WAS READ
03F4 42            1171            LR    A,R1      COMPARE R0,R1(DATA READ
03F5 13            1172            SL    1         JUST NOW) WITH PREVIOUSLY
03F6 13            1173            SL    1         SAVED DATA
03F7 E6            1174            XS    RX3
03F8 9405    03FE  1175            BNZ   EARM1P
03FA 41            1176            LR    A,R0
03FB E5            1177            XS    RX2
03FC 9405    0402  1178            BZ    EARM2P
03FE 4A            1179  EARM1P    LR    A,RFLG    PSTF3 = 1 IF
03FF 2208          1180            OI    H'08'     R0, R1 DO NOT MATCH
0401 5A            1181            LR    RFLG,A
0402 40            1182  EARM2P    LR    A,R2FLG
0403 21F7          1183            NI    H'F7'     WRITE = 0
0405 52            1184            LR    R2FLG,A
0406 63            1185            LISU  P0RU
0407 6D            1186            LISL  P0RL
0408 4C            1187            LR    A,S
0409 B0            1188            OUTS  P0
040A 70            1189            CLR
040B B4            1190            OUTS  P4
040C 0C            1191            PK
                   1192  *
                   1193  *
                   1194  *WRITE ROUTINE
                   1195  *
                   1196  *ACCEPT DATA
                   1197  *
040D 7E            1198  WRITS     LIS   H'E'      RX5 = CONTROL LINES
040E 58            1199            LR    RX5,A     = ACCEPT DATA
040F 71            1200            LIS   1
```

```
0410 B4          1201          OUTS  P4        CLOCK = 1 = LOW
0411 72          1202          LIS   2         STBY MODE
0412 53          1203          LR    R2,A
0413 75          1204          LIS   5
0414 54          1205          LR    RX1,A
0415 42          1206          LR    A,R1      SAVE R1 IN RX3
0416 56          1207          LR    RX3,A
0417 41          1208          LR    A,R0      SAVE R0 IN RX2
0418 55          1209          LR    RX2,A
0419 2B          1210          NOP
041A 70          1211          CLR
041B 9004   0420 1212          BR    ADT1P+1
041D 0F          1213  ADTL    LR    DC,Q      DELAY
041E 0F          1214          LR    DC,Q
041F 48          1215  ADT1P   LR    A,RX5
0420 B4          1216          OUTS  P4        CLOCK = 0 = HIGH FOR 19.5 C
0421 42          1217          LR    A,R1
0422 C2          1218          AS    R1
0423 52          1219          LR    R1,A
0424 7E          1220          LIS   H'E'
0425 9203   0429 1221          BNC   *+4
0427 2210        1222          OI    H'10'
0429 B4          1223          OUTS  P4
042A 58          1224          LR    RX5,A
042B 1F          1225          INC
042C B4          1226          OUTS  P4        CLOCK = 1 = LOW FOR
042D 34          1227          DS    RX1       18 CYCLES - NORMAL 100P
042E 81EE   041D 1228          BP    ADTL      18.5 CYCLES - IF RX1 = -1
0430 41          1229          LR    A,R0      18 CYCLES IF LAST CYCLE
0431 52          1230          LR    R1,A
0432 77          1231          LIS   7
0433 54          1232          LR    RX1,A
0434 33          1233          DS    R2
0435 [illegible]E9   041F 1234 BNZ   ADT1P
0437 [illegible] 1235          LR    A,RX5
0438 [illegible] 1236          OUTS  P4        CLOCK = 0 = HIGH
0439 [illegible] 1237          CLR
043A [illegible] 1238          OUTS  P4        STBY MODE
                 1239  *
                 1240  *ERASE AND WRITE
                 1241  *
043B 73          1242          LIS   3
043C 53          1243          LR    R2,A
043D 70          1244          CLR             ERASE & WRITE TIME
043E 54          1245          LR    RX1,A     =256 CLOCKS
043F 74          1246          LIS   4         CONTROL = ERASE
0440 58          1247          LR    RX5,A
0441 33          1248          DS    R2        DELAY
0442 71          1249          LIS   1
0443 B4          1250          OUTS  P4        CLOCK = 1 = LOW
0444 0F          1251          LR    DC,Q
0445 0F          1252          LR    DC,Q
0446 2B          1253          NOP
0447 70          1254          CLR
0448 9004   044D 1255          BR    ERW1P+1
044A 0F          1256  ERWL    LR    DC,Q
044B 0F          1257          LR    DC,Q
044C 48          1258  ERW1P   LR    A,RX5
044D B4          1259          OUTS  P4        CLOCK = 0 = HIGH
044E 8E          1260          ADC             DELAY
044F 2B          1261          NOP
0450 48          1262  ERW2P   LR    A,RX5
0451 B4          1263          OUTS  P4        SETUP CONTROL LINES
0452 0F          1264          LR    DC,Q
0453 1F          1265          INC
0454 B4          1266          OUTS  P4        CLOCK = 1 = LOW
0455 34          1267          DS    RX1       FOR 18 CYCLES
```

```
0456 94F3   044A 1268          BNZ   ERWL
0458 48          1269          LR    A,RX5
0459 52          1270          LR    R1,A
045A 76          1271          LIS   6
045B 58          1272          LR    RX5,A
045C 42          1273          LR    A,R1
045D 8E          1274          ADC
045E 33          1275          DS    P2
045F B4          1276          OUTS  P4        CLOCK = 0 = HIGH
0460 94EF   0450 1277          BNZ   ERW2P
0462 70          1278          CLR
0463 B4          1279          OUTS  P4
0464 2903A9 03A9 1280          JMP   PEADP+1
                 1281  *
                 1282          EJECT
                 1283  *
                 1284  *SUBROUTINE TO WRITE PRICE. LINMR INTO EAROM
                 1285  *SUBROUTINES CALLED - PUSH, PULL, EROMWS
                 1286  *
0467 08          1287  WRITPS   LR    K,P
0468 2802E1 02E1 1288          PI    PUSH
046B 4A          1289          LR    A,RFLG
046C 21BF        1290          NI    H'BF'     PRICF = 0
046E 5A          1291          LR    RFLG,A
046F 67          1292          LISU  SELRU
0470 6B          1293          LISL  SELRL
0471 70          1294          CLR
0472 CE          1295          AS    D
0473 9410   0484 1296          BNZ   WRT0P
0475 2032        1297          LI    50        MEMORY LOCATION OF
0477 57          1298          LR    RX4,A     FREE VEND MODE DATA
0478 4C          1299          LR    A,S
0479 2532        1300          CI    50
047B 8403   047F 1301          BZ    *+4
047D 70          1302          CLR
047E 5C          1303          LR    S,A
047F 67          1304          LISU  FVMU
0480 68          1305          LISL  FVML
0481 5C          1306          LR    S,A
0482 900A   048D 1307          BR    WRT1P
0484 2564        1308  WRT0P    CI    100
0486 940B   0492 1309          BNZ   WRT2P
0488 70          1310          CLR               MEMORY LOCATION OF
0489 57          1311          LR    RX4,A     'NO. OF SELECT LINES' DATA
048A 4C          1312          LR    A,S
048B 6C          1313          LISL  SELRL+1
048C 5C          1314          LR    S,A
048D 51          1315  WRT1P    LR    R0,A
048E 70          1316          CLR
048F 52          1317          LR    R1,A
0490 9008   0499 1318          BR    WRT3P
0492 57          1319  WRT2P    LR    RX4,A
0493 4C          1320          LR    A,S       ACC = PRICE
0494 51          1321          LR    R0,A
0495 63          1322          LISU  DISDU     STORE RANDOM NO. IN
0496 6F          1323          LISL  DISDL     UPPER 6 BITS OF PRICE
0497 4C          1324          LR    A,S
0498 52          1325          LR    R1,A
0499 2805EA 05EA 1326  WRT3P    PI    DBNCS
049C 2802362 0362 1327          PI    EROMWS
049F 2802EC 02EC 1328          PI    PULL
04A2 00          1329          PK
                 1330  *
                 1331          EJECT
                 1332  *
                 1333  *SUBROUTINE TO RESET PRICE SETTING MODE
                 1334  *CONTROL RETURNED TO CALLING ROUTINE IF NOTHING
                 1335  *HAS TO BE WRITTEN INTO EAROM
```

```
                  1336  *OTHERWISE IT GOES TO "DEBNCE"
                  1337  *
04A3 40           1338  RPSTMS   LR     A,R2FLG
04A4 13           1339           SL     1
04A5 814A   04F0  1340           BP     RPST4P
04A7 63           1341           LISU   P0RU      TURN OFF DISPLAY
04A8 6D           1342           LISL   P0RL
04A9 4C           1343           LR     A,S
04AA 2230         1344           OI     DGNM
04AC B0           1345           OUTS   P0
04AD 73           1346           LIS    H'3'
04AE B4           1347           OUTS   P4
04AF 4C           1348           LR     A,S
04B0 B0           1349           OUTS   P0
04B1 70           1350           CLR
04B2 B4           1351           OUTS   P4
04B3 64           1352           LISU   DISPLU    CLEAR DISPLAY REGS.
04B4 6F           1353           LISL   DISPLL+7
04B5 5D           1354           LR     I,A
04B6 8FFE   04B5  1355           BR7    *-1
04B8 40           1356           LR     A,R2FLG
04B9 21BF         1357           NI     H'BF'     PSTMF = 0
04BB 50           1358           LR     R2FLG,A
04BC 4A           1359           LR     A,RFLG
04BD 21C7         1360           NI     H'C7'     PSTF1, 2, 3 = 0
04BF 5A           1361           LR     RFLG,A
04C0 13           1362           SL     1
04C1 8108   04CA  1363           BP     RPST1P
04C3 280467 0467  1364           PI     WRITPS
04C6 4A           1365           LR     A,RFLG
04C7 2240         1366           OI     H'40'     PRICF = 1
04C9 5A           1367           LR     RFLG,A
04CA 67           1368  RPST1P   LISU   SELRU
04CB 6B           1369           LISL   SELRL
04CC 70           1370           CLR
04CD 5E           1371           LR     D,A
04CE 5C           1372           LR     S,A
04CF 67           1373           LISU   FVMU
04D0 6B           1374           LISL   FVML
04D1 4C           1375           LR     A,S
04D2 2532         1376           CI     50
04D4 4B           1377           LR     A,R1FLG
04D5 9408   04DE  1378           BNZ    RPST2P
04D7 2408E0 08E0  1379           DCI    SCNSEL    FREE VEND MODE
04DA 2220         1380           OI     H'20'     MVPF = 1
04DC 8108   04E3  1381           BP     RPST3P
04DE 2408A4 08A4  1382  RPST2P   DCI    STBY
04E1 21DF         1383           NI     H'DF'     MVPF = 0
04E3 5B           1384  RPST3P   LR     R1FLG,A
04E4 0C           1385           LR     Q,DC
04E5 4A           1386           LR     A,RFLG    CHECK PRICF
04E6 13           1387           SL     1
04E7 8108   04F0  1388           BP     RPST4P
04E9 4A           1389           LR     A,RFLG
04EA 21BF         1390           NI     H'BF'     PRICF = 0
04EC 5A           1391           LR     RFLG,A
04ED 290D45 0D45  1392           JMP    DEBNCE
04F0 1C           1393  RPST4P   POP
                  1394  *
                  1395           EJECT
                  1396  *
                  1397  ************
                  1398  * PAYOUT SUBROUTINES
                  1399  ************
                  1400  *
                  1401  * ISAR=TL4R:ACCEPT A DOLLAR INTO CASH BOX
                  1402  * ISAR=0'64':PAY A DOLLAR COIN
                  1403  * ISAR=0'65':PAY A QUARTER
```

```
                    * ISAR=0'66':PAY A DIME
                    * ISAR=0'67':PAY A NICKEL
                    * ISAR SAVED IN PTYPE AND RESTORED AT THE END
                    *
04F1 0A             PAYONS   LR     A,IS
04F2 65                      LISU   PTRU
04F3 6E                      LISL   PTRL+2
04F4 5C                      LR     S,A
04F5 08                      LR     K,P
04F6 2802E1 02E1             PI     PUSH
04F9 2805EA 05EA             PI     DBNCS
04FC 4A                      LR     A,RFLG     CHECK PRUNF
04FD 15                      SL     4
04FE 913C   053B             BM     CSWP
0500 78                      LIS    H'8'
0501 EA                      XS     RFLG
0502 5A                      LR     RFLG,A
0503 65                      LISU   PTRU       CHECK PTYPE
0504 6E                      LISL   PTRL+2
0505 4C                      LR     A,S
0506 2520                    CI     TL4R
0508 8413   051C             BZ     PDIM       BR IF ACCEPT $
050A 2536                    CI     C1R-1
050C 9127   0534             BM     PNKL
050E 840D   051C             BZ     PDIM
                    *
                    *
0510 63             PQR      LISU   P5RU       TURN REVERSE RELAY ON
0511 6E                      LISL   P5RL
0512 4C                      LR     A,S
0513 2204                    OI     REVRM
0515 B5                      OUTS   P5
0516 5C                      LR     S,A
0517 7F                      LIS    PT1K       RELAY ON TIME
0518 54                      LR     RX1,A
0519 2802F7 02F7             PI     WAITS
                    *
051C 63             PDIM     LISU   P5RU       TURN SELECTOR MOTOR ON
051D 6E                      LISL   P5RL
051E 4C                      LR     A,S
051F 2240                    OI     SLCM
0521 B5                      OUTS   P5
0522 5C                      LR     S,A
0523 2332                    LI     PT3K       SELECTOR MOTOR ON TIME
0525 54                      LR     RX1,A
0526 2802F7 02F7             PI     WAITS
                    *
0529 65                      LISU   PTRU
052A 6E                      LISL   PTRL+2
052B 4C                      LR     A,S
052C 2534                    CI     C1R-3
052E 8464   0593             BZ     POF1P      BR IF $ PAYOUT
0530 2520                    CI     TL4R
0532 8460   0593             BZ     POF1P      BR IF ACCEPT $
                    *
                    *
0534 63             PNKL     LISU   P5RU       TURN PAYOUT MOTOR ON
0535 6E                      LISL   P5RL
0536 4C                      LR     A,S
0537 2220                    OI     PMOTM
0539 B5                      OUTS   P5
053A 5C                      LR     S,A
                    *
053B 65             CSWP     LISU   PTRU       SET PTR
053C 6C                      LISL   PTRL
053D 70                      CLR
053E 5D                      LR     1,A
053F 200A                    LI     PMKL
```

```
0541 5C                1472            LR    S,A
0542 2A0549 0549       1473            DCI   CYSW
0545 0E                1474            LR    Q,DC
0546 290D45 0D45       1475  CYSW0P    JMP   DEBNCE
                       1476  *
0549 65                1477  CYSW      LISU  PTRU
054A 6D                1478            LISL  PTRL+1
054B 3C                1479            DS    S
054C 9413   0560       1480            BNZ   CYSW1P
054E 200A              1481            LI    PMKL
0550 5E                1482            LR    D,A
0551 3C                1483            DS    S
0552 940D   0560       1484            BNZ   CYSW1P
                       1485  * TIMED OUT
0554 62                1486            LISU  INRU
0555 68                1487            LISL  INRL-7     CHECK CYCLE SWITCH
0556 70                1488            CLR
0557 CC                1489            AS    S
0558 9110   0569       1490            BM    CYSW2P     BR IF CYCLE SW ON
055A 4A                1491            LR    A,RFLG     SET SDNF = 1
055B 2210              1492            OI    H'10'
055D 5A                1493            LR    RFLG,A
055E 9034   0593       1494            BR    POF1P
0560 70                1495  CYSW1P    CLR
0561 C1                1496            AS    R0
0562 81E3   0546       1497            BP    CYSW0P     BR IF NO CHANGE
0564 62                1498            LISU  INRU
0565 68                1499            LISL  INRL-7
0566 5D                1500            XS    S
0567 71D3   053B       1501            BM    CSWP       BR IF CYSW OFF
                       1502  *
0569 2802EC 02EC       1503  CYSW2P    PI    PULL
056C 65                1504            LISU  PTRU
056D 6E                1505            LISL  PTRL+2
056E 4C                1506            LR    A,S
056F 0C                1507            LR    IS,A
0570 2805EA 05EA       1508            PI    DBNCS
0573 0C                1509            PK
                       1510  *
                       1511            EJECT
                       1512  *
0574 4A                1513  PAYOFS    LR    A,RFLG
0575 15                1514            SL    4
0576 9102   0579       1515            BM    *+3
0578 1C                1516            POP              RETURN IF PAYOUT ALREADY OF
0579 0A                1517            LR    A,IS
057A 65                1518            LISU  PTRU
057B 6E                1519            LISL  PTRL+2
057C 5C                1520            LR    S,A
057D 08                1521            LR    K,P
057E 2802E1 02E1       1522            PI    PUSH
                       1523  *
                       1524  * COAST ANGLE COMPENSATION
                       1525  *
0581 65                1526            LISU  PTRU
0582 6C                1527            LISL  PTRL
0583 2000              1528            LI    COMP1K
0585 CC                1529            AS    S
0586 74                1530            LIS   4
0587 9007   058F       1531            BR    *+8
0589 2500              1532            CI    COMP2K
058B 8103   058F       1533            BP    POF0P
058D 2000              1534            LI    COMP3K
058F 54                1535  POF0P     LR    RX1,A
0590 2802F7 02F7       1536            PI    WAITS
                       1537  *
0593 2805EA 05EA       1538  POF1P     PI    DBNCS
0596 63                1539            LISU  P5RU       TURN PAYOUT OF SELECTOR MOT
```

```
0597 6E                1540          LISL  P5RL
0598 4C                1541          LR    A,S
0599 219F              1542          NI    H'FF'-MOTM
059B B5                1543          OUTS  P5
059C 5C                1544          LR    S,A
059D 2078              1545          LI    PT4K       SELECTOR MOTOR OFF TIME
059F 54                1546          LR    RX1,A
05A0 2802F7 02F7       1547          PI    WAITS
05A3 63                1548          LISU  P5RU       TURN REVERSE RELAY OFF
05A4 6E                1549          LISL  P5RL
05A5 4C                1550          LR    A,S
05A6 21FB              1551          NI    H'FF'-REVRM
05A8 B5                1552          OUTS  P5
05A9 5C                1553          LR    S,A
05AA 7F                1554          LIS   PT2K       RELAY OFF TIME
05AB 54                1555          LR    RX1,A
05AC 2802F7 02F7       1556          PI    WAITS
05AF 4A                1557          LR    A,RFLG
05B0 21F7              1558          NI    H'F7'      PRUNF = 0
05B2 5A                1559          LR    RFLG,A
05B3 2110              1560          NI    H'10'
05B5 84B3    0569      1561          BZ    CYSW2P
05B7 290B4D 0B4D       1562          JMP   PAY9P
                       1563  *
                       1564          EJECT
                       1565  *
                       1566  * SUBROUTINE TO COMPUTE NO. OF
                       1567  * DOLLAR COINS TO BE RETURNED AS CHANGE
                       1568  *
05BA 70                1569  CHGDS   CLR
05BB 54                1570          LR    RX1,A
05BC 66                1571          LISU  C1RU
05BD 6C                1572          LISL  C1RL-3
05BE 4C                1573          LR    A,S
05BF 55                1574          LR    RX2,A
05C0 64                1575          LISU  CHGRU
05C1 6A                1576          LISL  CHGRL
05C2 35                1577  CHGD1P  DS    RX2
05C3 910C    05D0      1578          BM    CHGD2P
05C5 20EC              1579          LI    -20
05C7 CC                1580          AS    S
05C8 9207    05D0      1581          BNC   CHGD2P
05CA 5C                1582          LR    S,A
05CB 44                1583          LR    A,RX1
05CC 1F                1584          INC
05CD 54                1585          LR    RX1,A
05CE 90F3    05C2      1586          BR    CHGD1P
05D0 1C                1587  CHGD2P  POP
                       1588  *
                       1589          EJECT
                       1590  *
                       1591  * SUBROUTINE TO TRANSFER $ CHANGE REGISTER TO
                       1592  * $ COIN REGISTER
                       1593  *
05D1 66                1594  TRFRS   LISU  C1RU
05D2 6C                1595          LISL  C1RL-3
05D3 4C                1596          LR    A,S
05D4 55                1597          LR    RX2,A
05D5 44                1598          LR    A,RX1
05D6 5C                1599          LR    S,A        C20R = RX1
05D7 18                1600          COM
05D8 1F                1601          INC
05D9 C5                1602          AS    RX2
05DA 64                1603          LISU  TL4RU      TL4R = C20R-RX1
05DB 68                1604          LISL  TL4RL
05DC 5C                1605          LR    S,A
05DD 1C                1606          POP
                       1607  *
```

```
                  1608            EJECT
                  1609   *
                  1610   * SUBROUTINE TO TURN OFF VEND
                  1611   *
05DE 40           1612   VNDOFS   LR     A,R2FLG
05DF 21F3         1613            NI     H'F3'      VENDF,VENDF2 = 0
05E1 50           1614            LR     R2FLG,A
05E2 63           1615            LISU   P5RU
05E3 6E           1616            LISL   P5RL
05E4 4C           1617            LR     A,S
05E5 21F7         1618            NI     H'FF'-VENDM
05E7 5C           1619            LR     S,A
05E8 B5           1620            OUTS   P5
05E9 1C           1621            POP
                  1622   *
                  1623            EJECT
                  1624   *
                  1625   *
                  1626   * SUBROUTINE TO DEBOUNCE INPUTS
                  1627   *
05EA 0A           1628   DBNCS    LR     A,IS       SAVE ISAR
05EB 59           1629            LR     9,A
05EC 1A           1630            DI
05ED 40           1631            LR     A,R2FLG
05EE 15           1632            SL     4
05EF 9108   05F8  1633            BM     DBNC1P
05F1 13           1634            SL     1
05F2 8105   05F8  1635            BP     DBNC1P
05F4 A6           1636            INS    P6
05F5 64           1637            LISU   VNDU
05F6 6B           1638            LISL   VNDL
05F7 5C           1639            LR     S,A
05F8 63           1640   DBNC1P   LISU   P0RU
05F9 6D           1641            LISL   P0RL
05FA 4C           1642            LR     A,S
05FB 2222         1643            OI     SWENM      ENABLE PRICE SETTING SWITCH
05FD B0           1644            OUTS   P0         ON PORT 4
05FE 62           1645            LISU   INRU       DEBOUNCE P0
05FF 68           1646            LISL   INRL-7
0600 A0           1647            INS    P0
0601 ED           1648            XS     I
0602 FC           1649            NS     S
0603 5C           1650            LR     S,A
0604 6C           1651            LISL   INRL-3     DEBOUNCE P4 - SWITCHES
0605 A4           1652            INS    P4
0606 ED           1653            XS     I
0607 FC           1654            NS     S
0608 5C           1655            LR     S,A
0609 63           1656            LISU   P0RU       ENABLE SELECT INPUTS
060A 6D           1657            LISL   P0RL       ON PORT 4
060B 4C           1658            LR     A,S
060C 2232         1659            OI     SLENM
060E B0           1660            OUTS   P0
060F 62           1661            LISU   INRU       DEBOUNCE P1
0610 6A           1662            LISL   INRL-5
0611 A1           1663            INS    P1
0612 ED           1664            XS     I
0613 FC           1665            NS     S
0614 5C           1666            LR     S,A
0615 6E           1667            LISL   INRL-1     DEBOUNCE P4 - SELECT
0616 A4           1668            INS    P4
0617 ED           1669            XS     I
0618 FC           1670            NS     S
0619 5C           1671            LR     S,A
061A 40           1672            LR     A,R2FLG    TEST VENDF2,VENDF
061B 15           1673            SL     4
061C 9123   0640  1674            BM     DBNC3P
061E 13           1675            SL     1
```

```
061F 2151   0671 1676          BP    DBNC8P    BR IF VENDF = 0
0621 A6          1677          INS   P6        VENDF = 1,VENDF2 = 0
0622 64          1678          LISU  VNDU      FILTER VEND INPUT
0623 6B          1679          LISL  VNDL
0624 EC          1680          XS    S
0625 9128   064E 1681          BM    DBNC4P    BR IF NO MATCH
0627 EC          1682          XS    S
0628 9125   064E 1683          BM    DBNC4P    BR IF VEND-IN INACTIVE
                 1684  *
                 1685  * VEND INPUT CHANGED FROM INACTIVE(1) TO ACTIVE(0)
062A 40          1686  DBNC2P  LR    A,R2FLG
062B 2208        1687          OI    H'08'     VENDF2 = 1
062D 50          1688          LR    R2FLG,A
062E 20C8        1689          LI    200       INITIALIZE TIMER
0630 B7          1690          OUTS  7
0631 67          1691          LISU  SELRU     SELIR = SELR
0632 6B          1692          LISL  SELRL
0633 4C          1693          LR    A,S
0634 6F          1694          LISL  SELRL+4
0635 5C          1695          LR    S,A
0636 64          1696          LISU  VNDU      LOAD VNDR WITH
0637 6B          1697          LISL  VNDL      DELAY CONST.
0638 2078        1698          LI    120       TIME = 600 MICRO SECS.
063A 5C          1699          LR    S,A
063B 3C          1700          DS    S
063C 94FE   063B 1701          BNZ   *-1
063E 900F   064E 1702          BR    DBNC4P
                 1703  * VENDF2 = 1
0640 62          1704  DBNC3P  LISU  INRU      CHECK VEND MODE
0641 6C          1705          LISL  INRL-3
0642 4C          1706          LR    A,S
0643 2110        1707          NI    FVSWM
0645 8408   064E 1708          BZ    DBNC4P    BR IF SHORT VEND
0647 65          1709          LISU  PTRU
0648 6D          1710          LISL  PTRL+1
0649 4C          1711          LR    A,S
064A 2502        1712          CI    FVTK-2
064C 8124   0671 1713          BP    DBNC8P
                 1714  *
                 1715  * SCAN SELECT INPUTS
064E 67          1716  DBNC4P  LISU  SELRU
064F 6F          1717          LISL  SELRL+4
0650 A4          1718          INS   P4
0651 213F        1719          NI    SLCTM
0653 EC          1720          XS    S
0654 8405   065A 1721          BZ    DBNC5P
0656 EC          1722          XS    S
0657 5C          1723          LR    S,A
0658 9018   0671 1724          BR    DBNC8P
065A CC          1725  DBNC5P  AS    S
065B 9406   0662 1726          BNZ   DBNC6P
065D 40          1727          LR    A,R2FLG
065E 2202        1728          OI    H'02'     VENDF1 = 1
0660 9006   0667 1729          BR    DBNC7P
0662 6B          1730  DBNC6P  LISL  SELRL
0663 EC          1731          XS    S
0664 840C   0671 1732          BZ    DBNC8P
0666 40          1733          LR    A,R2FLG
0667 21F3        1734  DBNC7P  NI    H'F3'     VENDF,VENDF2 = 0
0669 50          1735          LR    R2FLG,A
066A 63          1736          LISU  P5RU      TURN OFF VEND
066B 6E          1737          LISL  P5RL
066C 4C          1738          LR    A,S
066D 21F7        1739          NI    H'FF'-VENDM
066F 5C          1740          LR    S,A
0670 B5          1741          OUTS  P5
0671 63          1742  DBNC8P  LISU  P0RU      RESTORE P0
0672 6D          1743          LISL  P0RL
```

```
0673 4C          1744          LR    A,S
0674 B0          1745          OUTS  P0
0675 49          1746          LR    A,9        RESTORE ISAR
0676 0B          1747          LR    IS,A
0677 1C          1748          POP
                 1749  *
                 1750          EJECT
                 1751  *
                 1752  ****************************************
                 1753  * MAIN PROGRAM
                 1754  ****************************************
                 1755  *
                 1756  *
                 1757  *PRICE SETTING MODE PROGRAM
                 1758  *
                 1759  *PRICE SETTING SWITCH IS ON
                 1760  *CHANGE THE STATE TO PRICE SETTING MODE
                 1761  *
0678 40          1762  PSTP    LR    A,R2FLG
0679 2240        1763          OI    H'40'      PSTMF = 1
067B 50          1764          LR    R2FLG,A
067C 4A          1765          LR    A,RFLG
067D 2187        1766          NI    H'87'      PSTF1, 2, 3 = 0
067F 5A          1767          LR    RFLG,A
0680 4B          1768          LR    A,R1FLG
0681 21DF        1769          NI    H'DF'      MVPF = 0
0683 5B          1770          LR    R1FLG,A
0684 67          1771          LISU  FVMU
0685 68          1772          LISL  FVML
0686 70          1773          CLR
0687 5C          1774          LR    S,A
0688 67          1775          LISU  PSTRU
0689 6E          1776          LISL  PSTRL+1
068A 20C8        1777          LI    PST2K
068C 5C          1778          LR    S,A
068D 6B          1779          LISL  SELRL
068E 20FE        1780          LI    -2
0690 5C          1781          LR    S,A
0691 2A06AD 06AD 1782          DCI   PSTM
0694 0E          1783          LR    Q,DC
0695 63          1784          LISU  DISDU
0696 6F          1785          LISL  DISDL
0697 78          1786          LIS   8
0698 5C          1787          LR    S,A
0699 64          1788          LISU  DISPLU
069A 6F          1789          LISL  DISPLL+7
069B 7C          1790          LIS   H'C'
069C 5E          1791          LR    D,A
069D 7A          1792          LIS   H'A'
069E 5E          1793          LR    D,A
069F 2805EA 05EA 1794          PI    DBNCS
06A2 42          1795          LR    A,R1
06A3 2503        1796          CI    H'03'
06A5 8104   06AA 1797          BP    *+5
06A7 230816 0816 1798          JMP   PSTMG      BR IF LINE SW ON
06AA 230733 0733 1799          JMP   PSTMR1
                 1800  *
                 1801          EJECT
                 1802  *
                 1803  *PRICE SETTING MODE
                 1804  *
06AD 4A          1805  PSTM    LR    A,RFLG
06AE 15          1806          SL    4
06AF 8114   06C4 1807          BP    PSTM2P
06B1 67          1808          LISU  PSTRU      WAITING LOOP, IF DATA WRITT
06B2 6E          1809          LISL  PSTRL+1    IN PREVIOUS WRITE OPERATION
06B3 3E          1810          DS    D          DID NOT MATCH WITH
06B4 940C   06C1 1811          BNZ   PSTM1P     DESIRED DATA
```

```
06B6 3C              1812            DS    S
06B7 9409    06C1    1813            BNZ   PSTM1P
06B9 4A              1814            LR    A,RFLG
06BA 21F7            1815            NI    H'F7'      PSTF3 = 0
06BC 5A              1816            LR    RFLG,A
06BD 63              1817            LISU  PSWU
06BE 6C              1818            LISL  PSWL+1
06BF 70              1819            CLR
06C0 5C              1820            LR    S,A
06C1 290D45  0D45    1821  PSTM1P    JMP   DEBNCE
06C4 67              1822  PSTM2P    LISU  PSTRU
06C5 6E              1823            LISL  PSTRL+1
06C6 70              1824            CLR
06C7 C2              1825            AS    R1
06C8 9409    06D2    1826            BNZ   PSTM2P1
                     1827  * SLOW/FAST TIMING LOOP
06CA 3C              1828            DS    S
06CB 94F5    06C1    1829            BNZ   PSTM1P
06CD 2028            1830            LI    PST3K
06CF 5C              1831            LR    S,A
06D0 9017    06E8    1832            BR    PSTM3P
                     1833  *
06D2 4A              1834  PSTM2P1   LR    A,RFLG
06D3 21DF            1835            NI    H'DF'      PSTF1 = 0
06D5 5A              1836            LR    RFLG,A
06D6 20C8            1837            LI    PST2K
06D8 5C              1838            LR    S,A
06D9 42              1839            LR    A,R1
06DA 2503            1840            CI    H'03'
06DC 810B    06E8    1841            BP    PSTM3P     BR IF ONLY PRICE SW CHANGED
06DE 4A              1842            LR    A,RFLG
06DF 13              1843            SL    1
06E0 9142    0723    1844            BM    PSTML1     BR IF PRICF = 1
06E2 63              1845            LISU  PSWU
06E3 6C              1846            LISL  PSWL+1
06E4 7C              1847            LIS   LNSWM
06E5 FC              1848            NS    S
06E6 844C    0733    1849            BZ    PSTMR1     BR IF ALL LINE SW OFF
06E8 205EA   05EA    1850  PSTM3P    PI    DBNCS
06EB 4A              1851            LR    A,RFLG
06EC 2110            1852            NI    H'10'
06EE 94D2    06C1    1853            BNZ   PSTM1P     BR IF PSTF2 = 1
06F0 67              1854            LISU  SELRU
06F1 6C              1855            LISL  SELRL+1
06F2 4C              1856            LR    A,S
06F3 54              1857            LR    RX1,A      RX1 = LINMR
06F4 252D            1858            CI    D'45'
06F6 9102    06F9    1859            BM    *+3
06F8 13              1860            SL    1
06F9 56              1861            LR    RX3,A      RX3 = 2* LINMR OR LINMR
06FA 63              1862            LISU  PSWU       CHECK LINE SWITCHES
06FB 6C              1863            LISL  PSWL+1
06FC 7C              1864            LIS   LNSWM
06FD FC              1865            NS    S
06FE 8404    0703    1866            BZ    *+5
0700 2907CD  07CD    1867            JMP   PSTMA      LINE SW ON
0703 73              1868            LIS   PRSWM
0704 FC              1869            NS    S
0705 8404    070A    1870            BZ    *+5
0707 290841  0841    1871            JMP   PSTMZ      PRICE SW ON
070A 4A              1872            LR    A,RFLG     ALL SWITCHES OFF
070B 13              1873            SL    1
070C 81B4    06C1    1874            BP    PSTM1P     BR IF PRICF = 0
070E 13              1875            SL    1
070F 67              1876            LISU  PSTRU
0710 6D              1877            LISL  PSTRL
0711 910A    071C    1878            BM    PSTM4P
0713 2064            1879  PST3P1    LI    PST4K      PST1R = PST4K
```

```
0715 5C            1880            LR    S,A
0716 4A            1881            LR    A,RFLG
0717 2220          1882            OI    H'20'      PSTF1 = 1
0719 5A            1883            LR    RFLG,A
071A 90A6    06C1  1884            BR    PSTM1P
071C 3C            1885  PSTM4P    DS    S
071D 94A3    06C1  1886            BNZ   PSTM1P
071F 4A            1887            LR    A,RFLG
0720 21DF          1888            NI    H'DF'      PSTF1 = 0
0722 5A            1889            LR    RFLG,A
                   1890  *
                   1891  * LOAD DATA INTO EAROM
0723 280467  0467  1892  PSTML1    PI    WRITPS     WRITE THE PRICE
0726 4A            1893            LR    A,RFLG     CHECK PSTF3
0727 15            1894            SL    4
0728 8198    06C1  1895            BP    PSTM1P     BR IF IT IS 0
072A 67            1896            LISU  PSTRU
072B 6D            1897            LISL  PSTRL
072C 200F          1898            LI    PST0K
072E 5D            1899            LR    I,A
072F 70            1900            CLR
0730 5C            1901            LR    S,A
0731 9001    0733  1902            BR    PSTMR1
                   1903  *
                   1904  * READ DATA FROM EAROM
0733 2805EA  05EA  1905  PSTMR1    PI    DBNCS
0736 4A            1906            LR    A,RFLG
0737 21EF          1907            NI    H'EF'      PSTF2 = 0
0739 5A            1908            LR    RFLG,A
073A 67            1909            LISU  SELRU
073B 6B            1910            LISL  SELRL
073C 4D            1911            LR    A,I
073D 1F            1912            INC
073E 9161    07A0  1913            BM    PSTMR6
0740 8460    07A1  1914            BZ    PSTMR7
0742 24FF          1915            AI    -1
0744 8429    076E  1916            BZ    PSTMR4
0746 2564          1917            CI    D'100'
0748 8448    0791  1918            BZ    PSTMR5
074A 18            1919            COM
074B 1F            1920            INC
074C CE            1921            AS    D          ACC = LINMR - LINER
074D 9120    076E  1922            BM    PSTMR4     BR IF LINE NO. GT LINMR
                   1923  * LINE NO. = 1 THRU LINMR
                   1924  * READ PRICE
074F 4C            1925  PSTMR2    LR    A,S
0750 57            1926            LR    RX4,A
0751 280365  0365  1927            PI    EROMRS
0754 67            1928            LISU  SELRU
0755 6A            1929            LISL  SELRL-1
0756 41            1930            LR    A,R0       LOAD PRICE REG.
0757 5C            1931            LR    S,A
0758 58            1932            LR    BINR,A
                   1933  * DISPLAY PRICE
0759 2805EA  05EA  1934  PSTMR3    PI    DBNCS
075C 28030C  030C  1935            PI    BCD8
075F 64            1936            LISU  DISPLU
0760 68            1937            LISL  DISPLL
0761 44            1938            LR    A,RX1
0762 5D            1939            LR    I,A
0763 45            1940            LR    A,RX2
0764 210F          1941            NI    H'0F'
0766 5D            1942            LR    I,A
0767 45            1943            LR    A,RX2
0768 14            1944            SR    4
0769 2210          1945            OI    H'10'
076B 5C            1946            LR    S,A
076C 905D    07CA  1947            BR    PSTMR8
```

```
                  1948  * LINE NO. = 0 OR LINMR+1 THRU 2*LINMR
                  1949  * READ FREE VEND MODE DATA
                  1950  * OR NO. OF VEND FOR A SELECTION
                  1951  * AND DISPLAY IT
076E 18           1952  PSTMR4   COM
076F 2433         1953           AI     D'51'
0771 57           1954           LR     RX4,A
0772 280365 0365  1955           PI     EROMRS
0775 41           1956           LR     A,R0
0776 67           1957           LISU   SELRU
0777 6A           1958           LISL   SELRL-1
0778 5C           1959           LR     S,A
0779 [illegible]  1960           LR     BINL,A
077A 42           1961           LR     A,R1
077B 5            1962           LR     BINU,A
077C [illegible]0335 0335 1963   PSTMR41 PI     BCD14
077F 64           1964           LISU   DISPLU
0780 [illegible]  1965           LISL   DISPLL
0781 45           1966           LR     A,BCDL
0782 210F         1967           NI     H'0F'
0784 5D           1968           LR     I,A
0785 45           1969           LR     A,BCDL
0786 14           1970           SR     4
0787 5D           1971           LR     I,A
0788 46           1972           LR     A,BCDU
0789 210F         1973           NI     H'0F'
078B 5D           1974           LR     I,A
078C 46           1975           LR     A,BCDU
078D 14           1976           SR     4
078E 5C           1977           LR     S,A
078F 903A   07CA  1978           BR     PSTMR8
                  1979  * LINE NO. = 100
                  1980  * READ NO. OF SELECT LINES
                  1981  * AND DISPLAY IT
0791 70           1982  PSTMR5   CLR
0792 57           1983           LR     RX4,A
0793 280365 0365  1984           PI     EROMRS
0796 67           1985           LISU   SELRU
0797 6A           1986           LISL   SELRL-1
0798 41           1987           LR     A,R0
0799 5C           1988           LR     S,A
079A 6C           1989           LISL   SELRL+1
079B 5C           1990           LR     S,A
079C 64           1991           LISU   DISPLU
079D 69           1992           LISL   DISPLL+1
079E 905F   07FE  1993           BR     PSTMD+1
                  1994  *
                  1995  *
07A0 72           1996  PSTMR6   LIS    2
07A1 2461         1997  PSTMR7   AI     D'97'
07A3 57           1998           LR     RX4,A
07A4 280365 0365  1999           PI     EROMRS
07A7 2805EA 05EA  2000           PI     DBNCS
07AA 64           2001           LISU   DISPLU
07AB 68           2002           LISL   DISPLL
07AC 41           2003           LR     A,R0
07AD 210F         2004           NI     H'0F'
07AF 5D           2005           LR     I,A
07B0 41           2006           LR     A,R0
07B1 14           2007           SR     4
07B2 5D           2008           LR     I,A
07B3 42           2009           LR     A,R1
07B4 210F         2010           NI     H'0F'
07B6 2210         2011           OI     H'10'
07B8 5D           2012           LR     I,A
07B9 37           2013           DS     RX4
07BA 280365 0365  2014           PI     EROMRS
07BD 64           2015           LISU   DISPLU
```

```
07BF 6B              2016            LISL  DISPLL+3
07C0 41              2017            LR    A,R0
07C1 210F            2018            NI    H'0F'
07C3 5D              2019            LR    I,A
07C4 41              2020            LR    A,R0
07C4 14              2021            SR    4
07C5 5D              2022            LR    I,A
07C6 42              2023            LR    A,R1
07C7 210F            2024            NI    H'0F'
07C9 5C              2025            LR    S,A
07CA 290D45 0D45     2026  PSTMR8    JMP   DEBNCE
                     2027  *
                     2028  * LINE SW ON
                     2029  *
07CD 4C              2030  PSTMA     LR    A,S
07CE 67              2031            LISU  SELRU
07CF 6B              2032            LISL  SELRL
07D0 15              2033            SL    4
07D1 8111    07E3    2034            BP    PSTMB      UP SW ON
07D3 13              2035            SL    1
07D4 9147    081C    2036            BM    PSTMH      DN & UP BOTH ON
07D6 4C              2037            LR    A,S        DN SW ON
07D7 1F              2038            INC
07D8 91F1    07CA    2039            BM    PSTMR8     BR IF  LINE NO. = -2
07DA 24FE            2040            AI    -2
07DC 2563            2041            CI    D'99'
07DE 940C    07EB    2042            BNZ   PSTMC
07E0 46              2043            LR    A,RX3      LINE NO. = LINMR
07E1 9009    07EB    2044            BR    PSTMC      OR 2* LINMR
                     2045  *LINE DN SW OFF, UP SW ON
07E3 46              2046  PSTMB     LR    A,RX3
07E4 18              2047            COM
07E5 1F              2048            INC
07E6 CC              2049            AS    S          ACC = INER - MAX. NO.
07E7 81E2    07CA    2050            BP    PSTMR8
07E9 4C              2051            LR    A,S        INCREMENT LINE NO.
07EA 1F              2052            INC
07EB 5C              2053  PSTMC     LR    S,A
07EC 64              2054            LISU  DISPLU
07ED 6F              2055            LISL  DISPLL+7
07EE 55              2056            LR    RX2,A      RX2 = LINER
07EF 1F              2057            INC
07F0 841F    0810    2058            BZ    PSTME
07F2 9121    0814    2059            BM    PSTMF
07F4 44              2060            LR    A,RX1
07F5 18              2061            COM
07F6 C5              2062            AS    RX2        ACC = LINER - LINMR -1
07F7 9105    07FD    2063            BM    PSTMD
07F9 1F              2064            INC
07FA 55              2065            LR    RX2,A
07FB 71              2066            LIS   1
07FC 5E              2067            LR    D,A
07FD 45              2068  PSTMD     LR    A,RX2
07FE 5B              2069            LR    BINL,A
07FF 6A              2070            CLR
0800 5A              2071            LR    BINU,A
0801 2405EA 05EA     2072            PI    DBNCS
0804 2400335 0335    2073            PI    BCD14
0807 45              2074            LR    A,BCDL
0808 14              2075            SR    4
0809 5E              2076            LR    D,A
080A 45              2077            LR    A,BCDL
080B 210F            2078            NI    H'0F'
080D 5E              2079            LR    D,A
080E 9009    0818    2080            BR    PSTMG+2
0810 7F              2081  PSTME     LIS   H'F'
0811 5E              2082            LR    D,A
0812 9003    0816    2083            BR    PSTMG
```

```
0814 7C          2084  PSTMF    LIS   H'C'
0815 5E          2085           LR    D,A
0816 7A          2086  PSTMG    LIS   H'A'
0817 5E          2087           LR    D,A
0818 8FFD   0816 2088           BR7   *-2
081A 90AF   07CA 2089           BR    PSTMR8
                 2090  *
                 2091  *LINE UP & DN BOTH ON
                 2092  *
081C 46          2093  PSTMH    LR    A,RX3
081D 18          2094           COM
081E 1F          2095           INC
081F CC          2096           AS    S
0820 94A9   07CA 2097           BNZ   PSTMR8
0822 6D          2098           LISL  PSTRL
0823 4A          2099           LR    A,RFLG     CHECK PSTF1
0824 2120        2100           NI    H'20'
0826 9404   082B 2101           BNZ   *+5
0828 290713 0713 2102           JMP   PST3P1
082B 3C          2103           DS    S
082C 949D   07CA 2104           BNZ   PSTMR8
082E 4A          2105           LR    A,RFLG
082F 21DF        2106           NI    H'DF'      PSTF1 = 0
0831 2210        2107           OI    H'10'      PSTF2 = 1
0833 5A          2108           LR    RFLG,A
0834 6B          2109           LISL  SELRL
0835 2064        2110           LI    D'100'
0837 5C          2111           LR    S,A
0838 64          2112           LISU  DISPLU
0839 6F          2113           LISL  DISPLL+7
083A 72          2114           LIS   2
083B 5E          2115           LR    D,A
083C 70          2116           CLR
083D 5E          2117           LR    D,A
083E 5E          2118           LR    D,A
083F 90D6   0816 2119           BR    PSTMG
                 2120  *
                 2121  * PRICE SW ON
                 2122  *
0841 4C          2123  PSTMZ    LR    A,S
0842 67          2124           LISU  SELRU
0843 6A          2125           LISL  SELRL-1
0844 3502        2126           CI    2
0846 9148   088F 2127           BM    PSTMT      DN & UP BOTH ON
0848 940A   0853 2128           BNZ   PSTMY      UP SW ON
084A 3D          2129           DS    I          DN SW ON
084B 70          2130           CLR
084C CC          2131           AS    S
084D 9408   0856 2132           BNZ   PSTMX
084F 6A          2133           LISL  SELRL-1
0850 5C          2134           LR    S,A
0851 9048   089A 2135           BR    PSTMS1
0853 4C          2136  PSTMY    LR    A,S
0854 1F          2137           INC
0855 5D          2138           LR    I,A
0856 70          2139  PSTMX    CLR              CHECK LINE NO.
0857 CE          2140           AS    D
0858 9136   088F 2141           BM    PSTMT
085A 8437   0892 2142           BZ    PSTMS
085C 2564        2143           CI    D'100'
085E 9417   0876 2144           BNZ   PSTMV
0860 4A          2145           LR    A,RFLG     LINE NO. = 100
0861 2240        2146           OI    H'40'
0863 5A          2147           LR    RFLG,A
0864 4C          2148           LR    A,S
0865 252D        2149           CI    LNMK
0867 8104   086C 2150           BP    PSTMW
0869 202D        2151           LI    LNMK
```

```
086B 5C            2152            LR    S,A
086C 2500          2153  PSTMW     CI    0
086E 9403    0872  2154            BNZ   PSTMW1
0870 71            2155            LIS   1
0871 5C            2156            LR    S,A
0872 64            2157  PSTMW1    LISU  DISPLU
0873 69            2158            LISL  DISPLL+1
0874 9089    07FE  2159            BR    PSTMD+1
                   2160  *
0876 18            2161  PSTMV     COM
0877 1F            2162            INC
0878 C4            2163            AS    RX1        ACC = LINMR - LINER
0879 9115    088F  2164            BM    PSTMT
087B 4A            2165            LR    A,RFLG
087C 2240          2166            OI    H'40'
087E 5A            2167            LR    RFLG,A
087F 4C            2168            LR    A,S
0880 1F            2169            INC
0881 8408    088A  2170            BZ    PSTMU
0883 25C8          2171            CI    D'200'
0885 4C            2172            LR    A,S
0886 8204    088B  2173            BC    PSTMU+1
0888 20C7          2174            LI    D'199'
088A 5C            2175  PSTMU     LR    S,A
088B 58            2176            LR    BINR,A
088C 290759  0759  2177            JMP   PSTMR3
088F 290D45  0D45  2178  PSTMT     JMP   DEBNCE
                   2179  *
                   2180  * LINE NO. = 0
0892 4C            2181  PSTMS     LR    A,S
0893 2532          2182            CI    50
0895 8104    089A  2183            BP    PSTMS1
0897 2032          2184            LI    50
0899 5C            2185            LR    S,A
089A 57            2186  PSTMS1    LR    BINL,A
089B 70            2187            CLR
089C 58            2188            LR    BINU,A
089D 4A            2189            LR    A,RFLG     PRICF = 1
089E 2240          2190            OI    H'40'
08A0 5A            2191            LR    RFLG,A
08A1 23077C  077C  2192            JMP   PSTMR41
                   2193  *
                   2194            EJECT
                   2195  *
                   2196  *STANDBY STATE
                   2197  *
08A4 4A            2198  STBY      LR    A,RFLG     CHECK COINF
08A5 13            2199            SL    1
08A6 9139    08E0  2200            BM    SCNSEL
08A8 74            2201            LIS   H'4'       CHECK INVF
08A9 FB            2202            NS    R1FLG
08AA 942F    08DA  2203            BNZ   STB1P
08AC C2            2204            AS    R1         CHECK PRICE SETTING SW
08AD 8404    08B2  2205            BZ    *+5
08AF 290678  0678  2206            JMP   PSTP
08B2 74            2207            LIS   H'4'       CHECK PRVF
08B3 FA            2208            NS    RFLG
08B4 8425    08DA  2209            BZ    STB1P
08B6 62            2210            LISU  INRU
08B7 6E            2211            LISL  INRL-1
08B8 4C            2212            LR    A,S
08B9 67            2213            LISU  SELRU
08BA 6B            2214            LISL  SELRL
08BB EC            2215            XS    S
08BC 213F          2216            NI    SLCTM
08BE 841B    08DA  2217            BZ    STB1P      NO CHANGE IN SELECT INPUT
08C0 ED            2218            XS    I
08C1 57            2219            LR    RX4,A
```

```
08C2 18            2220            COM
08C3 1F            2221            INC
08C4 CE            2222            AS    D
08C5 9114    08DA  2223            BM    STB1P
08C7 70            2224            CLR
08C8 C7            2225            AS    RX4
08C9 5C            2226            LR    S,A
08CA 8412    08DD  2227            BZ    STB3P
08CC 2805EA  05EA  2228            PI    DBNCS
08CF 280365  0365  2229            PI    EROMRS
08D2 41            2230            LR    A,R0
08D3 58            2231            LR    BINR,A
08D4 67            2232            LISU  SELRU
08D5 6A            2233            LISL  SELRL-1
08D6 5C            2234            LR    S,A
08D7 290289  0289  2235            JMP   CRD3P
08DA 290D45  0D45  2236  STB1P     JMP   DEBNCE
08DD 290291  0291  2237  STB3P     JMP   CDISP
                   2238  *
                   2239            EJECT
                   2240  *
                   2241  *
                   2242  *SELECTION SCAN ROUTINE
                   2243  *
08E0 4A            2244  SCNSEL    LR    A,RFLG
08E1 21FE          2245            NI    H'FE'       ECPF = 0
08E3 5A            2246            LR    RFLG,A
08E4 74            2247            LIS   H'4'        CHECK INVF
08E5 FB            2248            NS    R1FLG
08E6 9437    091E  2249            BNZ   SEL1P
08E8 C2            2250            AS    R1          CHECK PRICE SETTING SW
08E9 8404    08EE  2251            BZ    *+5
08EB 290678  0678  2252            JMP   PSTP
08EE C0            2253            AS    R2FLG       CHECK LN6F
08EF 812E    091E  2254            BP    SEL1P
08F1 62            2255            LISU  INRU
08F2 6E            2256            LISL  INRL-1
08F3 4C            2257            LR    A,S
08F4 213F          2258            NI    SLCTM
08F6 8427    091E  2259            BZ    SEL1P       NO SELECTION
08F8 67            2260            LISU  SELRU
08F9 6F            2261            LISL  SELRL+4
08FA 5C            2262            LR    S,A
08FB 6B            2263            LISL  SELRL
08FC EC            2264            XS    S
08FD 8427    0925  2265            BZ    SEL3P       NO CHANGE IN SELECTION
08FF ED            2266            XS    1
0900 57            2267            LR    RX4,A
0901 18            2268            COM
0902 1F            2269            INC
0903 CE            2270            AS    D
0904 9119    091E  2271            BM    SEL1P       SELECTION NO. OUT OF RANGE
0906 47            2272            LR    A,RX4       SELR = SEL. NO.
0907 5C            2273            LR    S,A
0908 67            2274            LISU  FVMU
0909 68            2275            LISL  FVML
090A 4C            2276            LR    A,S
090B 2532          2277            CI    50
090D 8458    0966  2278            BZ    SELIND1
090F 2805EA  05EA  2279            PI    DBNCS
0912 280365  0365  2280            PI    EROMRS
0915 67            2281            LISU  SELRU       PRICE REG. = PRICE
0916 6A            2282            LISL  SELRL-1
0917 41            2283            LR    A,R0
0918 5C            2284            LR    S,A
0919 2A092C  092C  2285            DCI   SELIN
091C 9004    0921  2286            BR    SEL2P
091E 2A08E0  08E0  2287  SEL1P     DCI   SCNSEL
```

```
0921 0E                2288  SEL2P    LR     Q.DC
0922 290D45 0D45       2289           JMP    DEBNCE
0925 67                2290  SEL3P    LISU   FVMU
0926 68                2291           LISL   FVML
0927 4C                2292           LR     A.S
0928 2532              2293           CI     50
092A 843B    0966      2294           BZ     SELIND1
                       2295  *
092C 67                2296  SELIN    LISU   CRDU
092D 6A                2297           LISL   CRDL+1
092E 4C                2298           LR     A.S
092F 18                2299           COM
0930 1F                2300           INC
0931 54                2301           LR     RX1.A      RX1 = -PRICE
0932 69                2302           LISL   CRDL
0933 4C                2303           LR     A.S
0934 8404    0939      2304           BZ     SELINA
0936 C4                2305           AS     RX1
0937 92E6    091E      2306           BNC    SEL1P
0939 64                2307  SELINA   LISU   CHGRU
093A 6A                2308           LISL   CHGRL
093B 5C                2309           LR     S.A
093C 2805EA  05EA      2310           PI     DBNCS
093F 62                2311           LISU   INRU
0940 6C                2312           LISL   INRL-3
0941 4C                2313           LR     A.S
0942 2120              2314           NI     DBSWM
0944 8408    094D      2315           BZ     SELINC     BR IF SINGLE SELECT
0946 65                2316           LISU   TLIRU
0947 6B                2317           LISL   TLIRL
0948 4C                2318           LR     A.S
0949 2130              2319           NI     TL2M+TL1M
094B 841E    096A      2320           BZ     SELIND     BR IF TL1 AND TL2 BOTH FULL
094D 2805BA  05BA      2321  SELINC   PI     CHGDS
0950 280B58  0B58      2322           PI     CHVNDS
0953 64                2323           LISU   CHGRU
0954 6A                2324           LISL   CHGRL
0955 70                2325           CLR
0956 CC                2326           AS     S
0957 8412    096A      2327           BZ     SELIND
0959 63                2328           LISU   P5RU       TURN ON EX. CH. LIGHT
095A 6E                2329           LISL   P5RL
095B 4C                2330           LR     A.S
095C 21FD              2331           NI     H'FF'-ECM
095E 5C                2332           LR     S.A
095F B5                2333           OUTS   P5
0960 4A                2334           LR     A.RFLG
0961 2203              2335           OI     H'03'      ECF. ECPF = 1
0963 5A                2336           LR     RFLG.A
0964 90B9    091E      2337           BR     SEL1P
                       2338  *
0966 67                2339  SELIND1  LISU   CRDU
0967 6A                2340           LISL   CRDL+1
0968 70                2341           CLR
0969 5C                2342           LR     S.A
096A 4B                2343  SELIND   LR     A.R1FLG
096B 2210              2344           OI     H'10'      CRMF1 = 1
096D 21F6              2345           NI     H'F6'      CRMF2, CRETF = 0
096F 5B                2346           LR     R1FLG.A
0970 40                2347           LR     A.R2FLG
0971 2204              2348           OI     H'04'      VENDF = 1
0973 50                2349           LR     R2FLG.A
0974 65                2350           LISU   PTRU       LOAD FIXED VEND TIME
0975 6D                2351           LISL   PTRL+1
0976 2004              2352           LI     FVTK
0978 5E                2353           LR     D.A
0979 2007              2354           LI     TOKU
097B 5C                2355           LR     S.A
```

```
097C 2A098A 098A 2356          DCI   VEND      CHANGE STATE
097F 0E          2357          LR    Q.DC
0980 63          2358          LISU  P5RU      TURN VEND ON
0981 6E          2359          LISL  P5RL
0982 4C          2360          LR    A.S
0983 2208        2361          OI    VENDM
0985 5C          2362          LR    S.A
0986 B5          2363          OUTS  P5
0987 290D45 0D45 2364  SELINE  JMP   DEBNCE
                 2365  *
                 2366          EJECT
                 2367  *
098A 62          2368  VEND    LISU  INRU
098B 6C          2369          LISL  INRL-3
098C 4C          2370          LR    A.S
098D 2110        2371          NI    FVSWM
098F 9444   09D4 2372          BNZ   VEND1P    BR IF FIXED VEND TIME
0991 70          2373          CLR             CHECK LN6
0992 C0          2374          AS    R2FLG
0993 814D   09E1 2375          BP    VEND6P    BR IF LINE 6 OPEN
0995 15          2376          SL    4
0996 13          2377          SL    1         CHECK VENDF
0997 8115   09AD 2378          BP    VEND0P1
                 2379  *
                 2380  * INTERNAL TIME OUT
0999 65          2381          LISU  PTRU
099A 6D          2382          LISL  PTRL+1
099B 3E          2383          DS    D
099C 9441   09DE 2384          BNZ   VEND5P
099E 3C          2385          DS    S
099F 943E   09DE 2386          BNZ   VEND5P
                 2387  *
09A1 2004        2388          LI    SELK
09A3 5C          2389          LR    S.A
09A4 2805DE 05DE 2390          PI    VNDOFS
09A7 2A0A3F 0A3F 2391          DCI   SEL2W
09AA 0E          2392          LR    Q.DC
09AB 901B   09C7 2393          BR    VEND0P2
                 2394  *
                 2395  *
09AD 40          2396  VEND0P1 LR    A.R2FLG
09AE 21FD        2397          NI    H'FD'     VENDF1 = 0
09B0 50          2398          LR    R2FLG.A
09B1 207D        2399          LI    VNDK
09B3 63          2400          LISU  WATRU
09B4 6F          2401          LISL  WATRL
09B5 5C          2402          LR    S.A
09B6 2A09BA 09BA 2403          DCI   LN6WAT
09B9 0E          2404          LR    Q.DC
                 2405  *
                 2406  * WAIT FOR LINE 6
                 2407  *
09BA 70          2408  LN6WAT  CLR
09BB C0          2409          AS    R2FLG
09BC 8127   09E4 2410          BP    VEND7P
09BE 63          2411          LISU  WATRU
09BF 6F          2412          LISL  WATRL
09C0 3C          2413          DS    S
09C1 941C   09DE 2414          BNZ   VEND5P
                 2415  *
                 2416  * TIME OUT BECAUSE SELECTION
                 2417  * CHANGED OR DISAPPEARED
                 2418  *
09C3 2A08E0 08E0 2419  VEND0P  DCI   SCNSEL
09C6 0E          2420          LR    Q.DC
09C7 4B          2421  VEND0P2 LR    A.R1FLG
09C8 21EF        2422          NI    H'EF'     CRMF1 = 0
09CA 2209        2423          OI    H'09'     CRETF, CRMF2 = 1
```

```
09CC 5B                2424            LR     R1FLG.A
09CD 67                2425            LISU   CRDU
09CE 69                2426            LISL   CRDL
09CF 4C                2427            LR     A.S
09D0 58                2428            LR     BINR.A
09D1 290289 0289       2429            JMP    CRD3P
                       2430   *
                       2431   * FIXED VEND TIME MODE
                       2432   *
09D4 65                2433   VEND1P   LISU   PTRU
09D5 6D                2434            LISL   PTRL+1
09D6 70                2435            CLR
09D7 CC                2436            AS     S
09D8 8408    09E1      2437            BZ     VEND6P
09DA 74                2438            LIS    H'4'
09DB F0                2439            NS     R2FLG
09DC 84E6    09C3      2440            BZ     VEND0P
                       2441   * NO VEND2P,VEND3P,VEND4P LABELS
09DE 290D45 0D45       2442   VEND5P   JMP    DEBNCE
                       2443   *
                       2444   * VEND COMPLETED
                       2445   *
09E1 2805DE 05DE       2446   VEND6P   PI     VNDOFS     TURN OFF VEND
09E4 4A                2447   VEND7P   LR     A.RFLG
09E5 2220              2448            OI     H'20'      TEF = 1
09E7 5A                2449            LR     RFLG.A
09E8 40                2450            LR     A.R2FLG
09E9 2201              2451            OI     H'01'      SALEF = 1
09EB 50                2452            LR     R2FLG.A
09EC 67                2453            LISU   CRDU
09ED 6A                2454            LISL   CRDL+1
09EE 4C                2455            LR     A.S
09EF 12                2456            COM
09F0 1F                2457            INC
09F1 69                2458            LISL   CRDL
09F2 CC                2459            AS     S
09F3 5C                2460            LR     S.A
09F4 2909F7 09F7       2461            JMP    CRETP
                       2462   *
                       2463            EJECT
                       2464   *
09F7 4B                2465   CRETP    LR     A.R1FLG
09F8 2210              2466            OI     H'10'      CRMF1 = 1
09FA 21F6              2467            NI     H'F6'      CRETF,CRMF2 = 0
09FC 5B                2468            LR     R1FLG.A
09FD 13                2469            SL     1
09FE 20C8              2470            LI     CT1K
0A00 9104    0A05      2471            BM     CRET1P
0A02 65                2472            LISU   CTRU
0A03 68                2473            LISL   CTRL
0A04 4C                2474            LR     A.S
0A05 54                2475   CRET1P   LR     RX1.A
0A06 2802F7 02F7       2476            PI     WAITS
0A09 71                2477            LIS    H'1'       CHECK SALEF
0A0A F0                2478            NS     R2FLG
0A0B 9408    0A14      2479            BNZ    CRET2P
0A0D 2A0B07 0B07       2480   CRET0P   DCI    PAY
0A10 0E                2481            LR     Q.DC
0A11 290291 0291       2482            JMP    CDISP      CLEAR DISPLAY
0A14 2A0A4A 0A4A       2483   CRET2P   DCI    SALE
0A17 0E                2484            LR     Q.DC
0A18 290D45 0D45       2485            JMP    DEBNCE
                       2486   *
                       2487            EJECT
                       2488   *
                       2489   * IN DECLING BALANCE, WAIT UNTIL L6 RECLOSES
                       2490   *
0A1B 70                2491   VENDW    CLR
```

```
0A1C C0                 AS    R2FLG
0A1D 810F    0A2D       BP    VENW1P     BR IF LN 6 OPEN
0A1F 2028               LI    VDBK
0A21 54                 LR    RX1,A
0A22 2802F7 02F7        PI    WAITS
0A25 4B                 LR    A,R1FLG
0A26 2201               OI    H'01'      CRMF2 = 1
0A28 5B                 LR    R1FLG,A
0A29 2A0A30 0A30        DCI   SELWAT
0A2C 0E                 LR    Q,DC
0A2D 290D45 0D45 VENW1P JMP   DEBNCE
                 *
                 * WAIT UNTIL LAST SELECTION DISAPPEARS
                 *
0A30 62          SELWAT LISU  INRU
0A31 6E                 LISL  INRL-1
0A32 4C                 LR    A,S
0A33 67                 LISU  SELRU
0A34 6B                 LISL  SELRL
0A35 EC                 XS    S
0A36 213F               NI    SLCTM
0A38 84F4    0A2D       BZ    VENW1P
0A3A 70                 CLR
0A3B 5C                 LR    S,A
0A3C 29091E 091E        JMP   SEL1P
                 *
                        EJECT
                 *
                 * WAIT BEFORE MAKING NEXT SELECTION
                 * AFTER INTERNAL TIME OUT
                 *
0A3F 65          SEL2W  LISU  PTRU
0A40 6D                 LISL  PTRL+1
0A41 3E                 DS    D
0A42 94EA    0A2D       BNZ   VENW1P
0A44 3C                 DS    S
0A45 94E7    0A2D       BNZ   VENW1P
0A47 29091E 091E        JMP   SEL1P
                 *
                        EJECT
                 *
                 * UPDATE SALES TOTAL
                 *
0A4A 40          SALE   LR    A,R2FLG
0A4B 21EE               NI    H'EE'      CASHF,SALEF = 0
0A4D 50                 LR    R2FLG,A
0A4E 2064               LI    D'100'
0A50 53          SALE1P LR    R2,A       SAVE EAROM ADDRESS
0A51 67                 LISU  SELRU
0A52 6A                 LISL  SELRL-1
0A53 4C                 LR    A,S
0A54 58                 LR    BINR,A
0A55 28030C 030C        PI    BCD8
0A58 45                 LR    A,RX2      MOVE BCD NO.
0A59 14                 SR    4
0A5A 06                 LR    QU,A
0A5B 45                 LR    A,RX2
0A5C 15                 SL    4
0A5D E4                 XS    RX1
0A5E 07                 LR    QL,A
0A5F 43                 LR    A,R2       RX4=EAROM ADDRESS
0A60 57                 LR    RX4,A
0A61 37          SALE2P DS    RX4
0A62 280365 0365        PI    EROMRS
0A65 2805EA 05EA        PI    DBNCS
0A68 42                 LR    A,R1
0A69 210F               NI    H'0F'
0A6B 52                 LR    R1,A
```

```
0A6C 03              2560            LR    A.QL       ADD LOWER BYTE
0A6D 2466            2561            AI    H'66'
0A6F D1              2562            ASD   R0
0A70 51              2563            LR    R0.A
0A71 70              2564            CLR              SAVE CARRY
0A72 19              2565            LNK
0A73 54              2566            LR    RX1.A
0A74 02              2567            LR    A.QU       ADD UPPER BYTE
0A75 2466            2568            AI    H'66'
0A77 D2              2569            ASD   R1
0A78 2466            2570            AI    H'66'
0A7A D4              2571            ASD   RX1
0A7B 52              2572            LR    R1.A
0A7C 14              2573            SR    4          SAVE CARRY
0A7D 07              2574            LR    QL.A
0A7E 70              2575            CLR
0A7F 06              2576            LR    QU.A
0A80 280362 0362     2577            PI    EROMWS
0A83 71              2578            LIS   1
0A84 50              2579            XS    R2FLG
0A85 50              2580            LR    R2FLG.A
0A86 2101            2581            NI    H'01'
0A88 94D8    0A61    2582            BNZ   SALE2P
0A8A 47              2583            LR    A.RX4
0A8B 2560            2584            CI    D'96'
0A8D 94C2    0A50    2585            BNZ   SALE1P
0A8F 67              2586  SALE3P    LISU  SELRU
0A90 6B              2587            LISL  SELRL
0A91 4C              2588            LR    A.S
0A92 252D            2589            CI    D'45'
0A94 911E    0AB3    2590            BM    SALE5P     BR IF SEL. NO. GT 45
0A96 2432            2591            AI    D'50'
0A98 57              2592            LR    RX4.A
0A99 280365 0365     2593            PI    EROMRS
0A9C 2805EA 05EA     2594            PI    DBNCS
0A9F 41              2595            LR    A.R0
0AA0 1F              2596            INC
0AA1 51              2597            LR    R0.A
0AA2 42              2598            LR    A.R1
0AA3 19              2599            LNK
0AA4 52              2600            LR    R1.A
0AA5 2527            2601            CI    H'27'      CHECK IF IT IS 10,000
0AA7 9408    0AB0    2602            BNZ   SALE4P
0AA9 41              2603            LR    A.R0
0AAA 24F0            2604            AI    -H'10'
0AAC 9403    0AB0    2605            BNZ   SALE4P
0AAE 51              2606            LR    R0.A
0AAF 52              2607            LR    R1.A
0AB0 280362 0362     2608  SALE4P    PI    EROMWS
0AB3 4A              2609  SALE5P    LR    A.RFLG
0AB4 21F7            2610            NI    H'F7'      PSTF3 = 0
0AB6 5A              2611            LR    RFLG.A
0AB7 74              2612            LIS   4
0AB8 EB              2613            XS    R1FLG      INVF = 1
0AB9 5B              2614            LR    R1FLG.A
0ABA 67              2615            LISU  SELRU
0ABB 6B              2616            LISL  SELRL
0ABC 72              2617            LIS   2
0ABD CC              2618            AS    S
0ABE 65              2619            LISU  INCLU
0ABF 6F              2620            LISL  INCLL
0AC0 5C              2621            LR    S.A
0AC1 70              2622  SALE6P    CLR
0AC2 67              2623            LISU  CRDU
0AC3 69              2624            LISL  CRDL
0AC4 CC              2625            AS    S
0AC5 843E    0B04    2626            BZ    SALE9P
0AC7 64              2627            LISU  CHGRU
```

```
0AC8 6A                 LISL  CHGRL
0AC9 5C                 LR    S,A
0ACA 62                 LISU  INRU
0ACB 6C                 LISL  INRL-3
0ACC 4C                 LR    A,S
0ACD 2120               NI    DBSWM
0ACF 3434     0B04      BZ    SALE9P     BR IF SINGLE VEND
0AD1 2805BA   05BA      PI    CHGDS
0AD4 2805D1   05D1      PI    TRFRS
0AD7 2805EA   05EA      PI    DBNCS
0ADA 40                 LR    A,R2FLG
0ADC 21DF               NI    H'DF'      INVSWF = 0
0ADE 50                 LR    R2FLG,A
0ADF 3C         SALE7P  DS    S          TRANSFER $ COINS
0AE0 9206     0AE6      BNC   SALE8P     TO CASH BOX
0AE2 2804F1   04F1      PI    PAYONS
0AE5 90F9     0ADE      BR    SALE7P
0AE6 40         SALE8P  LR    A,R2FLG
0AE7 2220               OI    H'20'      INVSWF = 1
0AE9 50                 LR    R2FLG,A
0AEA 67                 LISU  CRDU
0AEB 69                 LISL  CRDL
0AEC 4C                 LR    A,S
0AED 58                 LR    BINR,A
0AEE 66                 LISU  C1RU
0AEF 6C                 LISL  C1RL-3
0AF0 4C                 LR    A,S
0AF1 2503               CI    3
0AF3 4B                 LR    A,R1FLG
0AF4 9103     0AF8      BM    *+4        BR IF C20R > OR = 4
0AF6 21DF               NI    H'DF'      MVPF = 0
0AF8 2208               OI    H'08'      CRETF = 1
0AFA 21EF               NI    H'EF'      CRMF1 = 0
0AFC 5B                 LR    R1FLG,A
0AFD 2A0A1B   0A1B      DCI   VENDW
0B00 0E                 LR    Q,DC
0B01 290289   0289      JMP   CRD3P
0B04 290A0D   0A0D      JMP   CRET0P
                        *
                        *
                        EJECT
                        *
                        * PAYOUT STATE
                        *
0B07 63         PAY     LISU  P0RU       TURN OFF DISPLAY
0B08 6D                 LISL  P0RL
0B09 4C                 LR    A,S
0B0A 2201               OI    H'01'
0B0C 5C                 LR    S,A
0B0D B0                 OUTS  P0
0B0E 40                 LR    A,R2FLG
0B0F 21DF               NI    H'DF'      INVSWF = 0
0B11 50                 LR    R2FLG,A
0B12 67                 LISU  CRDU       CHGR = CREDIT
0B13 69                 LISL  CRDL
0B14 4C                 LR    A,S
0B15 64                 LISU  CHGRU
0B16 6A                 LISL  CHGRL
0B17 5C                 LR    S,A
0B18 4A                 LR    A,RFLG
0B19 2120               NI    H'20'
0B1B 841C     0B38      BZ    PAY4P      BR IF TEF=0
0B1D 2805BA   05BA      PI    CHGDS
0B20 2805D1   05D1      PI    TRFRS
0B23 2805EA   05EA      PI    DBNCS
0B26 3C         PAY3P   DS    S          TRANSFER $ COINS
0B27 9206     0B2E      BNC   PAY3P1     TO CASH BOX
```

```
0B29 2804F1 04F1 2695            PI    PAYONS
0B2C 90F9   0B26 2696            BR    PAY3P
0B2E 66          2697  PAY3P1    LISU  C1RU       PAY $ COINS
0B2F 6C          2698            LISL  C1RL-3
0B30 3C          2699  PAY3P2    DS    S
0B31 922B   0B5D 2700            BNC   PAYCHG
0B33 2804F1 04F1 2701            PI    PAYONS
0B36 90F9   0B30 2702            BR    PAY3P2
                 2703  *
                 2704  *
0B38 66          2705  PAY4P     LISU  C1RU       PAY CHANGE
0B39 6B          2706            LISL  C1RL-4
0B3A 2805EA 05EA 2707            PI    DBNCS
0B3D 4D          2708  PAY5P     LR    A,I        INCREMENT ISAR
0B3E 3C          2709  PAY6P     DS    S
0B3F 9206   0B46 2710            BNC   PAY7P
0B41 2804F1 04F1 2711            PI    PAYONS
0B44 90F9   0B3E 2712            BR    PAY6P
0B46 70          2713  PAY7P     CLR
0B47 5C          2714            LR    S,A
0B48 280574 0574 2715            PI    PAYOFS
0B4B 8FF1   0B3D 2716  PAY8P     BR7   PAY5P
0B4D 4A          2717  PAY9P     LR    A,R2FLG
0B4E 2220        2718            OI    H'20'      INVSW=1
0B50 5A          2719            LR    R2FLG,A
0B51 240C11 0C11 2720            DCI   EOCW
0B54 0E          2721            LR    Q,DC
0B55 290D45 0D45 2722            JMP   DEBNCE
                 2723  *
                 2724            EJECT
                 2725  *
                 2726  * SUBROUTINE TO COMPUTE CHANGE
                 2727  * CHGR = AMOUNT OF CHANGE
                 2728  *
0B58 4A          2729  CHVNDS    LR    A,RFLG
0B59 2280        2730            OI    H'80'      CHGF = 1
0B5B 5A          2731            LR    RFLG,A
0B5C 08          2732            LR    K,P
                 2733  *
                 2734  *
0B5D 64          2735  PAYCHG    LISU  CHGRU
0B5E 68          2736            LISL  CHGRL-2
0B5F 2040        2737            LI    TL3M       TLMR = TL3M
0B61 5D          2738            LR    I,A
0B62 20FB        2739            LI    -5         COINR = -C5
0B64 5D          2740            LR    I,A
0B65 6D          2741            LISL  CH1RL-2    CH5R = 0
0B66 70          2742            CLR
0B67 5C          2743            LR    S,A
                 2744  *
0B68 0A          2745  PCHG1P    LR    A,IS       SAVE ISAR
0B69 54          2746            LR    RX1,A
0B6A 6B          2747  PCHG2P    LISL  TLIRL      SAVE TLIR IN RX2
0B6B 65          2748            LISU  TLIRU
0B6C 4C          2749            LR    A,S
0B6D 55          2750            LR    RX2,A
0B6E 64          2751            LISU  CHGRU
0B6F 68          2752            LISL  CHGRL-2    TEST TLI
0B70 FC          2753            NS    S
0B71 44          2754            LR    A,RX1
0B72 0B          2755            LR    IS,A
0B73 940B   0B7F 2756            BNZ   PCHG3P     BR IF EMPTY
0B75 24DA        2757            AI    1-CH1R
0B77 78          2758            LIS   TL2K
0B78 8405   0B7E 2759            BZ    PCH2P1     BR IF DIME
0B7A 74          2760            LIS   TL1K
0B7B 8102   0B7E 2761            BP    PCH2P1     BR IF NICKEL
0B7D 74          2762            LIS   TL3K
```

```
0B7E 5C              2763  PCH2P1   LR    S,A
0B7F 3C              2764  PCHG3P   DS    S
0B80 912B    0BAC    2765           BM    PCHG5P
0B82 6A              2766           LISL  CHGRL
0B83 4E              2767           LR    A,D
0B84 CD              2768           AS    I
0B85 56              2769           LR    RX3,A
0B86 44              2770           LR    A,RX1      ISAR = ADDRESS OF CHIR
0B87 0B              2771           LR    IS,A
0B88 9223    0BAC    2772           BNC   PCHG5P     BR IF CHANGE < COIN
0B8A 2525            2773           CI    CH5R
0B8C 840F    0B9C    2774           BNZ   PCHG4P     BR IF N OR D PAYOUT
0B8E 45              2775           LR    A,RX2
0B8F 2110            2776           NI    TLIM
0B91 840A    0B9C    2777           BZ    PCHG4P     BR IF N TUBE FULL
0B93 46              2778           LR    A,RX3      BR IF REMAINING CHANGE
0B94 2501            2779           CI    1          = 1 OR 3
0B96 8415    0BAC    2780           BZ    PCHG5P
0B98 2503            2781           CI    3
0B9A 8411    0BAC    2782           BZ    PCHG5P
0B9C 46              2783  PCHG4P   LR    A,RX3
0B9D 6A              2784           LISL  CHGRL
0B9E 5C              2785           LR    S,A
0B9F 44              2786           LR    A,RX1
0BA0 0B              2787           LR    IS,A
0BA1 70              2788           CLR
0BA2 CA              2789           AS    RFLG
0BA3 91DB    0B7F    2790           BM    PCHG3P
0BA5 66              2791           LISU  C1RU
0BA6 2804F1  04F1    2792           PI    PAYONS
0BA9 64              2793           LISU  CH1RU
0BAA 90BD    0B68    2794           BR    PCHG1P
0BAC 280574  0574    2795  PCHG5P   PI    PAYOFS
0BAF 2805EA  05EA    2796  PCHG6P   PI    DBNCS
0BB2 4D              2797           LR    A,I        INCREMENT ISAR
0BB3 0A              2798           LR    A,IS
0BB4 54              2799           LR    RX1,A
0BB5 70              2800           CLR
0BB6 5C              2801           LR    S,A        CHIR = 0
0BB7 68              2802           LISL  CHGRL-2
0BB8 4C              2803           LR    A,S
0BB9 12              2804           SR    1
0BBA 5D              2805           LR    I,A        LOAD TLMR
0BBB 14              2806           SR    4
0BBC 18              2807           COM
0BBD 1F              2808           INC
0BBE 5D              2809           LR    I,A        LOAD COINR
0BBF 94AA    0B6A    2810           BNZ   PCHG2P
0BC1 2080            2811           LI    H'80'
0BC3 EA              2812           XS    RFLG
0BC4 9103    0BC8    2813           BM    PCHG7P
0BC6 5A              2814           LR    RFLG,A
0BC7 0C              2815           PK
                     2816  *
                     2817  *
0BC8 70              2818  PCHG7P   CLR
0BC9 CC              2819           AS    S
0BCA 840D    0BD8    2820           BZ    PCHG9P
0BCC 66              2821           LISU  C1RU
0BCD 6F              2822           LISL  C1RL
0BCE 5C              2823           LR    S,A
0BCF 2804F1  04F1    2824  PCHG8P   PI    PAYONS
0BD2 3C              2825           DS    S
0BD3 94FB    0BCF    2826           BNZ   PCHG8P
0BD5 280574  0574    2827           PI    PAYOFS
0BD8 290B4D  0B4D    2828  PCHG9P   JMP   PAY9P
                     2829  *
```

```
                  2830          EJECT
                  2831  *
                  2832  * INVENTORY PROGRAM
                  2833  *
0BDB 4A           2834  INVP    LR    A,RFLG
0BDC 2204         2835          OI    H'04'     PRVF=1
0BDE 21EF         2836          NI    H'EF'     SDNF=0
0BE0 5A           2837          LR    RFLG,A
0BE1 4B           2838          LR    A,R1FLG
0BE2 2210         2839          OI    H'10'     CRMF1=1
0BE4 21F6         2840          NI    H'F6'     CRETF,CRMF2 = 0
0BE6 5B           2841          LR    R1FLG,A
0BE7 40           2842          LR    A,R2FLG
0BE8 21DF         2843          NI    H'DF'     INVSWF = 0
0BEA 50           2844          LR    R2FLG,A
0BEB 63           2845          LISU  P0RU      TURN OFF DISPLAY
0BEC 6D           2846          LISL  P0RL
0BED 4C           2847          LR    A,S
0BEE 2201         2848          OI    H'01'
0BF0 5C           2849          LR    S,A
0BF1 B0           2850          OUTS  P0
0BF2 0A           2851  INV1P   LR    A,IS
0BF3 54           2852          LR    RX1,A
0BF4 63           2853          LISU  INVU
0BF5 69           2854          LISL  INVL+1
0BF6 4C           2855          LR    A,S
0BF7 12           2856          SR    1
0BF8 12           2857          SR    1
0BF9 8412   0C0C  2858          BZ    INV4P
0BFB 18           2859          COM
0BFC 2439         2860          AI    0'71'
0BFE 0B           2861          LR    IS,A
0BFF E4           2862          XS    RX1
0C00 9406   0C07  2863          BNZ   INV3P
0C02 2804F1 04F1  2864  INV2P   PI    PAYONS
0C05 90EC   0BF2  2865          BR    INV1P
0C07 280574 0574  2866  INV3P   PI    PAYOFS
0C0A 90E7   0BF2  2867          BR    INV1P
0C0C 280574 0574  2868  INV4P   PI    PAYOFS
0C0F 90C8   0BD8  2869          BR    PCHG9P
                  2870  *
                  2871          EJECT
                  2872  *
                  2873  * END OF CYCLE STATE
                  2874  *
0C11 4A           2875  EOCW    LR    A,RFLG    CHECK SDNF
0C12 2110         2876          NI    H'10'
0C14 9418   0C2D  2877          BNZ   EOC3P
0C16 C0           2878          AS    R2FLG     CHECK LN6
0C17 8115   0C2D  2879          BP    EOC3P
0C19 74           2880          LIS   H'4'      CHECK INVF
0C1A FB           2881          NS    R1FLG
0C1B 9411   0C2D  2882          BNZ   EOC3P
0C1D 62           2883          LISU  INRU
0C1E 6A           2884          LISL  INRL-5
0C1F 4C           2885          LR    A,S
0C20 18           2886          COM
0C21 210F         2887          NI    COINM
0C23 9409   0C2D  2888          BNZ   EOC3P
0C25 2028         2889          LI    EOCK
0C27 54           2890          LR    RX1,A
0C28 2802F7 02F7  2891          PI    WAITS
0C2B 9004   0C30  2892          BR    MVP0P
0C2D 290D45 0D45  2893  EOC3P   JMP   DEBNCE
                  2894  *
                  2895  * CHECK IF FREE VEND MODE,
                  2896  * FIND MAXIMUM NO. OF SELECT LINES
                  2897  * AND CHECK IF ALL VEND PRICES = 0
```

```
                    2898  *
0C30 2032           2899  MVP0P    LI     50
0C32 57             2900           LR     RX4,A
0C33 280365 0365    2901           PI     EROMRS
0C36 67             2902           LISU   FVMU
0C37 68             2903           LISL   FVML
0C38 70             2904           CLR
0C39 C1             2905           AS     R0
0C3A 5C             2906           LR     S,A
0C3B 840C   0C48    2907           BZ     MVP0P1
0C3D 2532           2908           CI     50
0C3F 8408   0C48    2909           BZ     MVP0P1
0C41 70             2910           CLR
0C42 5C             2911           LR     S,A
0C43 51             2912           LR     R0,A
0C44 52             2913           LR     R1,A
0C45 280362 0362    2914           PI     EROMWS
0C48 70             2915  MVP0P1   CLR
0C49 57             2916           LR     RX4,A
0C4A 280365 0365    2917           PI     EROMRS
0C4D 67             2918           LISU   SELRU
0C4E 6C             2919           LISL   SELRL+1
0C4F 70             2920           CLR
0C50 C1             2921           AS     R0
0C51 5C             2922           LR     S,A
0C52 9404   0C57    2923           BNZ    MVP1P
0C54 71             2924           LIS    1
0C55 9007   0C5D    2925           BR     MVP2P
0C57 252D           2926  MVP1P    CI     LNMK
0C59 8208   0C62    2927           BC     MVP3P
0C5B 202D           2928           LI     LNMK
0C5D 5C             2929  MVP2P    LR     S,A
0C5E 51             2930           LR     R0,A
0C5F 280362 0362    2931           PI     EROMWS
                    2932  *
0C62 67             2933  MVP3P    LISU   SELRU
0C63 6C             2934           LISL   SELRL+1
0C64 4C             2935           LR     A,S
0C65 57             2936           LR     RX4,A
0C66 67             2937           LISU   CRDU
0C67 69             2938           LISL   CRDL
0C68 70             2939           CLR
0C69 5C             2940           LR     S,A        MAX: PRICE=0
0C6A 280365 0365    2941  MVP4P    PI     EROMRS
0C6D 70             2942           CLR
0C6E C1             2943           AS     R0
0C6F 8410   0C80    2944           BZ     MVP6P
0C71 25C7           2945           CI     D'199'
0C73 8209   0C7D    2946           BC     MVP5P
0C75 20C7           2947           LI     D'199'
0C77 51             2948           LR     R0,A
0C78 280362 0362    2949           PI     EROMWS
0C7B 20C7           2950           LI     D'199'
0C7D 67             2951  MVP5P    LISU   CRDU
0C7E 69             2952           LISL   CRDL
0C7F 5C             2953           LR     S,A
0C80 37             2954  MVP6P    DS     RX4
0C81 94E8   0C6A    2955           BNZ    MVP4P
                    2956  *
0C83 4A             2957           LR     A,RFLG
0C84 21F7           2958           NI     H'F7'      PSTF3 = 0
0C86 5A             2959           LR     RFLG,A
0C87 67             2960           LISU   CRDU
0C88 69             2961           LISL   CRDL
0C89 70             2962           CLR
0C8A CC             2963           AS     S
0C8B 67             2964           LISU   FVMU
0C8C 68             2965           LISL   FVML
```

```
0C8D 9404    0C92 2966            BNZ    *+5
0C8F 2032         2967            LI     50
0C91 5C           2968            LR     S,A
0C92 4C           2969            LR     A,S
0C93 2532         2970            CI     50
0C95 4B           2971            LR     A,R1FLG
0C96 9408    0C9F 2972            BNZ    EOC1P
0C99 2403E0 08E0 2973            DCI    SCNSEL     MAX. PRICE = 0
0C9E 2120         2974            OI     H'20'
0C9F 8046    0CA4 2975            BR     EOC2P
0CA1 2403A4 08A4 2976  EOC1P     DCI    STBY       MAX. PRICE > 0
0CA4 21DF         2977            NI     H'DF'
0CA6 21EF         2978  EOC2P    NI     H'EF'      CRMF1 = 0
0CA8 2209         2979            OI     H'09'      CRETF,CRMF2 = 1
0CA9 5B           2980            LR     R1FLG,A
0CA9 4A           2981            LR     A,RFLG
0CAA 219E         2982            NI     H'9E'
0CAC 5A           2983            LR     RFLG,A
0CAD 0E           2984            LR     Q,DC
0CAE 63           2985            LISU   P0RU       TURN ON DISPLAY
0CAF 6D           2986            LISL   P0RL
0CB0 4C           2987            LR     A,S
0CB1 21FE         2988            NI     H'FE'
0CB3 5C           2989            LR     S,A
0CB4 B0           2990            OUTS   P0
0CB5 2805DE 05DE 2991            PI     VNDOFS
0CB8 67           2992            LISU   CRDU
0CB9 69           2993            LISL   CRDL
0CBA 70           2994            CLR
0CBB 5C           2995            LR     S,A
0CBC 67           2996            LISU   SELRU
0CBD 6B           2997            LISL   SELRL
0CBE 5C           2998            LR     S,A
0CBF 66           2999            LISU   C1RU       CLEAR CIR'S
0CC0 6F           3000            LISL   C1RL
0CC1 70           3001            CLR
0CC2 3E           3002            LR     D,A
0CC3 5E           3003            LR     D,A
0CC4 5E           3004            LR     D,A
0CC5 5C           3005            LR     S,A
                  3006  * TRANSFER 1 OR 4 $ COINS TO CASH BOX
0CC6 CA           3007            AS     RFLG
0CC7 71           3008            LIS    1
0CC8 8102    0CCB 3009            BP     *+3
0CCA 74           3010            LIS    4
0CCB 64           3011            LISU   TL4RU
0CCC 68           3012            LISL   TL4RL
0CCD 5C           3013            LR     S,A
0CCE 2804F1 04F1 3014            PI     PAYONS
0CD1 3C           3015            DS     S
0CD2 94FB    0CCE 3016            BNZ    *-4
0CD4 4A           3017            LR     A,RFLG
0CD5 217F         3018            NI     H'7F'      PORF = 0
0CD7 5A           3019            LR     RFLG,A
0CD8 290291 0291 3020            JMP    CDISP      CLEAR DISPLAY
                  3021  *
                  3022            EJECT
                  3023  *
                  3024  * POWER ON RESET
                  3025  *
                  3026  *
                  3027  *
                  3028  *
0CDB 74           3029  RESET     LIS    4
0CDC 51           3030            LR     1,A
0CDD 70           3031            CLR
0CDE 50           3032            LR     0,A
0CDF 2070         3033  RST1P     LI     CRM+DGNM
```

```
0CE1 E0            3034          OUTS  P0
0CE2 72            3035          LIS   ECM
0CE3 B5            3036          OUTS  P5
0CE4 63            3037          LISU  P5RU
0CE5 6E            3038          LISL  P5RL
0CE6 5E            3039          LR    D,A
0CE7 73            3040          LIS   3
0CE8 B4            3041          OUTS  P4
0CE9 2060          3042          LI    CRM+EROM
0CEB B0            3043          OUTS  P0
0CEC 70            3044          CLR
0CED B1            3045          OUTS  P1
0CEE B4            3046          OUTS  P4
0CEF 2040          3047          LI    CRM
0CF1 B0            3048          OUTS  P0
0CF2 5C            3049          LR    S,A
0CF3 20AA          3050          LI    H'AA'
0CF5 52            3051          LR    2,A
0CF6 E2            3052          XS    2
0CF7 94E7    0CDF  3053          BNZ   RST1P
0CF9 30            3054          DS    0
0CFA 94E4    0CDF  3055          BNZ   RST1P
0CFC 31            3056          DS    1
0CFD 94E1    0CDF  3057          BNZ   RST1P
                   3058  *
                   3059  *
                   3060  * SETUP TIMER
0CFF 70            3061          CLR
0D00 B6            3062          OUTS  6
0D01 20FA          3063          LI    D'250'     TIMER CONST. = 250
0D03 B7            3064          OUTS  7
0D04 208A          3065          LI    H'8A'      SCALER = 20
0D06 B6            3066          OUTS  6          TIME = 2.5 MSEC (4 MHZ)
                   3067  * SETUP REGISTERS
0D07 70            3068          CLR
0D08 5A            3069          LR    RFLG,A     RFLG = 0
0D09 5B            3070          LR    R2FLG,A    R2FLG = 0
0D0A 66            3071          LISU  CIRU
0D0B 6F            3072          LISL  CIRL
0D0C 5D            3073          LR    I,A
0D0D 8FFE    0D0C  3074          BR7   *-1
0D0F 62            3075          LISU  INPU
0D10 5D            3076          LR    I,A
0D11 8FFE    0D10  3077          BR7   *-1
0D13 63            3078          LISU  INVU
0D14 6C            3079          LISL  INVL+4
0D15 5E            3080          LR    D,A
0D16 8FFE    0D15  3081          BR7   *-1
0D18 64            3082          LISU  DISPLU
0D19 5D            3083          LR    I,A
0D1A 8FFE    0D19  3084          BR7   *-1
0D1C 65            3085          LISU  CTRU
0D1D 5D            3086          LR    I,A
0D1E 8FFE    0D1D  3087          BR7   *-1
0D20 2050          3088          LI    H'50'      R1FLG
0D22 5B            3089          LR    R1FLG,A
0D23 2032          3090          LI    50
0D25 58            3091          LR    RX5,A
0D26 2A0D2D 0D2D   3092          DCI   RWAIT
0D29 0E            3093          LR    Q,DC
0D2A 290D45 0D45   3094  RSTP    JMP   DEBNCE
                   3095  *
0D2D 38            3096  RWAIT   DS    RX5
0D2E 94FB    0D2A  3097          BNZ   RSTP
0D30 4A            3098          LR    A,RFLG
0D31 2280          3099          OI    H'80'
0D33 5A            3100          LR    RFLG,A
0D34 62            3101          LISU  INRU       CHECK CYCLE SW
```

```
0D35 68              3102            LISL  INRL-7
0D36 70              3103            CLR
0D37 CC              3104            AS    S
0D38 9109    0D42    3105            DM    RSTP1
0D3A 68              3106            LISU  C1RU
0D3B 6F              3107            LISL  C1RL
0D3C 2304F1  04F1    3108            PI    PAYONS
0D3F 280574  0574    3109            PI    PAYOFS
0D42 290B4D  0B4D    3110  RSTP1     JMP   PAY9P
                     3111  *
                     3112            EJECT
                     3113  *
                     3114  *
                     3115  * DEBOUNCE AT THE END OF EACH MACHINE CYCLE
                     3116  *
                     3117  *
0D45 2805EA  05EA    3118  DEBNCE    PI    DBNCS
0D48 1B              3119            EI
0D49 90FB    0D45    3120            BR    DEBNCE
                     3121  *
                     3122  *
                     3123  *
                     3124  *
                     3125  *
                     3126  *
                     3127            END
SYMBOL TYP  VAL  REFERENCES

ADDR1P   L 038A  1091  1071
ADDRL    L 0388  1085
ADDRS    L 0370
ADT1P    L 041F  1234  1212
ADTL     L 041D  1228
B14P1    L 035A  0990
BCD14    L 0335  2073  1963  1054
BCD14L   L 0342  1017  1011
BCD14P   L 0357  1006
BCD8     L 030C  2544  1935  0792
BCDL     A 0005  2077  2074  1969  1966  1060  1057  1009  1007
                 0995  0994  0992  0985
BCDU     A 0006  1975  1972  1002  0999  0997  0986
BINL     A 0007  2186  2069  1960  1012
BINR     A 0008  2651  2543  2428  2231  2176  1932  0960  0955
                 0938  0756
BINU     A 0008  2188  2071  1962  1053  1013  1005  1004  1003
                 0991  0987
C1M      A 0001
C1RL     A 0007  3107  3072  3000  2822  2706  2698  2653  1595
                 1572  0767
C1RU     A 0006  3106  3071  2999  2821  2791  2705  2697  2652
                 1594  1571  0771  0766
C1R      A 0037  1454  1426
C20M     A 0008
C2M      A 0002
C5M      A 0004
CDISP    L 0291  3020  2482  2237
CH1RL    A 0007  2741
CH1RU    A 0004  2793
CH1R     A 0027  2757
CH5R     A 0025  2773
CHGD1P   L 05C2  1586
CHGD2P   L 05D0  1581  1578
CHGDS    L 05BA  2690  2635  2321
CHGRL    A 0002  2802  2784  2766  2752  2736  2685  2628  2324
                 2308  1576
CHGRU    A 0004  2751  2735  2684  2627  2323  2307  1575
CHKCN    L 01E1
CHVNDS   L 0B58  2322
```

| | | | | | | | | | | |
|---|---|---|---|---|---|---|---|---|---|---|
| COINM | A | 000F | 2887 | 0661 | | | | | | |
| CONRP | L | 01EA | | | | | | | | |
| CRD1P | L | 026D | 0786 | | | | | | | |
| CRD2P | L | 027D | 0779 | | | | | | | |
| CRD3P | L | 0289 | 2664 | 2429 | 2235 | | | | | |
| CRDL | A | 0001 | 2993 | 2961 | 2952 | 2938 | 2682 | 2649 | 2624 | 2458 |
| | | | 2454 | 2426 | 2340 | 2302 | 2297 | 0750 | 0685 | 0612 0589 |
| CRDTBL | L | 000F | 0745 | | | | | | | |
| CRDTP | L | 0240 | 0662 | | | | | | | |
| CRDU | A | 0007 | 2932 | 2960 | 2951 | 2937 | 2681 | 2648 | 2623 | 2453 |
| | | | 2425 | 2339 | 2296 | 0749 | 0684 | 0611 | 0588 | |
| CRET0P | L | 000D | 2665 | | | | | | | |
| CRET1P | L | 0425 | 2471 | | | | | | | |
| CRET2P | L | 0414 | 2479 | | | | | | | |
| CRETM | A | 0000 | | | | | | | | |
| CRETP | L | 09F7 | 2461 | 0689 | | | | | | |
| CRM | A | 0040 | 3047 | 3042 | 3033 | 0449 | 0437 | | | |
| CRM1P | L | 00A7 | 0386 | 0384 | 0380 | | | | | |
| CRM2P | L | 00B3 | 0376 | | | | | | | |
| CRM3P | L | 00B8 | 0404 | | | | | | | |
| CRM4P | L | 00C5 | 0414 | 0410 | | | | | | |
| CRM5P | L | 00D2 | 0394 | | | | | | | |
| CRM6P | L | 00E2 | 0416 | | | | | | | |
| CRM7P | L | 00D7 | 0422 | 0402 | | | | | | |
| CRM8P | L | 00E9 | 0430 | | | | | | | |
| CRM9P | L | 00F1 | 0438 | | | | | | | |
| CRMP | L | 0085 | | | | | | | | |
| CSWP | L | 053B | 1501 | 1417 | | | | | | |
| CT1K | A | 00C8 | 2470 | 0398 | | | | | | |
| CT2K | A | 003C | 0440 | | | | | | | |
| CT3K | A | 000A | 0426 | 0400 | | | | | | |
| CTRL | A | 0000 | 2473 | 0439 | 0423 | 0390 | 0373 | | | |
| CTRU | A | 0005 | 3085 | 2472 | 0372 | | | | | |
| CYSW0P | L | 0546 | 1497 | | | | | | | |
| CYSW1P | L | 0560 | 1484 | 1480 | | | | | | |
| CYSW2P | L | 0569 | 1561 | 1490 | | | | | | |
| CYSWM | A | 0080 | | | | | | | | |
| CYSW | L | 0549 | 1473 | | | | | | | |
| DBL | L | 0317 | 0954 | | | | | | | |
| DBNC1P | L | 05F8 | 1635 | 1633 | | | | | | |
| DBNC2P | L | 062A | | | | | | | | |
| DBNC3P | L | 0640 | 1674 | | | | | | | |
| DBNC4P | L | 064E | 1708 | 1702 | 1683 | 1681 | | | | |
| DBNC5P | L | 065A | 1721 | | | | | | | |
| DBNC6P | L | 0662 | 1726 | | | | | | | |
| DBNC7P | L | 0667 | 1729 | | | | | | | |
| DBNC8P | L | 0671 | 1732 | 1724 | 1713 | 1676 | | | | |
| DBNCS | L | 05EA | 3118 | 2796 | 2707 | 2692 | 2637 | 2594 | 2556 | 2310 |
| | | | 2279 | 2228 | 2072 | 2000 | 1934 | 1905 | 1850 | 1794 1538 |
| | | | 1508 | 1414 | 1326 | 0926 | 0864 | 0811 | 0791 | 0787 0757 |
| | | | 0719 | 0651 | 0533 | 0455 | | | | |
| DBSWM | A | 0020 | 2633 | 2314 | | | | | | |
| DDM | A | 0010 | 0324 | | | | | | | |
| DEBNCE | L | 0D45 | 3120 | 3094 | 2893 | 2722 | 2502 | 2485 | 2442 | 2364 |
| | | | 2289 | 2236 | 2178 | 2026 | 1821 | 1475 | 1392 | 0920 0869 |
| | | | 0722 | | | | | | | |
| DECOD | L | 0295 | 0793 | | | | | | | |
| DGNM | A | 0030 | 3033 | 1344 | 0340 | 0308 | | | | |
| DIS1P | L | 0078 | 0328 | | | | | | | |
| DISDL | A | 0007 | 1785 | 1323 | 0313 | | | | | |
| DISDU | A | 0003 | 1784 | 1322 | 0312 | | | | | |
| DISP1 | L | 02BF | 0866 | | | | | | | |
| DISP2 | L | 02C3 | 0863 | | | | | | | |
| DISPLL | A | 0000 | 2158 | 2113 | 2055 | 2016 | 2002 | 1992 | 1965 | 1937 |
| | | | 1783 | 1353 | | | | | | |
| DISPLU | A | 0004 | 3082 | 2157 | 2112 | 2054 | 2015 | 2001 | 1991 | 1364 |
| | | | 1938 | 1788 | 1352 | 0322 | | | | |
| DISP | L | 0041 | 0295 | 0290 | | | | | | |

| | | | | | | | | | | |
|---|---|---|---|---|---|---|---|---|---|---|
| DISPL | L | 03B7 | | | | | | | | |
| EARM1P | L | 0355 | 1175 | | | | | | | |
| EARM2P | L | 0402 | 1178 | 1170 | | | | | | |
| EC1P | L | 01D0 | 0635 | | | | | | | |
| EC2P | L | 01D1 | 0638 | | | | | | | |
| EC3P | L | 01DE | 0642 | 0629 | 0626 | | | | | |
| ECM | A | 0002 | 3035 | 2331 | 0647 | | | | | |
| ECM1P | L | 0084 | 0358 | | | | | | | |
| ECP | L | 01BC | 0614 | 0610 | 0601 | 0596 | 0585 | 0581 | 0571 | |
| ECVP | L | 007C | 0303 | | | | | | | |
| EOC1P | L | 0C9F | 2972 | | | | | | | |
| EOC2P | L | 0CA4 | 2975 | | | | | | | |
| EOC3P | L | 0C2D | 2888 | 2882 | 2879 | 2877 | | | | |
| EOCK | A | 0028 | 2889 | | | | | | | |
| EOCW | L | 0C11 | 2720 | | | | | | | |
| EROM | A | 0020 | 3042 | 1043 | | | | | | |
| EROMRS | L | 0365 | 2941 | 2917 | 2901 | 2593 | 2555 | 2280 | 2229 | 2014 |
| | | | 1999 | 1984 | 1955 | 1927 | | | | |
| EROMWS | L | 0362 | 2949 | 2931 | 2914 | 2608 | 2577 | 1327 | 0721 | 0718 |
| ERW1P | L | 044C | 1255 | | | | | | | |
| ERW2P | L | 0450 | 1277 | | | | | | | |
| ERWL | L | 044A | 1268 | | | | | | | |
| FVML | A | 0000 | 2965 | 2903 | 2291 | 2275 | 1772 | 1374 | 1305 | |
| FVMU | A | 0007 | 2964 | 2902 | 2290 | 2274 | 1771 | 1373 | 1304 | |
| FVSWM | A | 0010 | 2371 | 1707 | 0294 | | | | | |
| FVTK | A | 0004 | 2352 | 1712 | | | | | | |
| FVTP | L | 0033 | | | | | | | | |
| INCLL | A | 0007 | 2620 | 0599 | 0583 | | | | | |
| INCLU | A | 0005 | 2619 | 0598 | 0582 | | | | | |
| INDB0P | L | 0020 | | | | | | | | |
| INDBP | L | 0022 | 0280 | | | | | | | |
| INRL | A | 0007 | 3102 | 2884 | 2631 | 2507 | 2369 | 2312 | 2256 | 2211 |
| | | | 1705 | 1667 | 1662 | 1651 | 1646 | 1499 | 1487 | 0673 0670 |
| | | | 0657 | 0631 | 0535 | 0510 | 0486 | 0460 | 0369 | 0360 0292 |
| | | | 0270 | | | | | | | |
| INRU | A | 0002 | 3101 | 3075 | 2883 | 2630 | 2506 | 2368 | 2311 | 2255 |
| | | | 2210 | 1704 | 1661 | 1645 | 1498 | 1486 | 0669 | 0656 0630 |
| | | | 0534 | 0509 | 0485 | 0459 | 0368 | 0359 | 0291 | 0274 0269 |
| INV1P | L | 0BF2 | 2867 | 2865 | | | | | | |
| INV2P | L | 0C02 | | | | | | | | |
| INV3P | L | 0C07 | 2863 | | | | | | | |
| INV4P | L | 0C0C | 2858 | | | | | | | |
| INVC1P | L | 0184 | | | | | | | | |
| INVC2P | L | 0194 | | | | | | | | |
| INVC3P | L | 01A2 | 0573 | | | | | | | |
| INVC4P | L | 01B8 | 0592 | | | | | | | |
| INVCP | L | 017C | 0556 | | | | | | | |
| INVD1P | L | 0129 | 0484 | | | | | | | |
| INVDP | L | 0115 | 0468 | 0466 | | | | | | |
| INVK | A | 00C8 | 0499 | | | | | | | |
| INVL | A | 0030 | 3079 | 2854 | 0700 | 0498 | 0489 | | | |
| INVM | A | 000C | 0491 | 0483 | | | | | | |
| INVP | L | 05D9 | 0723 | | | | | | | |
| INVSWP | L | 070B | 0689 | 0679 | 0668 | | | | | |
| INVU | A | 0003 | 3078 | 2853 | 0699 | 0497 | 0488 | | | |
| JINWP | L | 023C | 0709 | | | | | | | |
| JMSP | L | 023F | 0730 | 0702 | 0698 | 0695 | | | | |
| LN6DP | L | 014A | 0518 | 0516 | | | | | | |
| LN6K | A | 0014 | 0549 | | | | | | | |
| LN6L | A | 0002 | 0539 | | | | | | | |
| LN6M | A | 0040 | | | | | | | | |
| LN6P1 | L | 0165 | 0540 | | | | | | | |
| LN6P2 | L | 016B | 0548 | 0545 | 0543 | | | | | |
| LN6P3 | L | 0179 | 0559 | | | | | | | |
| LN6U | A | 0003 | 0538 | | | | | | | |
| LN6WAT | L | 09BA | 2403 | | | | | | | |
| LNMK | A | 002D | 2928 | 2926 | 2151 | 2149 | | | | |
| LNSWM | A | 000C | 1864 | 1847 | | | | | | |

| | | | | | | | | | | |
|---|---|---|---|---|---|---|---|---|---|---|
| MOTM | A 0060 | 1542 | | | | | | | | |
| MVP0P | L 0C30 | 2892 | | | | | | | | |
| MVP0P1 | L 0C48 | 2909 | 2907 | | | | | | | |
| MVP1P | L 0C57 | 2923 | | | | | | | | |
| MVP2P | L 0C5D | 2925 | | | | | | | | |
| MVP3P | L 0C62 | 2927 | | | | | | | | |
| MVP4P | L 0C6A | 2955 | | | | | | | | |
| MVP5P | L 0C7D | 2946 | | | | | | | | |
| MVP6P | L 0C80 | 2944 | | | | | | | | |
| P0RL | A 0005 | 2986 | 2846 | 2673 | 1743 | 1657 | 1641 | 1342 | 1186 | |
| | | 1041 | 0839 | 0447 | 0435 | 0305 | | | | |
| P0RU | A 0003 | 2985 | 2845 | 2672 | 1742 | 1656 | 1640 | 1341 | 1185 | |
| | | 1040 | 0838 | 0446 | 0434 | 0304 | | | | |
| P0 | A 0000 | 3048 | 3043 | 3034 | 2990 | 2850 | 2677 | 1745 | 1660 | |
| | | 1647 | 1644 | 1349 | 1345 | 1188 | 1044 | 0868 | 0858 | 0856 |
| | | 0855 | 0852 | 0851 | 0450 | 0346 | 0341 | 0325 | 0309 | |
| P1 | A 0001 | 3045 | 1663 | | | | | | | |
| P4 | A 0004 | 3046 | 3041 | 1718 | 1668 | 1652 | 1351 | 1347 | 1279 | |
| | | 1276 | 1266 | 1263 | 1259 | 1250 | 1238 | 1236 | 1226 | 1223 |
| | | 1216 | 1201 | 1190 | 1166 | 1164 | 1162 | 1154 | 1145 | 1141 |
| | | 1139 | 1133 | 1122 | 1120 | 1115 | 1111 | 1109 | 1104 | 1095 |
| | | 1093 | 1083 | 1080 | 1075 | 1066 | 0348 | 0344 | 0331 | 0330 |
| | | 0311 | | | | | | | | |
| P5RL | A 0006 | 3038 | 2359 | 2329 | 1737 | 1616 | 1549 | 1540 | 1461 | |
| | | 1442 | 1432 | 0646 | 0605 | 0575 | | | | |
| P5RU | A 0003 | 3037 | 2358 | 2328 | 1736 | 1615 | 1548 | 1539 | 1460 | |
| | | 1441 | 1431 | 0645 | 0604 | 0574 | | | | |
| P5 | A 0005 | 3036 | 2363 | 2333 | 1741 | 1620 | 1552 | 1543 | 1464 | |
| | | 1445 | 1435 | 1155 | 0650 | 0608 | 0579 | | | |
| P6 | A 0006 | 1677 | 1636 | | | | | | | |
| PAY2P | L 0B1D | | | | | | | | | |
| PAY3P | L 0B26 | 2696 | | | | | | | | |
| PAY3P1 | L 0B2E | 2694 | | | | | | | | |
| PAY3P2 | L 0B30 | 2702 | | | | | | | | |
| PAY4P | L 0B38 | 2689 | | | | | | | | |
| PAY5P | L 0B3D | 2716 | | | | | | | | |
| PAY6P | L 0B3E | 2712 | | | | | | | | |
| PAY7P | L 0B46 | 2710 | | | | | | | | |
| PAY8P | L 0B4B | | | | | | | | | |
| PAY9P | L 0B4D | 3110 | 2828 | 1562 | | | | | | |
| PAYCHG | L 0B5D | 2700 | | | | | | | | |
| PAYOFS | L 0574 | 3109 | 2868 | 2866 | 2827 | 2795 | 2715 | | | |
| PAYONS | L 0451 | 3108 | 3014 | 2864 | 2824 | 2792 | 2711 | 2701 | 2695 | |
| | | 2643 | | | | | | | | |
| PAY | L 0B07 | 2480 | | | | | | | | |
| PCH2P1 | L 0B7E | 2761 | 2759 | | | | | | | |
| PCHG1P | L 0B68 | 2794 | | | | | | | | |
| PCHG2P | L 0B6A | 2810 | | | | | | | | |
| PCHG3P | L 0B7F | 2790 | 2756 | | | | | | | |
| PCHG4P | L 0B3C | 2777 | 2774 | | | | | | | |
| PCHG5P | L 0BAC | 2782 | 2780 | 2772 | 2765 | | | | | |
| PCHG6P | L 0BAF | | | | | | | | | |
| PCHG7P | L 0BC8 | 2813 | | | | | | | | |
| PCHG8P | L 0BCF | 2826 | | | | | | | | |
| PCHG9P | L 0BD8 | 2869 | 2820 | | | | | | | |
| PDIM | L 051C | 1428 | 1425 | | | | | | | |
| PMKL | A 000A | 1481 | 1471 | | | | | | | |
| PMOTM | A 0020 | 1463 | | | | | | | | |
| PNKL | L 0534 | 1427 | | | | | | | | |
| POF0P | L 058F | 1533 | | | | | | | | |
| POF1P | L 0593 | 1494 | 1457 | 1455 | | | | | | |
| PQR | L 0510 | | | | | | | | | |
| PRSWM | A 0003 | 1868 | | | | | | | | |
| PST0K | A 000F | 1898 | | | | | | | | |
| PST2K | A 00C8 | 1837 | 1777 | | | | | | | |
| PST3K | A 0028 | 1830 | | | | | | | | |
| PST3P1 | L 0713 | 2102 | | | | | | | | |
| PST4K | A 0064 | 1879 | | | | | | | | |

| | | | | | | | | | | |
|---|---|---|---|---|---|---|---|---|---|---|
| PSTM | L 06AD | 1782 | | | | | | | | |
| PSTM1P | L 06C1 | 1895 | 1886 | 1884 | 1874 | 1853 | 1829 | 1813 | 1811 | |
| PSTM2P | L 06C4 | 1807 | | | | | | | | |
| PSTM2P1 | L 06D2 | 1826 | | | | | | | | |
| PSTM3P | L 06E8 | 1841 | 1832 | | | | | | | |
| PSTM4P | L 071C | 1878 | | | | | | | | |
| PSTMA | L 07CD | 1867 | | | | | | | | |
| PSTMB | L 07E3 | 2034 | | | | | | | | |
| PSTMC | L 07EB | 2044 | 2042 | | | | | | | |
| PSTMD | L 07FD | 2159 | 2063 | 1993 | | | | | | |
| PSTME | L 0810 | 2058 | | | | | | | | |
| PSTMF | L 0814 | 2059 | | | | | | | | |
| PSTMG | L 0816 | 2119 | 2083 | 2080 | 1798 | | | | | |
| PSTMH | L 081C | 2036 | | | | | | | | |
| PSTML1 | L 0723 | 1844 | | | | | | | | |
| PSTMR1 | L 0733 | 1902 | 1849 | 1799 | | | | | | |
| PSTMR2 | L 074F | | | | | | | | | |
| PSTMR3 | L 0759 | 2177 | | | | | | | | |
| PSTMR4 | L 076E | 1922 | 1916 | | | | | | | |
| PSTMR41 | L 077C | 2192 | | | | | | | | |
| PSTMR5 | L 0791 | 1918 | | | | | | | | |
| PSTMR6 | L 07A0 | 1913 | | | | | | | | |
| PSTMR7 | L 07A1 | 1914 | | | | | | | | |
| PSTMR8 | L 07CA | 2104 | 2097 | 2089 | 2050 | 2039 | 1978 | 1947 | | |
| PSTMS | L 0892 | 2142 | | | | | | | | |
| PSTMS1 | L 089A | 2183 | 2175 | | | | | | | |
| PSTMT | L 08BF | 2164 | 2141 | 2127 | | | | | | |
| PSTMU | L 08B4 | 2173 | 2170 | | | | | | | |
| PSTMV | L 0876 | 2144 | | | | | | | | |
| PSTMW | L 086C | 2150 | | | | | | | | |
| PSTMW1 | L 0872 | 2154 | | | | | | | | |
| PSTMX | L 0856 | 2132 | | | | | | | | |
| PSTMY | L 0853 | 2128 | | | | | | | | |
| PSTMZ | L 0841 | 1871 | | | | | | | | |
| PSTP | L 0678 | 2252 | 2206 | | | | | | | |
| PSTRL | A 0005 | 2098 | 1897 | 1877 | 1823 | 1809 | 1776 | | | |
| PSTRU | A 0007 | 1896 | 1876 | 1822 | 1808 | 1775 | | | | |
| PSWD1P | L 0145 | 0508 | | | | | | | | |
| PSWDP | L 012E | 0494 | 0492 | | | | | | | |
| PSWK | A 0014 | 0524 | | | | | | | | |
| PSWL | A 0003 | 1863 | 1846 | 1818 | 0523 | 0513 | | | | |
| PSWM | A 000F | 0515 | 0505 | | | | | | | |
| PSWU | A 0003 | 1862 | 1845 | 1817 | 0522 | 0512 | | | | |
| PT1K | A 000F | 1437 | | | | | | | | |
| PT2K | A 000F | 1554 | | | | | | | | |
| PT3K | A 0032 | 1447 | | | | | | | | |
| PT4K | A 0078 | 1545 | | | | | | | | |
| PTRL | A 0004 | 2524 | 2434 | 2382 | 2351 | 1710 | 1527 | 1519 | 1505 | |
| | | 1478 | 1468 | 1452 | 1422 | 1410 | 0297 | | | |
| PTRU | A 0005 | 2523 | 2433 | 2381 | 2350 | 1709 | 1526 | 1518 | 1504 | |
| | | 1477 | 1467 | 1451 | 1421 | 1409 | 0296 | | | |
| PULL | L 02EC | 1503 | 1328 | | | | | | | |
| PUSHL | A 0003 | 0897 | 0883 | | | | | | | |
| PUSHU | A 0006 | 0896 | 0882 | | | | | | | |
| PUSH | L 02E1 | 1522 | 1413 | 1288 | | | | | | |
| R0 | A 0001 | 2948 | 2943 | 2930 | 2921 | 2912 | 2905 | 2606 | 2603 | |
| | | 2597 | 2595 | 2563 | 2562 | 2283 | 2230 | 2020 | 2017 | 2006 |
| | | 2003 | 1987 | 1956 | 1930 | 1496 | 1321 | 1315 | 1229 | 1208 |
| | | 1176 | 1158 | 1157 | 1151 | 1146 | 1131 | 0714 | 0482 | |
| R1 | A 0002 | 2913 | 2607 | 2600 | 2598 | 2572 | 2569 | 2559 | 2557 | |
| | | 2250 | 2204 | 2023 | 2009 | 1961 | 1839 | 1825 | 1795 | 1325 |
| | | 1317 | 1273 | 1270 | 1230 | 1219 | 1218 | 1217 | 1206 | 1171 |
| | | 1149 | 1048 | 1045 | 0715 | 0519 | 0507 | 0504 | 0282 | |
| R1FLG | A 000B | 3089 | 2980 | 2971 | 2881 | 2841 | 2838 | 2661 | 2656 | |
| | | 2614 | 2613 | 2499 | 2497 | 2468 | 2465 | 2424 | 2421 | 2346 |
| | | 2343 | 2248 | 2202 | 1770 | 1768 | 1384 | 1377 | 0782 | 0780 |
| | | 0697 | 0666 | 0617 | 0615 | 0595 | 0593 | 0568 | 0563 | 0558 |
| | | 0554 | 0445 | 0442 | 0433 | 0431 | 0429 | 0420 | 0411 | 0397 |

| | | | | | | | | | | |
|---|---|---|---|---|---|---|---|---|---|---|
| | | 0395 | 0381 | 0374 | 0357 | | | | | |
| R2 | A 0003 | 2552 | 2539 | 1275 | 1248 | 1243 | 1233 | 1203 | 1159 | |
| | | 1127 | 1090 | 1056 | 1016 | 0981 | 0862 | 0845 | 0784 | 0770 |
| | | 0768 | 0746 | 0739 | 0660 | 0456 | | | | |
| R2FLG | A 0000 | 3070 | 2878 | 2844 | 2842 | 2719 | 2717 | 2680 | 2678 | |
| | | 2647 | 2645 | 2640 | 2638 | 2580 | 2579 | 2537 | 2535 | 2492 |
| | | 2478 | 2452 | 2450 | 2439 | 2409 | 2398 | 2396 | 2374 | 2349 |
| | | 2347 | 2253 | 1764 | 1762 | 1735 | 1733 | 1727 | 1688 | 1686 |
| | | 1672 | 1631 | 1614 | 1612 | 1358 | 1356 | 1338 | 1184 | 1182 |
| | | 1168 | 1096 | 1037 | 1036 | 0789 | 0712 | 0710 | 0707 | 0693 |
| | | 0625 | 0557 | 0553 | 0551 | 0546 | 0542 | 0531 | 0301 | 0288 |
| READP | L 03A8 | 1280 | | | | | | | | |
| RESET | L 0CDB | 0220 | | | | | | | | |
| REVRM | A 0004 | 1551 | 1434 | | | | | | | |
| RFLG | A 002A | 3100 | 3098 | 3069 | 3019 | 3017 | 3007 | 2983 | 2981 | |
| | | 2959 | 2957 | 2875 | 2837 | 2834 | 2814 | 2812 | 2789 | 2731 |
| | | 2729 | 2697 | 2611 | 2609 | 2449 | 2447 | 2336 | 2234 | 2246 |
| | | 2244 | 2208 | 2198 | 2191 | 2159 | 2167 | 2165 | 2147 | 2145 |
| | | 2108 | 2105 | 2099 | 1908 | 1906 | 1893 | 1889 | 1887 | 1883 |
| | | 1881 | 1872 | 1851 | 1842 | 1836 | 1834 | 1816 | 1814 | 1805 |
| | | 1767 | 1765 | 1559 | 1557 | 1513 | 1493 | 1491 | 1420 | 1419 |
| | | 1415 | 1391 | 1389 | 1386 | 1367 | 1365 | 1361 | 1359 | 1291 |
| | | 1289 | 1181 | 1179 | 0744 | 0741 | 0706 | 0704 | 0683 | 0681 |
| | | 0644 | 0643 | 0640 | 0627 | 0473 | 0407 | 0377 | | |
| RPST1P | L 04CA | 1363 | | | | | | | | |
| RPST2P | L 04DE | 1378 | | | | | | | | |
| RPST3P | L 04E3 | 1381 | | | | | | | | |
| RPST4P | L 04F0 | 1388 | 1340 | | | | | | | |
| RPSTMS | L 04A3 | 0740 | 0703 | 0680 | | | | | | |
| RST1P | L 0CDF | 3057 | 3055 | 3053 | | | | | | |
| RSTP | L 0D2A | 3097 | | | | | | | | |
| RSTP1 | L 0D42 | 3105 | | | | | | | | |
| RWAIT | L 0D2D | 3092 | | | | | | | | |
| RX1 | A 0004 | 2890 | 2862 | 2852 | 2799 | 2786 | 2770 | 2754 | 2746 | |
| | | 2571 | 2566 | 2550 | 2495 | 2475 | 2305 | 2301 | 2163 | 2060 |
| | | 1938 | 1857 | 1598 | 1585 | 1583 | 1570 | 1555 | 1546 | 1535 |
| | | 1448 | 1438 | 1267 | 1245 | 1232 | 1227 | 1205 | 1147 | 1129 |
| | | 1089 | 1084 | 1064 | 1015 | 1010 | 0983 | 0959 | 0916 | 0861 |
| | | 0859 | 0847 | 0842 | 0834 | 0831 | 0800 | 0759 | 0363 | 0345 |
| | | 0339 | 0323 | 0307 | | | | | | |
| RX1L | A 0004 | 0676 | | | | | | | | |
| RX1U | A 0000 | 0675 | | | | | | | | |
| RX2 | A 0005 | 2775 | 2750 | 2548 | 2545 | 2068 | 2065 | 2062 | 2056 | |
| | | 1943 | 1940 | 1602 | 1597 | 1577 | 1574 | 1209 | 1177 | 1086 |
| | | 1062 | 0979 | 0965 | 0964 | 0949 | 0948 | 0946 | 0943 | 0829 |
| | | 0824 | 0813 | 0801 | 0761 | 0418 | 0388 | 0371 | 0342 | 0334 |
| | | 0333 | 0320 | 0281 | | | | | | |
| RX3 | A 0006 | 2783 | 2778 | 2769 | 2093 | 2046 | 2043 | 1861 | 1207 | |
| | | 1174 | 1087 | 1077 | 1059 | 0978 | 0966 | 0952 | 0822 | 0763 |
| | | 0337 | 0336 | | | | | | | |
| RX4 | A 0007 | 2954 | 2936 | 2916 | 2900 | 2592 | 2583 | 2554 | 2553 | |
| | | 2272 | 2267 | 2225 | 2219 | 2013 | 1998 | 1983 | 1954 | 1926 |
| | | 1319 | 1311 | 1298 | 0977 | 0968 | 0953 | 0945 | 0865 | 0837 |
| | | 0818 | 0802 | 0765 | 0720 | 0717 | | | | |
| RX5 | A 0008 | 3096 | 3091 | 1272 | 1269 | 1262 | 1258 | 1247 | 1235 | |
| | | 1224 | 1215 | 1199 | 1161 | 1144 | 1137 | 1092 | 1081 | 1074 |
| | | 0976 | 0867 | 0850 | 0841 | 0020 | | | | |
| SALE1P | L 0A50 | 2585 | | | | | | | | |
| SALE2P | L 0A61 | 2582 | | | | | | | | |
| SALE3P | L 0A8F | | | | | | | | | |
| SALE4P | L 0AB0 | 2605 | 2602 | | | | | | | |
| SALE5P | L 0AB3 | 2590 | | | | | | | | |
| SALE6P | L 0AC1 | | | | | | | | | |
| SALE7P | L 0ADE | 2644 | | | | | | | | |
| SALE8P | L 0AE6 | 2642 | | | | | | | | |
| SALE9P | L 0B04 | 2634 | 2626 | | | | | | | |
| SALEK | A 0014 | 0602 | | | | | | | | |
| SALEM | A 0030 | 0607 | | | | | | | | |

| | | | | | | | | | | |
|---|---|---|---|---|---|---|---|---|---|---|
| SALE | L 0949 | 2483 | | | | | | | | |
| SCNSEL | L 0959 | 2973 | 2419 | 2287 | 2200 | 1379 | | | | |
| SDT1P | L 0[illegible] | 1160 | | | | | | | | |
| SDT4P | L 0[illegible]E | 1143 | | | | | | | | |
| SDTP | L 0[illegible]D | | | | | | | | | |
| SEGM | L 0003 | 0830 | 0823 | 0812 | | | | | | |
| SEL1P | L 031E | 2529 | 2516 | 2337 | 2306 | 2271 | 2259 | 2254 | 2249 | |
| SEL2P | L 0921 | 2226 | | | | | | | | |
| SEL2W | L 0A3F | 2391 | | | | | | | | |
| SEL3P | L 0925 | 2265 | | | | | | | | |
| SELIN | L 092C | 2285 | | | | | | | | |
| SELINA | L 0939 | 2304 | | | | | | | | |
| SELINC | L 094D | 2315 | | | | | | | | |
| SELIND1 | L 0966 | 2294 | 2278 | | | | | | | |
| SELIND | L 096A | 2327 | 2320 | | | | | | | |
| SELINE | L 0987 | | | | | | | | | |
| SELK | A 0004 | 2388 | | | | | | | | |
| SELNM | A 0010 | 0580 | 0577 | | | | | | | |
| SELRL | A 0003 | 2997 | 2934 | 2919 | 2616 | 2587 | 2541 | 2510 | 2282 | |
| | | 2263 | 2261 | 2233 | 2214 | 2133 | 2125 | 2109 | 2032 | 1989 |
| | | 1986 | 1958 | 1929 | 1910 | 1855 | 1779 | 1730 | 1717 | 1694 |
| | | 1692 | 1369 | 1313 | 1293 | | | | | |
| SELRU | A 0007 | 2996 | 2933 | 2918 | 2615 | 2586 | 2540 | 2509 | 2281 | |
| | | 2260 | 2232 | 2213 | 2124 | 2031 | 1985 | 1957 | 1928 | 1909 |
| | | 1854 | 1716 | 1691 | 1368 | 1292 | | | | |
| SELWAT | L 0A30 | 2500 | | | | | | | | |
| SLCM | A 0040 | 1444 | | | | | | | | |
| SLCTM | A 003F | 2512 | 2258 | 2216 | 1719 | | | | | |
| SLENM | A 0032 | 1659 | | | | | | | | |
| STB1P | L 08DA | 2223 | 2217 | 2209 | 2203 | | | | | |
| STB3P | L 08DD | 2227 | | | | | | | | |
| STBY | L 08A4 | 2976 | 1382 | | | | | | | |
| SWENM | A 0022 | 1643 | | | | | | | | |
| TL1K1 | A 004B | 0764 | | | | | | | | |
| TL1K | A 0004 | 2760 | | | | | | | | |
| TL1M | A 0010 | 2776 | 2319 | | | | | | | |
| TL2K1 | A 0046 | 0762 | | | | | | | | |
| TL2K | A 0008 | 2758 | | | | | | | | |
| TL2M | A 0020 | 2319 | | | | | | | | |
| TL3K1 | A 0023 | 0760 | | | | | | | | |
| TL3K | A 0004 | 2762 | | | | | | | | |
| TL3M | A 0040 | 2737 | | | | | | | | |
| TL4R | A 0020 | 1456 | 1424 | | | | | | | |
| TL4RL | A 0000 | 3012 | 1604 | | | | | | | |
| TL4RU | A 0004 | 3011 | 1603 | | | | | | | |
| TLID1K | A 00C8 | 0475 | | | | | | | | |
| TLID2K | A 0028 | 0477 | | | | | | | | |
| TLID | L 00F3 | 0425 | 0419 | 0392 | 0389 | | | | | |
| TLIF1 | L 010A | 0458 | | | | | | | | |
| TLIRL | A 0003 | 2747 | 2317 | 0472 | 0463 | | | | | |
| TLIRU | A 0005 | 2748 | 2316 | 0471 | 0462 | | | | | |
| TLM | A 0070 | 0465 | 0457 | | | | | | | |
| TOKU | A 0007 | 2354 | | | | | | | | |
| TRFRS | L 05D1 | 2691 | 2636 | | | | | | | |
| VDB[illegible] | A 0022 | 2494 | | | | | | | | |
| VEND0P1 | L 034D | 2378 | | | | | | | | |
| VEND0P | L 09C3 | 2440 | | | | | | | | |
| VEND0P2 | L [illegible] | 2393 | | | | | | | | |
| VEND1P | L 0334 | 2372 | | | | | | | | |
| VEND5P | L 09DE | 2414 | 2386 | 2384 | | | | | | |
| VEND6P | L 09E1 | 2437 | 2375 | | | | | | | |
| VEND7P | L 09E4 | 2410 | | | | | | | | |
| VENDM | A 0008 | 2361 | 1739 | 1618 | | | | | | |
| VEND | L 098A | 2356 | | | | | | | | |
| VENDW | L 0A1B | 2662 | | | | | | | | |
| VENW1P | L 0A2D | 2528 | 2526 | 2513 | 2493 | | | | | |
| VFILK | A 0008 | | | | | | | | | |

```
VNDK      A 007D  2399
VNDL      A 0003  1697  1679  1638
VNDOFS    L 05DE  2991  2446  2390
VNDU      A 0004  1696  1678  1637
WAITP     L 0300  0925
WAITS     L 02F7  2891  2496  2476  1556  1547  1536  1449  1439
WAIT      L 0303  0918
WATRL     A 0007  2412  2401  0923  0915
WATRU     A 0003  2411  2400  0922  0914
WRITPS    L 0467  1892  1364
WRITS     L 040D  1098
WRT0P     L 0484  1298
WRT1P     L 048D  1307
WRT2P     L 0492  1309
WRT3P     L 0499  1312
03 ERRS
```

What we claim is:

1. A control device, for a vending machine which has a plurality of customer-operated selection switches and which has a plurality of money-sensing elements that respond to the insertion of money to provide credit-establishing signals, and which comprises a memory that has a plurality of locations therein wherein data can be stored, a data processing means, and data change switch means that are actuatable by a route man, said control device being located within said vending machine and thereby disposing said data change switch means within said vending machine, said data processing means being adapted to respond to signals from said data change switch means to change data in various of said plurality of locations within said memory, said control device and said vending machine having a first mode wherein actuation of said selection switches can enable said data processing means to effect the dispensing of products and having a second mode wherein actuation of said data change switch means can cause said data processing means to change data in said plurality of locations within said memory, said selection switches being actuatable, whenever said control device and said vending machine are in said first mode, to supply signals to said data processing means which said data processing means will utilize to determine whether products corresponding to said selection means can be vended, said data change switch means being actuatable, whenever said control device and said vending machine are in said second mode, to supply signals to said data processing means which said data processing means will utilize to change said data in various of said plurality of locations within said memory, and said data processing means responding to a credit-establishing signal from one of said money-sensing elements to automatically take said control device and said vending machine out of said second mode to enable said control device and said vending machine to operate in said first mode.

2. A control device as claimed in claim 1 wherein said data processing means will, whenever said control device and said vending machine are in said first mode, respond to an actuation of said data change switch means to automatically take said control device and said vending machine out of said first mode to enable said control device and said vending machine to operate in said second mode.

3. A control device as claimed in claim 1 wherein said vending machine has a display, wherein said control device and said vending machine have a third mode in which actuation of said selection switches can enable said data processing means to cause data in various of said plurality of locations within said memory to be exhibited by said display, wherein the control device has a coin storage tube therein, wherein said control device has an inventory switch that can be actuated to effect emptying of said coin storage tube, and wherein said data processing means can, whenever said control device and said vending machine are in said second mode, respond to a signal from said inventory switch to automatically take said control device and said vending machine out of said second mode and permit them to operate in said third mode.

4. A control device, for a vending machine which has a plurality of customer-operated selection switches and which has a plurality of money-sensing elements that respond to the insertion of money to provide credit-establishing signals and which has a display, and which comprises a memory that has a plurality of locations therein wherein data can be stored, a data processing means, said control device being located within said vending machine, said control device and said vending machine having a first mode wherein actuation of said selection switches can enable said data processing means to effect the dispensing of products and having a second mode wherein actuation of said selection switches can enable said data processing means to cause data to be exhibited by said display, said selection switches being actuatable, whenever said control device and said vending machine are in said first mode, to supply signals to said data processing means which said data processing means will utilize to determine whether products corresponding to said selection means can be vended, said selection switches being actuable, whenever said control device and said vending machine are in said second mode, to supply signals to said data processing means which said data processing means will utilize to cause said data in said memory to be exhibited by said display, and said data processing means responding to a credit-establishing signal from one of said money-sensing elements to automatically take said control device and said vending machine out of said second mode to enable said control device and said vending machine to operate in said first mode.

5. A control device as claimed in claim 4 wherein said control device has a coin storage tube therein, wherein said control device has an inventory switch that can be actuated to effect emptying of said coin storage tube, and wherein said data processing means can, whenever said control device and said vending machine are in said fist mode, respond to a signal from said inventory switch to automatically take said control device and said vending machine out of said first mode to enable said control device and said vending machine to operate in said second mode.

6. A control device as claim in claim 4 wherein said control device has a coin storage tube therein, wherein said control device has an inventory switch that can be actuated to effect emptying of said coin storage tube, wherein said data processing means can, whenever said control device and said vending machine are in said first mode, respond to a signal from said inventory switch to automatically take said control device and said vending machine out of said first mode to enable said control device and said vending machine to operate in said second mode, wherein said inventory switch has a normal position and an actuated position, and wherein said inventory switch can not develop said signal until said inventory switch has been shifted to its actuated position and then back to its normal position.

7. A control device, for a vending machine which has a plurality of customer-operated selection switches and which has a plurality of money-sensing elements that respond to the insertion of money to provide credit-establishing signals and which has a cancel sale button and which has a display, and which comprises a memory that has a plurality of locations therein wherein data can be stored, a data processing means, said control device being located within said vending machine, said control device and said vending machine having a first mode wherein actuation of said selection switches can enable said data processing means to effect the dispensing of products and having a second mode wherein actuation of said selection switches can enable said data processing means to cause data to be exhibited by said display, said selection switches being actuatable, whenever said control device and said vending machine are in said first mode, to supply signals to said data processing means which said data processing means will utilize to determine whether products corresponding to said selection means can be vended, said cancel sale button being actuatable, whenever said control device and said vending machine are in said first mode to supply signals to said data processing means which said data processing means will utilize to effect the dispensing of money equal to the value of money inserted by a customer, said selection switches being actuatable, whenever said control device and said vending machine are in said second mode, to supply signals to said data processing means which said data processing means will utilize to cause said data in said memory to be exhibited by said display, and said data processing means responding to actuation of said cancel sale button, whenever said control device and said vending machine are in said second mode, to automatically take said control device and said vending machine out of said second mode to enable said control device and said vending machine to operate in said first mode.

8. A control device as claimed in claim 7 wherein said control device has a coin storage tube therein, wherein said control device has an inventory switch that can be actuated to effect emptying of said coin storage tube, and wherein said data processing means can, whenever said control device and said vending machine are in said first mode, respond to a signal from said inventory switch to automatically take said control device and said vending machine out of said first said mode to enable said control device and said vending machine to operate in said second mode.

9. A control device as claimed in claim 7 wherein said control device has a coin storage tube therein, wherein said control device has an inventory switch that can be actuated to effect emptying of said coin storage tube, wherein said data processing means can, whenever said control device and said vending machine are in said first mode to respond to a signal from said inventory switch to automatically take said control device and said vending machine out of said first said mode to enable said control device and said vending machine to operate in said second mode, wherein said inventory switch has a normal position and an actuated position, and wherein said inventory switch can not develop said signal until said inventory switch has been shifted to its actuated position and then back to its normal position.

10. A control device, for a vending machine which can be placed in a price verification mode or in a product-vending mode and which has a plurality of selection switches and money-sensing elements and a display, and which comprises a memory and data processing means, said memory having a plurality of locations therein wherein data representing the prices of vendable products are stored, said data processing means being adapted, whenever said vending machine is in said price verification mode, to permit actuation of any of said selection switches to address the location in said memory where the data representing the price of the product corresponding to said selection switch is stored and to cause said display to exhibit the price of said product, said money-sensing elements responding to the insertion of money to provide credit-establishing signals, said data processing means responding to credit-establishing signals from said money-sensing elements to cause said display to exhibit values of credit corresponding to inserted money, and said data processing means, whenever said vending machine is in said price verification mode, automatically responding to a credit-establishing signal to take said vending machine out of said price verification mode and put it in said product-vending mode.

11. A control device, for a vending machine which has customer-operated selection switches and which has a non-public mode and a product-dispensing mode, and which comprises a memory in which price data can be stored, a dual-function price change switch that can be actuated to provide a signal which can effect a change in the price data stored in said memory, said selection switches being actuatable, whenever said vending machine is in said product-dispensing mode, to effect the dispensing of products, said selection switches being unable, whenever said vending machine is in said non-public mode, to effect the dispensing of products, and means responsive to actuation of said dual-function price change switch, whenever said vending machine is in said product-dispensing mode, to automatically take said vending machine out of said product-dispensing mode and place it in said non-public mode and to change price data in the memory, said switch being adapted to supply signals, whenever said vending machine is in said non-public mode, to effect a change in the price data stored in said memory.

12. The method of placing a vending machine, which has a control device and a plurality of customer-operated selection switches and a plurality of money-sensing elements that respond to the insertion of money to provide credit-establishing signals and a coin storage tube and an inventory switch for said coin storage tube and a display, in a price verification mode wherein said selection switches can be actuated to cause price data which is stored in locations in a memory corresponding to said product selection switches to be read from said memory and exhibited by said display, comprising actuating said inventory switch to develop a signal which will call for said vending machine to operate in the price verification mode, storing data indicating that said inventory switch has been actuated, responding to said stored data to operate said vending machine in said price verification mode, and thereafter using said selection switches to address said locations in said memory and thereby effect the exhibiting by said display of the price data in said locations in said memory.

13. The method of taking a vending machine, which has a control device and a plurality of customer-operated selection switches and a plurality of money-sensing elements that respond to the insertion of money to provide credit-establishing signals and a display, out of a price verification mode wherein said selection switches can be used to effect the addressing of locations in a memory where price data is stored and thereby cause said display to exhibit the value of said price data, and causing a credit-establishing signal to be developed by one of said money-sensing elements, while said vending machine is in said price verification mode, to effect the taking of said vending machine out of said price verification mode to permit subsequent operation of said vending machine in a product-vending mode.

14. The method of taking a vending machine, which has a control device and a plurality of customer-operated selection switches and a plurality of money-sensing elements that respond to the insertion of money to provide credit-establishing signals and a cancel sale button and a display, out of a price verification mode wherein said selection switches can be used to effect the addressing of locations in a memory where price data is stored and thereby cause said display to exhibit the value of said price data, causing said cancel sale button to be pressed to develop a signal, while said vending machine is in said price verification mode, to effect the taking of said vending machine out of said price verification mode to permit subsequent operation of said vending machine in a product-vending mode.

* * * * *